US007383889B2

(12) United States Patent
Ring et al.

(10) Patent No.: US 7,383,889 B2
(45) Date of Patent: Jun. 10, 2008

(54) MONO DIAMETER WELLBORE CASING

(75) Inventors: Lev Ring, Houston, TX (US); David Paul Brisco, Houston, TX (US); Brock Wayne Watson, Carrollton, TX (US); Kevin K. Waddell, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 423 days.

(21) Appl. No.: 10/495,344

(22) PCT Filed: Nov. 12, 2002

(86) PCT No.: PCT/US02/36267

§ 371 (c)(1),
(2), (4) Date: May 12, 2004

(87) PCT Pub. No.: WO03/042487

PCT Pub. Date: May 22, 2003

(65) Prior Publication Data

US 2005/0056433 A1 Mar. 17, 2005

Related U.S. Application Data

(60) Provisional application No. 60/387,961, filed on Jun. 12, 2002, provisional application No. 60/363,829, filed on Mar. 13, 2002, provisional application No. 60/338,996, filed on Nov. 12, 2001, provisional application No. 60/339,013, filed on Nov. 12, 2001.

(51) Int. Cl.
*E21B 23/02* (2006.01)

(52) U.S. Cl. ..... 166/382; 166/121; 166/207; 166/212; 166/384; 166/387

(58) Field of Classification Search ..... None
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |

(Continued)

FOREIGN PATENT DOCUMENTS

| | | |
|---|---|---|
| AU | 773168 | 5/2004 |

(Continued)

OTHER PUBLICATIONS

International Preliminary Examination Report, Application PCT/US02/24399, Aug. 6, 2004.

(Continued)

*Primary Examiner*—Zakiya W. Bates
(74) *Attorney, Agent, or Firm*—Conley Rose, P.C.

(57) ABSTRACT

An apparatus and method for forming a mono diameter wellbore casing.

199 Claims, 132 Drawing Sheets

U.S. PATENT DOCUMENTS

| | | | |
|---|---|---|---|
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,301,495 | A | 11/1942 | Abegg |
| 2,305,282 | A | 12/1942 | Taylor, Jr. et al. |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,723,721 | A | 11/1955 | Corsette |
| 2,734,580 | A | 2/1956 | Layne |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,162,245 | A | 12/1964 | Howard et al. |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Hearn |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,572,777 | A | 3/1971 | Blose et al. |
| 3,574,357 | A | 4/1971 | Alexandru et al. |
| 3,579,805 | A | 5/1971 | Kast |
| 3,581,817 | A | 6/1971 | Kammerer, Jr. |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinley et al. |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,826,124 | A | 7/1974 | Baksay |
| 3,830,294 | A | 8/1974 | Swanson |
| 3,830,295 | A | 8/1974 | Crowe |
| 3,834,742 | A | 9/1974 | McPhillips |
| 3,848,668 | A | 11/1974 | Sizer et al. |
| 3,866,954 | A | 2/1975 | Slator et al. |
| 3,874,446 | A | 4/1975 | Crowe |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,915,763 | A | 10/1975 | Jennings et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,963,076 | A | 6/1976 | Winslow |
| 3,970,336 | A | 7/1976 | O'Sickey et al. |
| 3,977,473 | A | 8/1976 | Page, Jr. |
| 3,989,280 | A | 11/1976 | Schwarz |
| 3,997,193 | A | 12/1976 | Tsuda et al. |
| 3,999,605 | A | 12/1976 | Braddick |
| 4,011,652 | A | 3/1977 | Black |
| 4,018,634 | A | 4/1977 | Fenci |
| 4,019,579 | A | 4/1977 | Thuse |
| 4,026,583 | A | 5/1977 | Gottlieb |
| 4,053,247 | A | 10/1977 | Marsh, Jr. |

4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchinson et al.
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,358,511 A 11/1982 Smith, Jr. et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,521,258 A 6/1985 Tamehiro et al.
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,598,938 A 7/1986 Boss et al.
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,629,218 A 12/1986 Dubois
4,629,224 A 12/1986 Lanriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.

4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,156,043 A 10/1992 Ose
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,249,628 A 10/1993 Surjaatmadja
5,253,713 A 10/1993 Gregg et al.
RE34,467 E 12/1993 Reeves
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,425,559 A 6/1995 Nobileau
5,426,130 A 6/1995 Thurber et al.
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.

5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,142,230 A 11/2000 Smalley et al.
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,183,013 B1 2/2001 Mackenzie et al.
6,183,573 B1 2/2001 Fujiwara et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,968 B1 7/2001 Freeman et al.
6,263,972 B1 7/2001 Richard et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.

6,491,108 B1 12/2002 Slup et al.
6,497,289 B1 * 12/2002 Cook et al. ..... 166/380
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,659,509 B2 12/2003 Goto et al.
6,662,876 B2 12/2003 Lauritzen
6,668,937 B1 12/2003 Murray
6,672,759 B2 1/2004 Feger
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,029 B2 * 3/2004 Metcalfe et al. ..... 166/378
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,755,447 B2 6/2004 Galle, Jr. et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrack
6,935,430 B2 8/2005 Harrell et al.
6,966,370 B2 11/2005 Cook et al.
6,976,539 B2 12/2005 Metcalfe et al.
6,976,541 B2 12/2005 Brisco et al.
7,000,953 B2 2/2006 Berghaus
7,007,760 B2 3/2006 Lohbeck
7,021,390 B2 4/2006 Cook et al.
7,036,582 B2 5/2006 Cook et al.
7,044,221 B2 5/2006 Cook et al.
7,048,062 B2 5/2006 Ring et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,684 B2 9/2006 Cook et al.
7,100,685 B2 9/2006 Cook et al.
7,108,061 B2 9/2006 Cook et al.
7,108,072 B2 9/2006 Cook et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,146,702 B2 12/2006 Cook et al.
7,147,053 B2 12/2006 Cook et al.
7,159,665 B2 1/2007 Cook et al.
7,159,667 B2 1/2007 Cook et al.
7,168,496 B2 1/2007 Cook et al.
7,168,499 B2 1/2007 Cook et al.
7,172,019 B2 2/2007 Cook et al.
7,172,021 B2 2/2007 Cook et al.
7,172,024 B2 2/2007 Cook et al.
7,174,964 B2 2/2007 Cook et al.
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024711 A1 2/2003 Simpson et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.

2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112606 A1 6/2004 Lewis et al.
2004/0129431 A1 7/2004 Jackson
2004/0149431 A1 8/2004 Wylie et al.
2004/0159446 A1 8/2004 Haugen et al.
2004/0174017 A1 9/2004 Brill et al.
2004/0188099 A1 9/2004 Cook et al.
2004/0194278 A1 10/2004 Brill et al.
2004/0194966 A1 10/2004 Zimmerman
2004/0216873 A1 11/2004 Frost, Jr. et al.
2004/0221996 A1 11/2004 Burge
2004/0228679 A1 11/2004 Reavis et al.
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230123 A1 10/2005 Cook et al.
2005/0236159 A1 10/2005 Cook et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0027371 A1 2/2006 Gorrara
2006/0032640 A1 2/2006 Costa et al.
2006/0048948 A1 3/2006 Noel
2006/0054330 A1 3/2006 Metcalfe et al.
2006/0065403 A1 3/2006 Watson et al.
2006/0065406 A1 3/2006 Shuster et al.
2006/0096762 A1 5/2006 Brisco
2006/0102360 A1 5/2006 Brisco et al.
2006/0112768 A1 6/2006 Shuster et al.
2006/0113086 A1 6/2006 Costa et al.
2006/0162937 A1 7/2006 Costa et al.
2006/0169460 A1 8/2006 Brisco
2006/0196679 A1 9/2006 Brisco et al.
2006/0207760 A1 9/2006 Watson et al.
2006/0208488 A1 9/2006 Costa
2006/0213668 A1 9/2006 Cook et al.
2006/0219414 A1 10/2006 Shuster
2006/0225892 A1 10/2006 Watson et al.
2006/0243444 A1 11/2006 Brisco
2006/0266527 A1 11/2006 Brisco et al.
2006/0272826 A1 12/2006 Shuster et al.
2007/0012456 A1 1/2007 Cook
2007/0017572 A1 1/2007 Cook
2007/0029095 A1 2/2007 Brisco
2007/0034383 A1 2/2007 Shuster et al.
2007/0039742 A1 2/2007 Costa

FOREIGN PATENT DOCUMENTS

AU 776580 1/2005
AU 780123 3/2005
AU 2001269810 8/2005
AU 782901 9/2005
AU 783245 10/2005
AU 2001294802 10/2005
AU 2001283026 7/2006
AU 2002239857 8/2006
AU 2001292695 10/2006
CA 736288 6/1966
CA 771462 11/1967
CA 1171310 7/1984
CA 2292171 6/2000
CA 2497854 6/2000
CA 2298139 8/2000
CA 2234386 3/2003
CA 2414449 9/2006
CA 2398001 10/2006
CA 2289811 1/2007
DE 174521 4/1953
DE 2458188 6/1975
DE 203767 11/1983
DE 233607 A1 3/1986
DE 278517 A1 5/1990
EP 0084940 A1 8/1983
EP 0272511 12/1987

| | | | |
|---|---|---|---|
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 961750 | | 6/1964 |
| GB | 1062610 | | 3/1967 |
| GB | 1111536 | | 5/1968 |
| GB | 1448304 | | 9/1976 |
| GB | 1460864 | | 1/1977 |
| GB | 1520552 | A | 8/1978 |
| GB | 1542847 | | 3/1979 |
| GB | 1563740 | | 3/1980 |
| GB | 1582767 | | 1/1981 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2331103 | A | 5/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2391028 | A | 1/2004 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2395734 | A | 6/2004 |
| GB | 2396635 | A | 6/2004 |
| GB | 2396639 | A | 6/2004 |

| | | | |
|---|---|---|---|
| GB | 2396646 | A | 6/2004 |
| GB | 2396869 | A | 7/2004 |
| GB | 2398087 | A | 8/2004 |
| GB | 2398326 | A | 8/2004 |
| GB | 2396641 | B | 9/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2400624 | B | 2/2005 |
| GB | 2404402 | A | 2/2005 |
| GB | 2404680 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2414749 | A | 7/2005 |
| GB | 2414750 | A | 7/2005 |
| GB | 2414751 | A | 7/2005 |
| GB | 2398362 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2418944 | B | 8/2006 |
| GB | 2421257 | B | 8/2006 |
| GB | 2421258 | B | 8/2006 |
| GB | 2421259 | B | 8/2006 |
| GB | 2422859 | A | 8/2006 |
| GB | 2422860 | A | 8/2006 |
| GB | 2423317 | A | 8/2006 |
| GB | 2404676 | B | 9/2006 |
| GB | 2414493 | B | 9/2006 |
| GB | 2418941 | B | 9/2006 |
| GB | 2418942 | B | 9/2006 |
| GB | 2418943 | B | 9/2006 |
| GB | 2424077 | A | 9/2006 |
| GB | 2405893 | B | 10/2006 |
| GB | 2417273 | B | 10/2006 |
| GB | 2418216 | B | 10/2006 |
| GB | 2419907 | B | 10/2006 |
| GB | 2422860 | B | 10/2006 |
| GB | 2406125 | B | 11/2006 |
| GB | 2415004 | B | 12/2006 |
| GB | 2422859 | B | 12/2006 |
| GB | 2423317 | B | 12/2006 |
| GB | 2426993 | A | 12/2006 |
| GB | 2427636 | A | 1/2007 |
| GB | 2427885 | A | 1/2007 |
| GB | 2427886 | A | 1/2007 |
| ID | P01.012.197/2005 | | 1/2005 |
| ID | 044.392/2005 | | 9/2005 |
| ID | 03.09.046.2804/2006 | | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |

| | | | |
|---|---|---|---|
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 * | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04535 | A1 | 1/2001 |
| WO | WO01/18354 | A1 | 3/2001 |
| WO | WO01/26860 | A1 | 4/2001 |
| WO | WO01/38693 | A1 | 5/2001 |
| WO | WO01/83943 | A1 | 11/2001 |
| WO | WO 02/20941 | A1 | 3/2002 |
| WO | WO02/23007 | A1 | 3/2002 |
| WO | WO02/25059 | A1 | 3/2002 |
| WO | WO02/40825 | A1 | 5/2002 |
| WO | WO02/095181 | A1 | 5/2002 |
| WO | WO02/053867 | A2 | 7/2002 |
| WO | WO02/053867 | A3 | 7/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/023178 | A2 | 3/2003 |
| WO | WO03/023179 | A2 | 3/2003 |
| WO | WO03/023179 | A3 | 3/2003 |
| WO | WO02/38343 | A3 | 4/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042489 | A2 | 5/2003 |
| WO | WO03/048520 | A1 | 6/2003 |

| | | | |
|---|---|---|---|
| WO | WO03/048521 | A2 | 6/2003 |
| WO | WO03/055616 | A2 | 7/2003 |
| WO | WO03/058022 | A2 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/078785 | A2 | 9/2003 |
| WO | WO03/086675 | A2 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/102365 | A1 | 12/2003 |
| WO | WO03/104601 | A2 | 12/2003 |
| WO | WO03/106130 | A2 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/011776 | A2 | 2/2004 |
| WO | WO2004/018823 | A2 | 3/2004 |
| WO | WO2004/018824 | A2 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026073 | A2 | 4/2004 |
| WO | WO2004/026500 | A2 | 4/2004 |
| WO | WO2004/027200 | A2 | 4/2004 |
| WO | WO2004/027204 | A2 | 4/2004 |
| WO | WO2004/027205 | A2 | 4/2004 |
| WO | WO2004/027392 | A1 | 4/2004 |
| WO | WO2004/027786 | A2 | 4/2004 |
| WO | WO2004/057715 | A2 | 7/2004 |
| WO | WO2004/057715 | A3 | 7/2004 |
| WO | WO2004/067961 | A3 | 8/2004 |
| WO | WO2004/072436 | A1 | 8/2004 |
| WO | WO2004/074622 | A3 | 9/2004 |
| WO | WO2004/076798 | A3 | 9/2004 |
| WO | WO2004/083591 | A3 | 9/2004 |
| WO | WO2004/083592 | A3 | 9/2004 |
| WO | WO2004/083594 | A3 | 9/2004 |
| WO | WO2004/092528 | A3 | 10/2004 |
| WO | WO2004/092530 | A3 | 10/2004 |
| WO | WO2004/094766 | A3 | 11/2004 |
| WO | WO2005/017303 | A2 | 2/2005 |
| WO | WO2005/021921 | A3 | 3/2005 |
| WO | WO2005/021922 | A3 | 3/2005 |
| WO | WO2005/024141 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2006/060387 | A3 | 6/2006 |
| WO | WO2004/089608 | A3 | 7/2006 |
| WO | WO2006/079072 | A2 | 7/2006 |
| WO | WO2006/020810 | A3 | 8/2006 |
| WO | WO2006/088743 | A2 | 8/2006 |
| WO | WO2006/102171 | A2 | 9/2006 |
| WO | WO2006/102556 | A2 | 9/2006 |
| WO | WO2006/020734 | A3 | 11/2006 |
| WO | WO2006/020810 | A3 | 11/2006 |
| WO | WO2007/014339 | A2 | 2/2007 |

OTHER PUBLICATIONS

International Preliminary Examination Report, Application PCT/US02/25608, Jun. 1, 2005.

International Preliminary Examination Report, Application PCT/US02/25727, Jul. 7, 2004.

International Preliminary Examination Report PCT/US02/36157, Apr. 14, 2004.

International Preliminary Examination Report, Application PCT/US02/36267, Jan. 4, 2004.

International Preliminary Examination Report, Application PCT/US02/39418, Feb. 18, 2005.

International Preliminary Examination Report, Application PCT/US03/04837, Dec. 9, 2004.

International Preliminary Examination Report, Application PCT/US03/06544, May 10, 2005.

International Preliminary Examination Report, Application PCT/US03/10144, Jul. 7, 2004.

International Preliminary Examination Report, Application PCT/US03/11765, Dec. 10, 2004.

International Preliminary Examination Report, Application PCT/US03/11765, Jan. 25, 2005.

International Preliminary Examination Report, Application PCT/US03/11765, Jul. 18, 2005.

International Preliminary Examination Report, Application PCT/US01/11765, Aug. 15, 2005 (Corrected).

International Preliminary Examination Report, Application PCT/US03/13787, Mar. 2, 2005.

International Preliminary Examination Report, Application PCT/US03/13787, Apr. 7, 2005.

International Preliminary Examination Report, Application PCT/US03/14153, May 12, 2005.

International Preliminary Examination Report, Application PCT/US03/15020, May 9, 2005.

International Preliminary Examination Report, Application PCT/US03/20870, Sep. 30, 2004.

International Preliminary Examination Report, Application PCT/US03/25667, May 25, 2005.

International Preliminary Examination Report, Application PCT/US03/25675, Aug. 30, 2005.

International Preliminary Examination Report, Application PCT/US03/25676, Aug. 17, 2004.

International Preliminary Examination Report, Application PCT/US03/25677, Aug. 17, 2004.

International Preliminary Examination Report, Application PCT/US03/25742, Dec. 20, 2004.

International Preliminary Examination Report, Application PCT/US03/29460, Dec. 8, 2004.

International Preliminary Examination Report, Application PCT/US03/29858, May 23, 2005.

International Preliminary Examination Report, Application PCT/US03/29859, Aug. 16, 2004.

International Preliminary Examination Report, Application PCT/US03/38550, May 23, 2005.

International Preliminary Report on Patentability, Application PCT/US04/02122, May 13, 2005.

International Preliminary Report on Patentability, Application PCT/US04/04740, Apr. 27, 2005.

International Preliminary Report on Patentability, Application PCT/US04/06246, May 5, 2005.

International Preliminary Report on Patentability, Application PCT/US04/08030, Apr. 7, 2005.

International Preliminary Report on Patentability, Application PCT/US04/08030, Jun. 10, 2005.

International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
Written Opinion to Application No. PCT/US02/39425, Apr. 11, 2005.
Written Opinion to Application No. PCT/US03/25675, Nov. 24, 2004.
Written Opinion to Application No. PCT/US03/25675, May 9, 2005.
Written Opinion to Application No. PCT/US04/08171, May 5, 2005.
Combined Search Report and Written Opinion to Application No. PCT/US04/02122, Feb. 24, 2005.
Combined Search Report and Written Opinion to Application No. PCT/US04/10762, Sep. 1, 2005.
Combined Search Report and Written Opinion to Application No. PCT/US04/28423, Jul. 13, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Search Report to Application No. Norway 1999 5593, Aug. 20, 2002.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil & Gas Reporter*, Sep. 2004.
Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories- Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eernskanaal -2 Groningen," Enventure Global Technology; Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expandable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.
Demong et al., "Breakthroughs Using Solid Expandable Tubulars to Construct Extended Reach Wells," *Society of Petroleum Engineers*, IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore*, Jun. 2003.
Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52, Jul. 3, 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
Enventure Global Technology, Solid Expandable Tubulars are Enabling Technology, *Drilling Contractor*, Mar.-Apr. 2001.
"Enventure Ready to Rejuvinate the North Sea," *Roustabout*, Sep. 2004.
Escobar et al., "Increasing Solid Expandable Tubular Technology Reliability in a Myriad of Downhole Environments," *Society of Petroleum Engineers*, SPE/IADC 81094, 2003.
"Expandable Casing Accesses Remote Reservoirs," *Petroleum Engineer International*, Apr. 1999.
Filippov et al., "Expandable Tubular Solutions," *Society of Petroleum Engineers*, SPE 56500, 1999.
"First ever Set Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Grant et al., "Deepwater Expandable Openhole Liner Case Histories: Learnings Through Field Applications," *Offshore Technology Conference*, OCT 14218, 2002.
Gusevik et al., "Reaching Deep Reservoir Targets Using Solid Expandable Tubulars" *Society of Petroleum Engineers*, SPE 77612, 2002.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.

"Innovators Chart the Course,"
Langley, "Case Study: Value in Drilling Derived From Application-Specific Technology," Oct. 2004.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation- Extending Well Life Through The Use of Solid Expandable Casing Systems,".
Merritt et al., "Well Remediation Using Expandable Cased-Hole Liners", *World Oil*., Jul. 2002.
Merritt et al., "Well Remediation Using Expandable Cased-Hole Liners- Summary of Case Histories"
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Sim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.MITCHMET.com, "3d Surface Texture Parameters," 2004.
"Expand Your Opportunities." *Enventure*. CD-ROM. Jun. 1999.
"Expand Your Opportunities." *Enventure*. CD-ROM. May 2001.
Search Report to Application No. GB 0415835.8, Mar. 10, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2003.
Search and Examination Report to Application No. GB 0512398.9, Jul. 27, 2005.
Examination Report to Application No. GB 0400018.8, May 17, 2005.
Examination Report to Application No. GB 0400019.6, May 19, 2005.
Examination Report to Application No. GB 0400019.6, Sep. 2, 2005.
Examination Report to Application No. GB 0403891.5, Jun. 30, 2005.
Examination Report to Application No. GB 0403893.1, Feb. 14, 2005.
Examination Report to Application No. GB 0403920.2, Feb. 15, 2005.
Examination Report to Application No. GB 0404796.5, Apr. 14, 2005.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0408672.4, Jul. 12, 2004.
Examination Report to Application No. GB 0408672.4, Mar. 21, 2005.
Examination Report to Application No. GB 0412533.2, May 20, 2005.

Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Halliburton Energy Services, "Halliburton Completion Products" 1996, p. Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects; "Analysis of Metal Sheet Formability and It's Factors of Influence" Prof. Dorel Banabic (2003).
www.materialsources.com, "Low Temperature Bonding of Dissimilar and Hard-to-Bond Materials and Metal-Including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Recripocating Automotive Components" G Ryk, Y Klingeman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/15020; Jul. 30, 2003.
International Search Report, Application PCT/US03/19993; May 24, 2004.
International Search Report, Application PCT/US03/20694; Nov. 12, 2003.
International Search Report, Application PCT/US03/20870; May 24, 2004.

International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29859; May 21, 2004.
International Search Report, Application PCT/US03/38550; Jun. 15, 2004.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. GB 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Search Report to Application No. GB 0225505.7, Mar. 5, 2003.
Search and Examination Report to Application No. GB 0225505.7, Jul. 1, 2003.
Examination Report to Application No. GB 0300085.8, Nov. 28, 2003.
Examination Report to Application No. GB 030086.6, Dec. 1, 2003.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.

Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0235072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406258.4, May 20, 2004.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/39418; Jun. 9, 2004.
Written Opinion to Application No. PCT/US03/11765 May 11, 2004.
Mohawk Energy, :Minimizing Drilling Ecoprints Houston, Dec. 16, 2005.
International Preliminary Examination Report, Application PCT/US01/28690, Sep. 4, 2003.
International Preliminary Examination Report, Application PCT/US03/15020 (corrected), Nov. 14, 2004.
International Preliminary Report on Patentability, Application PCT/US04/00631, Mar. 2, 2006.
International Preliminary Report on Patentability, Application PCT/US04/04740, Jun. 27, 2006.
International Preliminary Report on Patentability, Application PCT/US04/10317, Jun. 23, 2006.
International Preliminary Report on Patentability, Application PCT/US04/028423, Mar. 9, 2006.
International Preliminary Report on Patentability, Application PCT/US04/028423, Jun. 19, 2006.
Combined Search Report and Written Opinion to Application No. PCT/US04/00631, Mar. 28, 2005.
Combined Search Report and Written Opinion to Application No. PCT/US04/28831, Dec. 19, 2005.
Combined Search Report and Written Opinion to Application No. PCT/US04/28889, Nov. 14, 2005.
Combined Search Report and Written Opinion to Application No. PCT/US05/28869, Apr. 17, 2006.
Search Report to Application No. GB 0507980.1, Apr. 24, 2006.
Examination Report to Application No. GB 0219757.2, Oct. 31, 2004.
Examination Report to Application No. GB 03701281.2, Jan. 31, 2006.
Examination Report to Application No. GB 0400019.6, Nov. 4, 2005.
Examination Report to Application No. GB 0406257.6, Nov. 9, 2005.
Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 21, 2006.
Examination Report to Application No. GB 0500275.3, Apr. 5, 2006.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0506699.8, May 11, 2006.

Examination Report to Application No. GB 0506700.4, May 16, 2006.
Examination Report to Application No. GB 0506702.0, May 11, 2006.
Examination Report to Application No. GB 0507979.3, Jan. 17, 2006.
Examination Report to Application No. GB 0507979.3, Jun. 6, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518025.2, May 25, 2006.
Examination Report to Application No. GB 0518039.3, Nov. 29, 2005.
Examination Report to Application No. GB 0518252.2, Oct. 28, 2005.
Examination Report to Application No. GB 0518252.2, May 25, 2006.
Examination Report to Application No. GB 0518799.2, Nov. 9, 2005.
Examination Report to Application No. GB 0518799.2, Jun. 14, 2006.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Examination Report to Application No. GB 0603576.0, Apr. 5, 2006.
Examination Report to Application No. GB 0603656.0, May 3, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0412876.5, Sep. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2003257878, Jan. 19, 2006.
Examination Report to Application No. AU 2003257878, Jan. 30, 2006.
Examination Report to Application No. AU 2003257881, Jan. 19, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 03071281.2; Nov. 7, 2005.
Search Report to Application No. EP 03071281.2; Nov. 14, 2005.
Search Report to Application No. EP 03723674.2; Nov. 22, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Examination Report to Application No. Norway 2002 1613, May 13, 2006.
Enventure Global Technology, "SET Technology: The Facts," 2004.
Flatern, "Oilfield Service Trio Target Jules Verne Territory," at http://www.oilonline.com.
Harris, "Tube Welding." At http://www.tubenet.org.uk.technical.ewi.html.
"Pipeline Rehabilitation by Sliplining with Polyethylene Pipe" 2006.
Tumey, "Letter: IP Analysis" May 6, 2006.
www.RIGZONE.com/news/article.asp?a_id=1755, "Tesco Provides Casing Drilling Operations Update," 2001.
www.RIGZONE.com/news/article.asp?a_id=2603, Conoco and Tesco Unveil Revolutionary Drilling Rig 2002.
International Preliminary Report on Patentability, Application PCT/US04/11973, Dec. 26, 2006.
International Preliminary Report on Patentability, Application PCT/US04/28438, Sep. 20, 2005.
International Preliminary Report on Patentability, Application PCT/US04/28887, Sep. 26, 2006.

International Preliminary Report on Patentability, Application PCT/US04/28889, Aug. 1, 2006.
International Preliminary Report on Patentability, Application PCT/US05/28642. Feb. 22, 2007.
International Preliminary Report on Patentability, Application PCT/US05/28819. Feb. 12, 2007.
Written Opinion to Application No. PCT/US04/29025, Jan. 4, 2007.
Combined Search Report and Written Opinion to Application No. PCT/US04/07711, Nov. 28, 2006.
Combined Search Report and Written Opinion to Application No. PCT/US04/26345, Oct. 5, 2006.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819. Aug. 3, 2006.
Combined Search Report and Written Opinion to Application No. PCT/US05/28846, Oct. 27, 2006.
Combined Search Report and Written Opinion to Application No. PCT/US06/02449, Oct. 24, 2006.
Combined Search Report and Written Opinion to Application No. PCT/US06/04809, Aug. 29, 2006.
Combined Search Report and Written Opinion to Application No. PCT/US06/09886, Dec. 4, 2006.
Examination Report to Application No. GB 0428141.6, Jul. 18, 2006.
Examination Report to Application No. GB 0503250.3, Aug. 11, 2006.
Examination Report to Application No. GB 0506702.0, Jul. 24, 2006.
Examination Report to Application No. GB 0517448.7, Jul. 19, 2006.
Examination Report to Application No. GB 0518039.3, Aug. 2, 2006.
Examination Report to Application No. GB 0518893.3, Jul. 28, 2006.
Examination Report to Application No. GB 0518893.3, Jan. 29, 2007.
Examination Report to Application No. GB 0519989.8, Oct. 6, 2006.
Examination Report to Application No. GB 0521931.6, Nov. 8, 2006.
Examination Report to Application No. GB 0522892.9, Aug. 14, 2006.
Examination Report to Application No. GB 0603576.0, Nov. 9, 2006.
Examination Report to Application No. GB 0603656.0, Nov. 10, 2006.
Examination Report to Application No. GB 0609173.0, Feb. 6, 2007.
Search and Examination Report to Application No. GB 0507980.1, Jun. 20, 2006.
Search and Examination Report to Application No. GB 0522049.6, Jul. 13, 2006.
Search and Examination Report to Application No. GB 0522052.0, Aug. 8, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Search and Examination Report to Application No. GB 0614415.8, Oct. 26, 2006.
Search and Examination Report to Application No. GB 0621053.0, Dec. 18, 2006.
Search and Examination Report to Application No. GB 0621054.6, Dec. 18, 2006.
Search and Examination Report to Application No. GB 0621055.3, Dec. 18, 2006.
Search and Examination Report to Application No. GB 0621059.5, Dec. 18, 2006.
Search and Examination Report to Application No. GB 06210560.3, Dec. 18, 2006.
Search and Examination Report to Application No. GB 0621062.9, Dec. 18, 2006.
Search and Examination Report to Application No. GB 0624328.1, Feb. 2, 2007.
Examination Report to Application No. AU 2001278196 ,Sep. 4, 2006.
Examination Report to Application No. EP 03752486.5; Jun. 28, 2006.
Examination Report to Application No. Norway 1999 5593,Feb. 15, 2002.
Examination Report to Application No. Norway 20020070, Jan. 24, 2007.
Examination Report to Application No. Norway 20002876, Sep. 20, 2006.
Examination Report to Application No. Norway 20023885, May 29, 2006.
Examination Report To Application No. Canada 2298139, Nov. 15, 2006.
Examination Report to Application No. Canada 2383231, Feb. 7, 2007.
Examination Report to Application No. Canada 2419806, Jan. 24, 2007.
Examination Report to Application No. Canada 2432030, Jan. 30, 2007.
Examination Report to Application No. Canada 2438807, Jan. 24, 2007.
Examination Report to Application No. Canada 2517524, Jan. 30, 2007.
Examination Report To Application No. CN 02827985.9, Mar. 1, 2007.

* cited by examiner

MONO DIAMETER WELLBORE CASING

CROSS REFERENCE TO RELATED APPLICATIONS

The present application is a National Stage patent application filing corresponding to PCT patent application Ser. No. PCT/US02/36,267, filed on Nov. 12, 2002, which claimed the benefit of the filing dates of: (1) U.S. provisional patent application Ser. No. 60/338,996, filed on Nov. 12, 2001, (2) U.S. provisional patent application Ser. No. 60/339,013, filed on Nov. 12, 2001 (3) U.S. provisional patent application Ser. No. 60/363,829, filed on Mar. 13, 2002, (4) U.S. provisional patent application Ser. No. 60/387,961, filed on Jun. 12, 2002 the disclosures of which are incorporated herein by reference.

The present application is related to the following: (1) U.S. patent application Ser. No. 09/454,139, filed on Dec. 3, 1999, now U.S. Pat. No. 6,604,763, (2) U.S. patent application Ser. No. 09/510,913, filed on Feb. 23, 2000, (3) U.S. patent application Ser. No. 09/502,350, filed on Feb. 10, 2000, now U.S. Pat. No. 6,823,937 (4) U.S. patent application Ser. No. 09/440,338, filed on Nov. 15, 1999, now U.S. Pat. No. 6,328,113 (5) U.S. patent application Ser. No. 09/523,460, filed on Mar. 10, 2000, now U.S. Pat. No. 6,640,903 (6) U.S. patent application Ser. No. 09/512,895, filed on Feb. 24, 2000, now U.S. Pat. No. 6,568,471 (7) U.S. patent application Ser. No. 09/511,941, filed on Feb. 24, 2000, now U.S. Pat. No. 6,575,240 (8) U.S. patent application Ser. No. 09/588,946, filed on Jun. 7, 2000, now U.S. Pat. No. 6,557,640 (9) U.S. patent application Ser. No. 09/559,122, filed on Apr. 26, 2000, now U.S. Pat. No. 6,604,763, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,021, filed on Sep. 7, 2001, (29) U.S. provisional patent application Ser. No. 60/3318,386, filed on Sep. 10, 2001, (30) U.S. provisional patent application Ser. No. 60/326,886, filed on Oct. 3, 2001, (31) U.S. utility patent application Ser. No. 09/969,922, filed on Oct. 3, 2001, (32) U.S. provisional patent application Ser. No. 60/338,996, filed on Nov. 12, 2001, (33) U.S. provisional patent application Ser. No. 60/339,013, filed on Nov. 12, 2001, (34) U.S. utility patent application Ser. No. 10/016,467, filed on Dec. 10, 2001, (35) U.S. provisional patent application Ser. No. 60/343,674, filed on Dec. 27, 2001, (36) U.S. provisional patent application Ser. No. 60/346,309, filed on Jan. 7, 2002, (37) U.S. provisional patent application Ser. No. 60/357,372, filed on Feb. 15, 2002, (38) U.S. provisional patent application Ser. No. 60/363,829, filed on Mar. 13, 2002, (39) U.S. provisional patent application Ser. No. 60/372,048, filed on Apr. 12, 2002, (40) U.S. provisional patent application Ser. No. 60/372,632, filed on Apr. 15, 2002, (41) U.S. provisional patent application Ser. No. 60/380,147, filed on May 6, 2002, (42) U.S. provisional patent application Ser. No. 60/383,917, filed on May 29, 2002, (43) U.S. provisional patent application Ser. No. 60/387,486, filed on Jun. 10, 2002, (44) U.S. provisional patent application Ser. No. 60/387,961, filed on Jun. 12, 2002, (45) U.S. provisional patent application Ser. No. 60/391,703, filed on Jun. 26, 2002, (46) U.S. provisional patent application Ser. No. 60/397,284, filed on Jul. 19, 2002, (47) U.S. provisional patent application Ser. No. 60/398,061, filed on Jul. 24, 2002, (48) U.S. provisional patent application Ser. No. 60/399,240, filed on Jul. 29, 2002, (49) U.S. provisional patent application Ser. No. 60/405,610, filed on Aug. 23, 2002, (50) U.S. provisional patent application Ser. No. 60/405,394, filed on Aug. 23, 2002, (51) U.S. provisional patent application Ser. No. 60/407,442, filed on Aug. 30, 2002, (52) U.S. provisional patent application Ser. No. 60/412,542, filed on Sep. 20, 2002, (53) U.S. provisional patent application Ser. No. 60/412,177, filed on Sep. 20, 2002, (54) U.S. provisional patent application Ser. No. 60/412,653, filed on Sep. 20, 2002, (55) U.S. provisional patent application Ser. No. 60/412,544, filed on Sep. 20, 2002, (56) U.S. provisional patent application Ser. No. 60/412,187, filed on Sep. 20, 2002, (57) U.S. provisional patent application Ser. No. 60/412,187, filed on Sep. 20, 2002, (58) U.S. provisional patent application Ser. No. 60/412,487, filed on Sep. 20, 2002, (58) U.S. provisional patent application Ser. No. 60/412,487, filed on Sep. 20, 2002, (59) U.S. provisional patent application Ser. No. 60/412,488, filed on Sep. 20, 2002, and (60) U.S. provisional patent application Ser. No. 60/412,371, filed on Sep. 20, 2002, (61) PCT Patent Application No. PCT/US02/36,157, filed on Nov. 11, 2002 and (62) PCT Patent Application No. PCT/US02/36,267, filed on Nov. 11, 2002 the disclosures of which are incorporated herein by reference.

This application is related to the following applications: (1) U.S. Patent No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No.

09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, now U.S. Pat. No. 6,695,012 which issued Feb. 24, 2004, which claims priority from provisional patent application Ser. No. 60/159,039, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, now U.S. Pat. No. 6,976,541 which issued Dec. 20, 2005, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04,353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25,608, filed on Aug. 13, 2002, which claims priority from provisional application 60/318,021, filed on Sept. 7, 2001, (36) PCT Application US02/24,399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20,256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, now U.S. Pat. No. 6,892,819 which issued May 17, 2005, which is a divisional of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, now U.S. Pat. No. 6,739,392 which issued May 25, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, now U.S. Pat. No. 6,725,919 which issued Apr. 27, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, now U.S. Pat. No. 6,758,278 which issued Jul. 6, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25,727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39,425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, now U.S. Pat. No. 6,745,845 which issued Jun. 8, 2004, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, now U.S. Pat. No. 6,705,395 which issued Mar. 16, 2004, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, now U.S. Pat. No. 6,631,759 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, now U.S. Pat. No. 6,631,769 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, now U.S. Pat. No. 7,063,142 which issued Jun. 20, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, now U.S. Pat. No. 6,684,947 which issued Feb. 3, 2004, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, now U.S. Pat. No. 6,966,370 which issued Nov. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, now U.S. Pat. No. 7,044,221 which issued May 16, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, now U.S. Pat. No. 7,011,161 which issued Mar. 14, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, now U.S. Pat. No. 7,040,396 which issued May 9, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, now U.S. Pat. No. 7,048,062 which issued May 23, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, now U.S. Pat. No. 6,857,473 which issued Feb. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36,157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11,765, filed on Apr. 16, 2003, which claims priority from U.S. provisional patent application Ser. No. 60/383,917, filed on May 29, 2002, (65) PCT application US 03/15,020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06,544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04,837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, now U.S. Pat. No. 7,077,213 which issued Jul. 18, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, now U.S. Pat. No. 7,036,582 which issued May 2, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, now U.S. Pat. No. 7,044,218 which issued May 16, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10,144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, (77) PCT application US 03/19,993, filed on Jun. 24, 2003, which claims priority from U.S. provisional patent application Ser. No. 60/397,284, filed on Jul. 19, 2002, (78) PCT application US 03/13,787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20,694, filed on Jul. 1, 2003, which claims priority from U.S. provisional patent application Ser. No. 60/398,061, filed on Jul. 24, 2002, (81) PCT application US 03/20,870, filed on Jul. 2, 2003, which claims priority from U.S. provisional patent application Ser. No. 60/399,240, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24,779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, (104) U.S. patent application Ser. No. 10/418,687, filed on Apr. 18, 2003, now U.S. Pat. No. 7,021,390 which issued Apr. 4, 2006, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application No. 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, now U.S. Pat. No. 6,968,618 which issued Nov. 29, 2005, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, now U.S. Pat. No. 7,055,608 which issued Jun. 6, 2006, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application serial no. PCT/US2004/06,246, filed on Feb. 26, 2004; (123) PCT patent application serial number PCT/US2004/08170, filed on Mar. 15, 2004; (124) PCT patent application serial number PCT/US2004/08,171, filed on Mar. 15, 2004; (125) PCT patent application serial number PCT/US2004/08,073, filed on Mar. 18, 2004; (126) PCT patent application serial number PCT/US2004/07711, filed on Mar. 11, 2004; (127) PCT patent application serial number PCT/US2004/029025, filed on Mar. 26, 2004; (128) PCT patent application serial number PCT/US2004/010317, filed on Apr. 2, 2004; (129) PCT patent application serial number PCT/US2004/010712, filed on Apr. 6, 2004; (130) PCT patent application serial number PCT/US2004/010762, filed on Apr. 6, 2004; (131) PCT patent application serial number PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application serial number PCT/US2005/027318, filed on Jul. 29, 2005; (135) PCT patent application serial number PCT/US2005/028936, filed on Aug. 12, 2005; (136) PCT patent application serial number PCT/US2005/028669, filed on Aug. 11, 2005; (137) PCT patent application serial number PCT/US2005/028453, filed on Aug. 11, 2005; (138) PCT patent application serial number PCT/US2005/028641, filed on Aug. 11, 2005; (139) PCT patent application serial number PCT/US2005/028819, filed on Aug. 11, 2005; (140) PCT patent application serial number PCT/US2005/028446, filed on Aug. 11, 2005; (141) PCT patent application serial number PCT/US2005/028642, filed on Aug. 11, 2005; (142) PCT patent application serial number PCT/US2005/028451, filed on Aug. 11, 2005, and (143), PCT patent application serial number PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005, (148) U.S. utility patent application Ser. No. 10/545,941, filed on Aug. 16, 2005, (149) U.S. utility patent application Ser. No. 546,078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application serial number PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645840, filed on Jan. 21, 2005, (161) PCT patent application serial number PCT/US2005/043122, filed on Nov. 29, 2005 which claims priority from U.S. provisional patent application Ser. No. 60/631703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application No. 60/717391, filed on Sep. 15, 2005; (166) U.S. National Stage application Ser. No. 10/55,0906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725181, filed on Oct. 11, 2005; (171) U.S. National Stage application Ser. No. 10/553,094, filed on Sep. 13, 2005; (172) U.S. National Stage application Ser. No. 10/553,566, filed on Oct. 17, 2005; (173) PCT Patent Application No. PCT/US2006/002449, (174) PCT Patent Application No. PCT/US2006/004809, filed on Feb. 9, 2006; (175) U.S. Utility patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, (188) U.S. utility patent application Ser. No. 10/950,869, filed on Sep. 27, 2004; (189) U.S. provisional patent application Ser. No. 60/761324, filed on Jan. 23, 2006, (190) U.S. provisional patent application Ser. No. 60/754,556, (191) U.S. utility patent application Ser. No. 11/380,051, filed on Apr. 25, 2006, (192) U.S. utility patent application Ser. No. 11/380,055, filed on Apr. 25, 2006, (193) U.S. utility patent application Ser. No. 10/522,039, filed on Mar. 10, 2006; (194) U.S. provisional patent application Ser. No. 60/746,813, filed on May 9, 2006; (195) U.S. utility patent application Ser. No. 11/45,684, filed on Jul. 11, 2006; and (196) U.S. utility patent application Ser. No. 11/456,587, filed on Jul. 11, 2006; (197) PCT Patent Application No. PCT/US2006/009886, filed on Mar. 21, 2006; (198) PCT Patent Application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003; (201) U.S. patent application Ser. No. 10/767,953, filed Jan. 29, 2004, now U.S. Pat. No. 7,077,211 which issued Jul. 18, 2006; (202) U.S. patent application No. 10/769,726, filed Jan. 30, 2004; (203) U.S. patent application Ser. No. 10/770,363 filed Feb. 2, 2004; (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; (212) U.S. utility patent application Ser. No. 11/074,266, filed on Mar. 7, 2005, (213) U.S. provisional patent application Ser. No. 60/832909, filed on Jul. 24, 2006, (214) U.S. utility patent application Ser. No. 11/536,302, filed Sep. 28, 2006, (215) U.S. utility patent application Ser. No. 11/538,228, filed Oct. 3, 2006, and (216) U.S. utility patent application Ser. No. 11/552,703, filed on Oct. 25, 2006.

BACKGROUND OF THE INVENTION

This invention relates generally to oil and gas exploration, and in particular to forming and repairing wellbore casings to facilitate oil and gas exploration.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming and/or repairing wellbore casings.

SUMMARY OF THE INVENTION

According to one aspect of the present invention, an apparatus for radially expanding and plastically deforming an expandable tubular member is provided that includes a float shoe adapted to mate with an end of the expandable tubular member, an adjustable expansion device coupled to the float shoe adapted to be controllably expanded to a larger outside dimension for radial expansion of the expandable tubular member or collapsed to a smaller outside dimension, an actuator coupled to the adjustable expansion device adapted to controllably displace the adjustable expansion device relative to the expandable tubular member, a locking device coupled to the actuator adapted to controllably engage the expandable tubular member, and a support member coupled to the locking device.

According to another aspect of the present invention, a method for radially expanding and plastically deforming an expandable tubular member within a borehole is provided that includes positioning an adjustable expansion device within the expandable tubular member, supporting the expandable tubular member and the adjustable expansion device within the borehole, lowering the adjustable expansion device out of the expandable tubular member, increasing the outside dimension of the adjustable expansion device, and displacing the adjustable expansion device upwardly relative to the expandable tubular member n times to radially expand and plastically deform n portions of the expandable tubular member.

According to another aspect of the present invention, a method for forming a mono diameter wellbore casing is provided that includes positioning an adjustable expansion device within a first expandable tubular member, supporting the first expandable tubular member and the adjustable expansion device within a borehole, lowering the adjustable expansion device out of the first expandable tubular member, increasing the outside dimension of the adjustable expansion device, displacing the adjustable expansion device upwardly relative to the first expandable tubular member m times to radially expand and plastically deform m portions of the first expandable tubular member within the borehole, positioning the adjustable expansion device within a second expandable tubular member, supporting the second expandable tubular member and the adjustable expansion device within the borehole in overlapping relation to the first expandable tubular member, lowering the adjustable expansion device out of the second expandable tubular member, increasing the outside dimension of the adjustable expansion device, and displacing the adjustable expansion device upwardly relative to the second expandable tubular member n times to radially expand and plastically deform n portions of the second expandable tubular member within the borehole.

According to another aspect of the present invention, an apparatus for radially expanding and plastically deforming an expandable tubular member is provided that includes a float shoe adapted to mate with an end of the expandable tubular member, an adjustable expansion device coupled to the float shoe adapted to be controllably expanded to a larger outside dimension for radial expansion of the expandable tubular member or collapsed to a smaller outside dimension, an actuator coupled to the adjustable expansion device adapted to controllably displace the adjustable expansion device relative to the expandable tubular member, a locking device coupled to the actuator adapted to controllably engage the expandable tubular member, a support member coupled to the locking device, and a sealing member for sealingly engaging the expandable tubular member adapted to define a pressure chamber above the adjustable expansion device during radial expansion of the expandable tubular member.

According to another aspect of the present invention, a method for radially expanding and plastically deforming an expandable tubular member within a borehole is provided that includes positioning an adjustable expansion device within the expandable tubular member, supporting the expandable tubular member and the adjustable expansion device within the borehole, lowering the adjustable expansion device out of the expandable tubular member, increasing the outside dimension of the adjustable expansion device, displacing the adjustable expansion device upwardly relative to the expandable tubular member n times to radially expand and plastically deform n portions of the expandable tubular member within the borehole, and pressurizing an interior region of the expandable tubular member above the adjustable expansion device during the radial expansion and plastic deformation of the expandable tubular member within the borehole.

According to another aspect of the present invention, a method for forming a mono diameter wellbore casing is provided that includes positioning an adjustable expansion device within a first expandable tubular member, supporting the first expandable tubular member and the adjustable expansion device within a borehole, lowering the adjustable expansion device out of the first expandable tubular member, increasing the outside dimension of the adjustable expansion device, displacing the adjustable expansion device upwardly relative to the first expandable tubular member m times to radially expand and plastically deform m portions of the first expandable tubular member within the borehole, pressurizing an interior region of the first expandable tubular member above the adjustable expansion device during the radial expansion and plastic deformation of the first expandable tubular member within the borehole, positioning the adjustable expansion device within a second expandable tubular member, supporting the second expandable tubular member and the adjustable expansion device within the borehole in overlapping relation to the first expandable tubular member, lowering the adjustable expansion device out of the second expandable tubular member, increasing the outside dimension of the adjustable expansion device, displacing the adjustable expansion device upwardly relative to the second expandable tubular member n times to radially expand and plastically deform n portions of the second expandable tubular member within the borehole, and pressurizing an interior region of the second expandable tubular member above the adjustable expansion device during the radial expansion and plastic deformation of the second expandable tubular member within the borehole.

According to another aspect of the present invention, an apparatus for drilling a borehole within a subterranean formation and then radially expanding and plastically deforming an expandable tubular member within the drilled borehole is provided that includes a float shoe adapted to mate with an end of the expandable tubular member, a drilling member coupled to the float shoe adapted to drill the borehole, an adjustable expansion device coupled to the float shoe adapted to be controllably expanded to a larger outside dimension for radial expansion of the expandable tubular member or collapsed to a smaller outside dimension, an actuator coupled to the adjustable expansion device adapted to controllably displace the adjustable expansion device relative to the expandable tubular member, a locking device coupled to the actuator adapted to controllably engage the expandable tubular member, and a support member coupled to the locking device.

According to another aspect of the present invention, a method for drilling a borehole within a subterranean formation and then radially expanding and plastically deforming an expandable tubular member within the drilled borehole is provided that include positioning an adjustable expansion device within the expandable tubular member, coupling a drilling member to an end of the expandable tubular member, drilling the borehole using the drilling member, positioning the adjustable expansion device and the expandable tubular member within the drilled borehole, lowering the adjustable expansion device out of the expandable tubular member, increasing the outside dimension of the adjustable expansion device, and displacing the adjustable expansion device upwardly relative to the expandable tubular member n times to radially expand and plastically deform n portions of the expandable tubular member within the drilled borehole.

According to another aspect of the present invention, a method for forming a mono diameter wellbore casing within a borehole is provided that includes positioning an adjustable expansion device within a first expandable tubular member, coupling a drilling member to an end of the first expandable tubular member, drilling a first section of the borehole using the drilling member, supporting the first expandable tubular member and the adjustable expansion device within the drilled first section of the borehole, lowering the adjustable expansion device out of the first expandable tubular member, increasing the outside dimension of the adjustable expansion device, displacing the adjustable expansion device upwardly relative to the first expandable tubular member m times to radially expand and plastically deform m portions of the first expandable tubular member within the drilled first section of the borehole, positioning the adjustable expansion device within a second expandable tubular member, coupling the drilling member to an end of the second expandable tubular member, drilling a second section of the borehole using the drilling member, supporting the second expandable tubular member and the adjustable expansion device within the borehole in overlapping relation to the first expandable tubular member within the second drilled section of the borehole, lowering the adjustable expansion device out of the second expandable tubular member, increasing the outside dimension of the adjustable expansion device, and displacing the adjustable expansion device upwardly relative to the second expandable tubular member n times to radially expand and plastically deform n portions of the second expandable tubular member within the drilled second section of the borehole.

According to another aspect of the present invention, an apparatus for drilling a borehole within a subterranean formation and then radially expanding and plastically deforming an expandable tubular member within the drilled borehole is provided that includes a float shoe adapted to mate with an end of the expandable tubular member, a drilling member coupled to the float shoe adapted to drill the borehole, an adjustable expansion device coupled to the float shoe adapted to be controllably expanded to a larger outside dimension for radial expansion of the expandable tubular member or collapsed to a smaller outside dimension, an actuator coupled to the adjustable expansion device adapted to controllably displace the adjustable expansion device relative to the expandable tubular member, a locking device coupled to the actuator adapted to controllably engage the expandable tubular member, a support member coupled to the locking device, and a sealing member for sealing engaging the expandable tubular member adapted to define a pressure chamber above the adjustable expansion device during the radial expansion of the expandable tubular member.

According to another aspect of the present invention, a method for drilling a borehole within a subterranean formation and then radially expanding and plastically deforming an expandable tubular member within the drilled borehole is provided that includes positioning an adjustable expansion device within the expandable tubular member, coupling a drilling member to an end of the expandable tubular member, drilling the borehole using the drilling member, positioning the adjustable expansion device and the expandable tubular member within the drilled borehole, lowering the adjustable expansion device out of the expandable tubular member, increasing the outside dimension of the adjustable expansion device, displacing the adjustable expansion device upwardly relative to the expandable tubular member n times to radially expand and plastically deform n portions of the expandable tubular member within the drilled borehole, and pressuring an interior portion of the expandable tubular member above the adjustable expansion device during the radial expansion and plastic deformation of the expandable tubular member within the drilled borehole.

According to another aspect of the present invention, a method for forming a mono diameter wellbore casing within a borehole is provided that includes positioning an adjustable expansion device within a first expandable tubular member, coupling a drilling member to an end of the first expandable tubular member, drilling a first section of the borehole using the drilling member, supporting the first expandable tubular member and the adjustable expansion device within the drilled first section of the borehole, lowering the adjustable expansion device out of the first expandable tubular member, increasing the outside dimension of the adjustable expansion device, displacing the adjustable expansion device upwardly relative to the first expandable tubular member m times to radially expand and plastically deform m portions of the first expandable tubular member within the drilled first section of the borehole, pressuring an interior portion of the first expandable tubular member above the adjustable expansion device during the radial expansion and plastic deformation of the first expandable tubular member within the first drilled section of the borehole, positioning the adjustable expansion device within a second expandable tubular member, coupling the drilling member to an end of the second expandable tubular member, drilling a second section of the borehole using the drilling member, supporting the second expandable tubular member and the adjustable expansion device within the borehole in overlapping relation to the first expandable tubular member within the second drilled section of the borehole, lowering the adjustable expansion device out of the second expandable tubular member, increasing the outside dimension of the adjustable expansion device, displacing the adjustable expansion device upwardly relative to the second expandable tubular member n times to radially expand and plastically deform n portions of the second expandable tubular member within the drilled second section of the borehole, and pressuring an interior portion of the second expandable tubular member above the adjustable expansion device during the radial expansion and plastic deformation of the second expandable tubular member within the drilled second section of the borehole.

According to another aspect of the present invention, an apparatus for radially expanding and plastically deforming an expandable tubular member is provided that includes a float shoe adapted to mate with an end of the expandable tubular member, a first adjustable expansion device coupled to the float shoe adapted to be controllably expanded to a first larger outside dimension for radial expansion of the expandable tubular member or collapsed to a first smaller outside dimension, a second adjustable expansion device coupled to the first adjustable expansion device adapted to be controllably expanded to a second larger outside dimension for radial expansion of the expandable tubular member or collapsed to a second smaller outside dimension, an actuator coupled to the first and second adjustable expansion devices adapted to controllably displace the first and second adjustable expansion devices relative to the expandable tubular member, a locking device coupled to the actuator adapted to controllably engage the expandable tubular member, and a support member coupled to the locking device. The first larger outside dimension of the first adjustable expansion device is larger than the second larger outside dimension of the second adjustable expansion device.

According to another aspect of the present invention, a method for radially expanding and plastically deforming an expandable tubular member within a borehole is provided that includes positioning first and second adjustable expansion devices within the expandable tubular member, supporting the expandable tubular member and the first and second adjustable expansion devices within the borehole, lowering the first adjustable expansion device out of the expandable tubular member, increasing the outside dimension of the first adjustable expansion device, displacing the first adjustable expansion device upwardly relative to the expandable tubular member to radially expand and plastically deform a lower portion of the expandable tubular member, displacing the first adjustable expansion device and the second adjustable expansion device downwardly relative to the expandable tubular member, decreasing the outside dimension of the first adjustable expansion device and increasing the outside dimension of the second adjustable expansion device, and displacing the second adjustable expansion device upwardly relative to the expandable tubular member to radially expand and plastically deform portions of the expandable tubular member above the lower portion of the expandable tubular member. The outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member, supporting the first expandable tubular member and the first and second adjustable expansion devices within a borehole, lowering the first adjustable expansion device out of the first expandable tubular member, increasing the outside dimension of the first adjustable expansion device, displacing the first adjustable expansion device upwardly relative to the first expandable tubular member to radially expand and plastically deform a lower portion of the first expandable tubular member, displacing the first adjustable expansion device and the second adjustable expansion device downwardly relative to the first expandable tubular member, decreasing the outside dimension of the first adjustable expansion device and increasing the outside dimension of the second adjustable expansion device, displacing the second adjustable expansion device upwardly relative to the first expandable tubular member to radially expand and plastically deform portions of the first expandable tubular member above the lower portion of the expandable tubular member, positioning first and second adjustable expansion devices within a second expandable tubular member, supporting the first expandable tubular member and the first and second adjustable expansion devices within the borehole in overlapping relation to the first expandable tubular member, lowering the first adjustable expansion device out of the second expandable tubular member, increasing the outside dimension of the first adjustable expansion device, displacing the first adjustable expansion device upwardly relative to the second expandable tubular member to radially expand and plastically deform a lower portion of the second expandable tubular member, displacing the first adjustable expansion device and the second adjustable expansion device downwardly relative to the second expandable tubular member, decreasing the outside dimension of the first adjustable expansion device and increasing the outside dimension of the second adjustable expansion device, and displacing the second adjustable expansion device upwardly relative to the second expandable tubular member to radially expand and plastically deform portions of the second expandable tubular member above the lower portion of the second expandable tubular member. The outside dimension of the first adjustable expansion device is greater than the outside dimension of the second adjustable expansion device.

According to another aspect of the present invention, an apparatus for radially expanding and plastically deforming an expandable tubular member is provided that includes a float shoe adapted to mate with an end of the expandable tubular member, a first adjustable expansion device coupled to the float shoe adapted to be controllably expanded to a first larger outside dimension for radial expansion of the expandable tubular member or collapsed to a first smaller outside dimension, a second adjustable expansion device coupled to the first adjustable expansion device adapted to be controllably expanded to a second larger outside dimension for radial expansion of the expandable tubular member or collapsed to a second smaller outside dimension, an actuator coupled to the first and second adjustable expansion devices adapted to controllably displace the first and second adjustable expansion devices relative to the expandable tubular member, a locking device coupled to the actuator adapted to controllably engage the expandable tubular member, a support member coupled to the locking device, and a sealing member for sealingly engaging the expandable tubular adapted to define a pressure chamber above the first and second adjustable expansion devices during the radial expansion of the expandable tubular member. The first larger outside dimension of the first adjustable expansion device is larger than the second larger outside dimension of the second adjustable expansion device.

According to another aspect of the present invention, a method for radially expanding and plastically deforming an expandable tubular member within a borehole is provided that includes positioning first and second adjustable expansion devices within the expandable tubular member, supporting the expandable tubular member and the first and second adjustable expansion devices within the borehole, lowering the first adjustable expansion device out of the expandable tubular member, increasing the outside dimension of the first adjustable expansion device, displacing the first adjustable expansion device upwardly relative to the expandable tubular member to radially expand and plastically deform a lower portion of the expandable tubular member, pressurizing an interior region of the expandable tubular member above the first adjustable expansion device during the radial expansion of the lower portion of the expandable tubular member by the first adjustable expansion device, displacing the first adjustable expansion device and the second adjustable expansion device downwardly relative to the expandable tubular member, decreasing the outside dimension of the first adjustable expansion device and increasing the outside dimension of the second adjustable expansion device, displacing the second adjustable expansion device upwardly relative to the expandable tubular member to radially expand and plastically deform portions of the expandable tubular member above the lower portion of the expandable tubular member, and pressurizing an interior region of the expandable tubular member above the second adjustable expansion device during the radial expansion of the portions of the expandable tubular member above the lower portion of the expandable tubular member by the second adjustable expansion device. The outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member, supporting the first expandable tubular member and the first and second adjustable expansion devices within a borehole, lowering the first adjustable expansion device out of the first expandable tubular member, increasing the outside dimension of the first adjustable expansion device, displacing the first adjustable expansion device upwardly relative to the first expandable tubular member to radially expand and plastically deform a lower portion of the first expandable tubular member, pressurizing an interior region of the first expandable tubular member above the first adjustable expansion device during the radial expansion of the lower portion of the first expandable tubular member by the first adjustable expansion device, displacing the first adjustable expansion device and the second adjustable expansion device downwardly relative to the first expandable tubular member, decreasing the outside dimension of the first adjustable expansion device and increasing the outside dimension of the second adjustable expansion device, displacing the second adjustable expansion device upwardly relative to the first expandable tubular member to radially expand and plastically deform portions of the first expandable tubular member above the lower portion of the expandable tubular member, pressurizing an interior region of the first expandable tubular member above the second adjustable expansion device during the radial expansion of the portions of the first expandable tubular member above the lower portion of the first expandable tubular member by the second adjustable expansion device, positioning first and second adjustable expansion devices within a second expandable tubular member, supporting the first expandable tubular member and the first and second adjustable expansion devices within the borehole in overlapping relation to the first expandable tubular member, lowering the first adjustable expansion device out of the second expandable tubular member, increasing the outside dimension of the first adjustable expansion device, displacing the first adjustable expansion device upwardly relative to the second expandable tubular member to radially expand and plastically deform a lower portion of the second expandable tubular member, pressurizing an interior region of the second expandable tubular member above the first adjustable expansion device during the radial expansion of the lower portion of the second expandable tubular member by the first adjustable expansion device, displacing the first adjustable expansion device and the second adjustable expansion device downwardly relative to the second expandable tubular member, decreasing the outside dimension of the first adjustable expansion device and increasing the outside dimension of the second adjustable expansion device, displacing the second adjustable expansion device upwardly relative to the second expandable tubular member to radially expand and plastically deform portions of the second expandable tubular member above the lower portion of the second expandable tubular member, and pressurizing an interior region of the second expandable tubular member above the second adjustable expansion device during the radial expansion of the portions of the second expandable tubular member above the lower portion of the second expandable tubular member by the second adjustable expansion device. The outside dimension of the first adjustable expansion device is greater than the outside dimension of the second adjustable expansion device.

According to another aspect of the present invention, an apparatus for radially expanding and plastically deforming an expandable tubular member is provided that includes a support member, a locking device coupled to the support member and releasably coupled to the expandable tubular member, an adjustable expansion device adapted to be controllably expanded to a larger outside dimension for radial expansion and plastic deformation of the expandable tubular member or collapsed to a smaller outside dimension; and an actuator coupled to the locking member and the adjustable expansion device adapted to displace the adjustable expansion device upwardly through the expandable tubular member to radially expand and plastically deform the expandable tubular member.

According to another aspect of the present invention, a method for radially expanding and plastically deforming an expandable tubular member within a borehole is provided that includes supporting the expandable tubular member, an hydraulic actuator, and an adjustable expansion device within the borehole, increasing the size of the adjustable expansion device, displacing the adjustable expansion device upwardly relative to the expandable tubular member using the hydraulic actuator to radially expand and plastically deform a portion of the expandable tubular member.

According to another aspect of the present invention, a method for forming a mono diameter wellbore casing within a borehole that includes a preexisting wellbore casing is provided that includes supporting the expandable tubular member, an hydraulic actuator, and an adjustable expansion device within the borehole, increasing the size of the adjustable expansion device, displacing the adjustable expansion device upwardly relative to the expandable tubular member using the hydraulic actuator to radially expand and plastically deform a portion of the expandable tubular member, and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, an apparatus for radially expanding and plastically deforming an expandable tubular member is provided that includes a support member; an expansion device for radially expanding and plastically deforming the tubular member coupled to the support member; and a sealing assembly for sealing an annulus defined between the support member and the tubular member.

According to another aspect of the present invention, an apparatus for radially expanding and plastically deforming an expandable tubular member is provided that includes a support member; a first expansion device for radially expanding and plastically deforming the tubular member coupled to the support member; and a second expansion device for radially expanding and plastically deforming the tubular member coupled to the support member.

According to another aspect of the present invention, an apparatus for radially expanding and plastically deforming an expandable tubular member is provided that includes a support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member.

According to another aspect of the present invention, an actuator is provided that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber.

According to another aspect of the present invention, a method of radially expanding and plastically deforming an expandable tubular member within a borehole having a preexisting wellbore casing is provided that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section.

According to another aspect of the present invention, a method for radially expanding and plastically deforming an expandable tubular member within a borehole is provided that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member.

According to another aspect of the present invention, a method for forming a mono diameter wellbore casing within a borehole that includes a preexisting wellbore casing is provided that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, a method of radially expanding and plastically deforming a tubular member is provided that includes positioning the tubular member within a preexisting structure; radially expanding and plastically deforming a lower portion of the tubular member to form a bell section; and radially expanding and plastically deforming a portion of the tubular member above the bell section.

According to another aspect of the present invention, a method of injecting a hardenable fluidic sealing material into an annulus between a tubular member and a preexisting structure is provided that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

According to another aspect of the present invention, a method of engaging a tubular member is provided that includes positioning a plurality of elements within the tubular member; and bringing the elements into engagement with the tubular member.

According to another aspect of the present invention, a locking device for locking a tubular member to a support member is provided that includes a radially movable locking device coupled to the support member for engaging an interior surface of the tubular member.

According to another aspect of the present invention, a method of locking a tubular member to a support member is provided that includes locking a locking element in a position that engages an interior surface of the tubular member.

DETAILED DESCRIPTION OF THE ILLUSTRATIVE EMBODIMENTS

Figure 1:
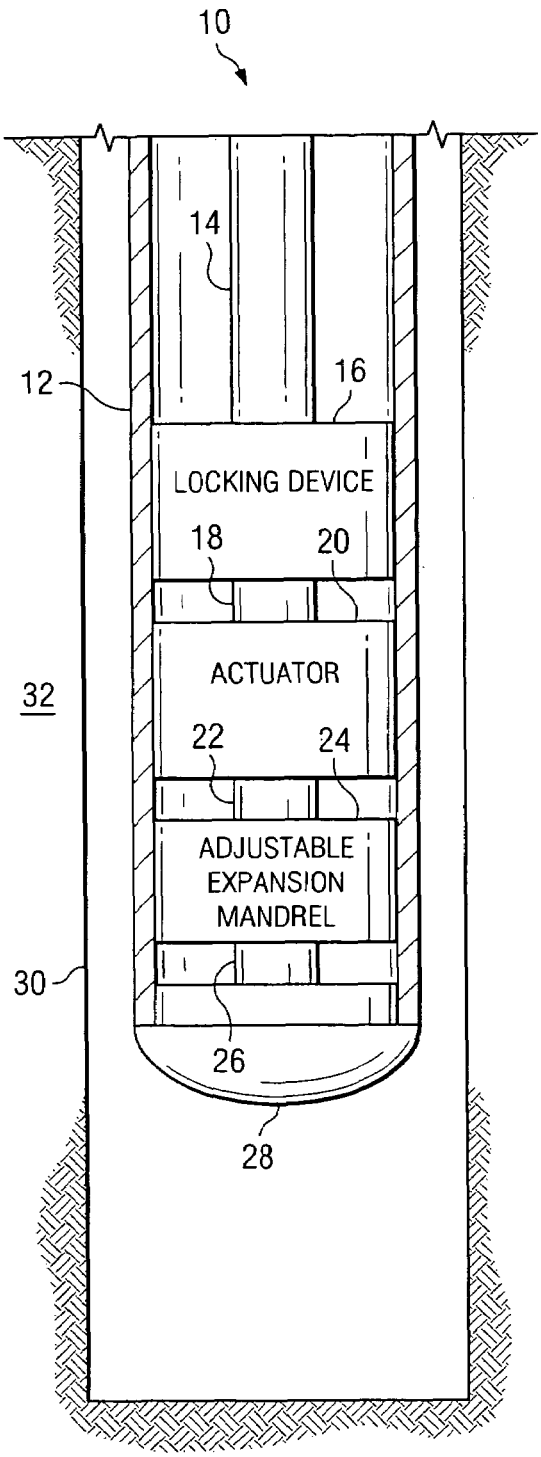
FIG. 1 is a fragmentary cross-sectional illustration of the placement of an embodiment of an apparatus for radially expanding and plastically deforming a tubular member within a preexisting structure.

Referring to FIG. 1, an exemplary embodiment of an apparatus 10 for radially expanding and plastically deforming a tubular member 12 includes a tubular support member 14 that extends into the tubular member that is coupled to an end of a locking device 16 for controllably engaging the tubular member. Another end of the locking device 16 is coupled to a tubular support member 18 that is coupled to an end of an actuator 20. Another end of the actuator 20 is coupled to a tubular support member 22 that is coupled to an end of an adjustable expansion mandrel 24 for radially expanding and plastically deforming the tubular member 12. Another end of the adjustable expansion mandrel 24 is coupled to a tubular support member 26 that is coupled to an end of a float shoe 28 that mates with and, is at least partially received within a lower end of the tubular member 12. In an exemplary embodiment, the locking device 16, the tubular support member 18, the actuator 20, the tubular support member 22, the adjustable expansion mandrel 24, and the tubular support member 26 are positioned within the tubular member 12.

In an exemplary embodiment, the tubular member 12 includes one or more solid and/or slotted tubular members, and one or more of the solid and/or slotted tubular members include resilient sealing members coupled to the exterior surfaces of the solid and/or slotted tubular members for engaging the wellbore 30 and/or one or more preexisting wellbore casings coupled to the wellbore. In an exemplary embodiment, the tubular support members, 14, 18, 22, and 26 define corresponding passages, that may or may not be valveable, for conveying fluidic materials into and/or through the apparatus 10.

In an exemplary embodiment, the locking device 16 includes one or more conventional controllable locking devices such as, for example, slips and/or dogs for controllably engaging the tubular member 12. In an exemplary embodiment, the locking device 16 is controlled by injecting fluidic materials into the locking device.

In an exemplary embodiment, the actuator 20 is a conventional actuator that is adapted to displaced the adjustable expansion mandrel 24 and float shoe 28 upwardly or downwardly relative to the actuator.

In an exemplary embodiment, the adjustable expansion mandrel 24 is a conventional adjustable expansion mandrel that may be expanded to a larger outside dimension or collapsed to a smaller outside dimension and includes external surfaces for engaging the tubular member 12 to thereby radially expand and plastically deform the tubular member when the adjustable expansion mandrel is expanded to the larger outside dimension. In an alternative embodiment, the adjustable expansion mandrel 24 may include a rotary adjustable expansion device such as, for example, the commercially available rotary expansion devices of Weatherford International, Inc. In several alternative embodiments, the cross sectional profile of the adjustable expansion mandrel 24 for radial expansion operations may, for example, be an n-sided shape, where n may vary from 2 to infinity, and the side shapes may include straight line segments, arcuate segments, parabolic segments, and/or hyperbolic segments. In several alternative embodiments, the cross sectional profile of the adjustable expansion mandrel 24 may, for example, be circular, oval, elliptical, and/or multifaceted.

In an exemplary embodiment, the float shoe 28 is a conventional float shoe.

In an exemplary embodiment, the apparatus 10 is positioned within a preexisting structure 30 such as, for example, a wellbore that traverses a subterranean formation 32. The wellbore 30 may have any orientation from vertical to horizontal. In several exemplary embodiments, the wellbore 30 may include one or more preexisting solid and/or slotted and/or perforated wellbore casings that may or may not overlap with one another within the wellbore.

Figure 2:
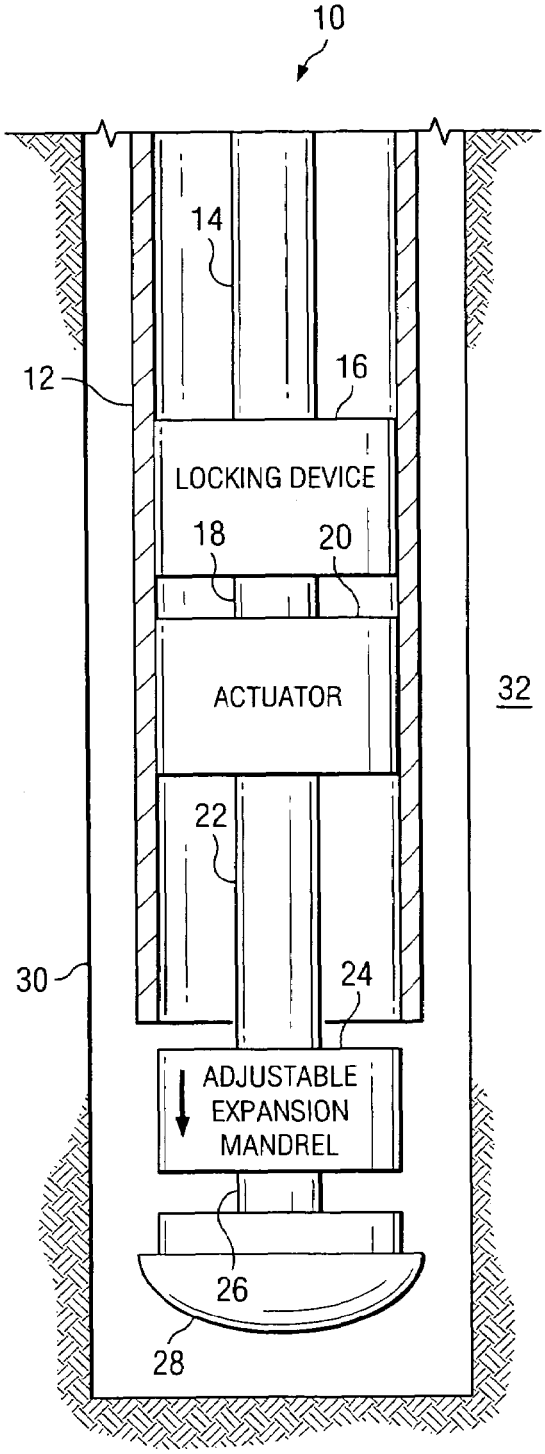
FIG. 2 is a fragmentary cross-sectional illustration of apparatus of FIG. 1 after displacing the adjustable expansion mandrel and the float shoe downwardly out of the end of the expandable tubular member.

As illustrated in FIG. 2, the adjustable expansion mandrel 24 and the float shoe 28 are then displaced downwardly out of the tubular member 12 by the actuator 20. During the downward displacement of the adjustable expansion mandrel 24 and the float shoe 28 out of the tubular member 12, the tubular member is maintained in a stationary position relative to the tubular support member 14 by the locking device 16.

Figure 3:
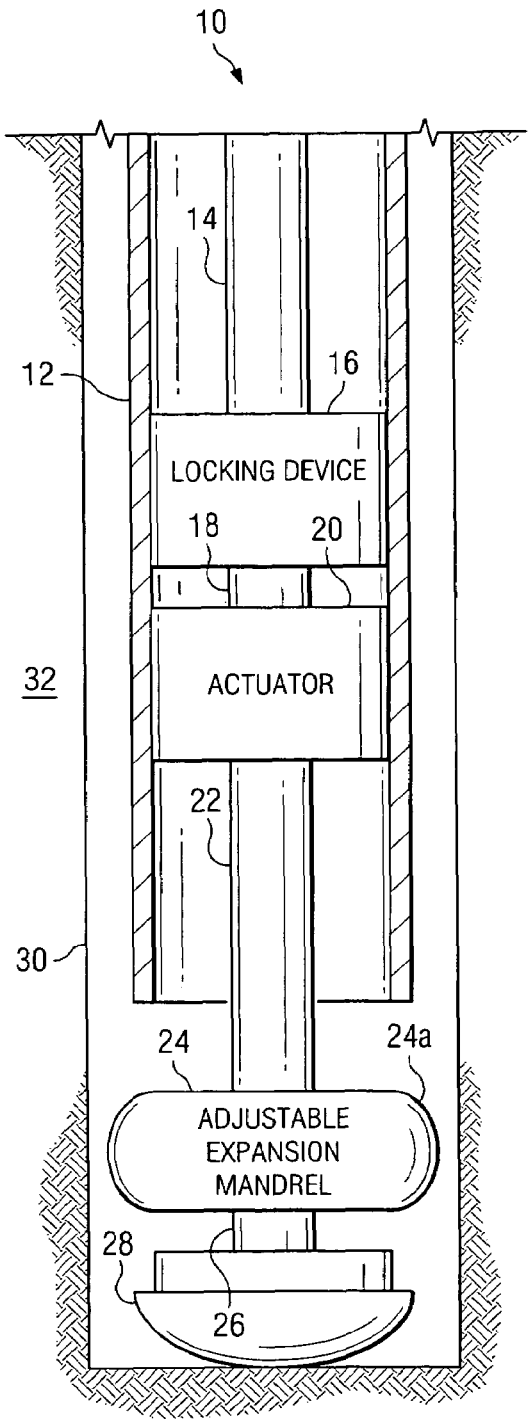
FIG. 3 is a fragmentary cross-sectional illustration of the apparatus of FIG. 2 after expanding the adjustable expansion mandrel.

As illustrated in FIG. 3, the adjustable expansion mandrel 24 is then expanded to the larger dimension. In several alternative embodiments, the adjustable expansion mandrel 24 may be expanded to the larger dimension by, for example, injecting a fluidic material into the adjustable expansion mandrel and/or by impacting the float shoe 28 on the bottom of the wellbore 30. After expanding the adjustable expansion mandrel 24 to the larger dimension, expansion surfaces 24*a* are defined on the adjustable expansion mandrel that may include, for example, conical, spherical, elliptical, and/or hyperbolic surfaces for radially expanding and plastically deforming the tubular member 12. In an exemplary embodiment, the expansion surfaces 24*a* also include means for lubricating the interface between the expansion surfaces and the tubular member 12 during the radial expansion and plastic deformation of the tubular member.

Figure 4:
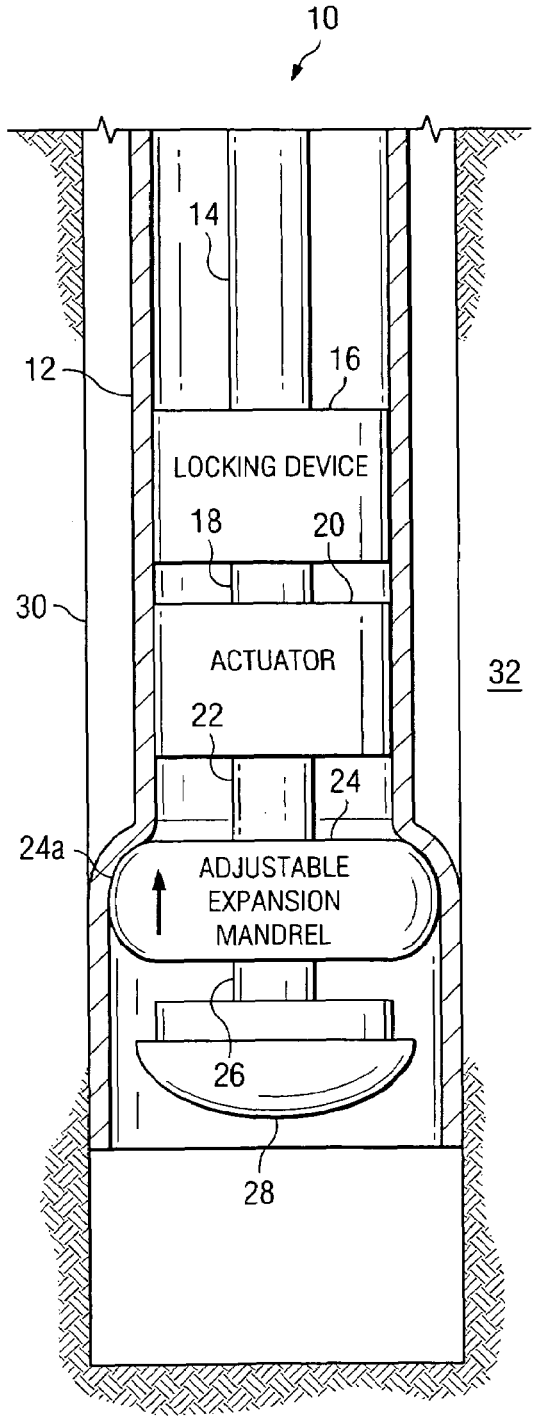
FIG. 4 is a fragmentary cross-sectional illustration of the apparatus of FIG. 3 after displacing the adjustable expansion mandrel upwardly to radially expand and plastically deform the expandable tubular member.

As illustrated in FIG. 4, the adjustable expansion mandrel 24 is then displaced upwardly by the actuator 20 to thereby radially expand and plastically deform a portion of the tubular member 12. In an exemplary embodiment, during the upward displacement of the adjustable expansion mandrel 24, the tubular member 12 is maintained in a stationary position relative to the tubular support member 14 by the locking device 16. In an exemplary embodiment, the tubular member 12 is radially expanded and plastically deformed into engagement with the wellbore 30 and/or one or more preexisting wellbore casings coupled to the wellbore 30. In an exemplary embodiment, the interface between the expansion surfaces 24*a* of the adjustable expansion mandrel 24 and the tubular member 12 is not fluid tight in order to facilitate the lubrication of the interface between the expansion surface of the adjustable expansion mandrel and the tubular member.

Figure 5:
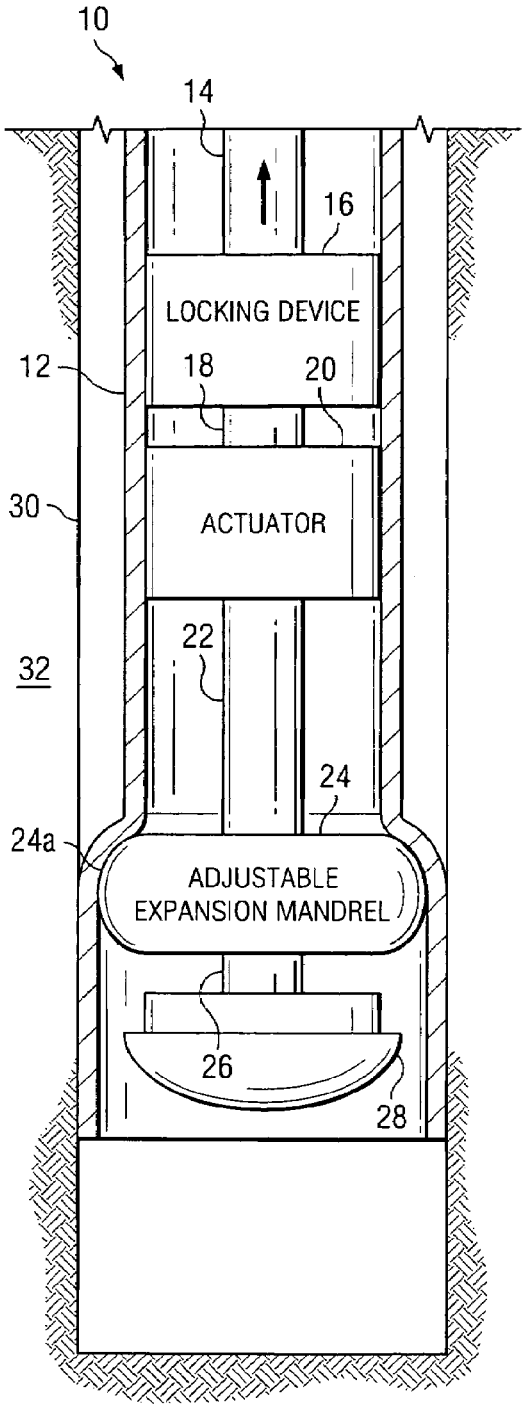
FIG. 5 is a fragmentary cross-sectional illustration of the apparatus of FIG. 4 after displacing the actuator, locking device, and tubular support member upwardly relative to the adjustable expansion mandrel and the expandable tubular member.

As illustrated in FIG. 5, the locking device 16 is then disengaged from the tubular member 12, and the tubular member 12 is supported by the adjustable expansion mandrel 24. The tubular support member 14, the locking device 16, the tubular support member 18, and the actuator 20 are then displaced upwardly relative to the adjustable expansion mandrel 24.

Figure 6:
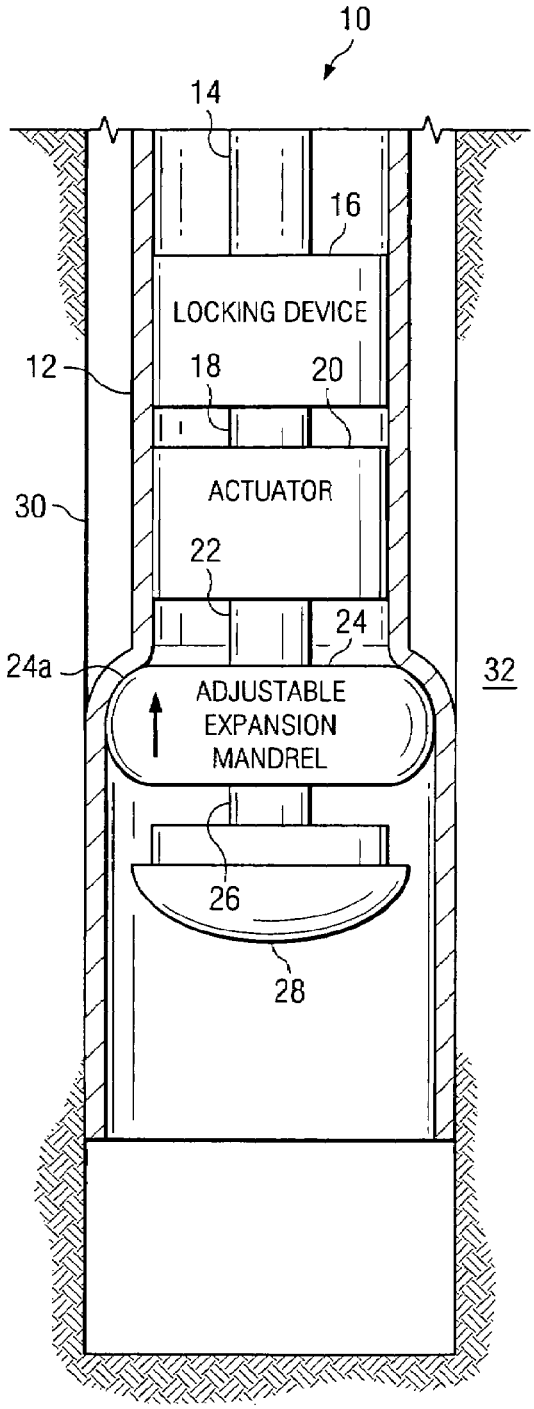
FIG. 6 is a fragmentary cross-sectional illustration of the apparatus of FIG. 5 after displacing the adjustable expansion mandrel upwardly to radially expand and plastically deform the expandable tubular member.

As illustrated in FIG. 6, the locking device 16 then engages the tubular member 12 to maintain the tubular member in a stationary position relative to the tubular support member 14, and the adjustable expansion mandrel 24 is displaced upwardly relative by the actuator 20 to radially expand and plastically deform another portion of the tubular member.

In an exemplary embodiment, the operations of FIGS. 5 and 6 are then repeated until the entire length of the tubular member 12 is radially expanded and plastically deformed by the adjustable expansion mandrel 24. In several alternative embodiments, the adjustable expansion mandrel 24 may be collapsed to the smaller dimension prior to the further, or complete, radial expansion and plastic deformation of the tubular member 12.

Figure 6A:
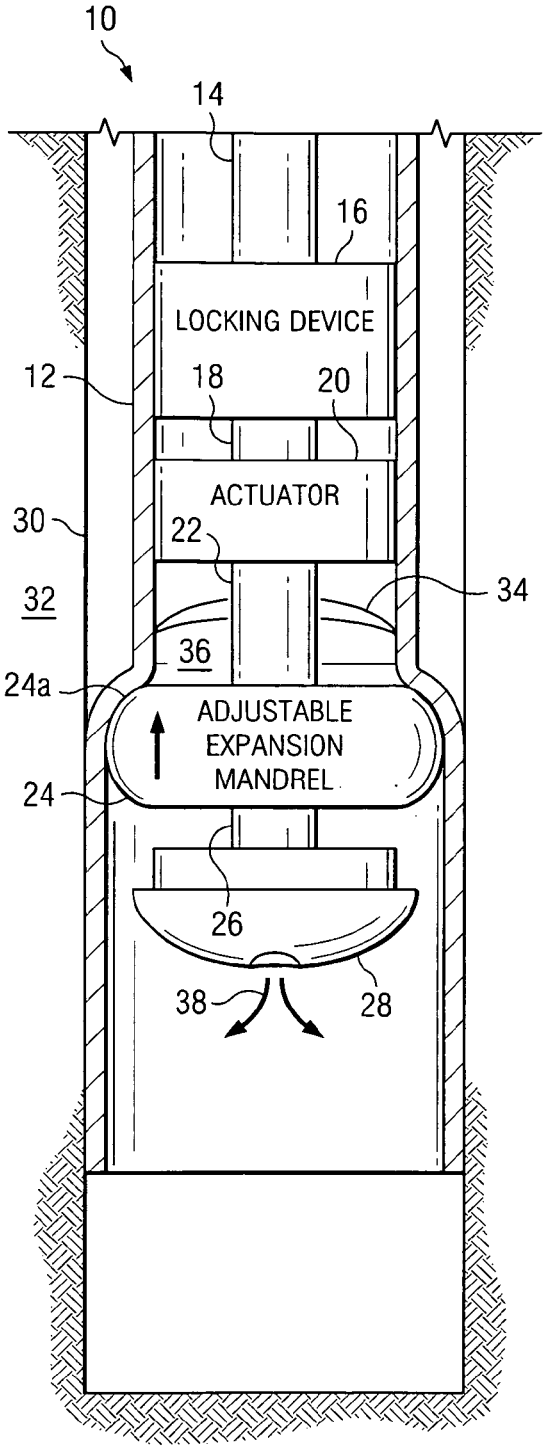
FIG. 6*a* is a fragmentary cross-sectional illustration of the apparatus of FIG. 6 that include one or more cup seals positioned above the adjustable expansion mandrel for defining an annular pressure chamber above the adjustable expansion mandrel.

In several alternative embodiments, as illustrated in FIG. 6*a*, the apparatus 10 further includes one or more cup seals 34 that are coupled to the tubular support member 22 and engage the tubular member 12 to define an annular chamber 36 above the adjustable expansion cone 24, and fluidic materials 38 are injected into the tubular member 12 through passages defined within the tubular support member 14, the locking device 16, the tubular support member 18, the actuator 20, the tubular support member 22, the adjustable expansion mandrel 24, the tubular support member 26, and the float shoe 28 to thereby pressurize the annular chamber 36. In this manner, the resulting pressure differential created across the cup seals 34 causes the cup seals to pull the adjustable expansion mandrel 24 upwardly to radially expand and plastically deform the tubular member 12. In several alternative embodiments, the injection of the fluidic material 38 into the tubular member 12 is provided in combination with, or in the alternative to, the upward displacement of the expansion mandrel 24 by the actuator 20. In several alternative embodiments, during the injection of the fluidic material 38, the locking device 16 is disengaged from the tubular member 12.

Figure 7:
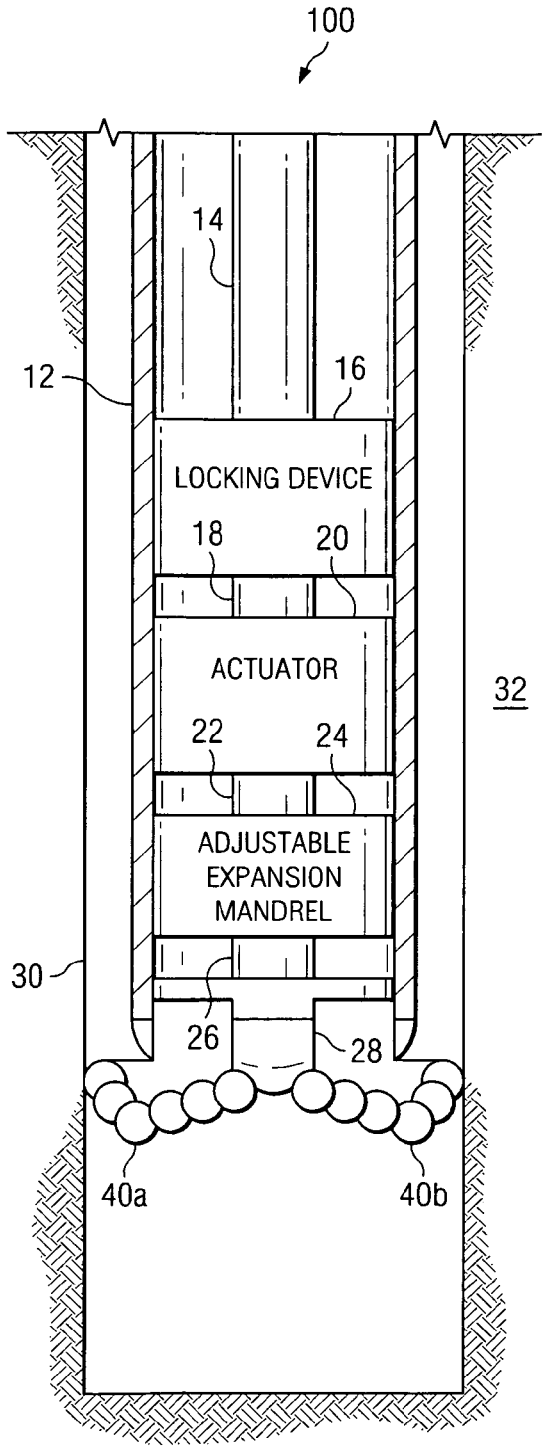
FIG. 7 is a fragmentary cross-sectional illustration of the placement of an embodiment of an apparatus for drilling a borehole and radially expanding and plastically deforming a tubular member within the drilled borehole.

Referring to FIG. 7, an alternative embodiment of an apparatus 100 for radially expanding and plastically deforming the tubular member 12 is substantially identical in design and operation to the apparatus 10 with the addition of one or more conventional drilling members 40*a*-40*b* that are pivotally coupled to the float shoe 28. During operation of the apparatus 100, the drilling members 40*a*-40*b* may be operated to extend the length and/or diameter of the wellbore 30, for example, by rotating the apparatus and/or by injecting fluidic materials into the apparatus to operate the drilling members.

As illustrated in FIG. 7, in an exemplary embodiment, the apparatus 100 is initially positioned within the preexisting structure 30.

Figure 8:
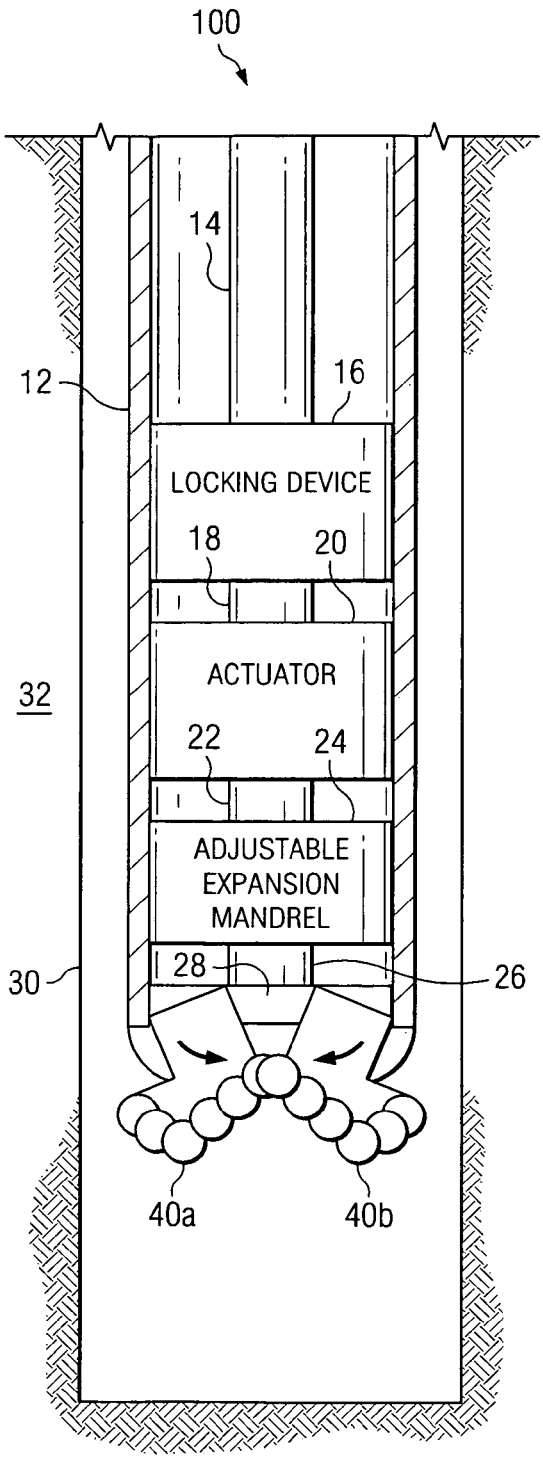
FIG. 8 is a fragmentary cross-sectional illustration of the apparatus of FIG. 7 after pivoting the drilling elements of the drilling member radially inwardly.

As illustrated in FIG. 8, in an exemplary embodiment, the drilling members 40*a*-40*b* may then be pivoted inwardly in a conventional manner.

Figure 9:
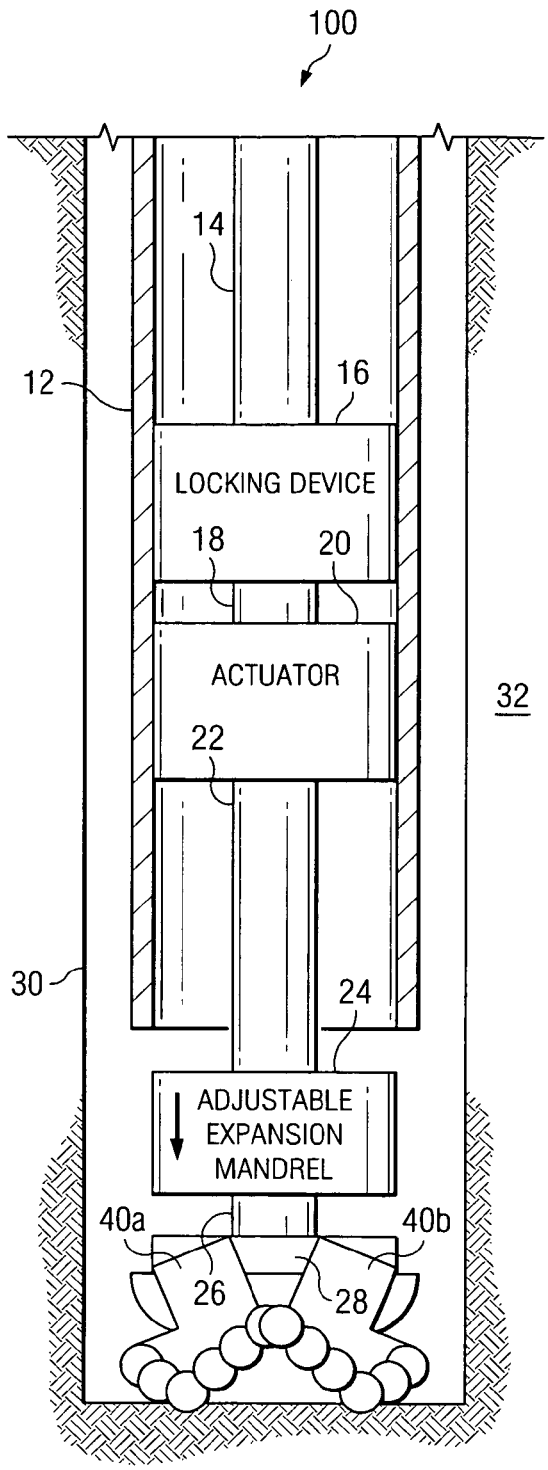
FIG. 9 is a fragmentary cross-sectional illustration of apparatus of FIG. 8 after displacing the adjustable expansion mandrel and drilling member downwardly out of the end of the expandable tubular member.

As illustrated in FIG. 9 the adjustable expansion mandrel 24, the float shoe 28, and the drilling members 40*a*-40*b* are then displaced downwardly out of the tubular member 12 by the actuator 20. During the downward displacement of the adjustable expansion mandrel 24, the float shoe 28, and the drilling members 40*a*-40*b* out of the tubular member 12, the tubular member is maintained in a stationary position relative to the tubular support member 14 by the locking device 16.

Figure 10:
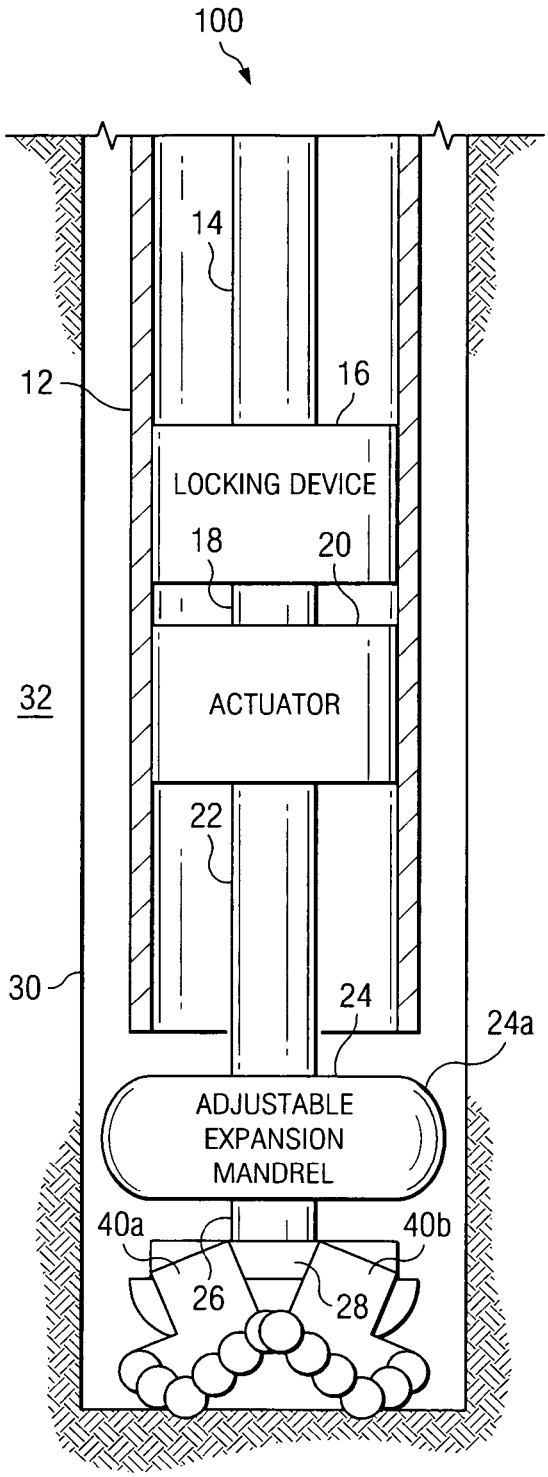
FIG. 10 is a fragmentary cross-sectional illustration of the apparatus of FIG. 9 after expanding the adjustable expansion mandrel.

As illustrated in FIG. 10, the adjustable expansion mandrel 24 is then expanded to the larger dimension. In several alternative embodiments, the adjustable expansion mandrel 24 may be expanded to the larger dimension by, for example, injecting a fluidic material into the adjustable expansion mandrel and/or by impacting the drilling members 40*a*-40*b* on the bottom of the wellbore 30. After expanding the adjustable expansion mandrel 24 to the larger dimension, expansion surfaces 24*a* are defined on the adjustable expansion mandrel that may include, for example, conical, spherical, elliptical, and/or hyperbolic surfaces for radially expanding and plastically deforming the tubular member 12. In an exemplary embodiment, the expansion surfaces 24*a* also include means for lubricating the interface between the expansion surfaces and the tubular member 12 during the radial expansion and plastic deformation of the tubular member.

Figure 11:
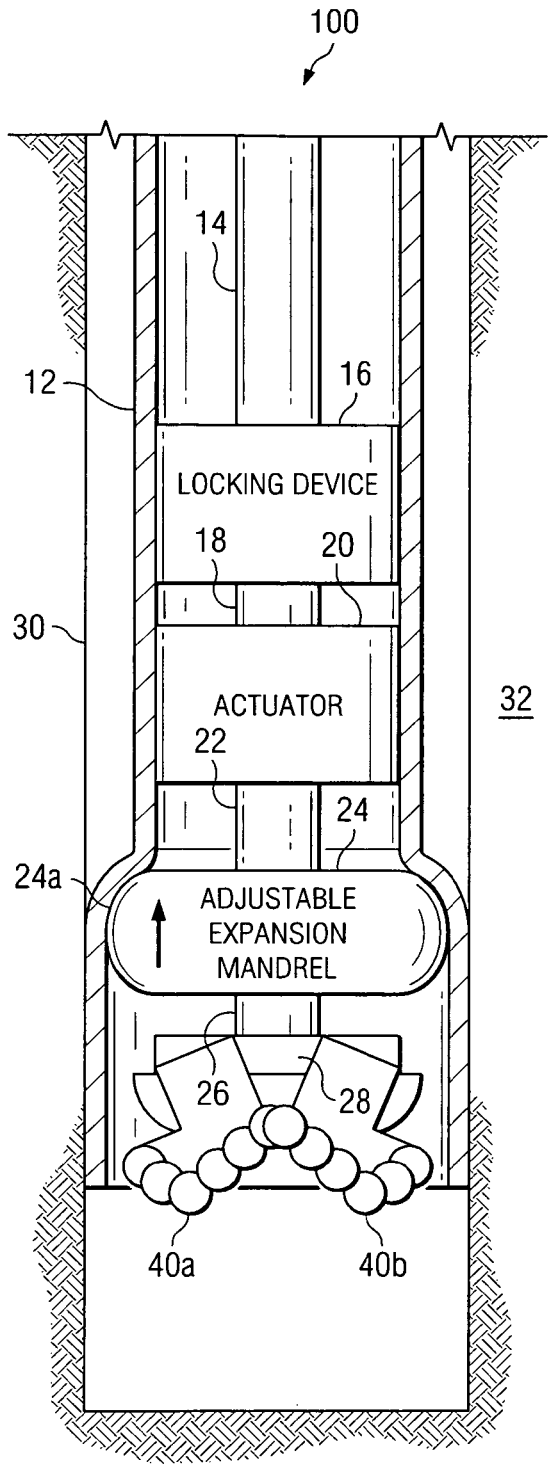
FIG. 11 is a fragmentary cross-sectional illustration of the apparatus of FIG. 10 after displacing the adjustable expansion mandrel upwardly to radially expand and plastically deform the expandable tubular member.

As illustrated in FIG. 11, the adjustable expansion mandrel 24 is then displaced upwardly by the actuator 20 to thereby radially expand and plastically deform a portion of the tubular member 12. In an exemplary embodiment, during the upward displacement of the adjustable expansion mandrel 24, the tubular member 12 is maintained in a stationary position relative to the tubular support member 14 by the locking device 16. In an exemplary embodiment, the tubular member 12 is radially expanded and plastically deformed into engagement with the wellbore 30 and/or one or more preexisting wellbore casings coupled to the wellbore 30. In an exemplary embodiment, the interface between the expansion surfaces 24*a* of the adjustable expansion mandrel 24 and the tubular member 12 is not fluid tight in order to facilitate the lubrication of the interface between the expansion surface of the adjustable expansion mandrel and the tubular member.

Figure 12:
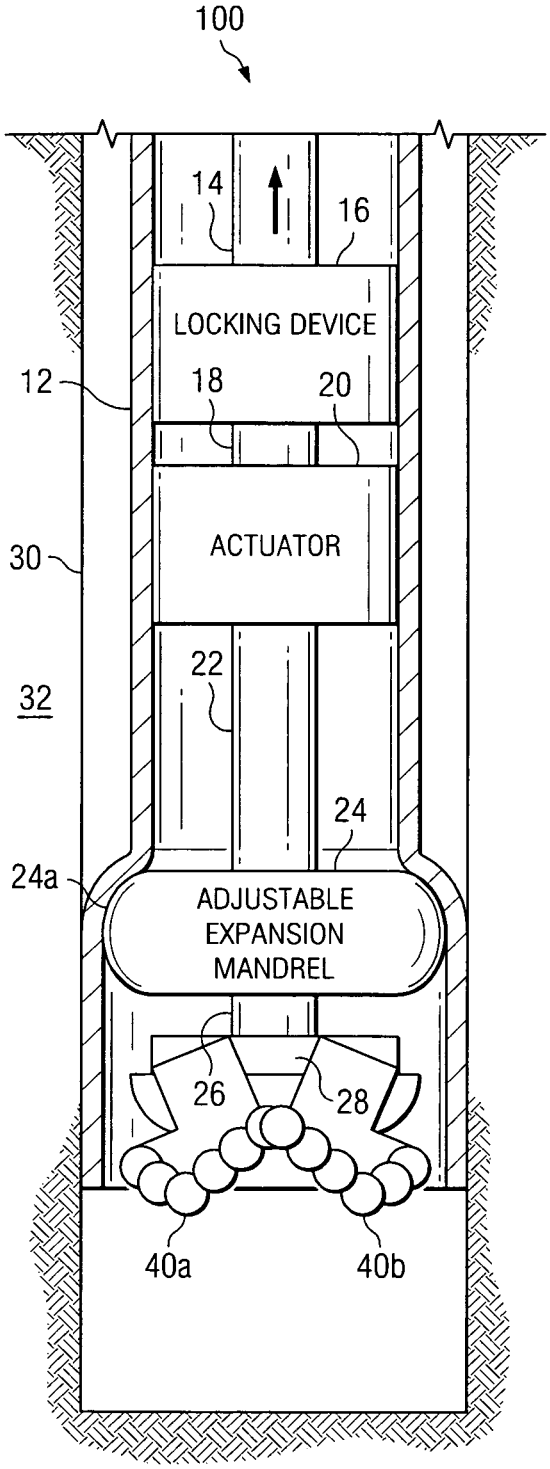
FIG. 12 is a fragmentary cross-sectional illustration of the apparatus of FIG. 11 after displacing the actuator, locking device, and tubular support member upwardly relative to the adjustable expansion mandrel and the expandable tubular member.

As illustrated in FIG. 12, the locking device 16 is then disengaged from the tubular member 12, and the tubular member 12 is supported by the adjustable expansion mandrel 24. The tubular support member 14, the locking device 16, the tubular support member 18, and the actuator 20 are then displaced upwardly relative to the adjustable expansion mandrel 24.

Figure 13:
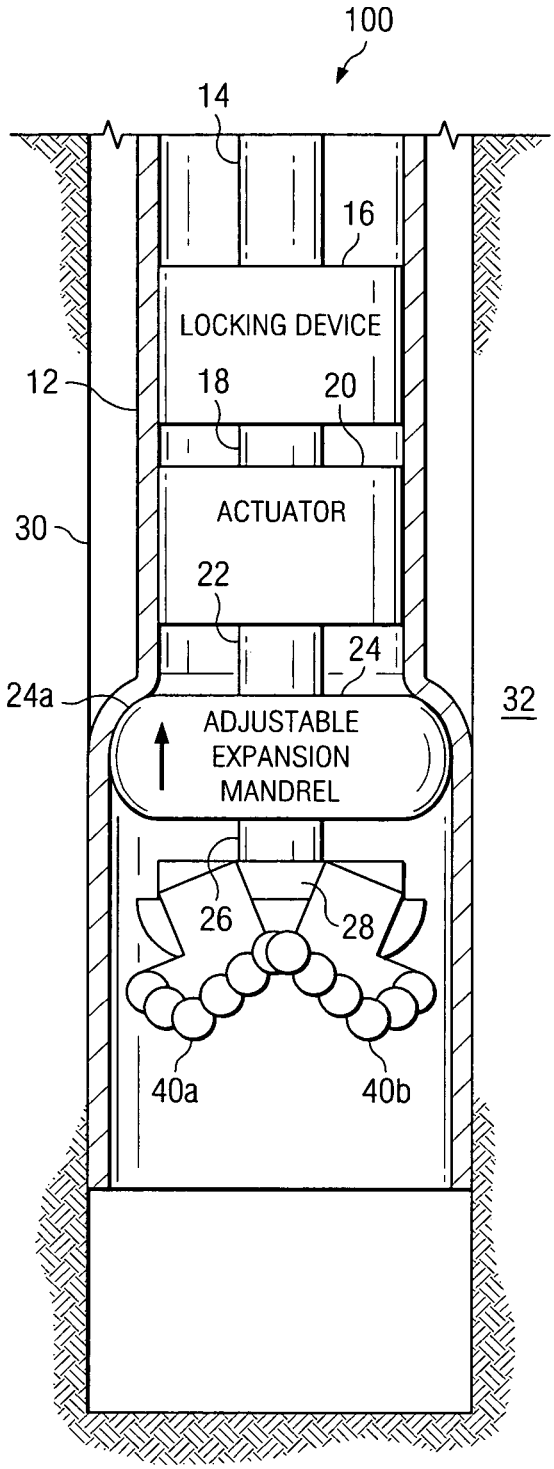
FIG. 13 is a fragmentary cross-sectional illustration of the apparatus of FIG. 12 after displacing the adjustable expansion mandrel upwardly to radially expand and plastically deform the expandable tubular member.

As illustrated in FIG. 13, the locking device 16 then engages the tubular member 12 to maintain the tubular member in a stationary position relative to the tubular support member 14, and the adjustable expansion mandrel 24 is displaced upwardly relative by the actuator 20 to radially expand and plastically deform another portion of the tubular member.

In an exemplary embodiment, the operations of FIGS. 12 and 13 are then repeated until the entire length of the tubular member 12 is radially expanded and plastically deformed by the adjustable expansion mandrel 24. In several alternative embodiments, the adjustable expansion mandrel 24 may be collapsed to the smaller dimension prior to the further, or complete, radial expansion and plastic deformation of the tubular member 12.

Figure 14:
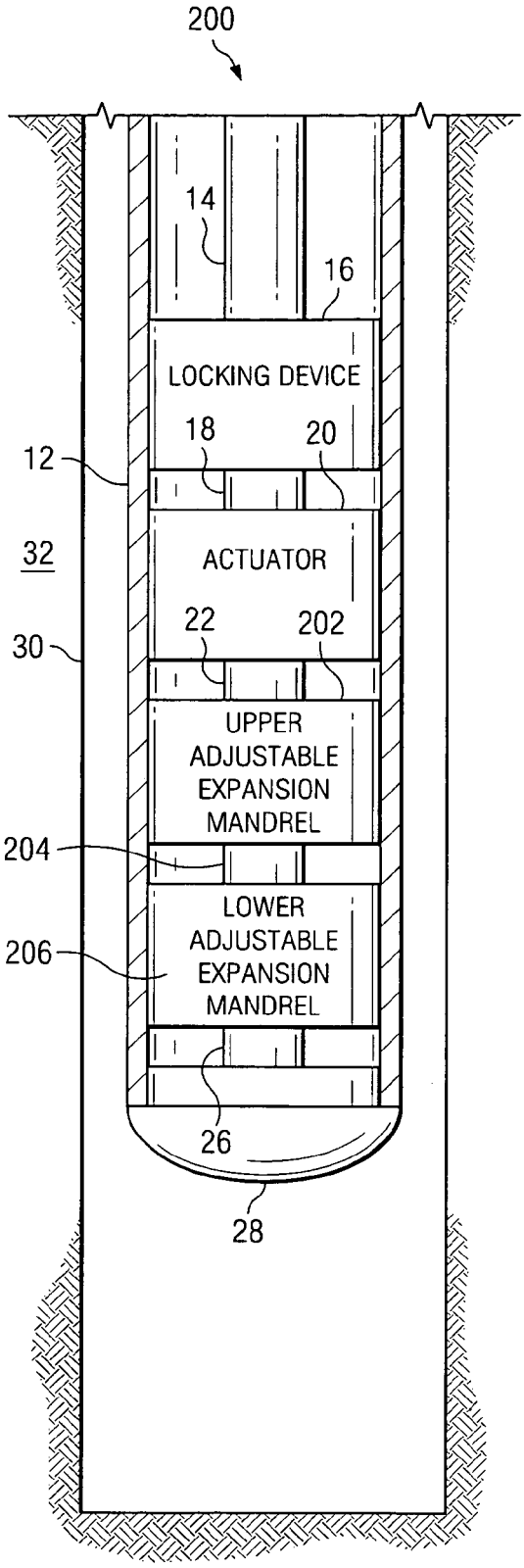
FIG. 14 is a fragmentary cross-sectional illustration of the placement of an embodiment of an apparatus for radially expanding and plastically deforming a tubular member within a preexisting structure.

Referring to FIG. 14, an alternative embodiment of an apparatus 200 for radially expanding and plastically deforming the tubular member 12 is substantially identical in design and operation to the apparatus 10 except that the adjustable expansion mandrel 24 has been replaced by an upper adjustable expansion mandrel 202 that is coupled to the tubular support member 22, a tubular support member 204 that is coupled to the upper adjustable expansion mandrel, and a lower adjustable expansion mandrel 206 that is coupled to the tubular support member 204 and the tubular support member 26.

The upper and lower adjustable expansion mandrels, 202 and 206, may be conventional adjustable expansion mandrels that may be expanded to larger outside dimensions or collapsed to smaller outside dimensions and include external surfaces for engaging the tubular member 12 to thereby radially expand and plastically deform the tubular member when the adjustable expansion mandrels are expanded to the larger outside dimensions. In an alternative embodiment, the upper and/or lower adjustable expansion mandrels, 202 and 206, may include rotary adjustable expansion devices such as, for example, the commercially available rotary expansion devices of Weatherford International, Inc. In an exemplary embodiment, the tubular support member 204 defines a passage, that may, or may not, be valveable, for conveying fluidic materials into and/or through the apparatus 200. In several alternative embodiments, the cross sectional profiles of the adjustable expansion mandrels, 202 and 206, for radial expansion operations may, for example, be n-sided shapes, where n may vary from 2 to infinity, and the side shapes may include straight line segments, arcuate segments, parabolic segments, and/or hyperbolic segments. In several alternative embodiments, the cross sectional profiles of the adjustable expansion mandrels, 202 and 206, may, for example, be circular, oval, elliptical, and/or multifaceted.

As illustrated in FIG. 14, in an exemplary embodiment, the apparatus 200 is initially positioned within the preexisting structure 30.

Figure 15:
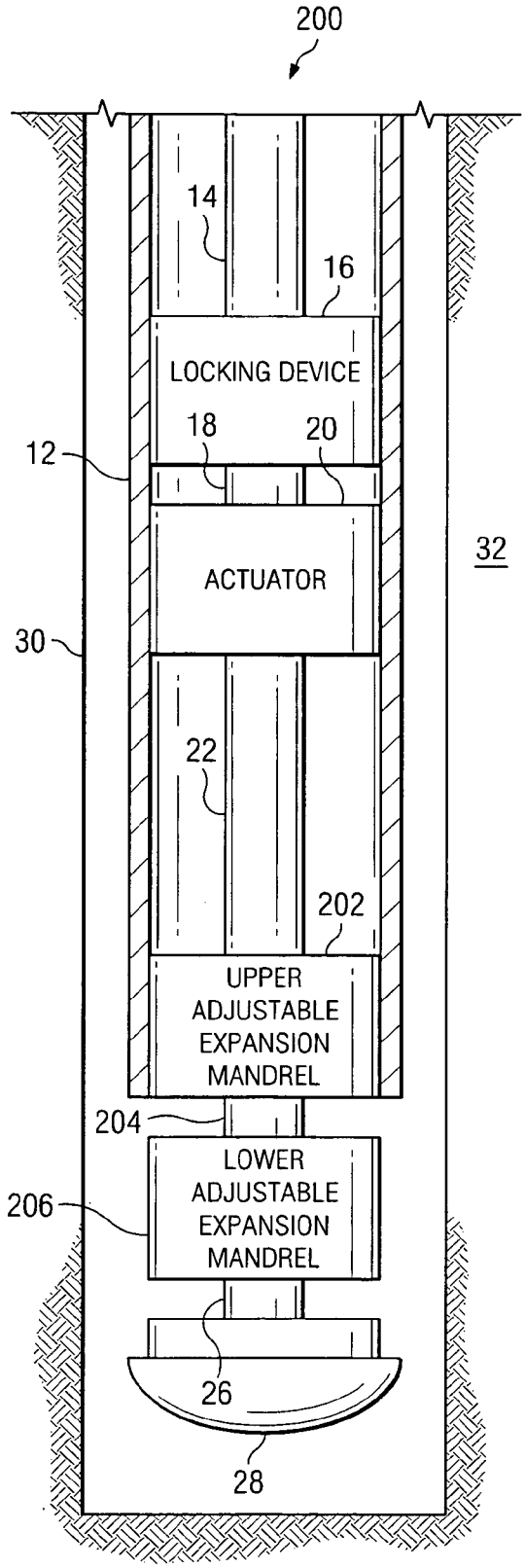
FIG. 15 is a fragmentary cross-sectional illustration of the apparatus of FIG. 14 after displacing the lower adjustable expansion mandrel and float shoe downwardly out of the end of the expandable tubular member.

As illustrated in FIG. 15, the lower adjustable expansion mandrel 206 and the float shoe 28 are then displaced downwardly out of the tubular member 12 by the actuator 20. During the downward displacement of the lower adjustable expansion mandrel 206 and the float shoe 28 out of the tubular member 12, the tubular member is maintained in a stationary position relative to the tubular support member 14 by the locking device 16.

Figure 16:
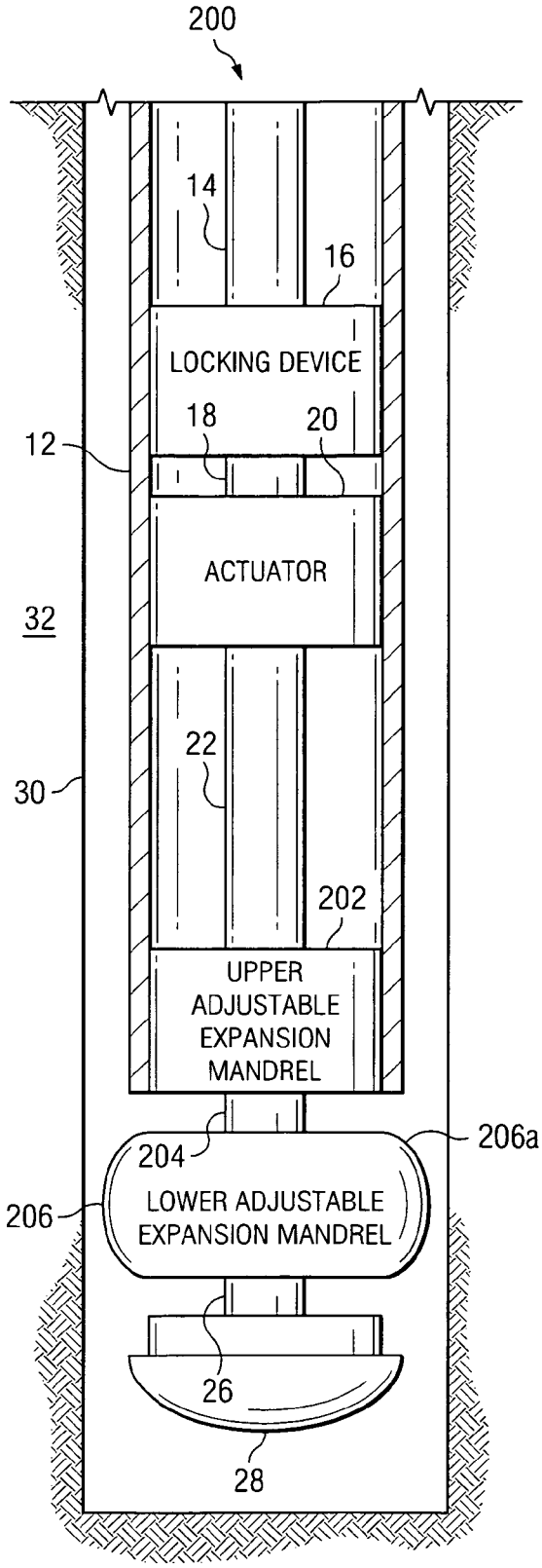
FIG. 16 is a fragmentary cross-sectional illustration of the apparatus of FIG. 15 after expanding the lower adjustable expansion mandrel.

As illustrated in FIG. 16, the lower adjustable expansion mandrel 206 is then expanded to the larger dimension. In several alternative embodiments, the lower adjustable expansion mandrel 206 may be expanded to the larger dimension by, for example, injecting a fluidic material into the lower adjustable expansion mandrel and/or by impacting the float shoe 28 on the bottom of the wellbore 30. After expanding the lower adjustable expansion mandrel 206 to the larger dimension, expansion surfaces 206*a* are defined on the lower adjustable expansion mandrel that may include, for example, conical, spherical, elliptical, and/or hyperbolic surfaces for radially expanding and plastically deforming the tubular member 12. In an exemplary embodiment, the expansion surfaces 206*a* also include means for lubricating the interface between the expansion surfaces and the tubular member 12 during the radial expansion and plastic deformation of the tubular member.

Figure 17:
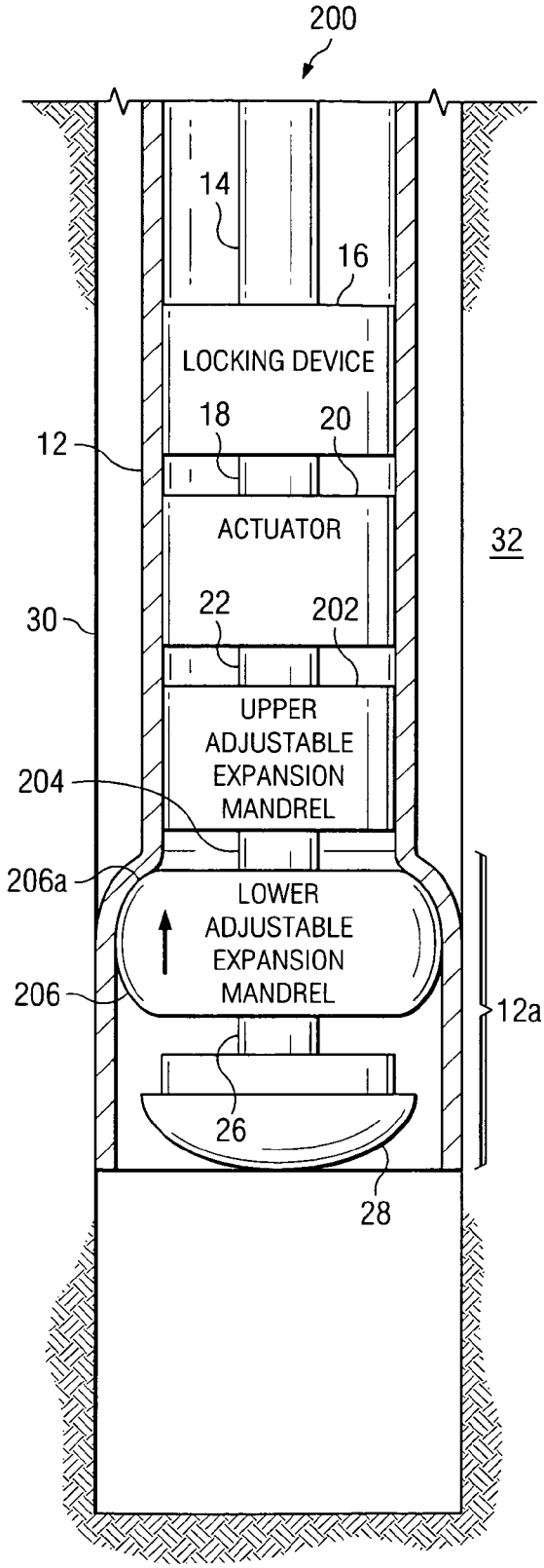
FIG. 17 is a fragmentary cross-sectional illustration of the apparatus of FIG. 16 after displacing the lower adjustable expansion mandrel upwardly to radially expand and plastically deform the expandable tubular member.

As illustrated in FIG. 17, the lower adjustable expansion mandrel 206 is then displaced upwardly by the actuator 20 to thereby radially expand and plastically deform a portion 12*a* of the tubular member 12. In an exemplary embodiment, during the upward displacement of the lower adjustable expansion mandrel 206, the tubular member 12 is maintained in a stationary position relative to the tubular support member 14 by the locking device 16. In an exemplary embodiment, the tubular member 12 is radially expanded and plastically deformed into engagement with the wellbore 30 and/or one or more preexisting wellbore casings coupled to the wellbore 30. In an exemplary embodiment, the interface between the expansion surfaces 206*a* of the lower adjustable expansion mandrel 206 and the tubular member 12 is not fluid tight in order to facilitate the lubrication of the interface between the expansion surface of the lower adjustable expansion mandrel and the tubular member. In an exemplary embodiment, the expansion surfaces 206*a* also include means for lubricating the interface between the expansion surfaces and the tubular member 12 during the radial expansion and plastic deformation of the tubular member.

Figure 18:
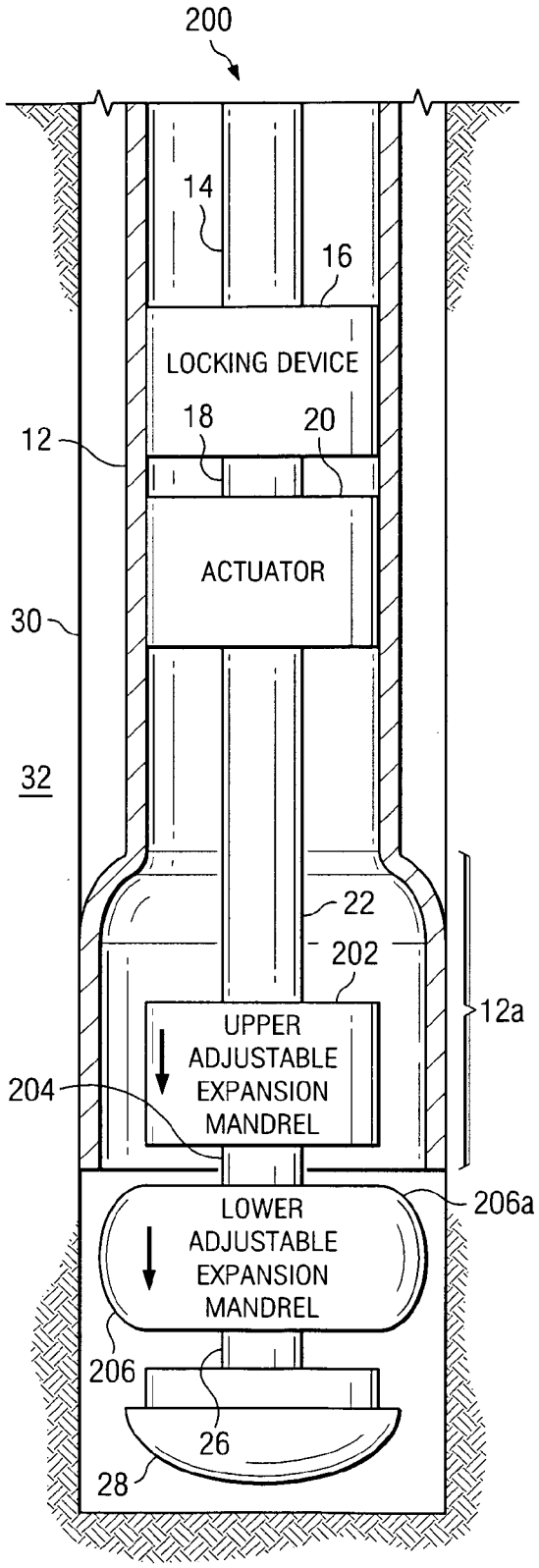
FIG. 18 is a fragmentary cross-sectional illustration of the apparatus of FIG. 17 after displacing the upper and lower adjustable expansion mandrels downwardly relative to the expandable tubular member.

As illustrated in FIG. 18, the upper and lower adjustable expansion mandrels, 202 and 206, and the float shoe 28 are then displaced downwardly by the actuator 20. During the downward displacement of the upper and lower adjustable expansion mandrels, 202 and 206, and the float shoe 28, the tubular member is maintained in a stationary position relative to the tubular support member 14 by the locking device 16.

Figure 19:
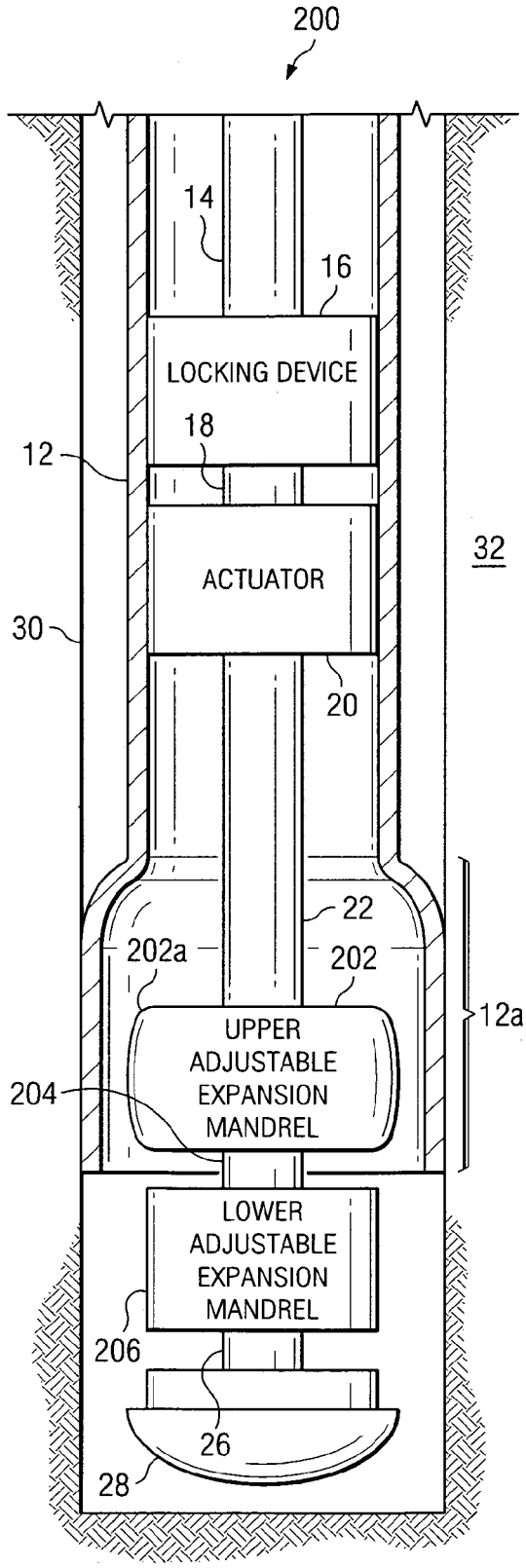
FIG. 19 is a fragmentary cross-sectional illustration of the apparatus of FIG. 18 after collapsing the lower adjustable expansion mandrel and expanding the upper adjustable expansion mandrel.

As illustrated in FIG. 19, the upper adjustable expansion mandrel 202 is then expanded to the larger dimension and the lower adjustable expansion mandrel 206 is collapsed to the smaller dimension. In an exemplary embodiment, the larger dimension of the upper adjustable expansion mandrel 202 is less than the larger dimension of the lower adjustable expansion mandrel 206. In several alternative embodiments, the upper adjustable expansion mandrel 202 may be expanded to the larger dimension and the lower adjustable expansion mandrel 206 may be collapsed to the smaller dimension by, for example, injecting fluidic material into the upper and/or adjustable expansion mandrel and/or by impacting the float shoe 28 on the bottom of the wellbore 30. After expanding the upper adjustable expansion mandrel 202 to the larger dimension, expansion surfaces 202*a* are defined on the upper adjustable expansion mandrel that may include, for example, conical, spherical, elliptical, and/or hyperbolic surfaces for radially expanding and plastically deforming the tubular member 12. In an exemplary embodiment, the expansion surfaces 202*a* also include means for lubricating the interface between the expansion surfaces and the tubular member 12 during the radial expansion and plastic deformation of the tubular member.

Figure 20:
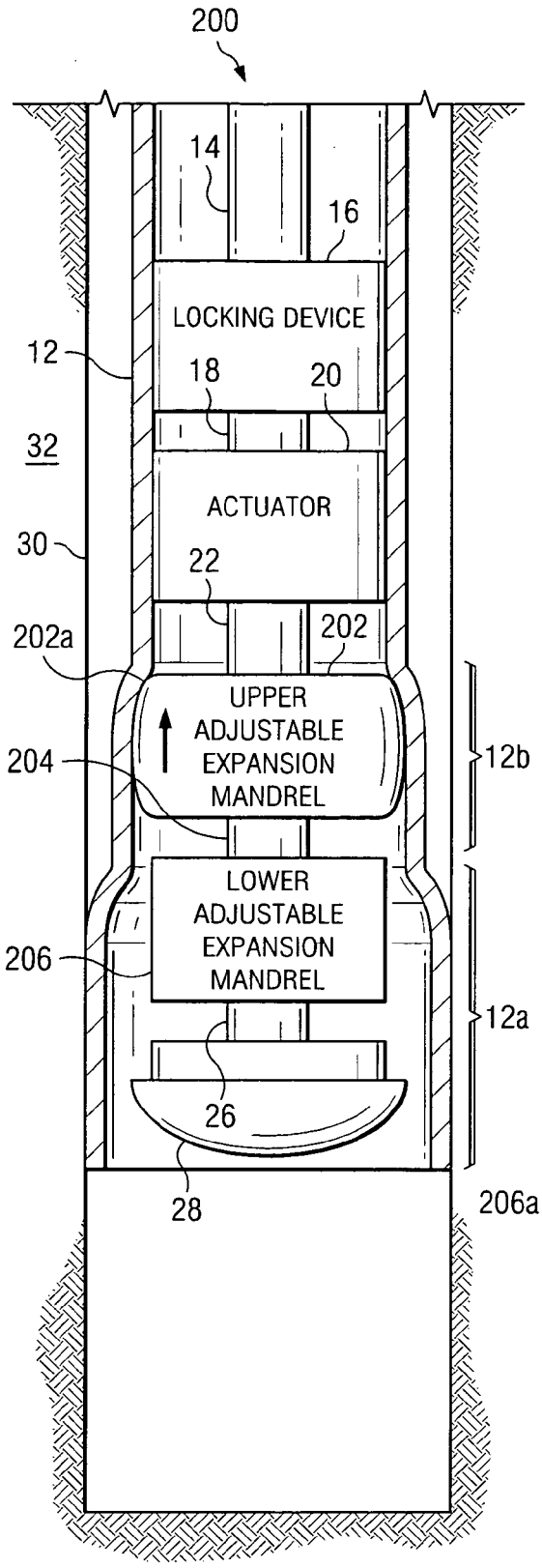
FIG. 20 is a fragmentary cross-sectional illustration of the apparatus of FIG. 19 after displacing the upper adjustable expansion mandrel upwardly to radially expand and plastically deform the expandable tubular member.

As illustrated in FIG. 20, the upper adjustable expansion mandrel 202 is then displaced upwardly by the actuator 20 to thereby radially expand and plastically deform a portion 12*b* of the tubular member 12 above the portion 12*a* of the tubular member. In an exemplary embodiment, the inside diameter of the radially expanded and plastically deformed portion 12*a* of the tubular member 12 is greater than the inside diameter of the radially expanded and plastically deformed portion 12*b* of the tubular member. In an exemplary embodiment, during the upward displacement of the upper adjustable expansion mandrel 202, the tubular member 12 is maintained in a stationary position relative to the tubular support member 14 by the locking device 16. In an exemplary embodiment, the tubular member 12 is radially expanded and plastically deformed into engagement with the wellbore 30 and/or one or more preexisting wellbore casings coupled to the wellbore 30. In an exemplary embodiment, the interface between the expansion surfaces 202*a* of the upper adjustable expansion mandrel 202 and the tubular member 12 is not fluid tight in order to facilitate the lubrication of the interface between the expansion surface of the upper adjustable expansion mandrel and the tubular member.

Figure 21:
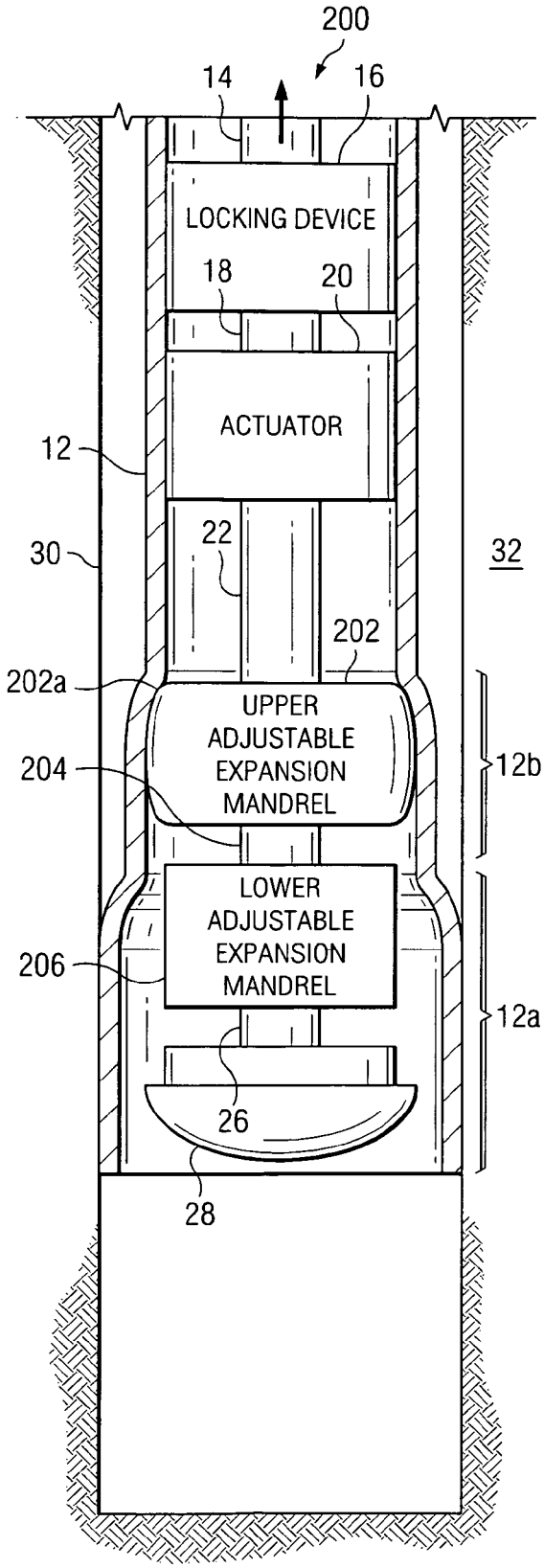
FIG. 21 is a fragmentary cross-sectional illustration of the apparatus of FIG. 20 after displacing the tubular support member, the locking device, and the actuator upwardly relative to the upper adjustable expansion mandrel and the expandable tubular member.

As illustrated in FIG. 21, the locking device 16 is then disengaged from the tubular member 12, and the tubular member 12 is supported by the upper adjustable expansion mandrel 202. The tubular support member 14, the locking device 16, the tubular support member 18, and the actuator 20 are then displaced upwardly relative to the upper adjustable expansion mandrel 202 and the tubular member 12.

Figure 22:
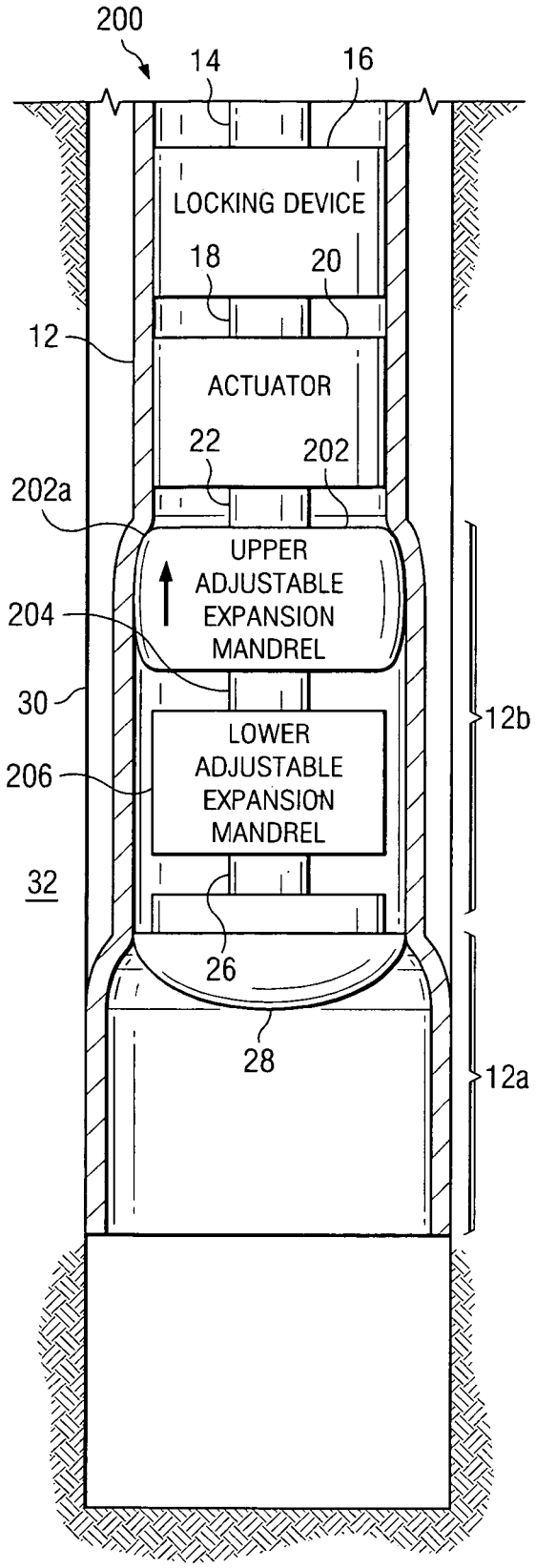
FIG. 22 is a fragmentary cross-sectional illustration of the apparatus of FIG. 21 after displacing the upper adjustable expansion mandrel upwardly to radially expand and plastically deform the expandable tubular member.

As illustrated in FIG. 22, the locking device 16 then engages the tubular member 12 to maintain the tubular member in a stationary position relative to the tubular support member 14, and the upper adjustable expansion mandrel 202 is displaced upwardly relative by the actuator 20 to radially expand and plastically deform the portion 12*b* of the tubular member.

In an exemplary embodiment, the operations of FIGS. 21 and 22 are then repeated until the remaining length of the portion 12*b* of the tubular member 12 is radially expanded and plastically deformed by the upper adjustable expansion mandrel 202. In several alternative embodiments, the upper adjustable expansion mandrel 202 may be collapsed to the smaller dimension prior to the further, or complete, radial expansion and plastic deformation of the tubular member 12.

Figure 23:
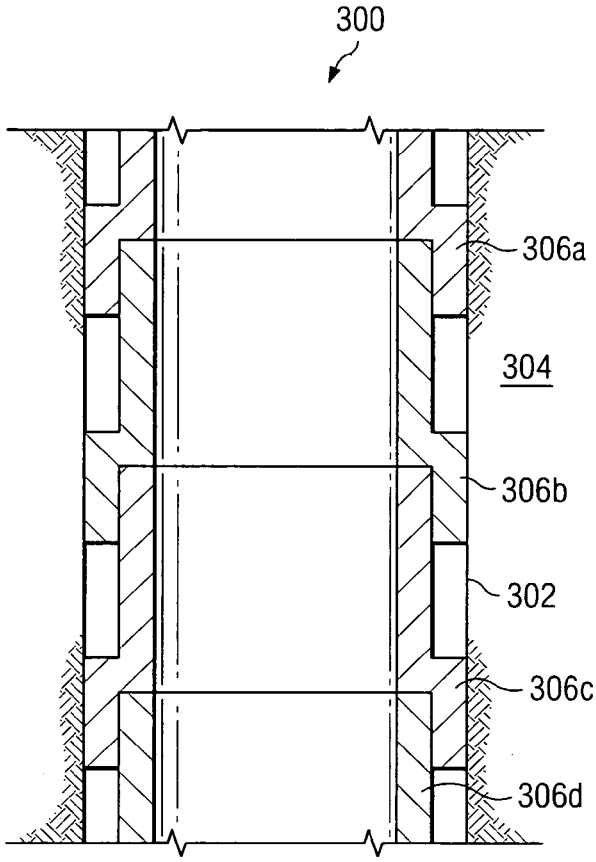
FIG. 23 is a fragmentary cross-sectional illustration of a mono diameter wellbore casing formed using one or more of the apparatus of FIGS. 1-22.

Referring to FIG. 23, in an exemplary embodiment, the method and apparatus of one or more of FIGS. 1-22 are repeated to provide a mono diameter wellbore casing 300 within a borehole 302 that traverses a subterranean formation 304 by successively overlapping and radially expanding and plastically deforming wellbore casing 306*a*-306*d* within the wellbore. In this manner, a wellbore casing 300 is provided that defines an interior passage having a substantially constant cross sectional area throughout its length. In several alternative embodiments, the cross section of the wellbore casing 300 may be, for example, square, rectangular, elliptical, oval, circular and/or faceted.

Referring to FIGS. 24*a*-24*k*, an exemplary embodiment of an apparatus 400 for radially expanding and plastically deforming a tubular member includes a tubular support member 402 that defines a longitudinal passage 402*a* that is threadably coupled to and received within an end of a tool joint adaptor 404 that defines a longitudinal passage 404*a* and radial passages 404*b* and 404*c*.

The other end of the tool joint adaptor 404 receives and is threadably coupled to an end of a gripper upper mandrel 406 that defines a longitudinal passage 406*a*, external radial mounting holes, 406*b* and 406*c*, an external annular recess 406*d*, an external annular recess 406*e*, hydraulic port 406*f*, an internal annular recess 406*g*, hydraulic port 406*h*, external radial mounting holes, 406*i* and 406*j*, and includes a flange 406*k*, and a flange 406*l*. Torsional locking pins, 408*a* and 408*b*, are coupled to the external radial mounting holes, 406*b* and 406*c*, respectively, of the gripper upper mandrel 406 and received within the radial passages, 404*b* and 404*c*, respectively, of the tool joint adaptor 404.

A spring retainer sleeve 410 that includes a flange 410*a* receives and is threadably coupled to the gripper upper mandrel 406 between an end face of the tool joint adaptor 404 and the flange 406*k* of the gripper upper mandrel. A bypass valve body 412 receives and is movably coupled to the gripper upper mandrel 406 that defines radial passages, 412*a* and 412*b*, and an internal annular recess 412*c* includes a flange 412*d*.

An end of a spring cover 414 receives and is movably coupled to the spring retainer sleeve 410 that defines an internal annular recess 414*a*. The other end of the spring cover 414 receives and is threadably coupled to an end of the bypass valve body 412. A spring guide 416, a spring 418, and a spring guide 420 are positioned within an annular chamber 422 defined between the spring cover 414 and the flange 406*k* of the gripper upper mandrel 406. Furthermore, an end of the spring guide 416 abuts an end face of the spring retainer sleeve 410.

Casing gripper locking dogs, 424*a* and 424*b*, are received and pivotally mounted within the radial passages, 412*a* and 412*b*, respectively, of the bypass valve body 412. An end of each of the casing gripper locking dogs, 424*a* and 424*b*, engage and are received within the outer annular recess 406*d* of the gripper upper mandrel 406. An end of a debris trap 426 receives and is threadably coupled to an end of the bypass valve body 412, and the other end of the debris trap receives and is movably coupled to the flange 406*l* of the gripper upper mandrel 406.

An end of a gripper body 428 receives and is threadably coupled to an end of the gripper upper mandrel 406 that defines a longitudinal passage 428*a*, radial passages, 428*b* and 428*c*, radial slip mounting passages, 428*d*-428*m*, and radial passages, 428*n* and 428*o*, includes a flange 428*p*.

Hydraulic slip pistons 432-a-432*j* are movably mounted with the radial slip mounting passages 428*d*-428*m*, respectively, for movement in the radial direction. Retainers 434*a*-434*j* are coupled to the exterior of the flange 428*p* of the gripper body 428 for limiting the outward radial movement of the hydraulic slip pistons 432*a*-432*j*, respectively, and springs 436*a*-436*j* are positioned within the radial slip mounting passages, 428*d*-428*m*, respectively, of the gripper body between the hydraulic slip pistons, 432*a*-432*j*, and the retainers, 434*a*-434*j*, respectively. During operation of the apparatus 400, pressurization of the radial slip mounting passages, 428*d*-428*m*, displaces the hydraulic slip pistons, 432*a*-432*j*, respectively, radially outwardly and compresses the springs, 436*a*-436*j*, respectively, and during depressurization of the radial slip mounting passages, 428*d*-428*m*, springs, 436*a*-436*j*, respectively, displace the hydraulic slip pistons, 432*a*-432*j*, inwardly. In an exemplary embodiment, displacement of the hydraulic slip pistons 432*a*-432*j* radially outwardly permits at least portions of the hydraulic slip pistons to engage and grip an outer tubular member.

Torsional locking pins, 438*a* and 438*b*, are coupled to the external radial mounting holes, 406*i* and 406*j*, respectively, of the gripper upper mandrel 406 and received within the radial passages, 428*b* and 428*c*, respectively, of the gripper body 428.

An end of a gripper body 440 receives and is threadably coupled to an end of the gripper body 428 that defines a longitudinal passage 440*a*, radial passages, 440*b* and 440*c*, radial slip mounting passages, 440*d*-440*m*, and radial passages, 440*n* and 440*o*, includes a flange 440*p*.

Hydraulic slip pistons 442*a*-442*j* are movably mounted with the radial slip mounting passages 440*d*-440*m*, respectively, for movement in the radial direction. Retainers 444*a*-444*j* are coupled to the exterior of the flange 440*p* of the gripper body 440 for limiting the outward radial movement of the hydraulic slip pistons 442*a*-442*j*, respectively, and springs 446*a*-446*j* are positioned within the radial slip mounting passages, 440*d*-440*m*, respectively, of the gripper body between the hydraulic slip pistons, 442*a*-442*j*, and the retainers, 444*a*-444*j*, respectively. During operation of the apparatus 400, pressurization of the radial slip mounting passages, 440*d*-440*m*, displaces the hydraulic slip pistons, 442*a*-442*j*, respectively, radially outwardly and compresses the springs, 446*a*-446*j*, respectively, and during depressurization of the radial slip mounting passages, 440*d*-440*m*, the springs, 446*a*-446*j*, respectively, displace the hydraulic slip pistons, 442*a*-442*j*, radially inward. In an exemplary embodiment, displacement of the hydraulic slip pistons

442*a*-442*j* radially outwardly permits at least portions of the hydraulic slip pistons to engage and grip an outer tubular member.

Torsional locking pins, 448*a* and 448*b*, are coupled to the external radial mounting holes, 428*n* and 428*o*, respectively, of the gripper body 428 and received within the radial passages, 440*b* and 440*c*, respectively, of the gripper body 440.

An end of a tool joint adaptor 450 that defines a longitudinal passage 450*a*, radial passages, 450*b* and 450*c*, and an inner annular recess 450*d*, receives and is threadably coupled to an end of the gripper body 440. Torsional locking pins, 452*a* and 452*b*, are coupled to the external radial mounting holes, 440*n* and 440*o*, respectively, of the gripper body 428 and received within the radial passages, 450*b* and 450*c*, respectively, of the tool joint adaptor 450.

A bypass tube 454 that defines a longitudinal passage 454*a* is received within the longitudinal passages, 406*a*, 428*a*, 440*a*, and 450*a*, of the gripper upper mandrel 406, the gripper body 428, the gripper body 440, and the tool joint adaptor 450, respectively, is coupled to the recess 406*g* of the gripper upper mandrel at one end and is coupled to the recess 450*d* of the tool joint adaptor at the other end.

An end of a cross over adaptor 456 that defines a longitudinal passage 456*a* receives and is threadably coupled to an end of the tool joint adaptor 450. The other end of the cross over adaptor 456 is received within and is coupled to an end of a tool joint adaptor 458 that defines a longitudinal passage 458*a* and external radial mounting holes, 458*b* and 458*c*.

An end of a positive casing locking body 460 that defines a tapered longitudinal passage 460*a* and radial passages, 460*b* and 460*c*, receives and is threadably coupled to the other end of the tool joint adaptor 458. Torsional locking pins, 462*a* and 462*b*, are coupled to the external radial mounting holes, 458*b* and 458*c*, respectively, of the tool joint adaptor 458 and received within the radial passages, 460*b* and 460*c*, respectively, of the positive casing locking body 460.

An end of a positive casing locking dog 464 mates with, is received within, and is coupled to the other end of the positive casing locking body 460 that includes internal flanges, 464*a* and 464*b*, and an external flange 464*c*. In an exemplary embodiment, the external flange 464*c* of the positive casing locking dog 464 includes an ribbed external surface 464*d* that engages and locks onto a ribbed internal surface 466*a* of a positive casing locking collar 466.

One end of the positive casing locking collar 466 is threadably coupled to a casing 468 and the other end of the positive casing locking collar is threadably coupled to a casing 470 that defines radial mounting holes, 470*a* and 470*b*, at a lower end thereof. In this manner, the casings, 468 and 470, are also engaged by and locked onto the positive casing locking dog 464.

The other end of the positive casing locking dog 464 mates with, is received within, and is coupled to an end of a positive casing locking body 472 that defines a tapered longitudinal passage 472*a* and radial passages, 472*b* and 472*c*. The other end of the positive casing locking body 472 receives, mates with, and is coupled to an end of a casing lock barrel adaptor 474 that defines external radial mounting holes, 474*a* and 474*b*, and external radial mounting holes, 474*c* and 474*d*. Torsional locking pins, 475*a* and 475*b*, are coupled to the external radial mounting holes, 474*a* and 474*b*, respectively, of the casing lock barrel adaptor 474 and received within the radial passages, 472*b* and 472*c*, respectively, of the positive casing locking body 472.

An end of a positive casing lock releasing mandrel 476 that defines a longitudinal passage 476*a*, an external annular recess 476*b*, an external annular recess 476*c*, an external annular recess 476*d*, and an external annular recessed end portion 476*e*, is received within and movably coupled to an end of the tool joint adaptor 458. The middle portion of the positive casing lock releasing mandrel 476 is received within and mates with the internal flanges, 464*a* and 464*b*, of the positive casing locking dogs 464. The other end of the positive casing lock releasing mandrel 476 is received within and is movably coupled to the end of the casing lock barrel adaptor 474, and the external annular recessed portion 476*e* of the positive casing lock releasing mandrel is threadably coupled to and received within an end of a positive casing lock lower mandrel 478 that defines a longitudinal passage 478*a*, external radial mounting holes, 478*b* and 478*c*, and an external annular recessed end portion 478*d*.

A shear pin ring 480 that defines radial passages, 480*a* and 480*b*, receives and mates with the positive casing lock lower mandrel 478. Shear pins, 482*a* and 482*b*, are coupled to the external radial mounting holes, 478*b* and 478*c*, respectively, of the positive casing lock lower mandrel 478 and are received within the radial passages, 480*a* and 480*b*, respectively, of the shear pin ring 480.

An end of an actuator barrel 484 that defines a longitudinal passage 484*a*, radial passages, 484*b* and 484*c*, and radial passages, 484*d* and 484*e*, is threadably coupled to an end of the casing lock barrel adaptor 474. Torsional locking pins, 486*a* and 486*b*, are coupled to the external radial mounting holes, 474*c* and 474*d*, respectively, of the casing lock barrel adaptor and are received within the radial passages, 484*b* and 484*c*, respectively, of the actuator barrel.

The other end of the actuator barrel 484 is threadably coupled to an end of a barrel connector 486 that defines an internal annular recess 486*a*, external radial mounting holes, 486*b* and 486*c*, radial passages, 486*d* and 486*e*, and external radial mounting holes, 486*f* and 486*g*. A sealing cartridge 488 is received within and coupled to the internal annular recess 486*a* of the barrel connector 486 for fluidicly sealing the interface between the barrel connector and the sealing cartridge. Torsional locking pins, 490*a* and 490*b*, are coupled to and mounted within the external radial mounting holes, 486*b* and 486*c*, respectively, of the barrel connector 486 and received within the radial passages, 484*d* and 484*e*, of the actuator barrel 484.

The other end of the barrel connector 486 is threadably coupled to an end of an actuator barrel 492 that defines a longitudinal passage 492*a*, radial passages, 492*b* and 492*c*, and radial passages, 492*d* and 492*e*. Torsional locking pins, 494*a* and 494*b*, are coupled to and mounted within the external radial mounting holes, 486*f* and 486*g*, respectively, of the barrel connector 486 and received within the radial passages, 492*b* and 492*c*, of the actuator barrel 492. The other end of the actuator barrel 492 is threadably coupled to an end of a barrel connector 496 that defines an internal annular recess 496*a*, external radial mounting holes, 496*b* and 496*c*, radial passages, 496*d* and 496*e*, and external radial mounting holes, 496*f* and 496*g*. A sealing cartridge 498 is received within and coupled to the internal annular recess 496*a* of the barrel connector 496 for fluidicly sealing the interface between the barrel connector and the sealing cartridge. Torsional locking pins, 500*a* and 500*b*, are coupled to and mounted within the external radial mounting holes, 496*b* and 496*c*, respectively, of the barrel connector 496 and received within the radial passages, 492*d* and 492*e*, of the actuator barrel 492.

The end of the barrel connector 496 is threadably coupled to an end of an actuator barrel 502 that defines a longitudinal passage 502*a*, radial passages, 502*b* and 502*c*, and radial passages, 502*d* and 502*e*. Torsional locking pins, 504*a* and 504*b*, are coupled to and mounted within the external radial mounting holes, 496*f* and 496*g*, respectively, of the barrel connector 496 and received within the radial passages, 502*b* and 502*c*, of the actuator barrel 502. The other end of the actuator barrel 502 is threadably coupled to an end of a barrel connector 506 that defines an internal annular recess 506*a*, external radial mounting holes, 506*b* and 506*c*, radial passages, 506*d* and 506*e*, and external radial mounting holes, 506*f* and 506*g*. Torsional locking pins, 508*a* and 508*b*, are coupled to and mounted within the external radial mounting holes, 506*b* and 506*c*, respectively, of the barrel connector 506 and received within the radial passages, 502*d* and 502*e*, of the actuator barrel 502. A sealing cartridge 510 is received within and coupled to the internal annular recess 506*a* of the barrel connector 506 for fluidicly sealing the interface between the barrel connector and the sealing cartridge.

The other end of the barrel connector 506 is threadably coupled to an end of an actuator barrel 512 that defines a longitudinal passage 512*a*, radial passages, 512*b* and 512*c*, and radial passages, 512*d* and 512*e*. Torsional locking pins, 514*a* and 514*b*, are coupled to and mounted within the external radial mounting holes, 506*f* and 506*g*, respectively, of the barrel connector 506 and received within the radial passages, 512*b* and 512*c*, of the actuator barrel 512. The other end of the actuator barrel 512 is threadably coupled to an end of a lower stop 516 that defines an internal annular recess 516*a*, external radial mounting holes, 516*b* and 516*c*, and an internal annular recess 516*d* that includes one or more circumferentially spaced apart locking teeth 516*e* at one end and one or more circumferentially spaced apart locking teeth 516*f* at the other end. A sealing cartridge 518 is received within and coupled to the internal annular recess 516*a* of the barrel connector 516 for fluidicly sealing the interface between the barrel connector and the sealing cartridge. Torsional locking pins, 520*a* and 520*b*, are coupled to and mounted within the external radial mounting holes, 516*b* and 516*c*, respectively, of the barrel connector 516 and received within the radial passages, 512*d* and 512*e*, of the actuator barrel 512.

A connector tube 522 that defines a longitudinal passage 522*a* is received within and sealingly and movably engages the interior surface of the sealing cartridge 488 mounted within the annular recess 486*a* of the barrel connector 486. In this manner, during longitudinal displacement of the connector tube 522 relative to the barrel connector 486, a fluidic seal is maintained between the exterior surface of the connector tube and the interior surface of the barrel connector. An end of the connector tube 522 is received within and is threadably coupled to an end of dart/ball guide 524 that defines a tapered passage 524*a* at the other end.

The other end of the connector tube 522 is received within and threadably coupled to an end of a piston 526 that defines a longitudinal passage 526*a* and radial passages, 526*b* and 526*c*, that includes a flange 526*d* at one end. A sealing cartridge 528 is mounted onto and sealingly coupled to the exterior of the piston 526 proximate the flange 526*d*. The sealing cartridge 528 also mates with and sealingly engages the interior surface of the actuator barrel 492. In this manner, during longitudinal displacement of the piston 526 relative to the actuator barrel 492, a fluidic seal is maintained between the exterior surface of the piston and the interior surface of the actuator barrel.

The other end of the piston 526 receives and is threadably coupled to an end of a connector tube 529 that defines a longitudinal passage 528*a*. The connector tube 529 is received within and sealingly and movably engages the interior surface of the sealing cartridge 498 mounted within the annular recess 496*a* of the barrel connector 496. In this manner, during longitudinal displacement of the connector tube 529 relative to the barrel connector 496, a fluidic seal is maintained between the exterior surface of the connector tube and the interior surface of the barrel connector.

The other end of the connector tube 529 is received within and threadably coupled to an end of a piston 530 that defines a longitudinal passage 530*a* and radial passages, 530*b* and 530*c*, that includes a flange 530*d* at one end. A sealing cartridge 532 is mounted onto and sealingly coupled to the exterior of the piston 530 proximate the flange 530*d*. The sealing cartridge 532 also mates with and sealingly engages the interior surface of the actuator barrel 502. In this manner, during longitudinal displacement of the piston 530 relative to the actuator barrel 502, a fluidic seal is maintained between the exterior surface of the piston and the interior surface of the actuator barrel.

The other end of the piston 530 receives and is threadably coupled to an end of a connector tube 534 that defines a longitudinal passage 534*a*. The connector tube 534 is received within and sealingly and movably engages the interior surface of the sealing cartridge 510 mounted within the annular recess 506*a* of the barrel connector 506. In this manner, during longitudinal displacement of the connector tube 534 relative to the barrel connector 506, a fluidic seal is maintained between the exterior surface of the connector tube and the interior surface of the barrel connector.

The other end of the connector tube 534 is received within and threadably coupled to an end of a piston 536 that defines a longitudinal passage 536*a*, radial passages, 536*b* and 536*c*, and external radial mounting holes, 536*d* and 536*e*, that includes a flange 536*f* at one end. A sealing cartridge 538 is mounted onto and sealingly coupled to the exterior of the piston 536 proximate the flange 536*d*. The sealing cartridge 538 also mates with and sealingly engages the interior surface of the actuator barrel 512. In this manner, during longitudinal displacement of the piston 536 relative to the actuator barrel 512, a fluidic seal is maintained between the exterior surface of the piston and the interior surface of the actuator barrel.

The other end of the piston 536 is received within and threadably coupled to an end of a lock nut 540 that defines radial passages, 540*a* and 540*b*, and includes one or more circumferentially spaced apart locking teeth 540*c* at the other end for engaging the circumferentially spaced apart locking teeth 516*e* of the lower stop 516.

A threaded bushing 542 is received within and threadably coupled to the circumferentially spaced apart locking teeth 540*c* of the lock nut 540. An end of a connector tube 544 that defines a longitudinal passage 544*a* is received within and is threadably coupled to the threaded bushing 542. A sealing sleeve 546 is received within and is threadably coupled to adjacent ends of the piston 536 and the connector tube 544 for fluidicly sealing the interface between the end of the piston and the end of the connector tube. Torsional locking pins, 548*a* and 548*b*, are mounted within and coupled to the external radial mounting holes, 536*d* and 536*e*, respectively, of the piston 536 that are received within the radial passages, 540*a* and 540*b*, of the stop nut 540.

The connector tube 544 is received within and sealingly and movably engages the interior surface of the sealing cartridge 518 mounted within the annular recess 516*a* of the barrel connector 516. In this manner, during longitudinal displacement of the connector tube 544 relative to the barrel connector 516, a fluidic seal is maintained between the exterior surface of the connector tube and the interior surface of the barrel connector.

The other end of the connector tube 544 is received within and is threadably coupled to a threaded bushing 550. The threaded bushing 550 is received within and threadably coupled to a lock nut 552 that defines radial passages, 552*a* and 552*b*, and includes one or more circumferentially spaced apart locking teeth 552*c* at one end for engaging the circumferentially spaced apart locking teeth 516*f* of the lower stop 516. The other end of the lock nut 552 receives and is threadably coupled to an end of tool joint adaptor 554 that defines a longitudinal passage 554*a*, external radial mounting holes, 554*b* and 554*c*. Torsional locking pins, 556*a* and 556*b*, are mounted within and coupled to the external radial mounting holes, 554*b* and 554*c*, respectively, of the tool joint adaptor 554 that are received within the radial passages, 552*a* and 552*b*, of the stop nut 552. A sealing sleeve 558 is received within and is threadably coupled to adjacent ends of the connector tube 544 and the tool joint adaptor 554 for fluidicly sealing the interface between the end of the connector tube and the end of the tool joint adaptor.

The other end of the tool joint adaptor 554 is received within and threadably coupled to an end of a tool joint adaptor 560 that defines a longitudinal passage 560*a*. A torsion plate 562 is received within and threadably coupled to the other end of the tool joint adaptor 560 that defines a longitudinal passage 562*a* and includes one or more circumferentially spaced apart locking teeth 562*b* at one end. An end of an upper bushing 564 is also received within and threadably coupled to the other end of the tool joint adaptor 560 proximate the torsion plate 562 that receives and is threadably coupled to an end of a cup mandrel 566 that defines a longitudinal passage 566*a* and includes a plurality of circumferentially spaced apart locking teeth 566*b* at one end for engaging the circumferentially spaced apart locking teeth 562*b* of the torsion plate 562. The end of the cup mandrel 566 is further positioned proximate an end face of the torsion plate 562.

A thimble 568 is mounted on and is threadably coupled to the cup mandrel 566 proximate an end face of the upper bushing 564. An inner thimble 570 is mounted on and is threadably coupled to the cup mandrel 566 proximate an end of the thimble 568, and one end of the inner thimble is received within and mates with the end of the thimble. A resilient packer cup 572 is mounted on and sealingly engages the cup mandrel 566 proximate an end of the inner thimble 570, and one end of the packer cup is received within and mates with the end of the inner thimble. A packer cup backup ring 574 is mounted on the inner thimble 570 proximate an end face of the thimble 568, and an end of the packer cup backup ring 574 receives and mates with the packer cup 572. A spacer 576 is mounted on and threadably engages the cup mandrel 566 proximate an end face of the packer cup 572.

A thimble 578 is mounted on and is threadably coupled to the cup mandrel 566 proximate an end of the spacer 576. An inner thimble 580 is mounted on and is threadably coupled to the cup mandrel 566 proximate an end of the thimble 578, and one end of the inner thimble is received within and mates with the end of the thimble. A resilient packer cup 582 is mounted on and sealingly engages the cup mandrel 566 proximate an end of the inner thimble 580, and one end of the packer cup is received within and mates with the end of the inner thimble. A packer cup backup ring 584 is mounted on the inner thimble 580 proximate an end face of the thimble 578, and an end of the packer cup backup ring 584 receives and mates with the packer cup 582. An adjustable spacer 586 is mounted on and threadably engages the cup mandrel 566 proximate an end face of the packer cup 582.

An end of a cone mandrel 588 that defines a longitudinal passage 588*a*, an external lock ring groove 588*b*, an external lock ring groove 588*c*, an external lock ring groove 588*d*, an external lock ring groove 588*e*, radial passages, 588*f* and 588*g*, and locking dog grooves 588*h* receives and is threadably coupled to an end of the cup mandrel 566. A shear pin bushing 590 that defines external radial mounting holes, 590*a* and 590*b*, at one end and an annular recess 590*c* at another end and includes circumferentially spaced apart locking teeth 590*d* at the other end is mounted on and is movably coupled to the cone mandrel 588. Torsional shear pins, 592*a* and 592*b*, are mounted within and coupled to the external radial mounting holes, 590*a* and 590*b*, respectively, of the shear pin bushing 590 and received within the radial passages, 470*a* and 470*b*, respectively, of the end of the casing 470. In this manner, torque loads may be transmitted between the casing 470 and the shear pin bushing 590. A resilient lock ring 594 is retained in the external lock ring groove 588*b* of the cone mandrel and received within the internal annular recess 590*c* at the end of the shear pin bushing 590.

Figure 24A:
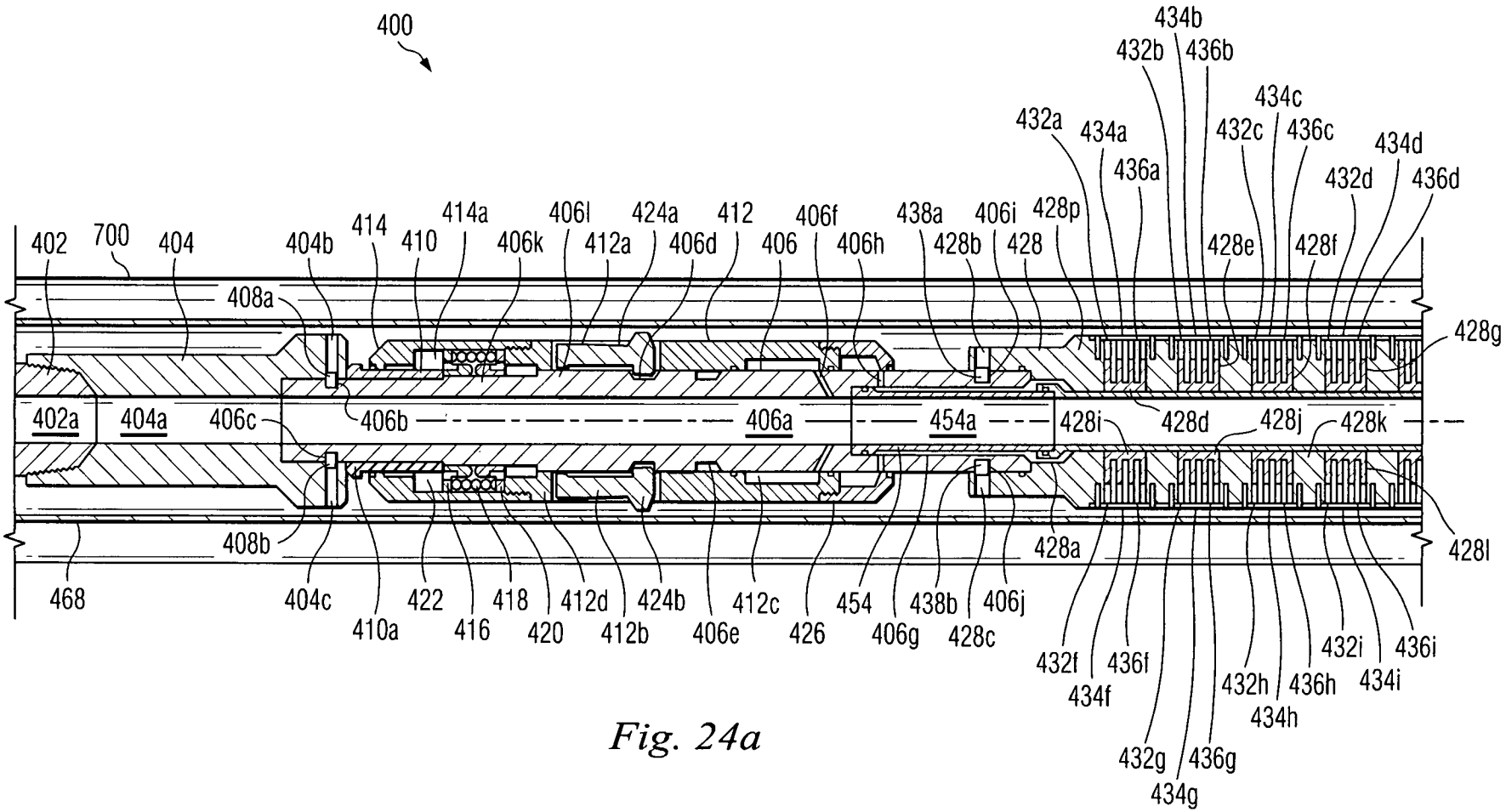
FIGS. 24*a*-24*k* are fragmentary cross sectional illustrations of the placement of an exemplary embodiment of an apparatus for radially expanding and plastically deforming a tubular member within a wellbore that traverses a subterranean formation.
Figure 24B:
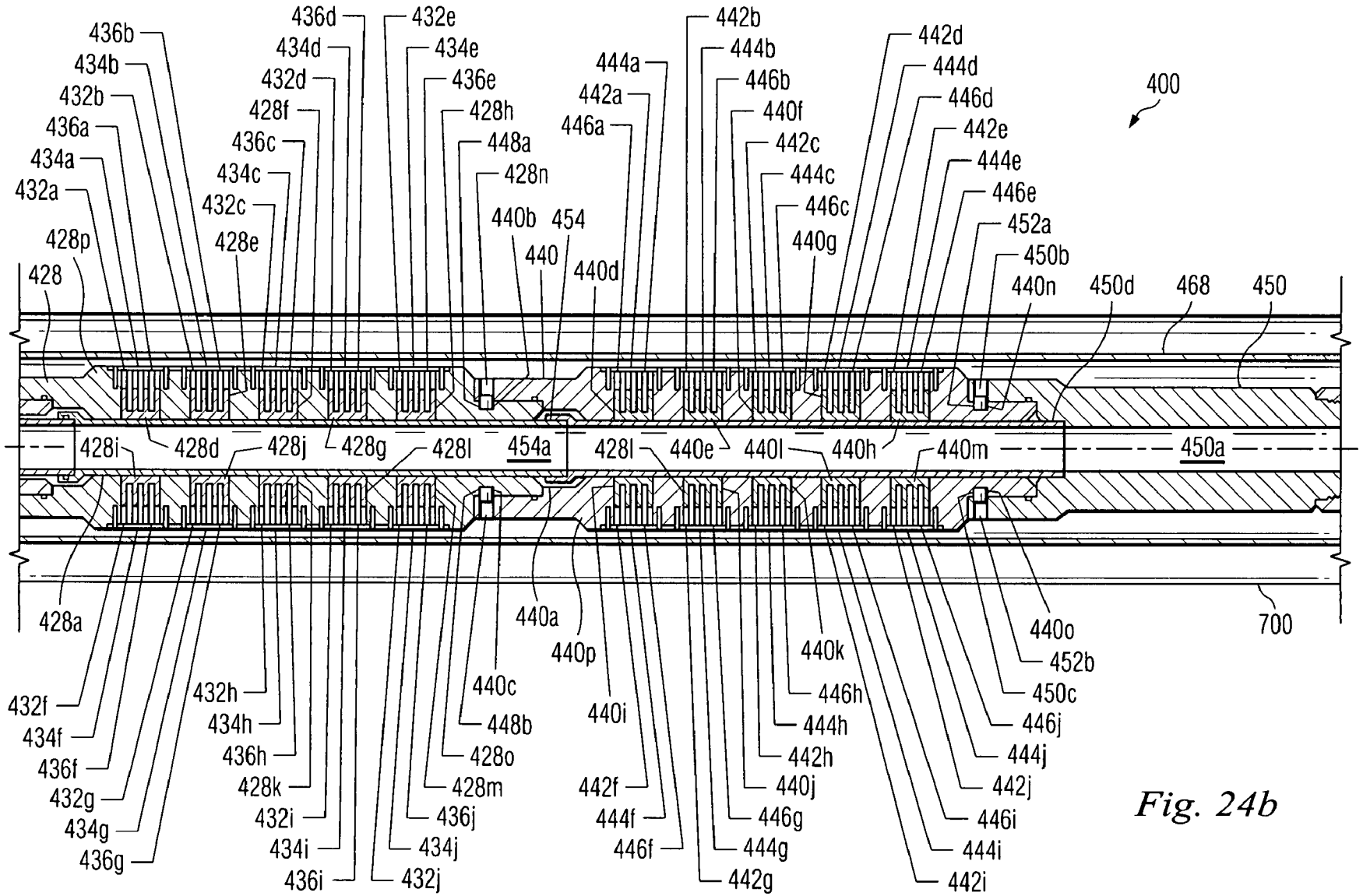
Figure 24C:
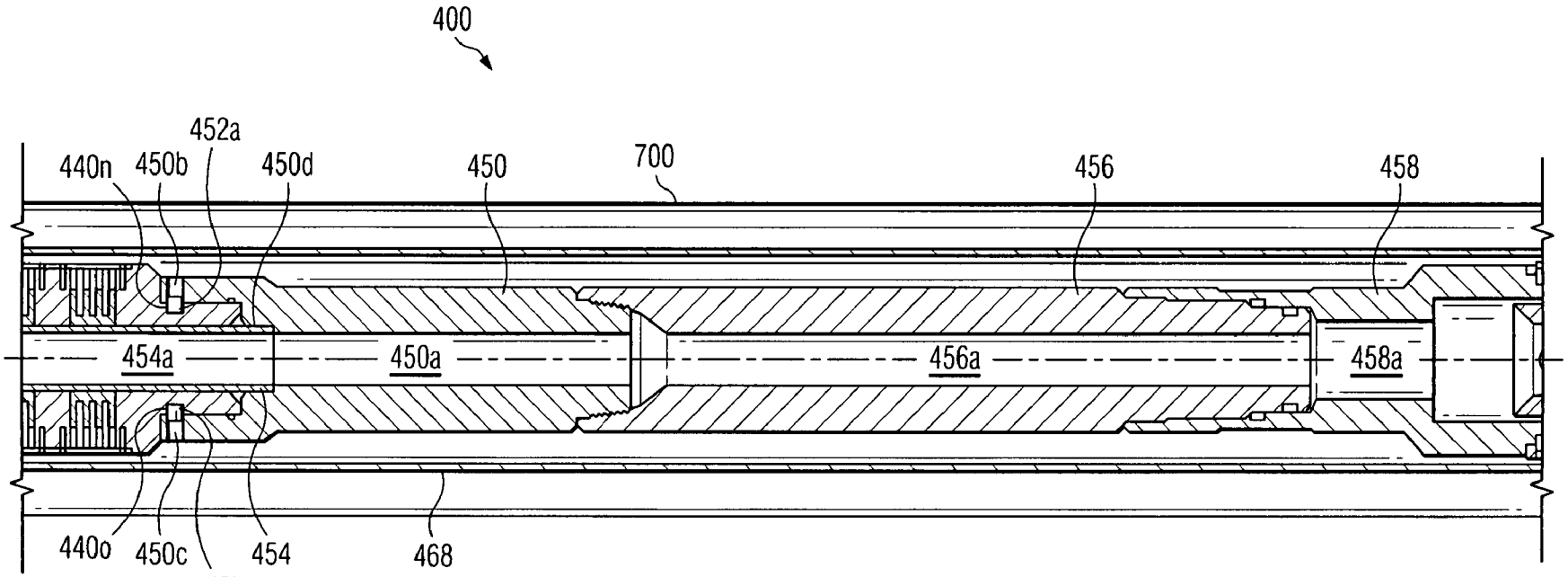
Figure 24D:
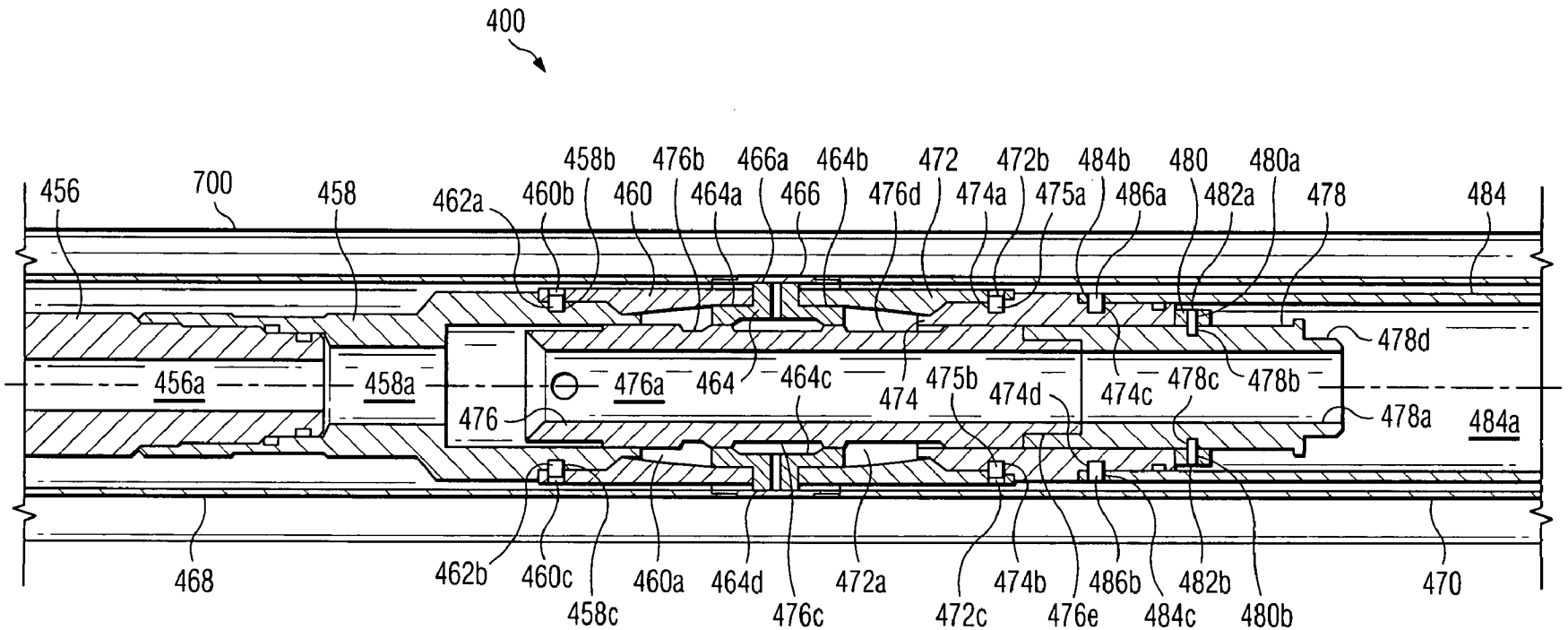
Figure 24E:
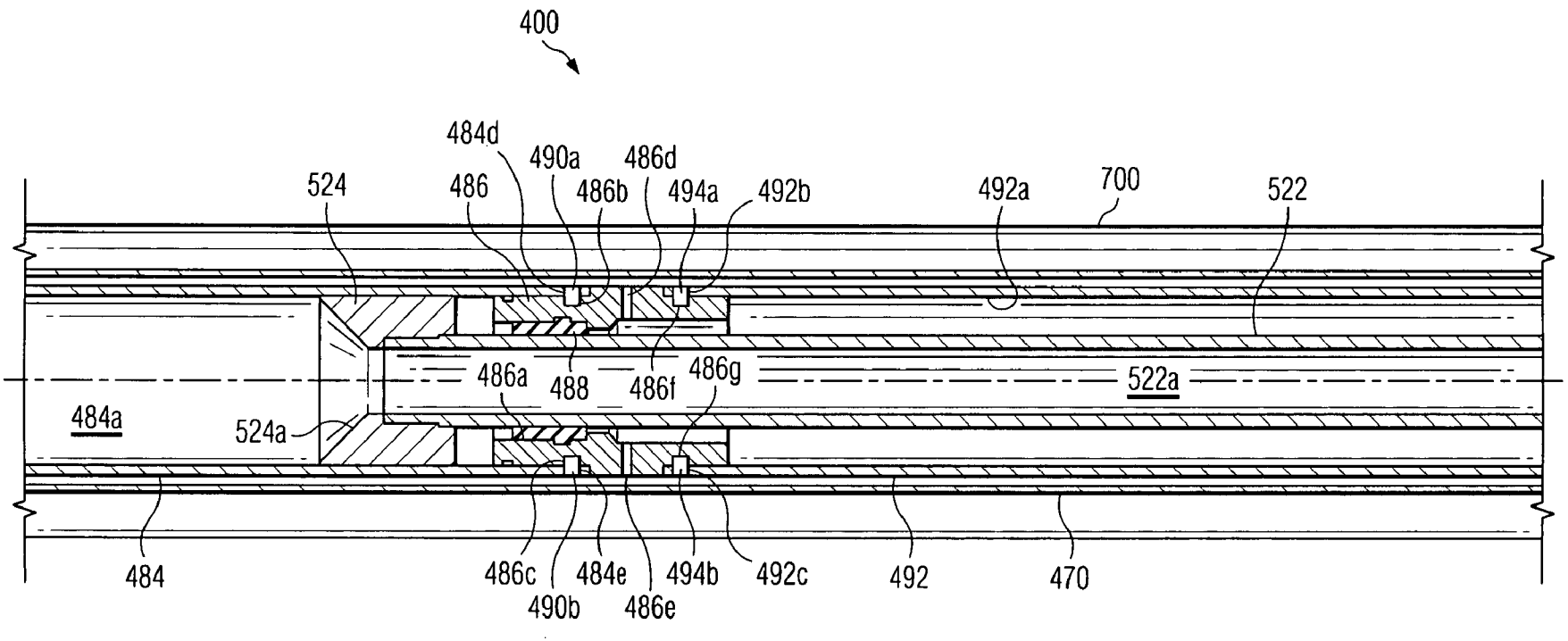
Figure 24F:
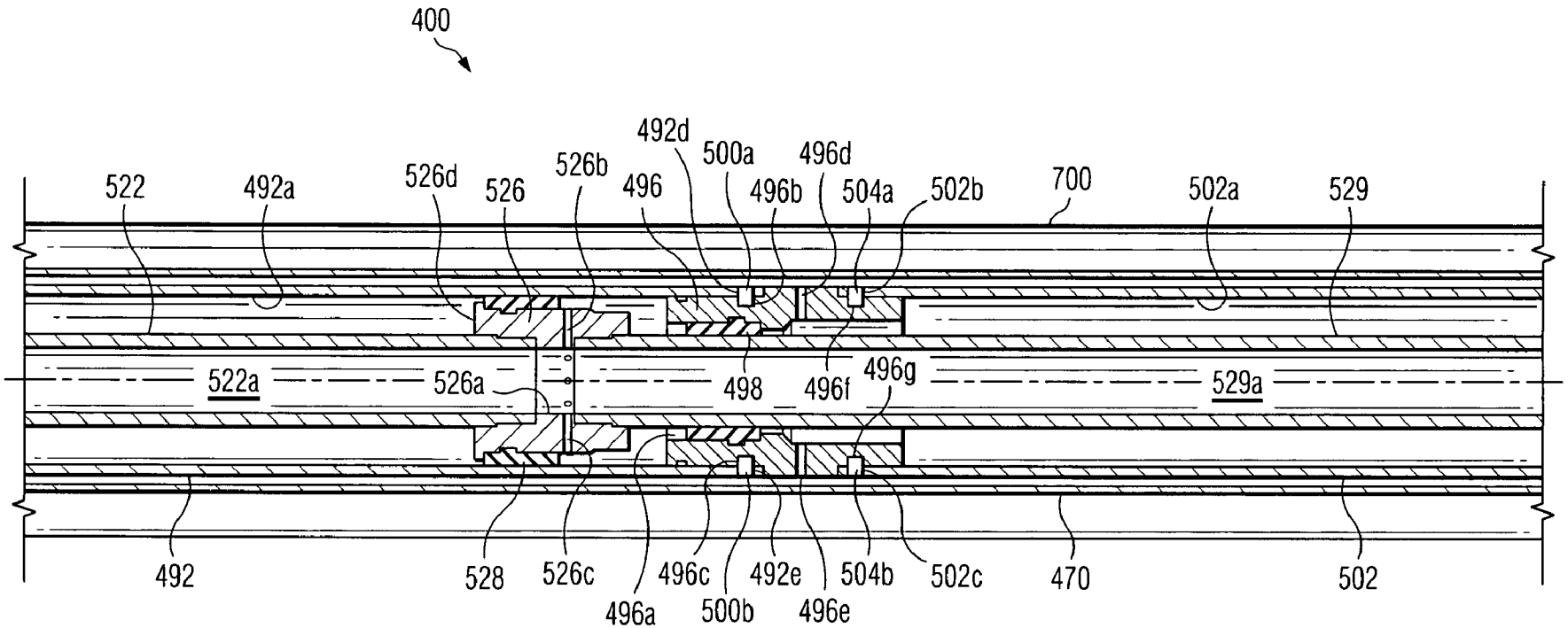
Figure 24G:
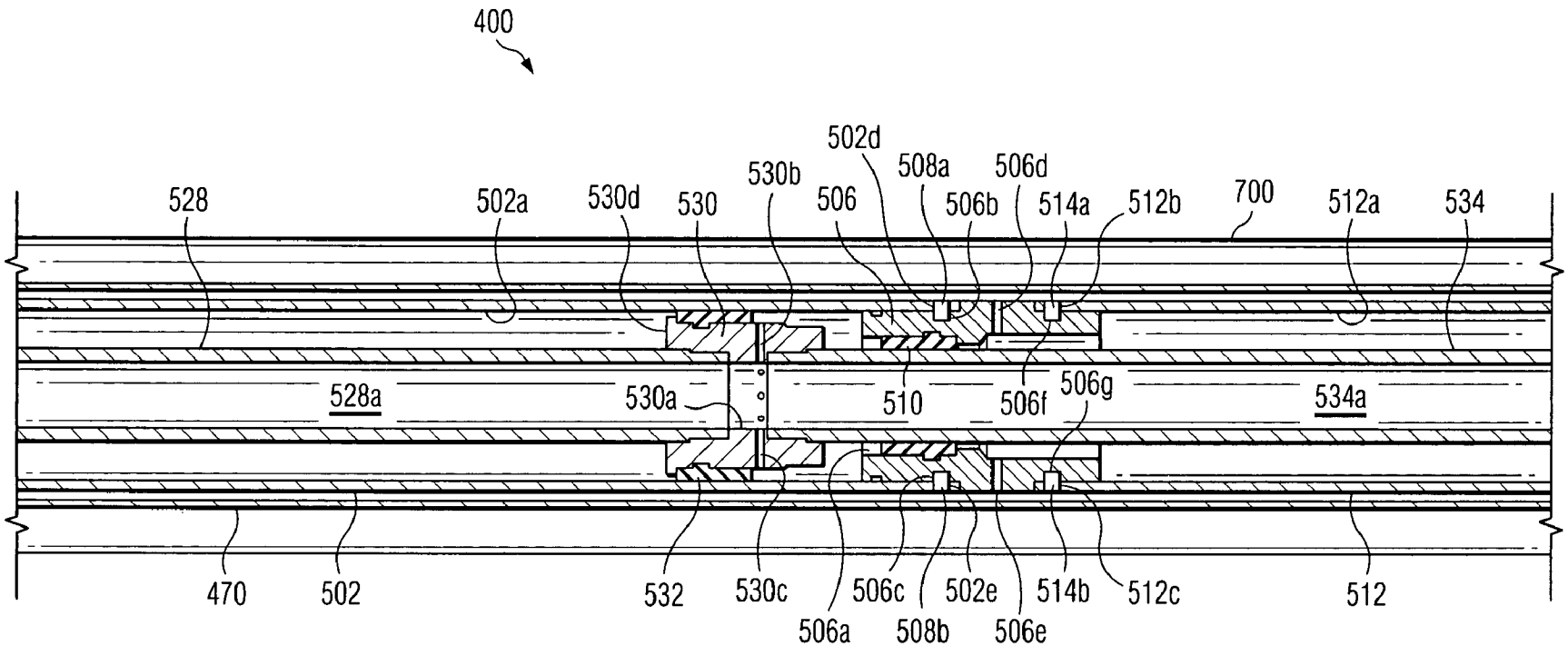
Figure 24H:
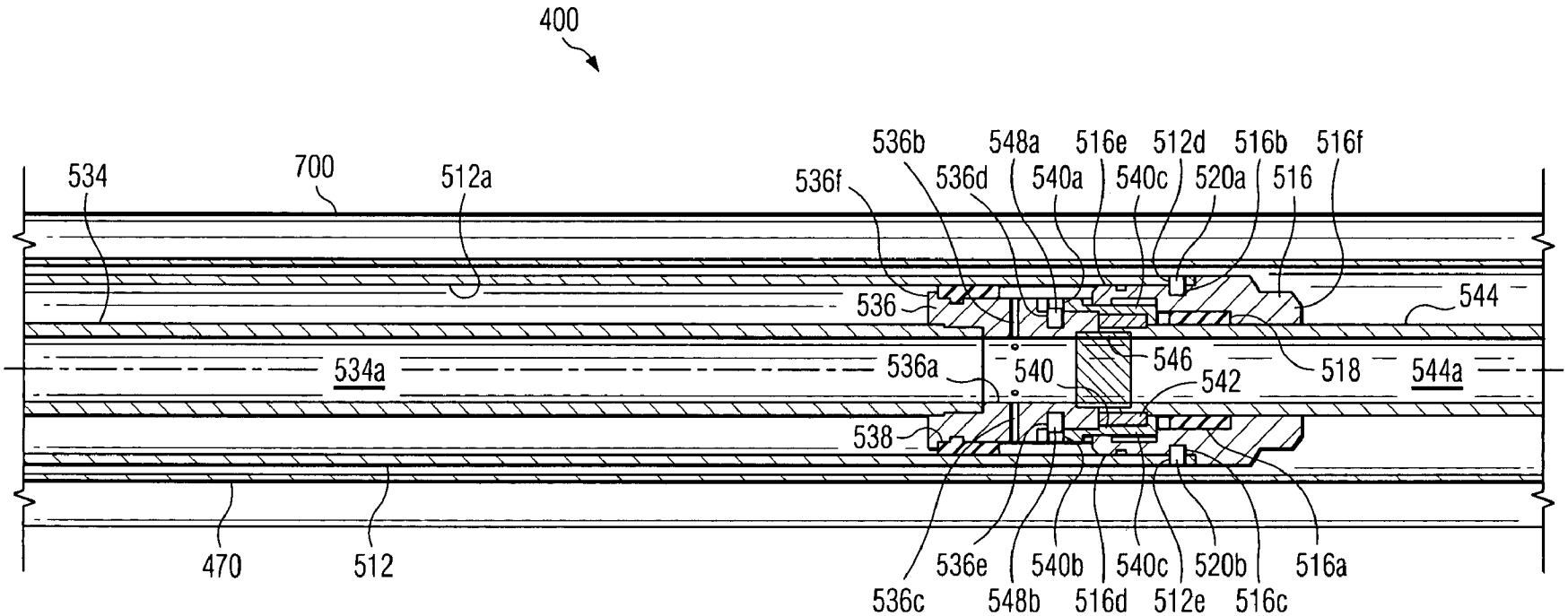
Figure 24I:
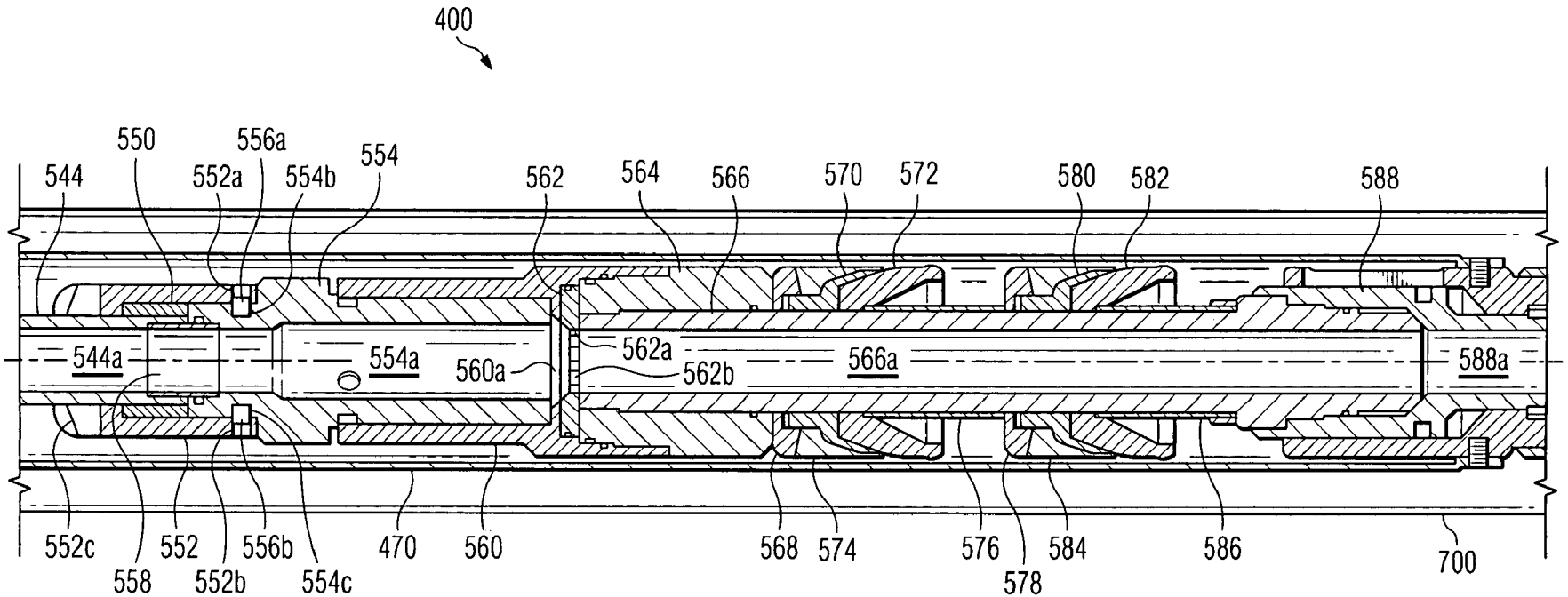
Figure 24J:
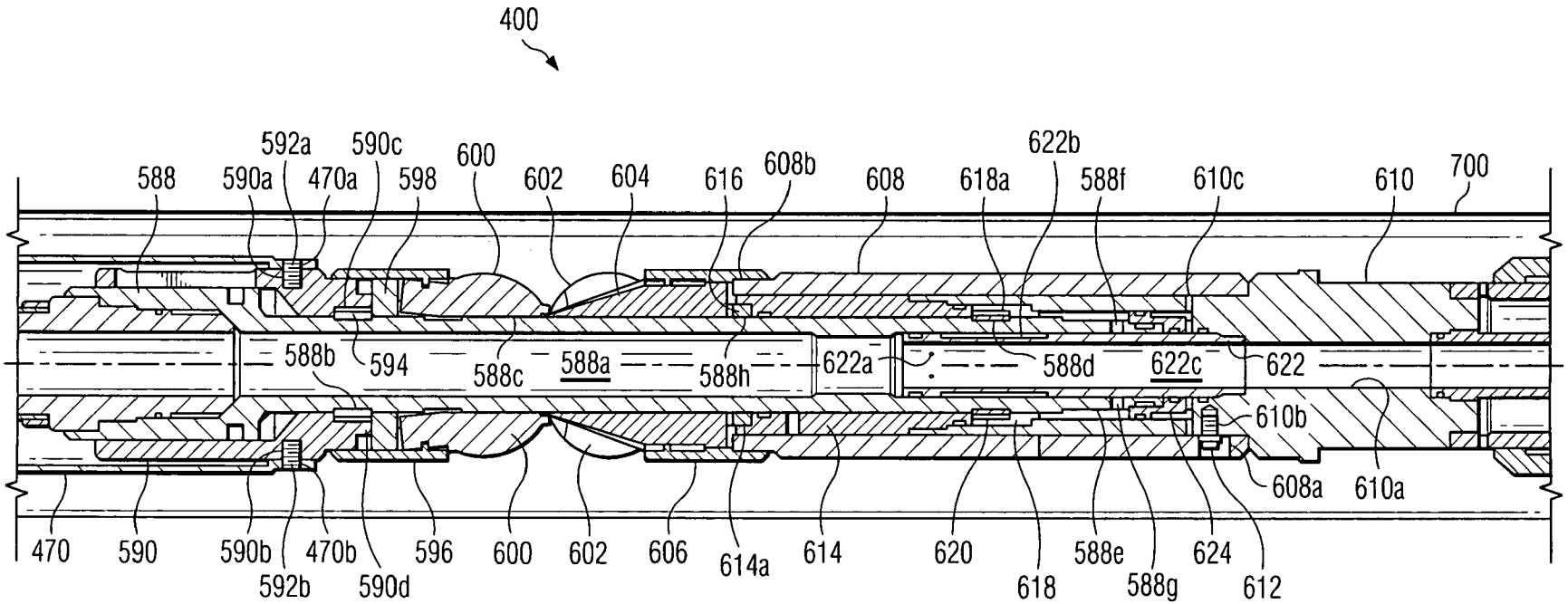
Figure 24K:
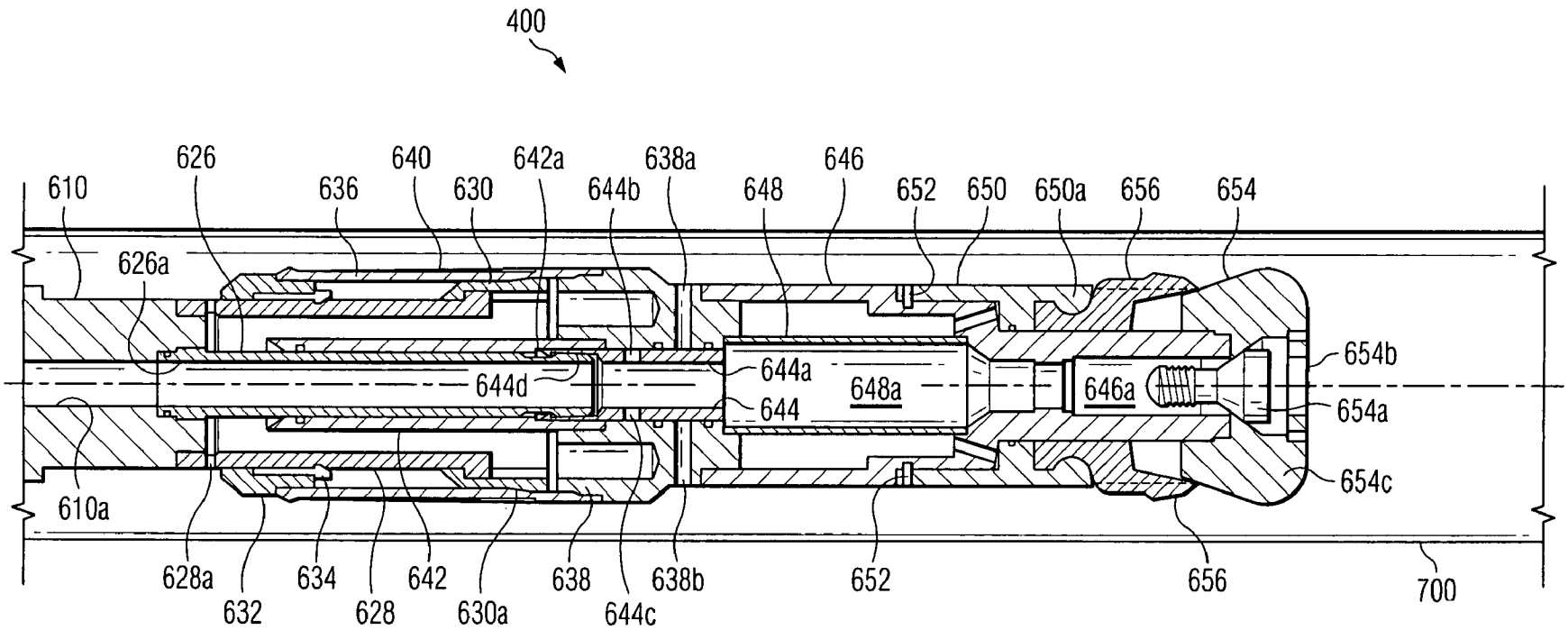
Figure 25A:
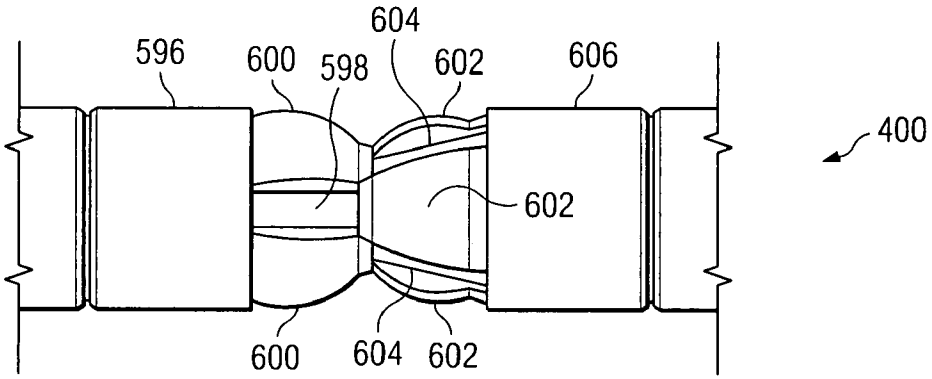
FIG. 25*a*-25*f* are fragmentary cross sectional and perspective illustrations of the expansion cone assembly of the apparatus of FIGS. 24*a*-24*k*.
Figure 25B:
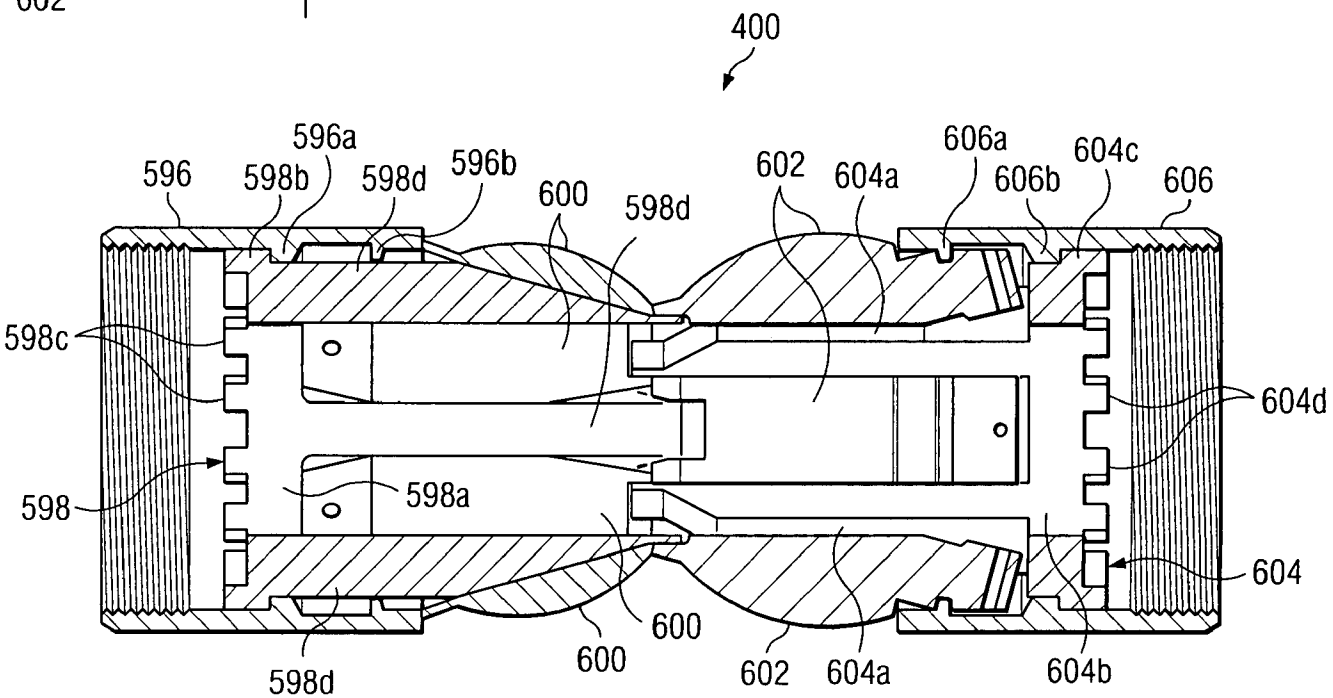

Referring to FIGS. 24*j*, 25*a*, and 25*b*, an upper cone retainer 596 receives, mates with, and is coupled to the end of the shear pin bushing 590 that includes an internal flange 596*a* and an internal upper pivot point flange 596*b*. An end of an upper cam 598 includes a tubular base 598*a* that mates with, receives, and is movably coupled to the cone mandrel 588. The tubular base 598*a* of the upper cam 598 further includes an external flange 598*b* that is received within and mates with the upper cone retainer 596 proximate the internal flange 596*a* of the upper cone retainer and a plurality of circumferentially spaced apart locking teeth 598*c* that engage the circumferentially spaced apart locking teeth 590*d* of the end of the shear pin bushing 590. In this manner, the upper cam 598 is retained within the upper cone retainer 596 and torque loads may be transmitted between the upper cam and the shear pin bushing 590.

Figure 25C:
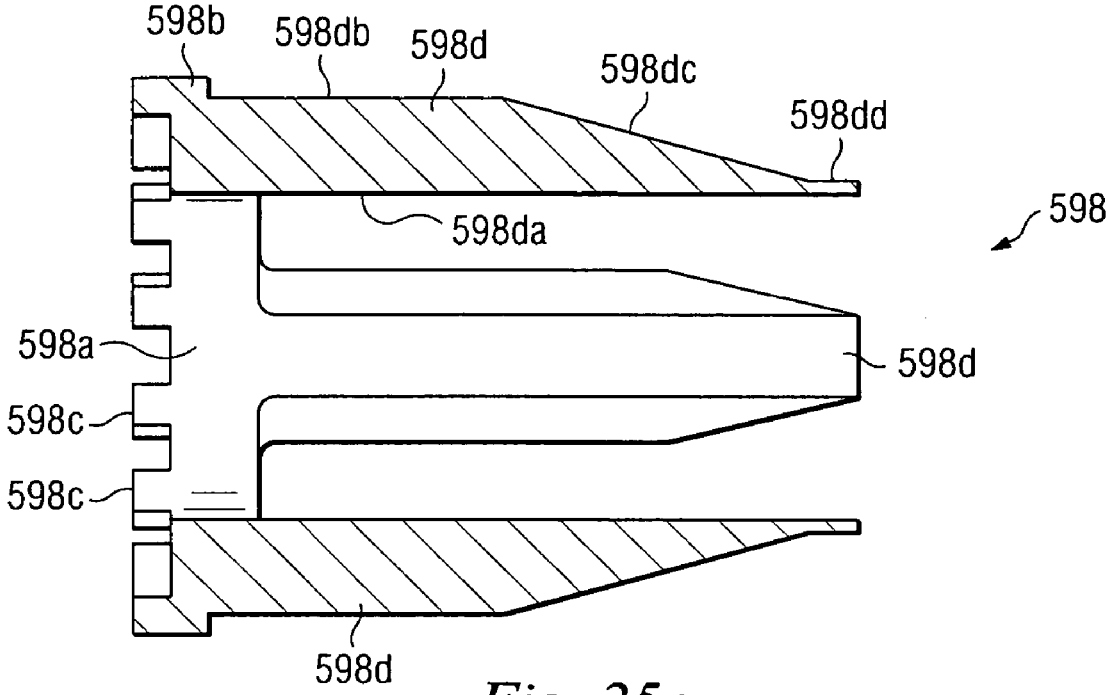

Referring to FIGS. 25*b* and 25*c*, the upper cam 598 further includes a plurality of circumferentially spaced apart cam arms 598*d* that extend from the tubular base 598*a* in the longitudinal direction that mate with, receive, and are movably coupled to the cone mandrel 588. Each cam arm 598*d* includes an inner surface 598*da* that is an arcuate cylindrical segment, a first outer surface 598*db* that is an arcuate cylindrical segment, a second outer surface 598*dc* that is an arcuate conical segment, and a third outer surface 598*dd* that is an arcuate cylindrical segment. In an exemplary embodiment, each of the cam arms 598*d* are identical.

Figure 25D:
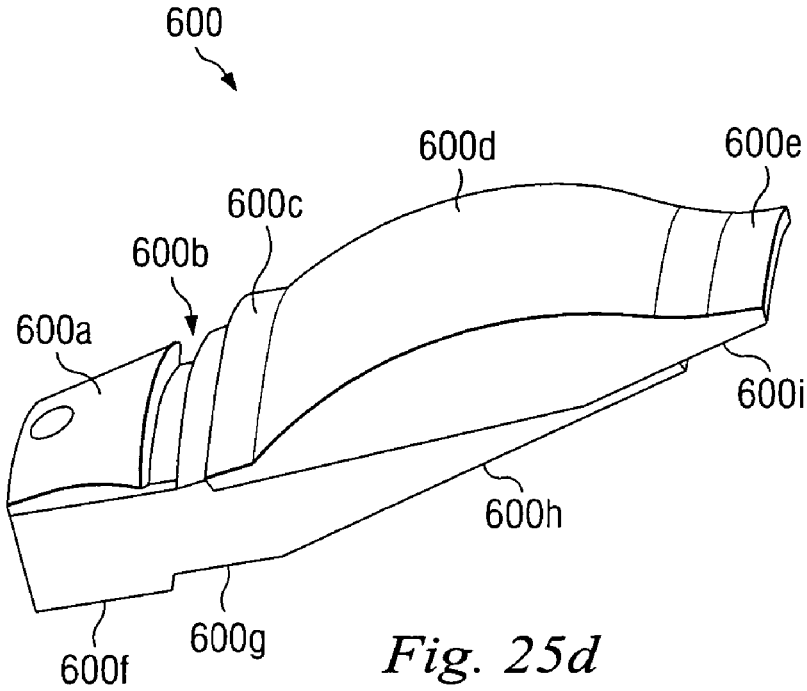

Referring to FIGS. 24*j*, 25*a*, and 25*d*, a plurality of circumferentialy spaced apart upper cone segments 600 are interleaved among the cam arms 598*d* of the upper cam 598. In an exemplary embodiment, each upper cone segment 600 includes a first outer surface 600*a* that defines a hinge groove 600*b*, a second outer surface 600*c*, a third outer surface 600*d*, a fourth outer surface 600*e*, a first inner surface 600*f*, a second inner surface 600*g*, a third inner surface 600*h*, and a fourth inner surface 600*i*. In an exemplary embodiment, the first outer surface 600*a*, the second outer surface 600*c*, the fourth outer surface 600*e*, the first inner surface 600*f*, the second inner surface 600*g*, and the fourth inner surface 600*i* are arcuate cylindrical segments. In an exemplary embodiment, the third outer surface 600*d* is an arcuate spherical segment. In an exemplary embodiment, the third inner surface 600*h* is an arcuate conical segment. In an exemplary embodiment, each of the upper cone segments 600 are identical. In an exemplary embodiment, the hinge grooves 600*b* of the upper cone segments 600 receive and mate with the pivot point 596*b* of the upper cone retainer 596. In this manner, the upper cone segments 600 are pivotally coupled to the upper cone retainer 596.

Figure 25E:
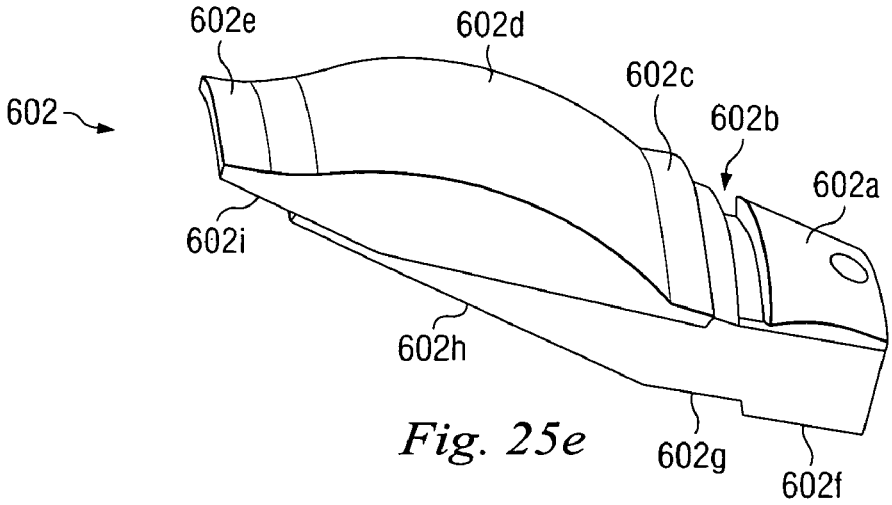
Figure 25F:
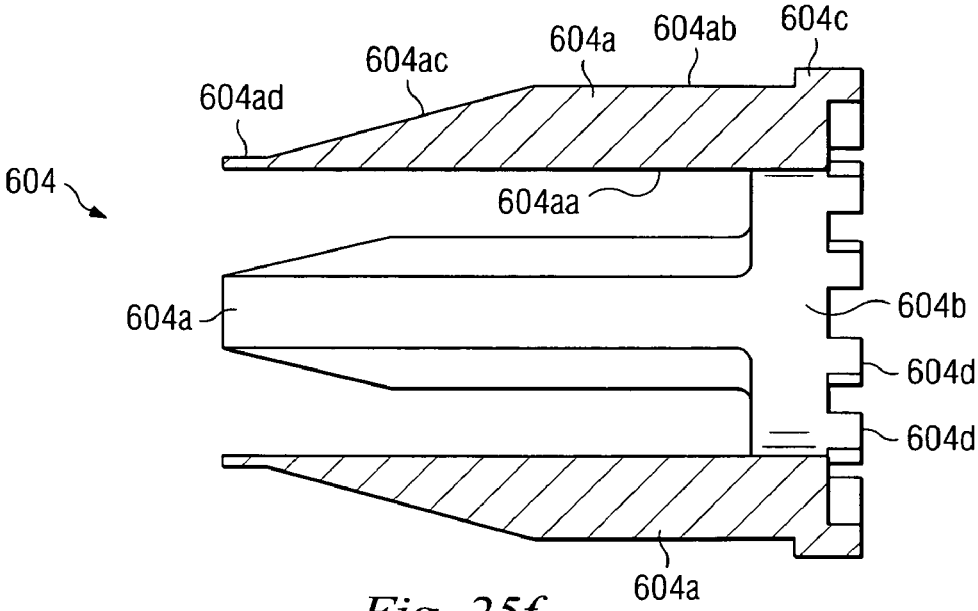
Figure 25G:
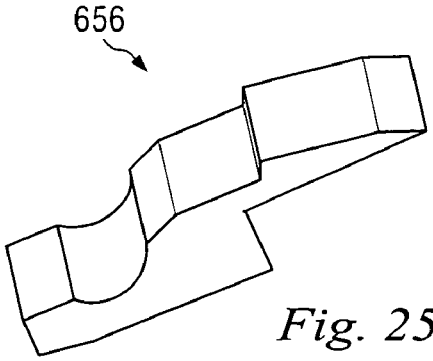
FIG. 25*g* is a perspective illustration of a float shoe locking dog.

Referring to FIGS. 24*j*, 25*a*, and 25*e*, a plurality of circumferentially spaced apart lower cone segments 602 overlap with and are interleaved among the upper cone segments 600. In an exemplary embodiment, each lower cone segment 602 includes a first outer surface 602*a* that defines a hinge groove 602*b*, a second outer surface 602*c*, a third outer surface 602*d*, a fourth outer surface 602*e*, a first inner surface 602*f*, a second inner surface 602*g*, a third inner surface 602*h*, and a fourth inner surface 602*i*. In an exemplary embodiment, the first outer surface 602*a*, the second outer surface 602*c*, the fourth outer surface 602*e*, the first inner surface 602*f*, the second inner surface 602*g*, and the fourth inner surface 602*i* are arcuate cylindrical segments. In an exemplary embodiment, the third outer surface 602*d* is an arcuate spherical segment. In an exemplary embodiment, the third inner surface 602*h* is an arcuate conical segment. In an exemplary embodiment, each of the lower cone segments 602 are identical.

Referring to FIGS. 24*j*, 25*a*, 25*b*, and 25*f*, a plurality of circumferentially spaced apart cam arms 604*a* that extend in the longitudinal direction from a tubular base 604*b* of a lower cam 604 overlap and are interleaved among the circumferentially spaced apart cam arms 598*d* of the upper cam 598 and mate with, receive, and are movably coupled to the cone mandrel 588. The tubular base 604*b* of the lower cam 604 mates with, receives, and is movably coupled to the cone mandrel 588 and includes an external flange 604*c* and a plurality of circumferentially spaced apart locking teeth 604*d*. Each cam arm 604*a* includes an inner surface 604*ac* that is an arcuate cylindrical segment, a first outer surface 604*ab* that is an arcuate cylindrical segment, a second outer surface 604*ac* that is an arcuate conical segment, and a third outer surface 604*ad* that is an arcuate cylindrical segment. In an exemplary embodiment, each of the cam arms 604*a* are identical.

An end of a lower cone retainer 606 includes an inner pivot point flange 606*a* that mates with and is received within the hinge grooves 602*b* of the lower cone segments 602. In this manner, the lower cone segments 602 are pivotally coupled to the lower cone retainer 606. The lower cone retainer 606 further includes an inner flange 606*b* that mates with and retains the external flange 604*c* of the lower cam 604. In this manner, the lower cam 604 is retained within the lower cone retainer 606.

The other end of the lower cone retainer 606 receives and is threadably coupled to an end of a release housing 608 that defines a radial passage 608*a* at another end and includes a plurality of circumferentially spaced apart locking teeth 608*b* at the end of the release housing for engaging the circumferentially spaced apart locking teeth 604*d* of the lower cam 604. In this manner, torque loads may be transmitted between the release housing 608 and the lower cam 604. An end of a lower mandrel 610 that defines a longitudinal passage 610*a*, an external radial mounting hole 610*b*, and radial passages 610*c* is received within, mates with, and is movably coupled to the other end of the release housing 608. A torsion locking pin 612 is mounted within and coupled to the external radial mounting hole 610*b* of the lower mandrel 610 and received within the radial passage 608*a* of the release housing 608. In this manner, longitudinal and torque loads may be transmitted between the release housing 608 and the lower mandrel 610.

An end of a locking dog retainer sleeve 614 that defines an inner annular recess 614*a* at one end and includes a plurality of circumferentially spaced apart locking teeth 614*b* at one end for engaging the locking teeth 604*d* of the lower cam 604 is received within and threadably coupled to an end of the lower mandrel 610. The locking dog retainer sleeve 614 is also positioned between and movably coupled to the release housing 608 and the cone mandrel 588. Locking dogs 616 are received within the inner annular recess 614*a* of the locking dog retainer sleeve 614 that releasably engage the locking dog grooves 588*h* provided in the exterior surface of the cone mandrel 588. In this manner, the locking dogs 616 releasably limit the longitudinal displacement of the lower cone segments 602, lower cam 604, and the lower cone retainer 606 relative to the cone mandrel 588.

A locking ring retainer 618 is received within and is threadably coupled to an end of the lower mandrel 610 that defines an inner annular recess 618*a* for retaining a resilient locking ring 620 within the lock ring groove 588*d* of the cone mandrel 588. The locking ring retainer 618 further mates with and is movably coupled to the cone mandrel 588. An end of an emergency release sleeve 622 that defines radial passages 622*a*, an outer annular recess 622*b*, and a longitudinal passage 622*c* is received within and is threadably coupled to an end of the lower mandrel 610. The emergency release sleeve 622 is also received within, mates with, and slidably and sealingly engages an end of the cone mandrel 588.

An end of a pressure balance piston 624 is received within, mates with, and slidably and sealingly engages the end of the lower mandrel 610 and receives, mates with, and is threadably coupled to an end of the cone mandrel 588. The other end of the pressure balance piston 624 receives, mates with, and slidably and sealingly engages the emergency release sleeve 622.

An end of a bypass valve operating probe 626 that defines a longitudinal passage 626*a* is received within and is threadably coupled to another end of the lower mandrel 610. An end of an expansion cone mandrel 628 that defines radial passages 628*a* receives and is threadably coupled to the other end of the lower mandrel 610. A sealing sleeve expansion cone 630 is slidably coupled to the other end of the expansion cone mandrel 628 that includes an outer tapered expansion surface 630*a*. A guide 632 is releasably coupled to another end of the expansion cone mandrel 628 by a retaining collet 634.

An end of an expandable sealing sleeve 636 receives and is mounted on the sealing sleeve expansion cone 630 and the guide 632. The other end of the expandable sealing sleeve 636 receives and is threadably coupled to an end of a bypass valve body 638 that defines radial passages, 638*a* and 638*b*. An elastomeric coating 640 is coupled to the exterior of at least a portion of the expandable sealing sleeve 636. An end of a probe guide 642 that defines an inner annular recess 642*a* is received within and is threadably coupled to an end of the bypass valve body 638 and receives and mates with an end of the bypass valve operating probe 626.

A bypass valve 644 that defines a longitudinal passage 644*a* and radial passages, 644*b* and 644*c*, and includes a collet locking member 644*d* at one end for releasably engaging an end of the bypass valve operating probe 626 is received within, mates with, and slidably and sealingly engages the bypass valve body 638. An end of a lower mandrel 646 that defines a longitudinal passage 646*a* receives and is threadably coupled to an end of the bypass valve body 638.

An end of a dart guide sleeve 648 that defines a longitudinal passage 648*a* is received within and is coupled to an end of the bypass valve body 638 and the other end of the dart guide sleeve 648 is received within and is coupled with the lower mandrel 646. An end of a differential piston 650 that includes an inner flange 650*a* at another end receives and is coupled to an end of the lower mandrel 646 by one or more shear pins 652. An end of a float valve assembly 654 including a float valve 654*a*, a valve guard 654*b*, and a guide nose 654*c* receives and is threadably coupled to an end of the lower mandrel 646. A plurality of circumferentially spaced apart locking dogs 656 are pivotally coupled to the inner flange 650*a* of the differential piston 650 and are further supported by an end of the float valve assembly 654.

As illustrated in FIGS. 24*a*-24*k*, in an exemplary embodiment, during operation of the apparatus 400, the apparatus is initially positioned within a preexisting structure 700 such as, for example, a wellbore that traverses a subterranean formation. In several alternative embodiments, the wellbore 700 may have any inclination from vertical to horizontal. Furthermore, in several alternative embodiments, the wellbore 700 may also include one or more preexisting wellbore casings, or other well construction elements, coupled to the wellbore. During the positioning of the apparatus 400 within the wellbore 700, the casings, 468 and 470, are supported by the positive casing locking dog 464 and the torsional shear pins, 592*a* and 592*b*. In this manner, axial and torque loads may be transmitted between the casings, 468 and 470, and the tubular support member 402.

Figure 25H:
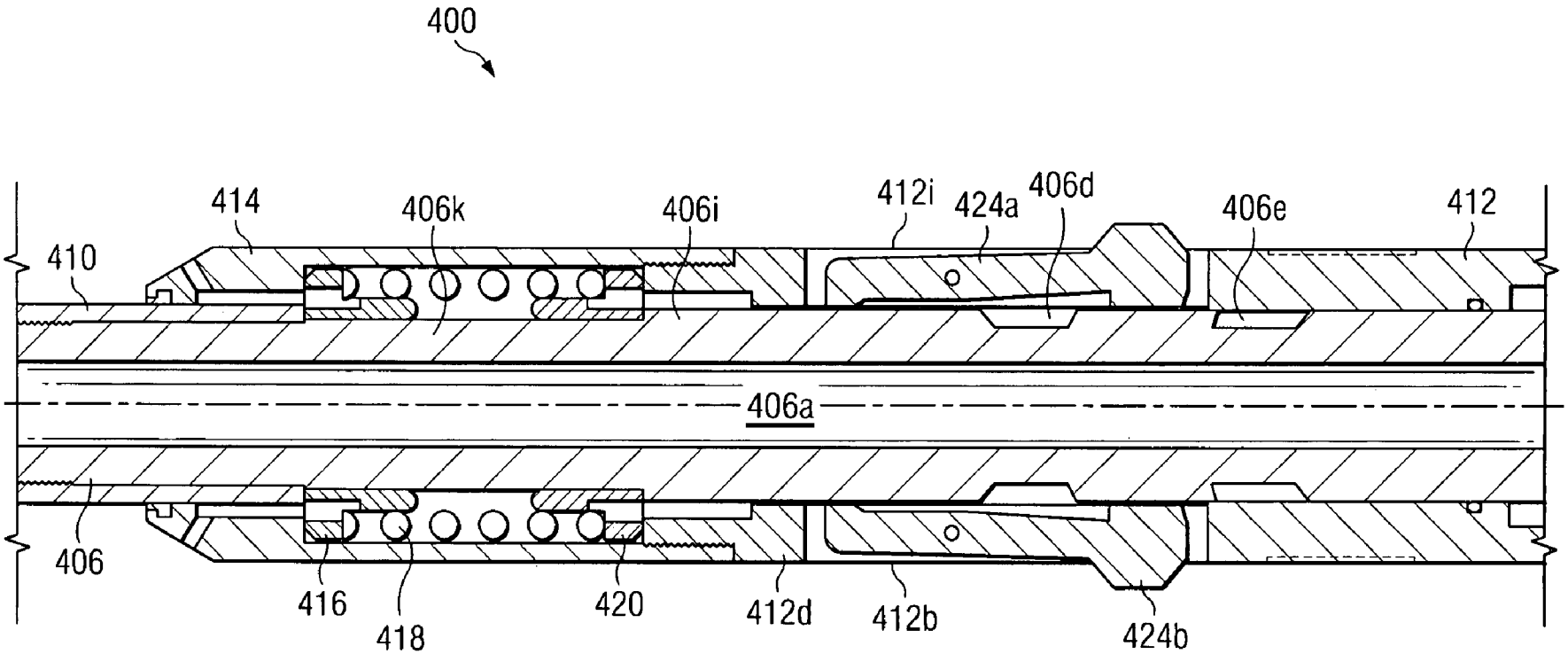
FIG. 25*h* is a fragmentary cross sectional illustration of the design and operation of the casing gripper locking dogs.

In an exemplary embodiment, as illustrated in FIG. 25*h*, prior to the assembly of the apparatus 400, the force of the spring 418 applies a sufficient downward longitudinal force to position the ends of the casing gripper locking dogs, 424*a* and 424*b*, between the outer annular recesses, 406*d* and 406*e*, of the gripper upper mandrel 406 thereby placing the bypass valve body 412 in a neutral position. In an exemplary embodiment, when the apparatus 400 is assembled by inserting the apparatus into the casing 468, the ends of the casing gripper locking dogs, 424*a* and 424*b*, impact the upper end of the casing 468 and are thereby displaced, along with the bypass valve body 412, upwardly relative to the gripper upper mandrel 406 until the ends of the casing gripper locking dogs pivot radially inwardly into engagement with the outer annular recess 406*d* of the gripper upper mandrel. In this manner, the bypass valve body 412 is positioned in an inactive position, as illustrated in FIG. 24*a*, that fluidicly decouples the casing gripper hydraulic ports, 406*f* and 406*h*. The upward displacement of the bypass valve body 412 relative to the gripper upper mandrel 406 further compresses the spring 418. The bypass valve body 412 is then maintained in the inactive position due to the placement of the casing gripper locking dogs, 424*a* and 424*b*, within the casing 468 thereby preventing the ends of the casing gripper locking dogs from pivoting radially outward out of engagement with the outer annular recess 406*d*.

Referring to FIGS. 26*a*-26*k*, when the apparatus 400 is positioned at a desired predetermined position within the wellbore 700, a fluidic material 702 is injected into the apparatus through the passages 402*a*, 404*a*, 406*a*, 454*a*, 450*a*, 456*a*, 458*a*, 476*a*, 478*a*, 484*a*, 522*a*, 529*a*, 534*a*, 544*a*, 554*a*, 566*a*, 588*a*, 622*c*, 610*a*, 626*a*, 644*a*, and 646*a* and out of the apparatus through the float valve 654*a*. In this manner the proper operation of the passages 402*a*, 404*a*, 406*a*, 454*a*, 450*a*, 456*a*, 458*a*, 476*a*, 478*a*, 484*a*, 522*a*, 529*a*, 534*a*, 544*a*, 554*a*, 566*a*, 588*a*, 622*c*, 610*a*, 626*a*, and 646*a* and the float valve 654*a* may be tested. A dart 704 is then injected into the apparatus with the fluidic material 702 through the passages 402*a*, 404*a*, 406*a*, 454*a*, 450*a*, 456*a*, 458*a*, 476*a*, 478*a*, 484*a*, 522*a*, 529*a*, 534*a*, 544*a*, 554*a*, 566*a*, 588*a*, 622*c*, 610*a*, 626*a*, and 644*a* until the dart is positioned and seated in the passage 646*a* of the lower mandrel 646. As a result of the positioning of the dart 704 in the passage 646*a* of the lower mandrel 646, the passage of the lower mandrel is thereby closed.

The fluidic material 702 is then injected into the apparatus thereby increasing the operating pressure within the passages 402*a* , 404*a* , 406*a*, 454*a*, 450*a*, 456*a*, 458*a*, 476*a*, 478*a*, 484*a*, 522*a*, 529*a*, 534*a*, 544*a*, 554*a*, 566*a*, 588*a*, 622*c*, 610*a*, 626*a*, and 644*a*. Furthermore, the continued injection of the fluidic material 702 into the apparatus 400 also causes the fluidic material 702 to pass through the radial passages, 526*b* and 526*c*, 530*b* and 530*c*, and 536*b* and 536*c*, of the piston 526, 530, and 536, respectively, into an annular pressure chamber 706 defined between the actuator barrel 492 and the connector tube 529, an annular pressure chamber 708 defined between the actuator barrel 502 and the connector tube 534, and an annular pressure chamber 710 defined between the actuator barrel 512 and the connector tube 544.

The pressurization of the annular pressure chambers, 706, 708, and 710 then cause the pistons 526, 530, and 536 to be displaced upwardly relative to the casing 470. As a result, the connector tube 529, the connector tube 534, the connector tube 544, the threaded bushing 550, the lock nut 552, the tool joint adaptor 554, the sealing sleeve 558, the tool joint adaptor 560, the torsion plate 562, the upper bushing 564, the cup mandrel 566, the thimble 568, the inner thimble 570, the packer cup 572, the backup ring 574, the spacer 576, the thimble 578, the inner thimble 580, the packer cup 582, the backup ring 584, the spacer 586, and the cone mandrel 588 are displaced upwardly relative to the casing 470, the shear pin bushing 590, the locking ring 594, the upper cone retainer 596, the upper cam 598, and the upper cone segments 600.

Figure 26A:
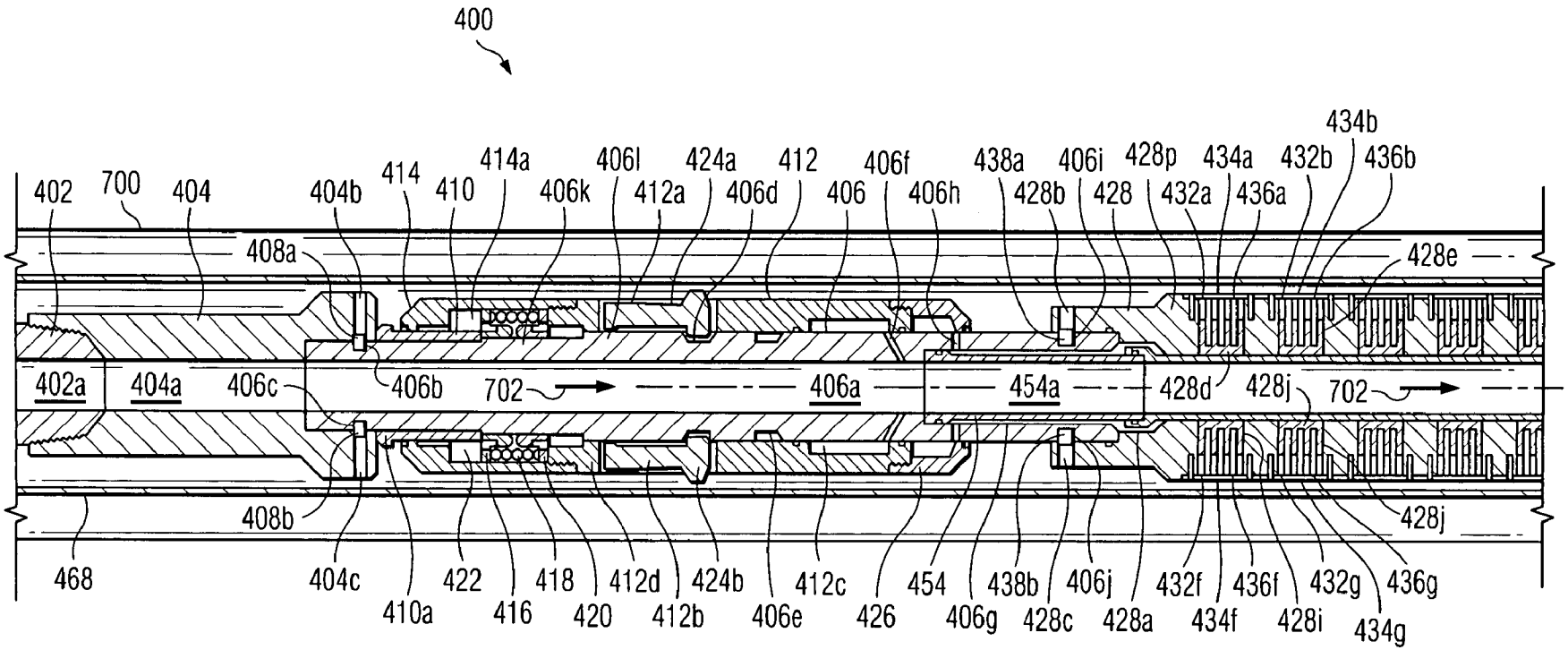
FIGS. 26*a*-26*k* are fragmentary cross sectional illustrations of the apparatus of FIGS. 24*a*-24*k* after expanding the expansion cone assembly.
Figure 26B:
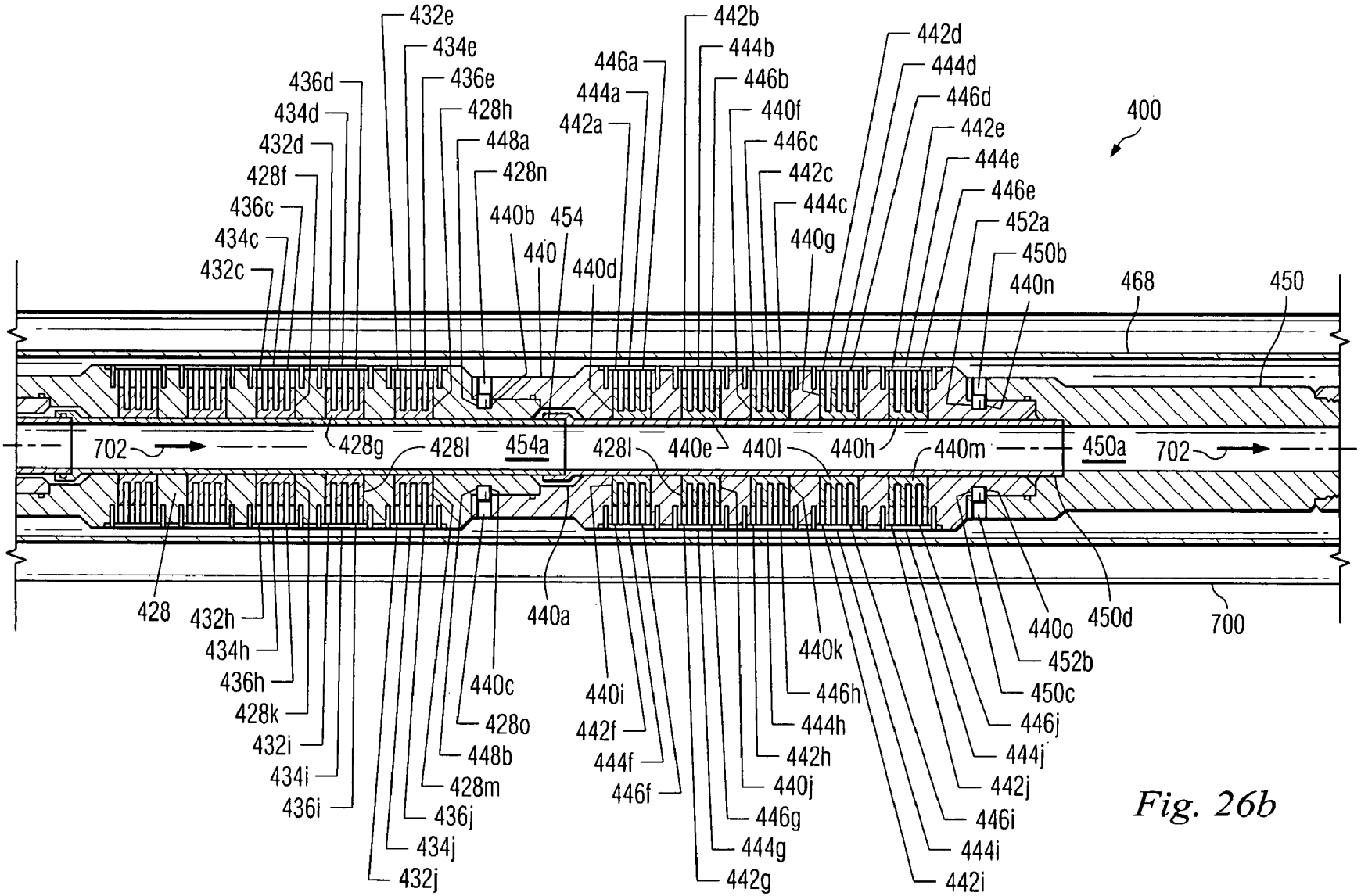
Figure 26C:
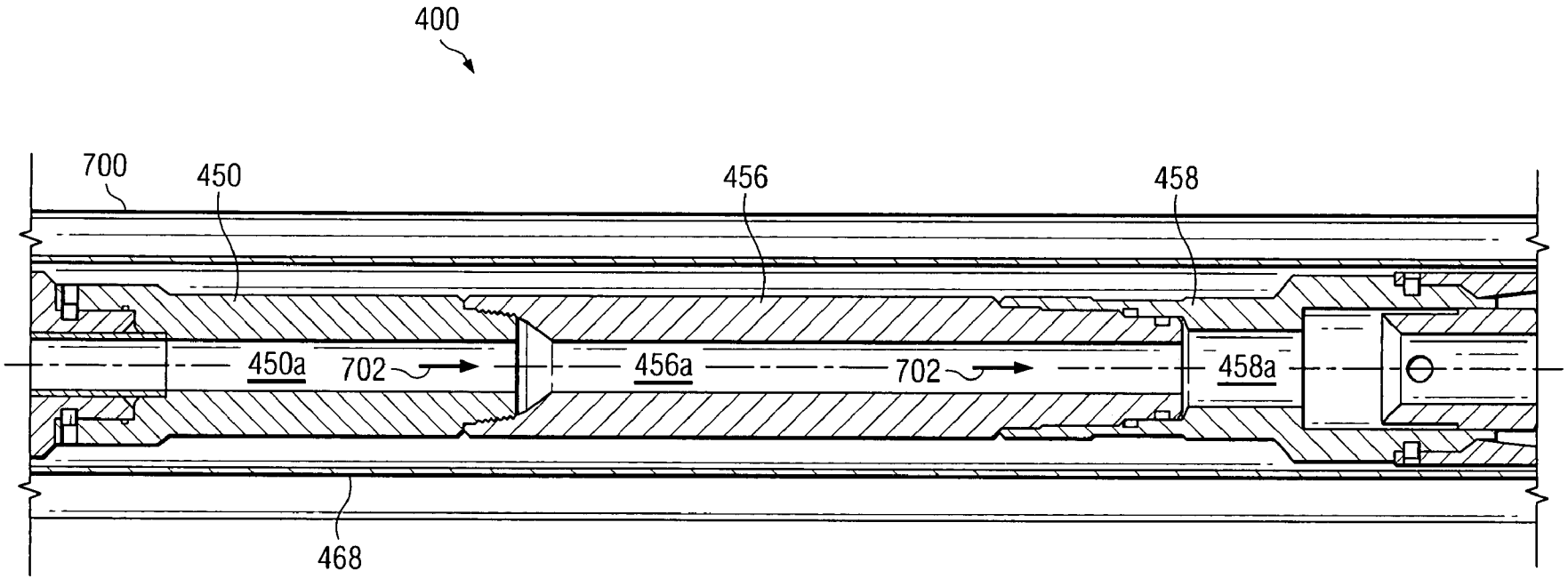
Figure 26D:
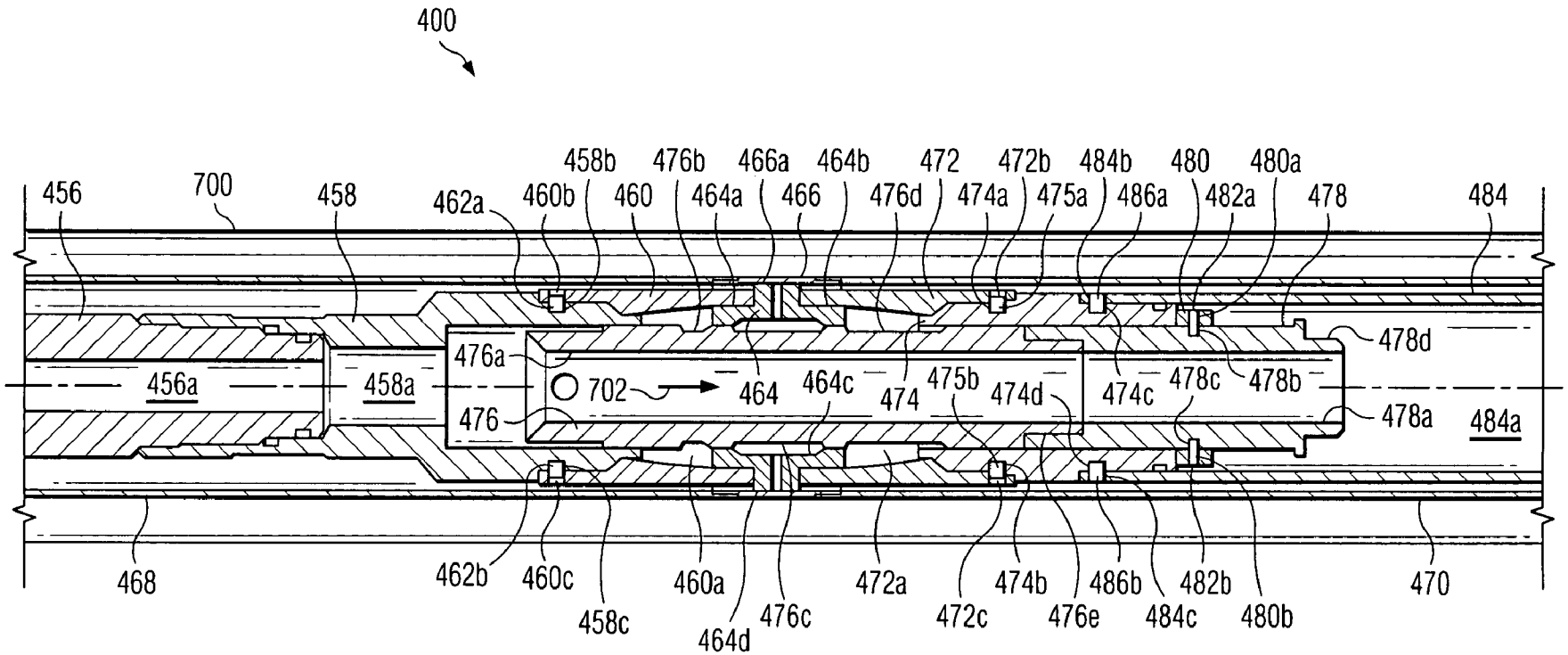
Figure 26E:
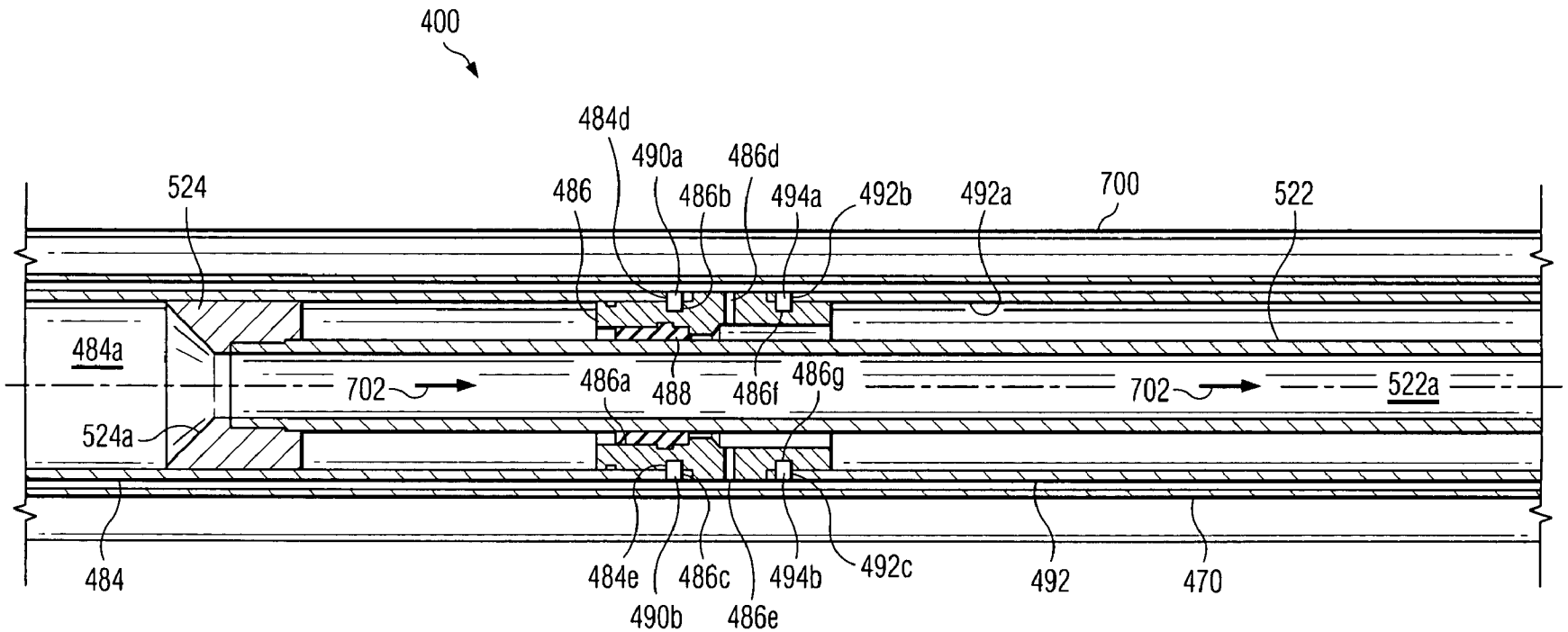
Figure 26F:
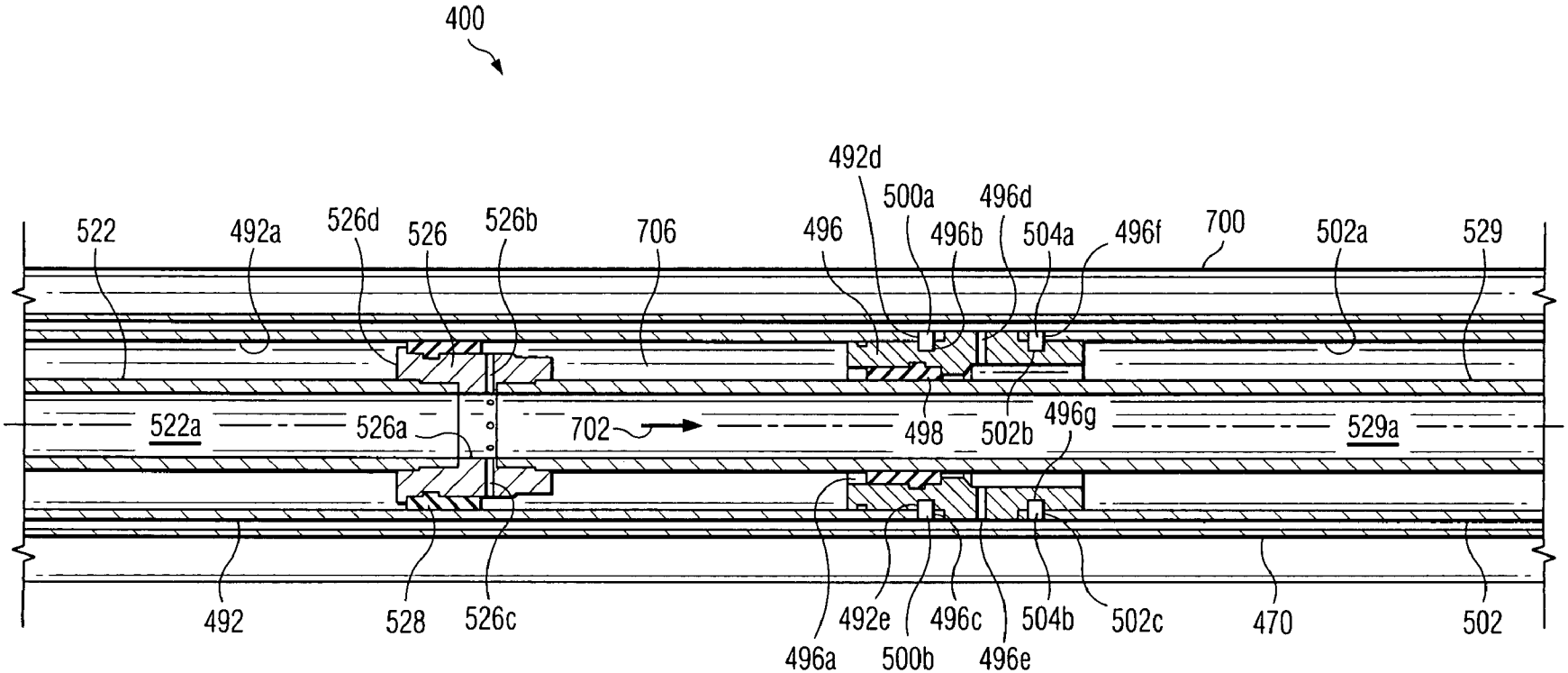
Figure 26G:
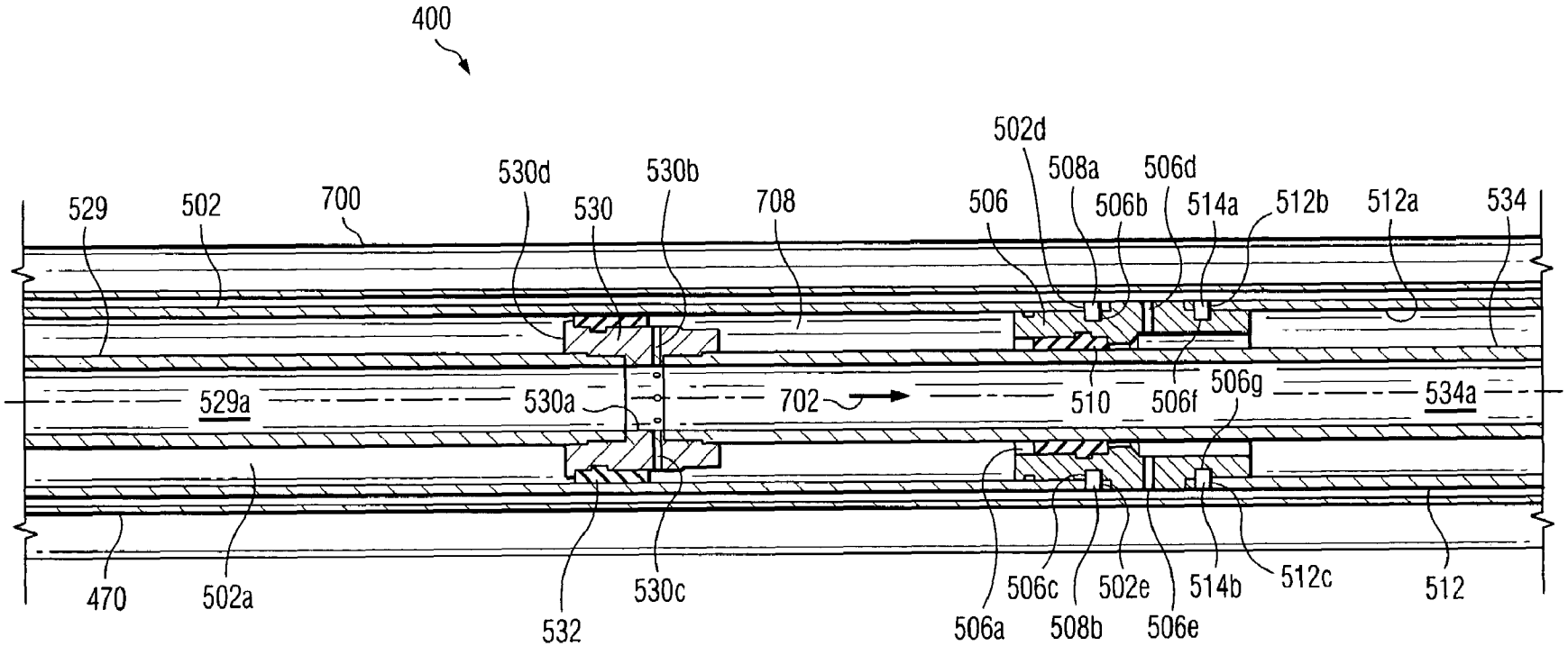
Figure 26H:
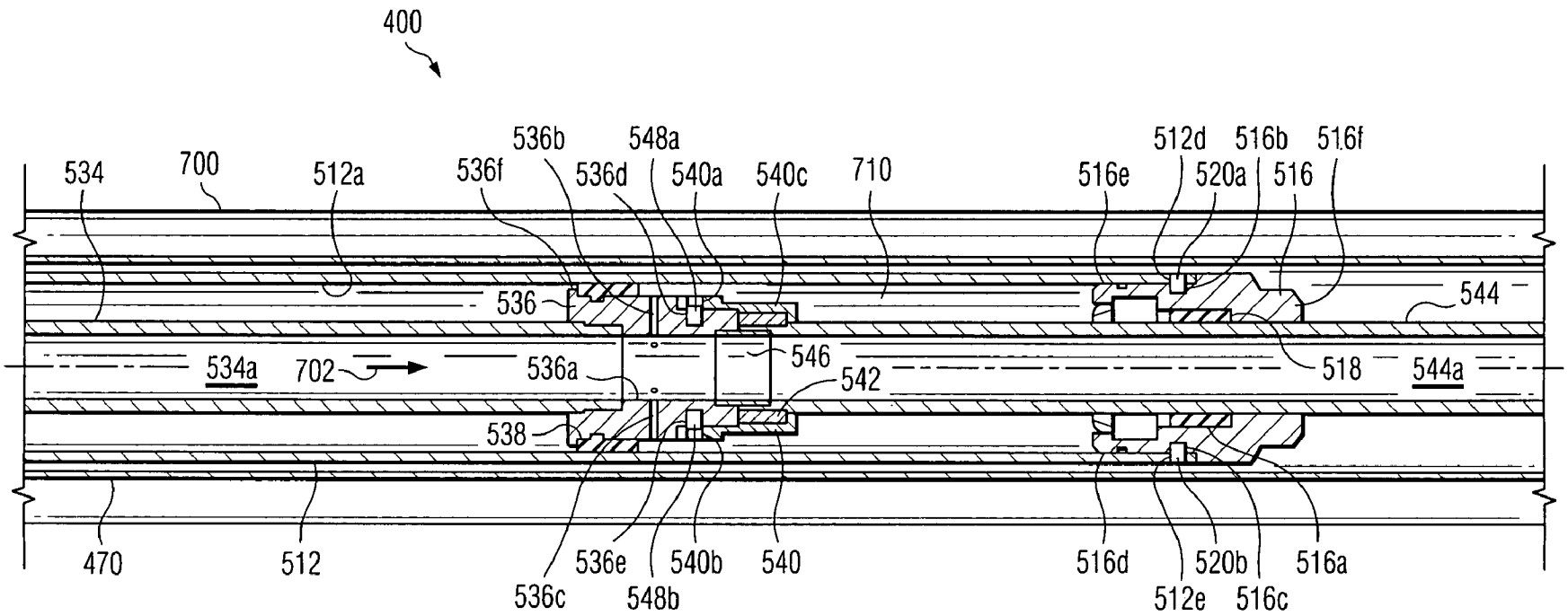
Figure 26I:
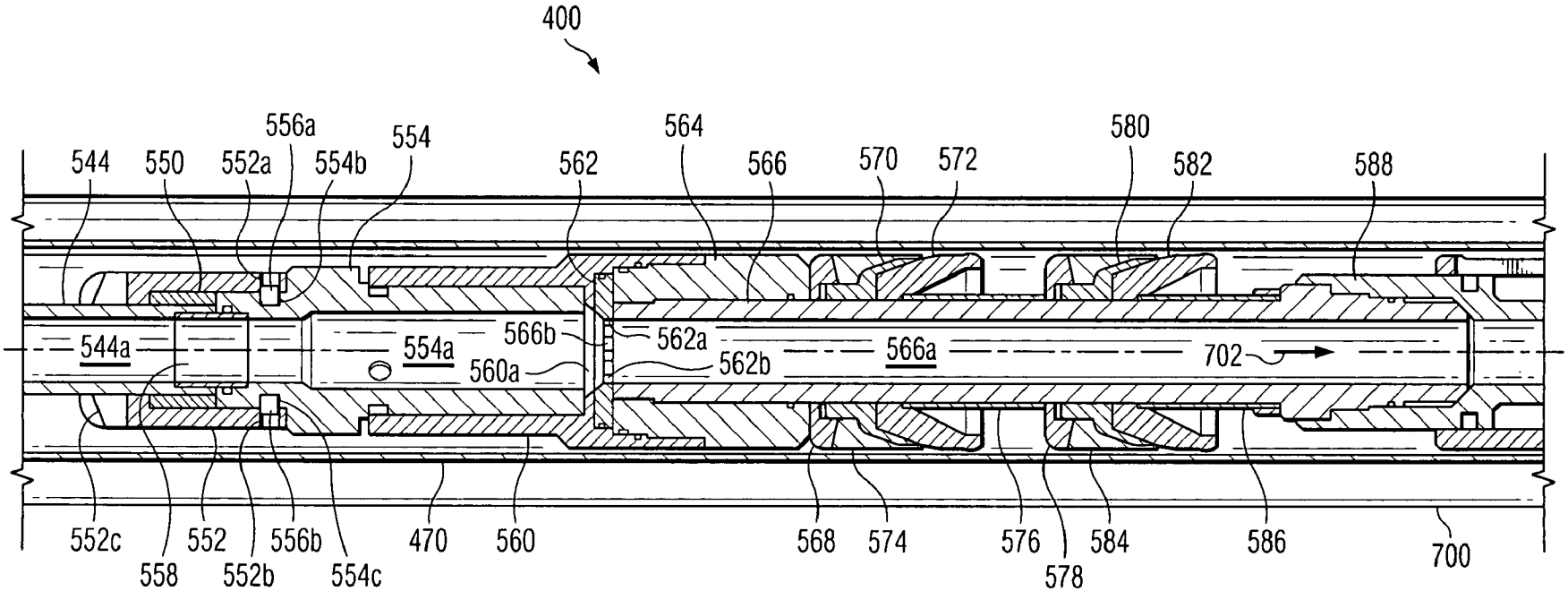
Figure 26J:
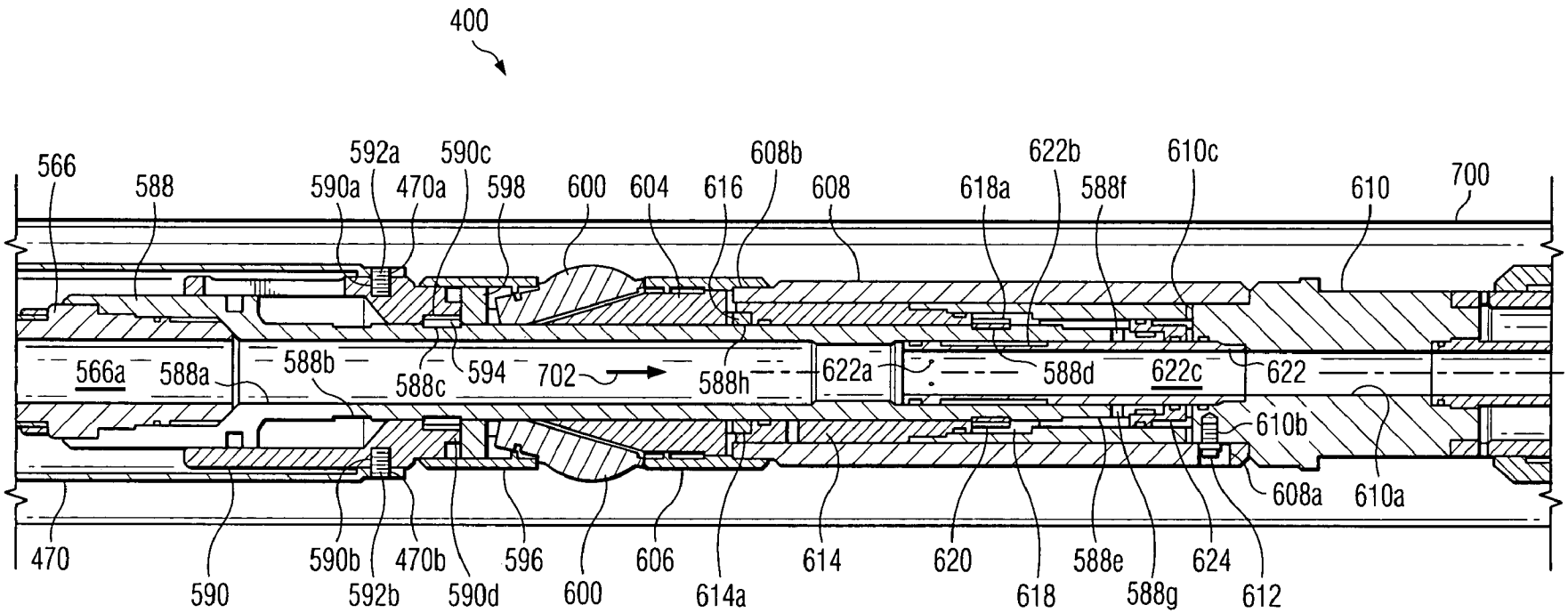
Figure 26K:
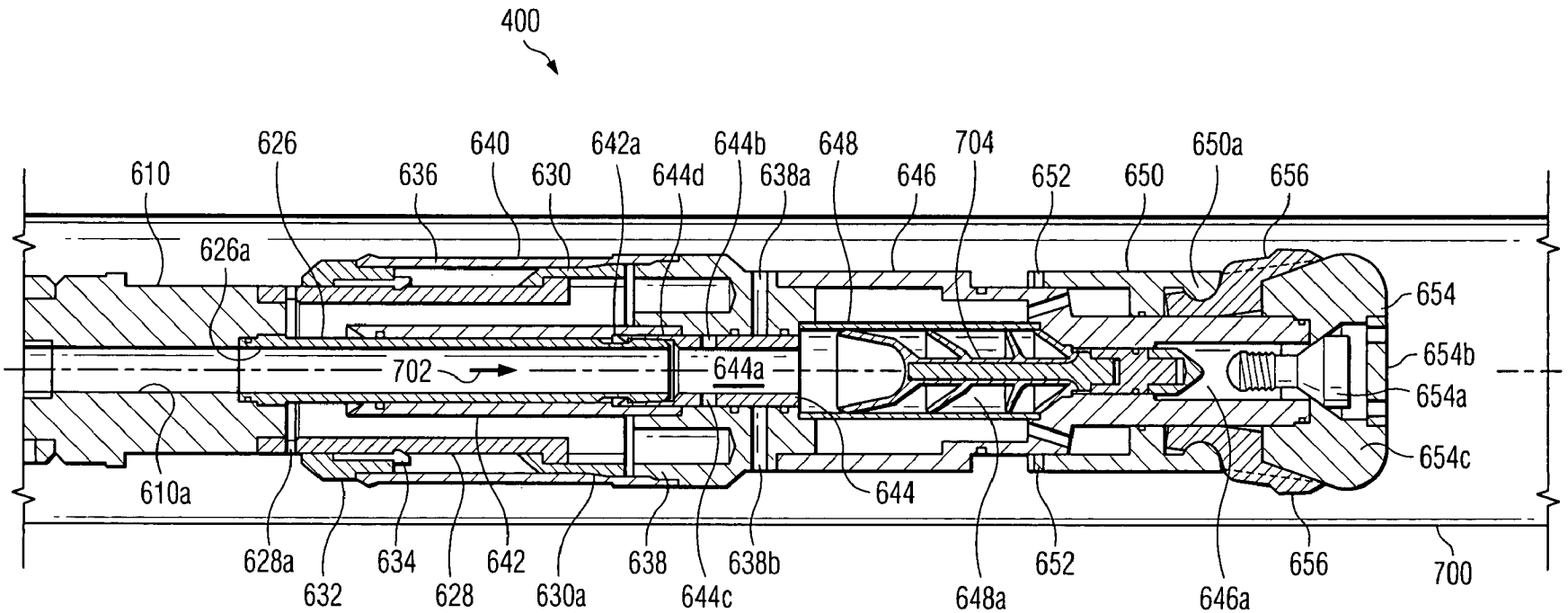
Figure 27B:
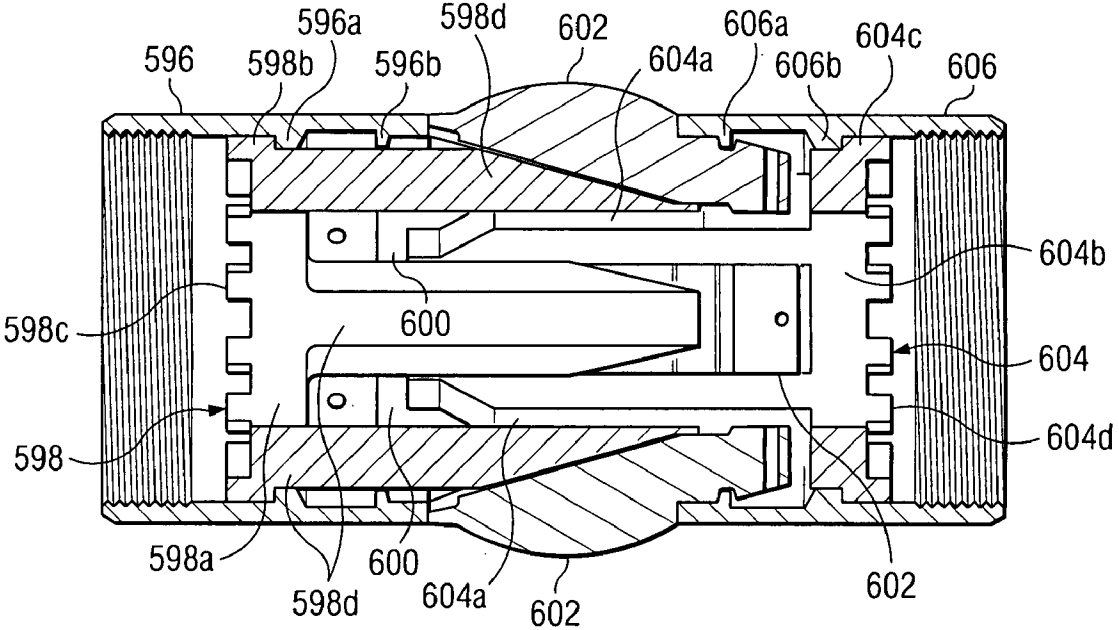
FIGS. 27*a*-27*b* are a fragmentary cross sectional and perspective illustrations of the expansion cone assembly of the apparatus of FIGS. 26*a*-26*k*.
Figure 27A:
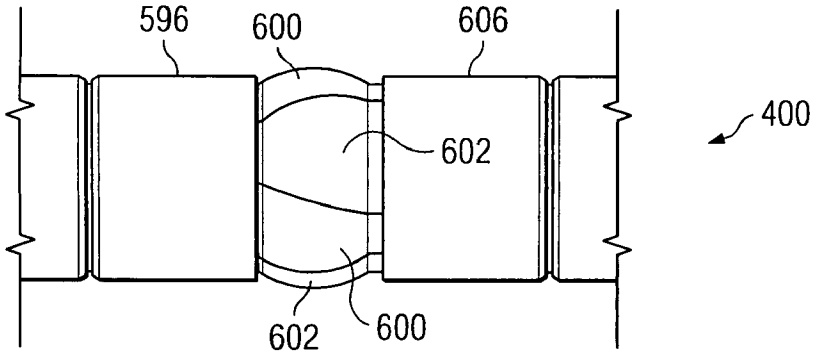
Figure 28A:
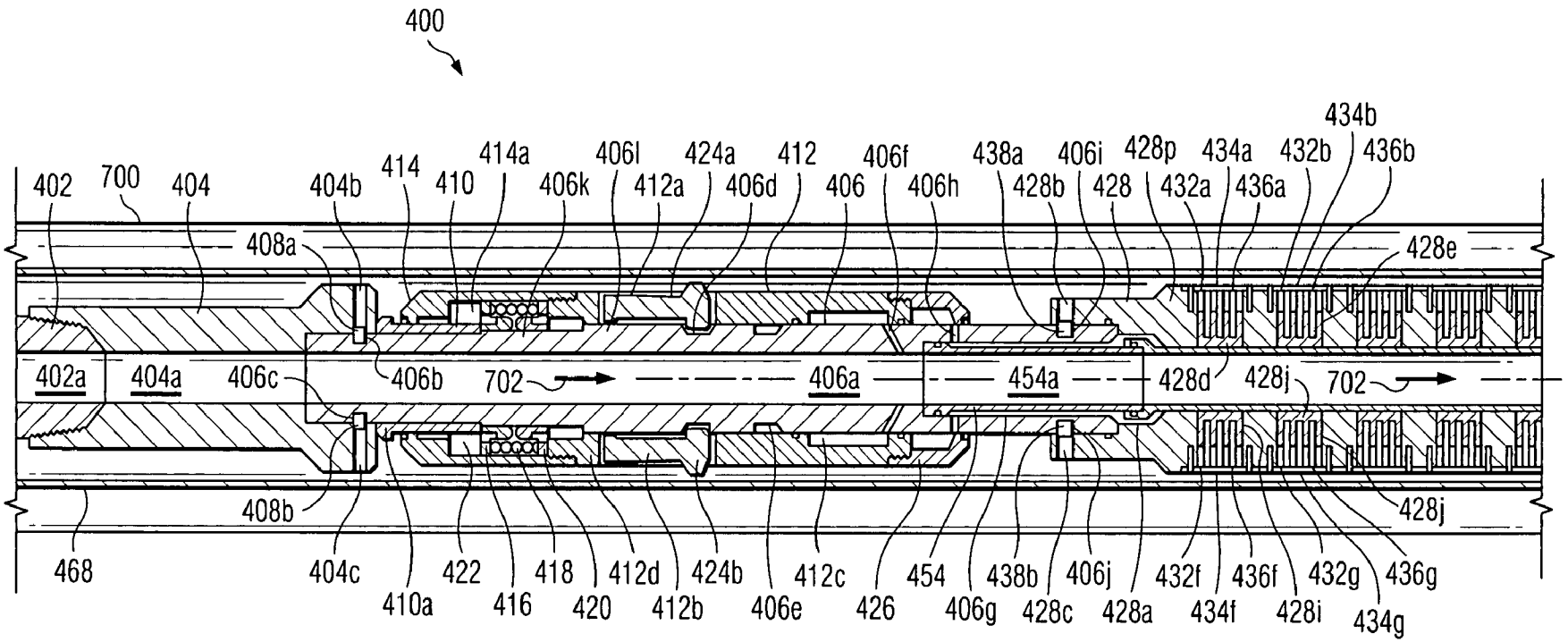
FIGS. 28*a*-28*j* are fragmentary cross sectional illustrations of the apparatus of FIGS. 26*a*-26*k* during the upward displacement of the expansion cone assembly by the actuators to radially expand and plastically deform a portion of the casing.
Figure 28B:
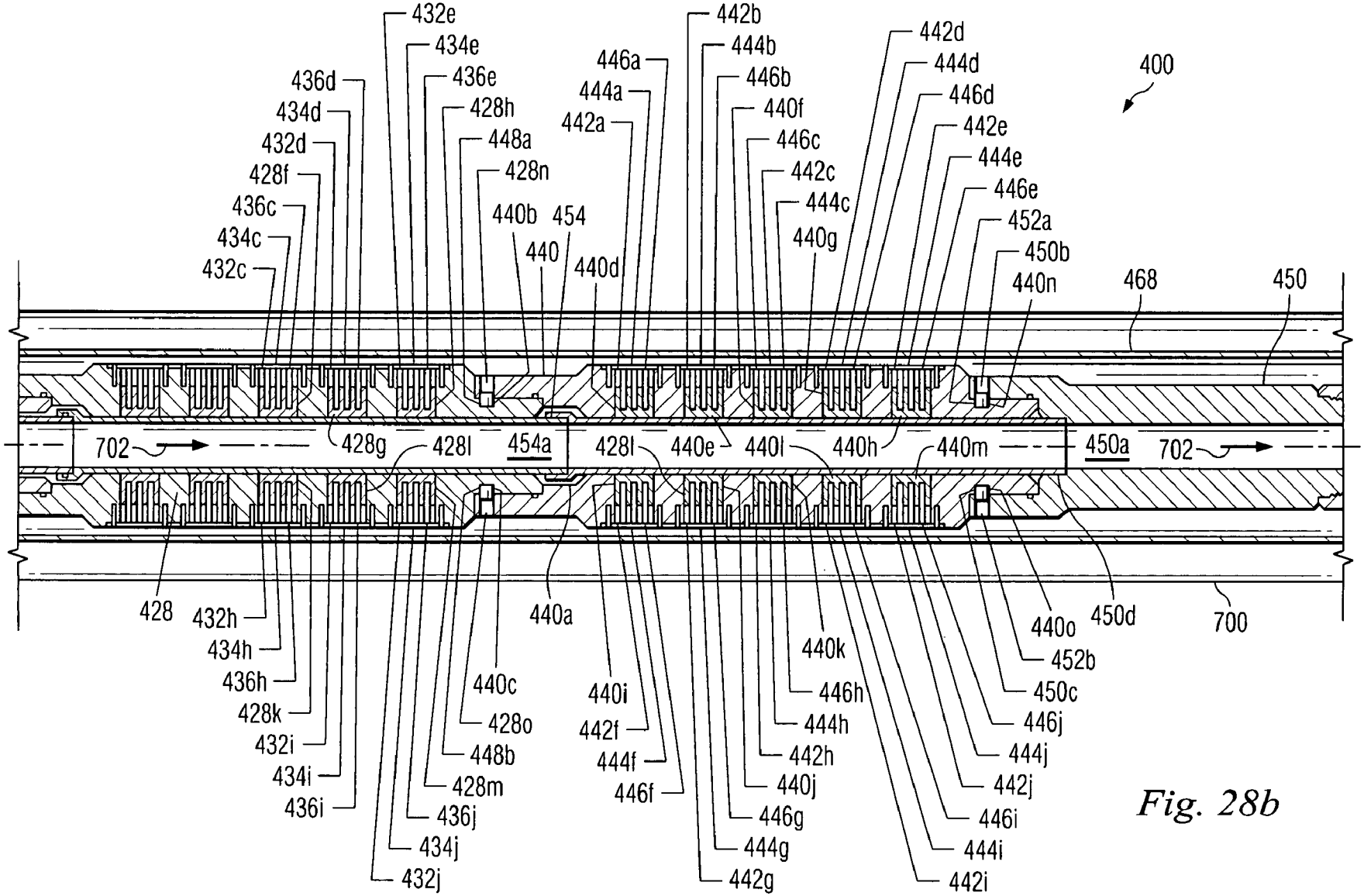
Figure 28C:
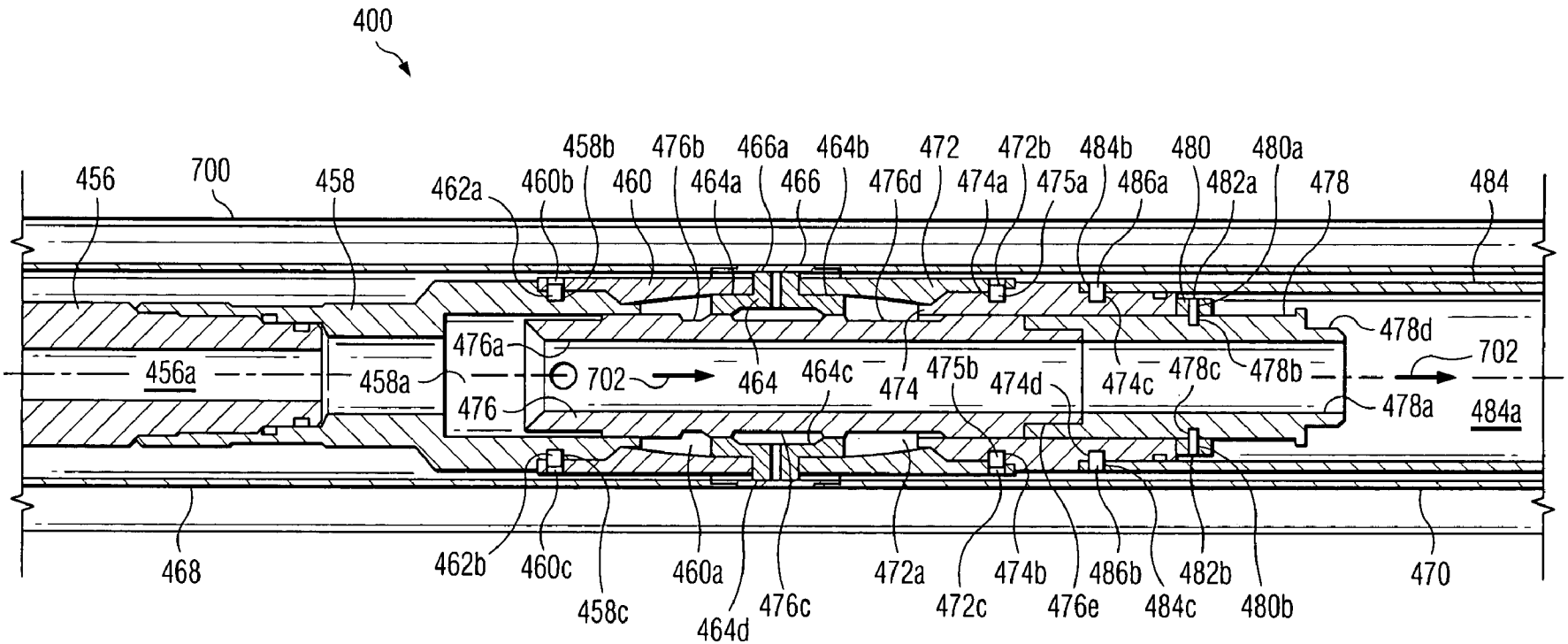
Figure 28D:
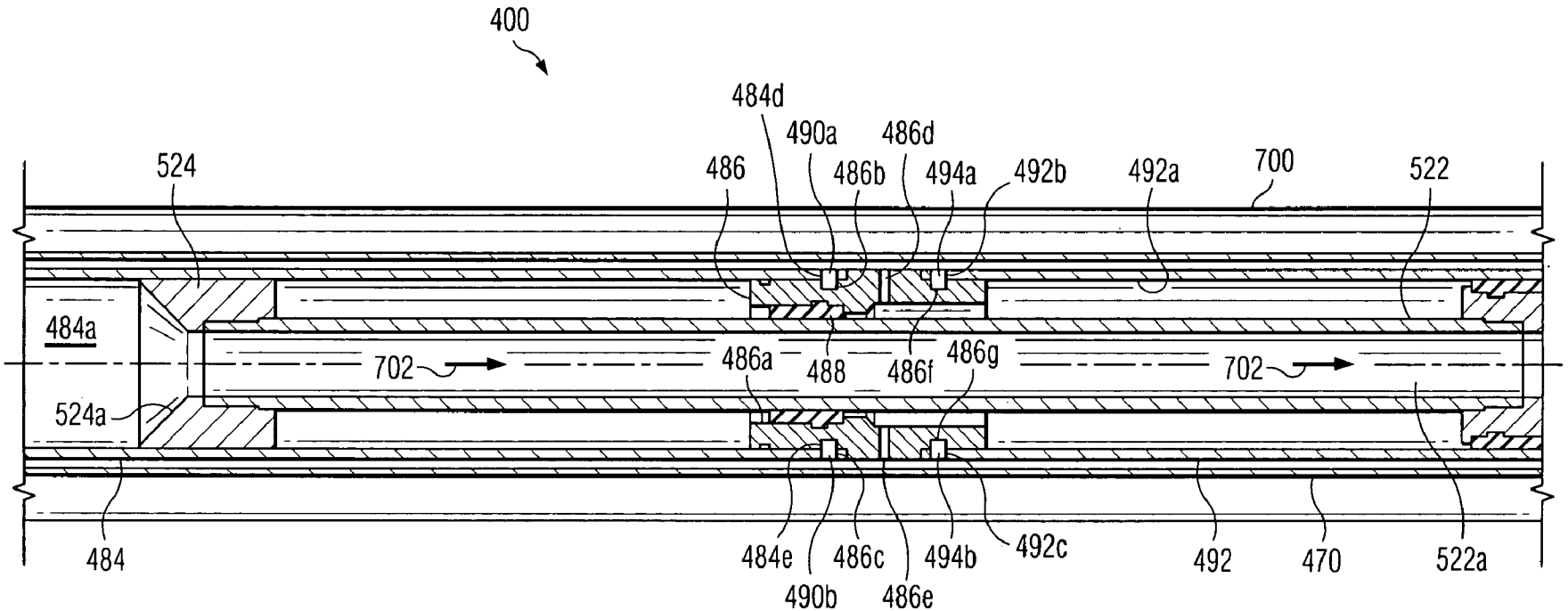
Figure 28E:
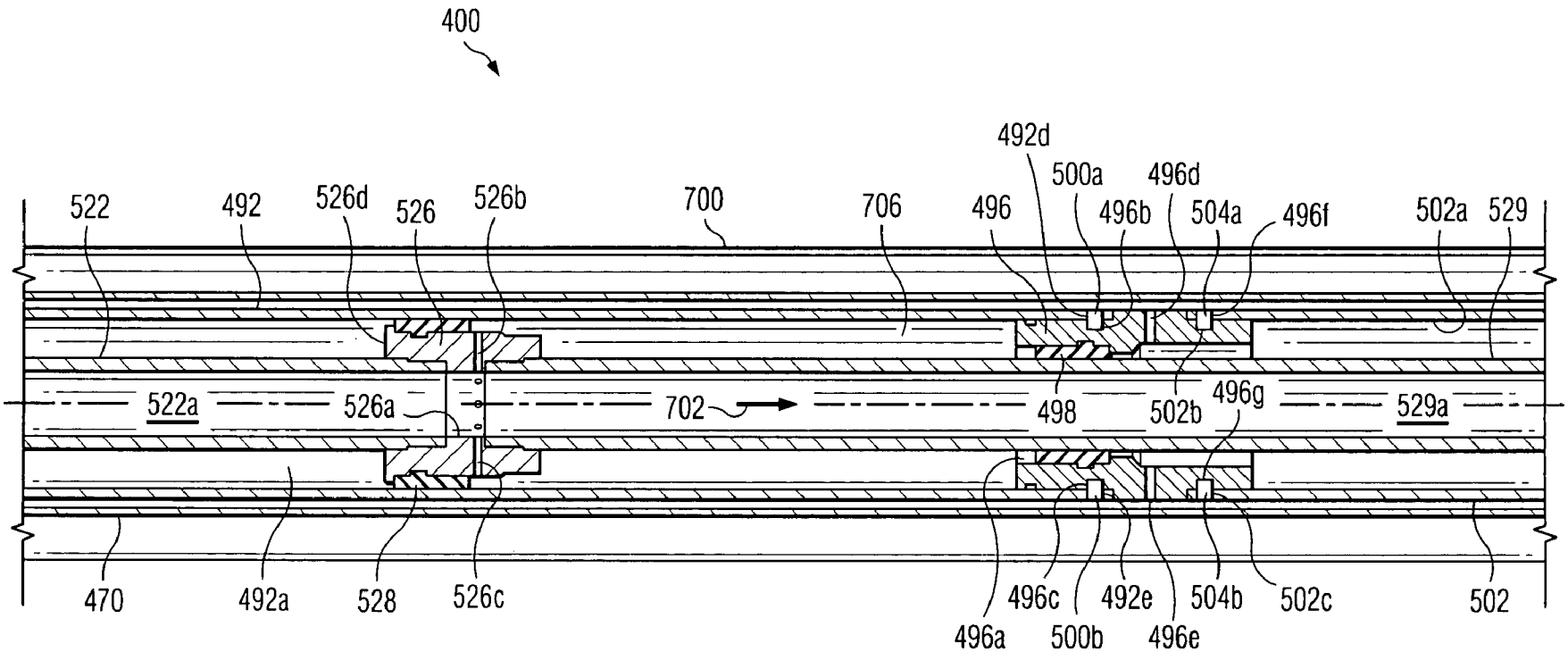
Figure 28F:
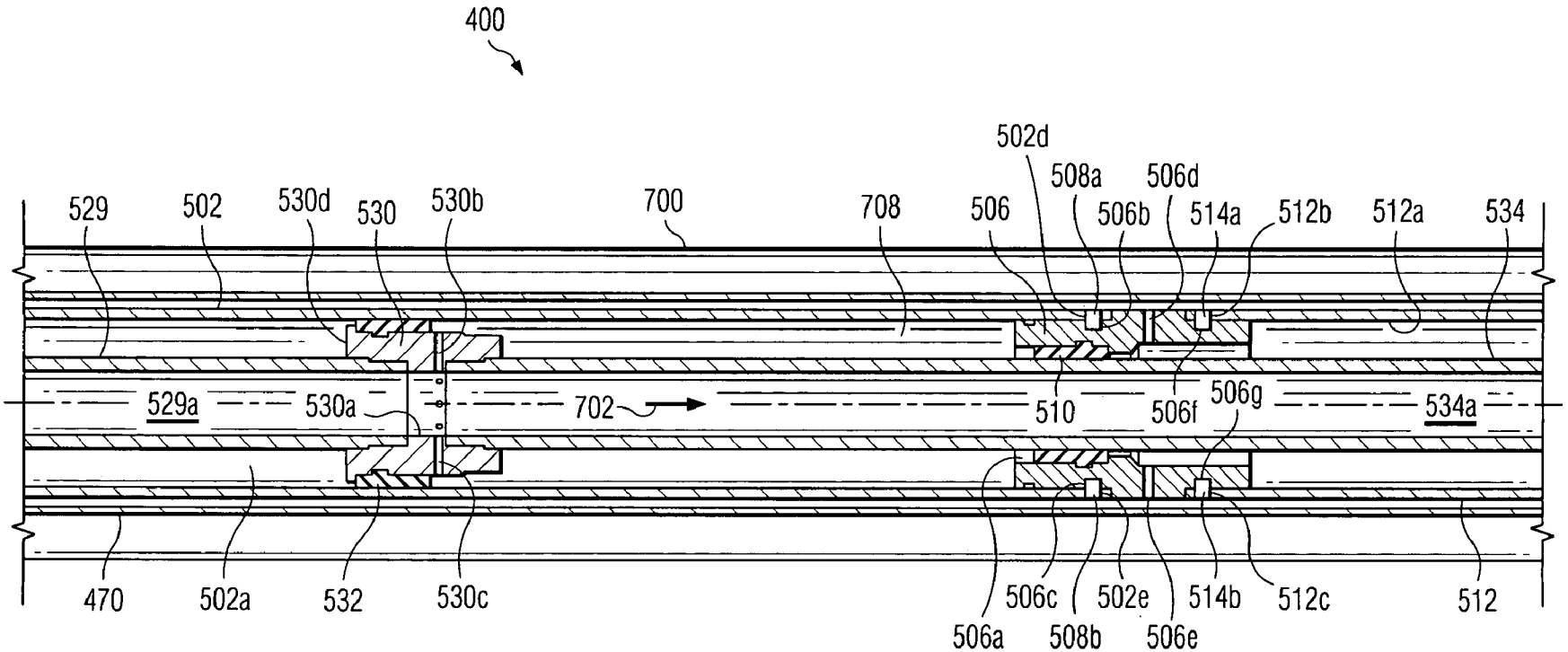
Figure 28G:
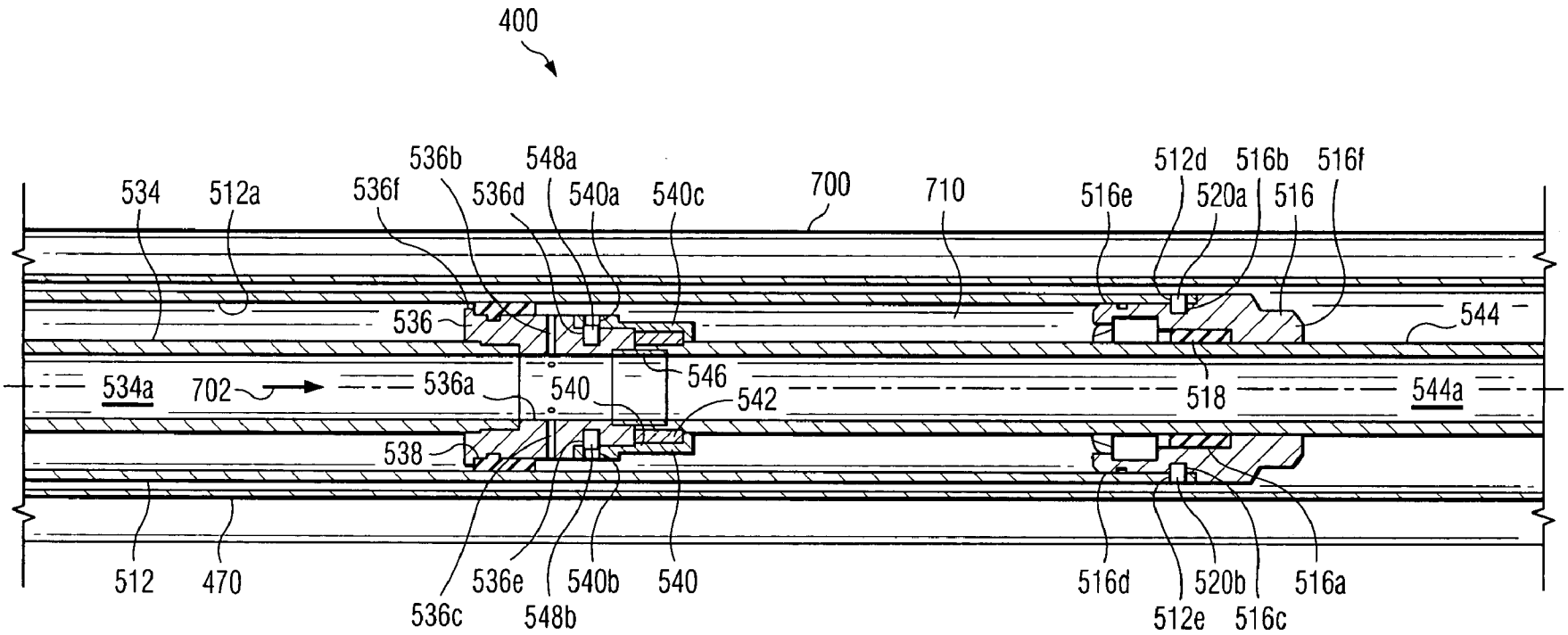
Figure 28H:
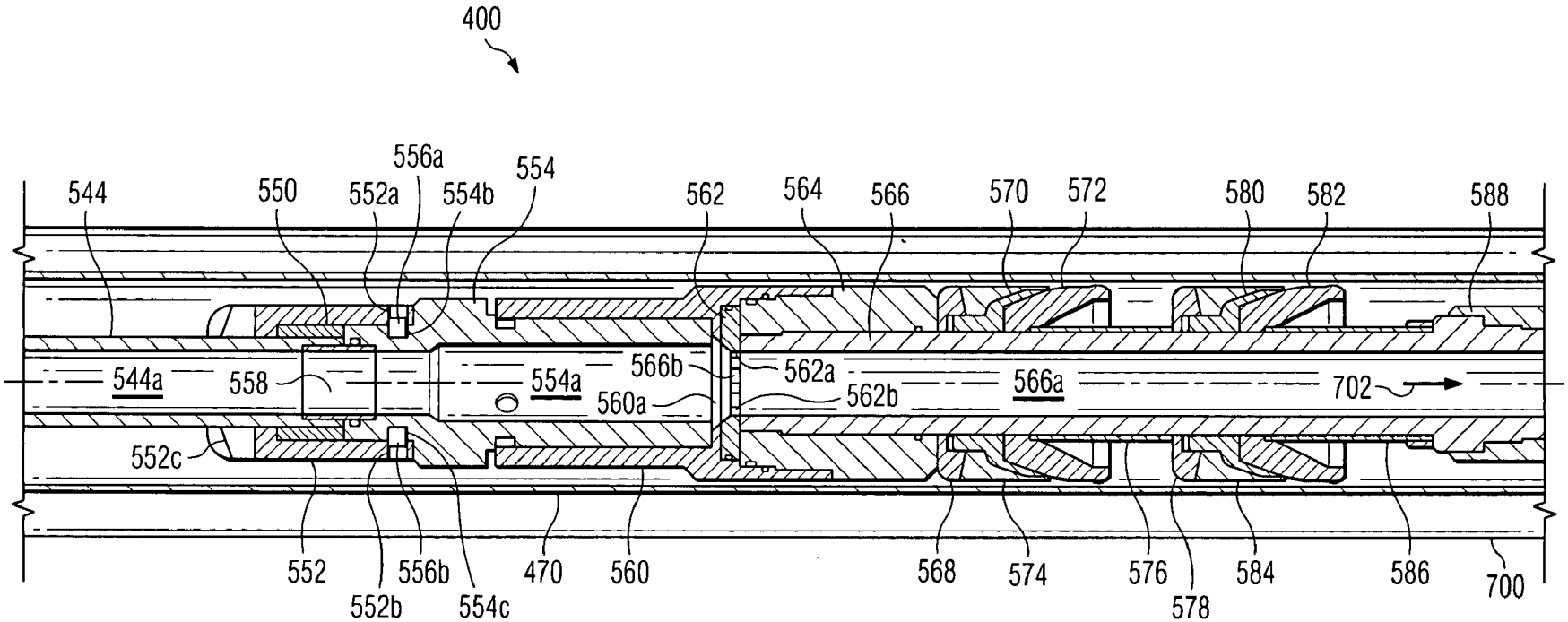
Figure 28I:
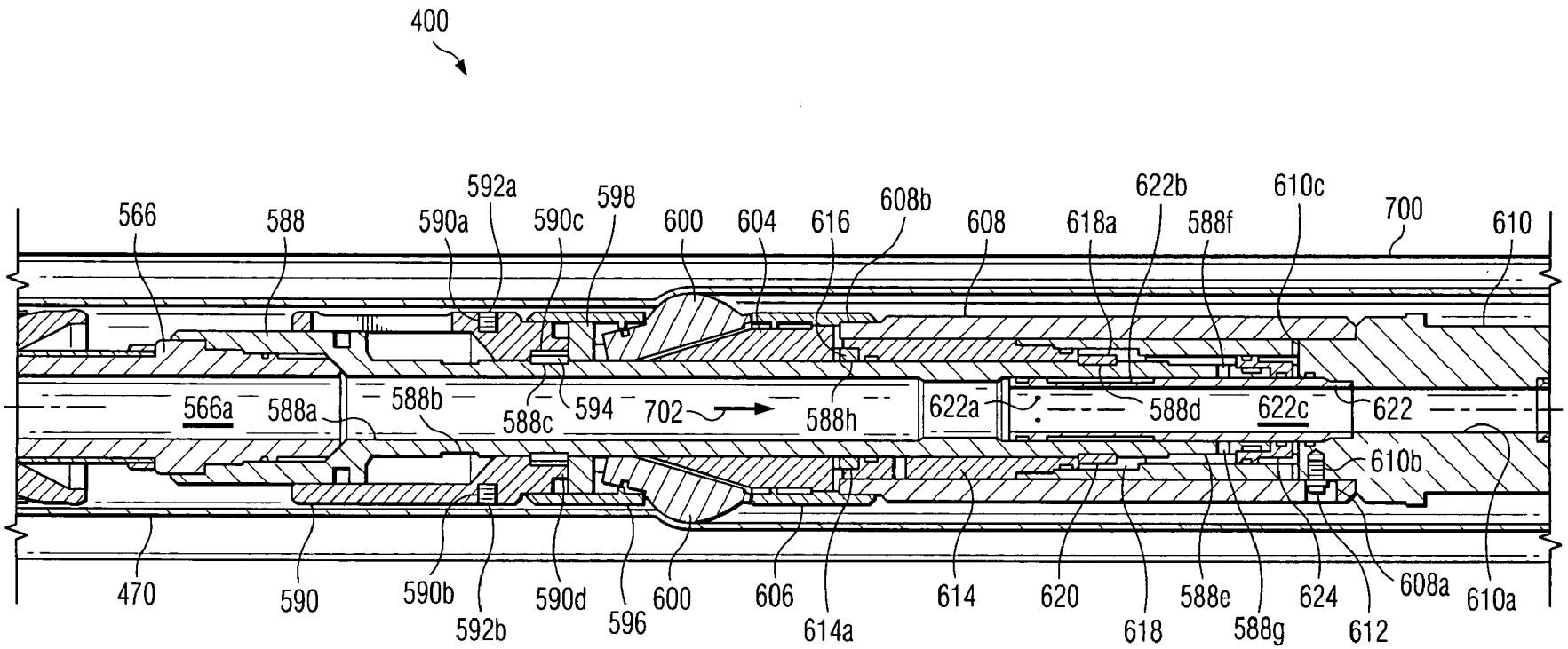
Figure 28J:
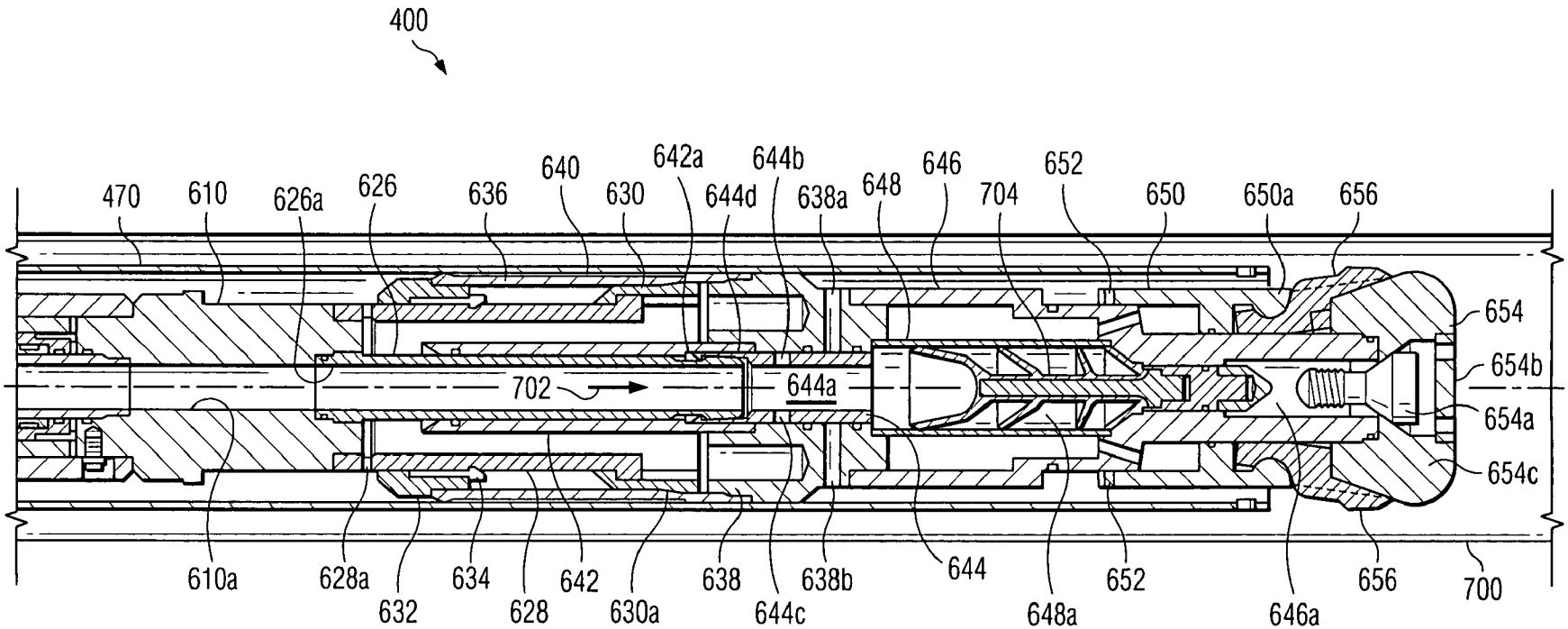
Figure 29A:
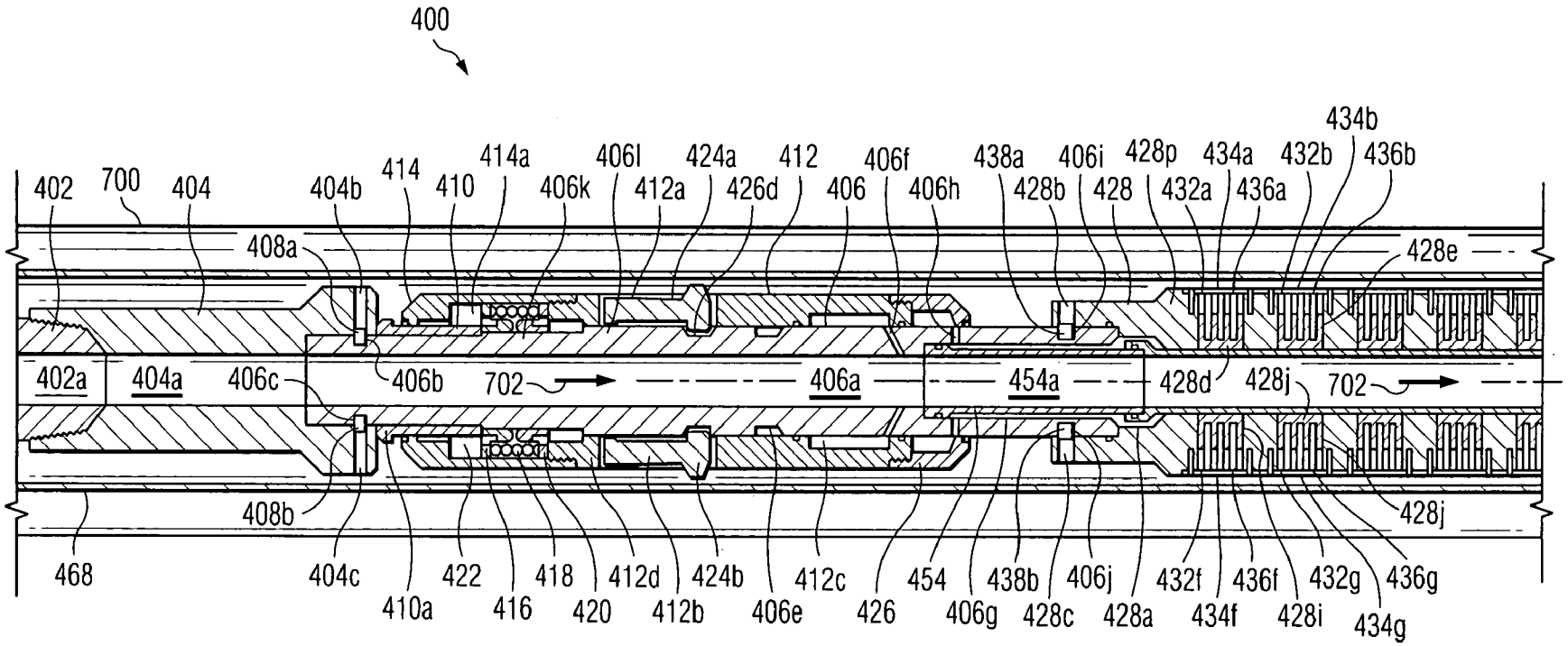
FIGS. 29*a*-29*m* are fragmentary cross sectional illustrations of the apparatus of FIGS. 28*a*-28*j* after the collapse of the expansion cone assembly.
Figure 29B:
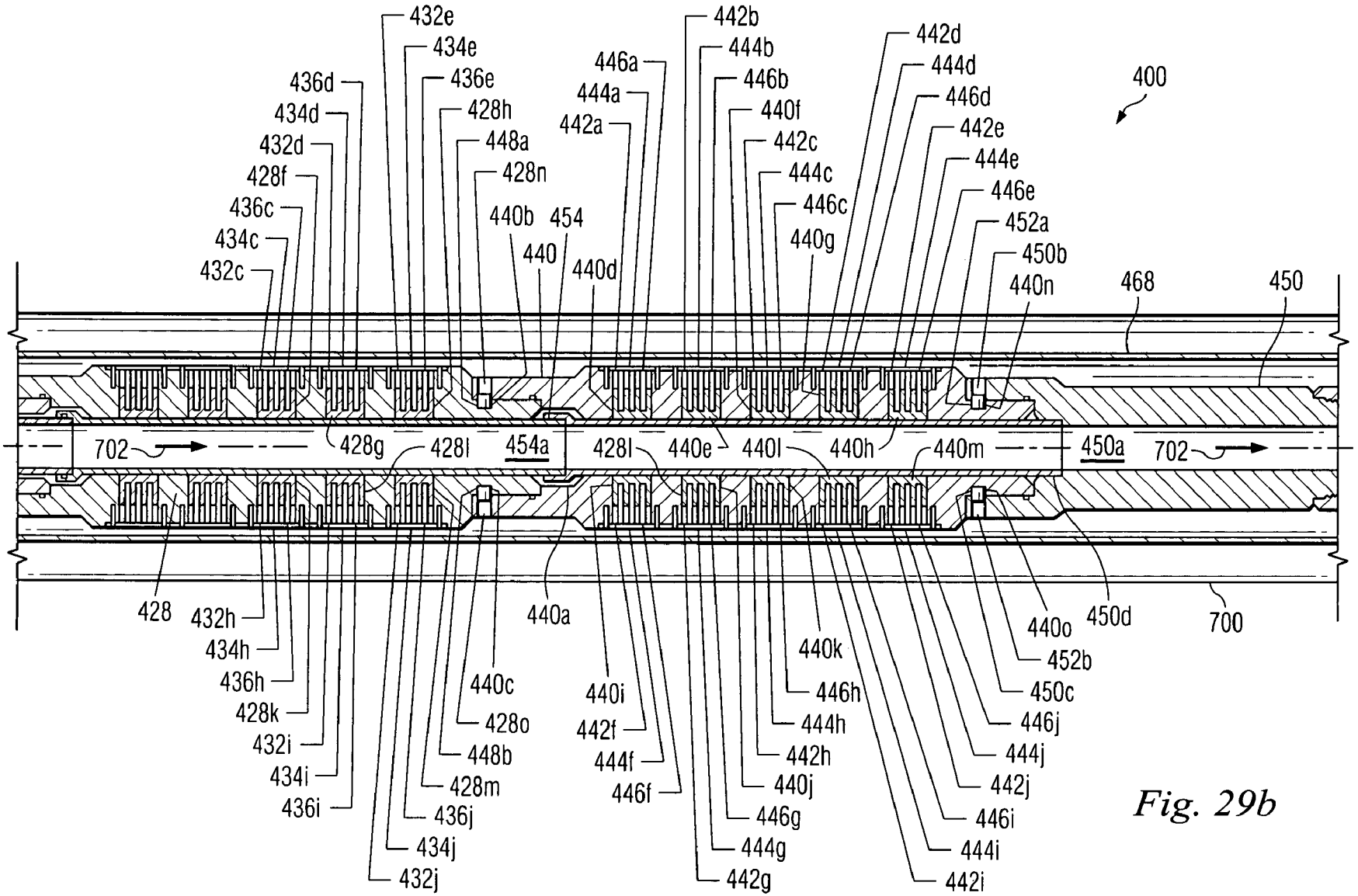
Figure 29C:
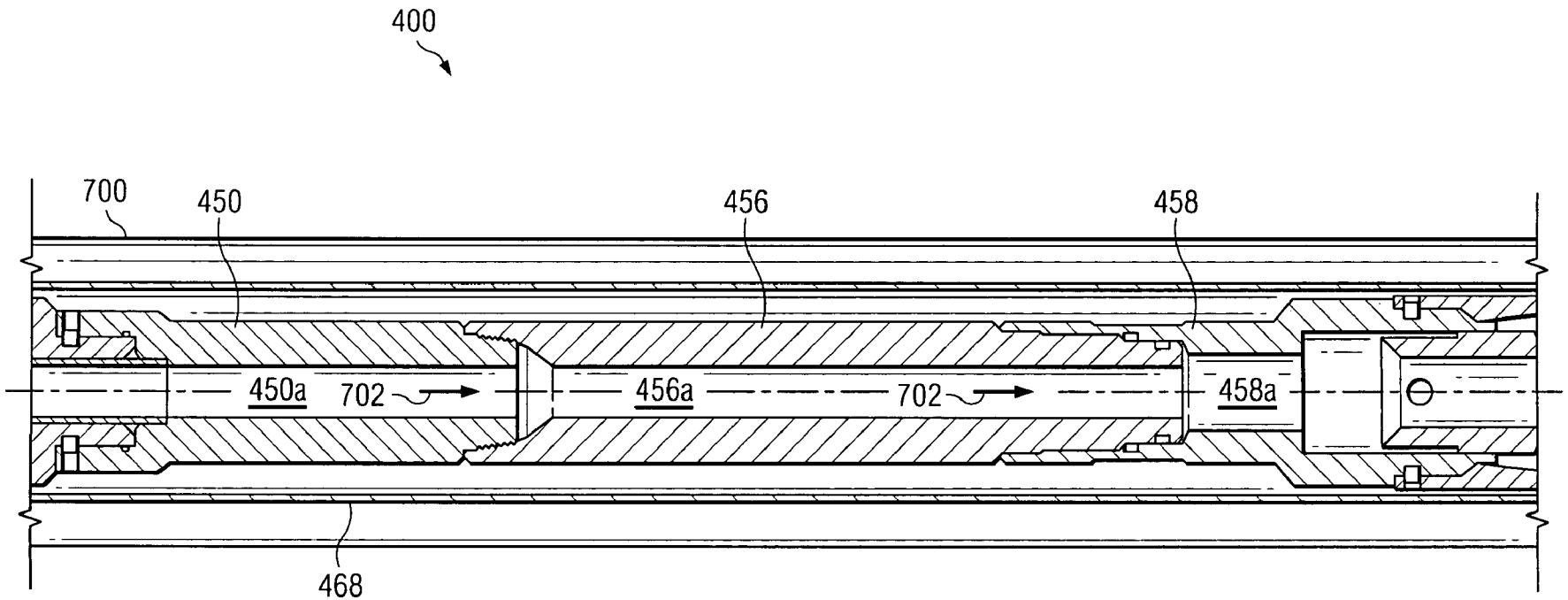
Figure 29D:
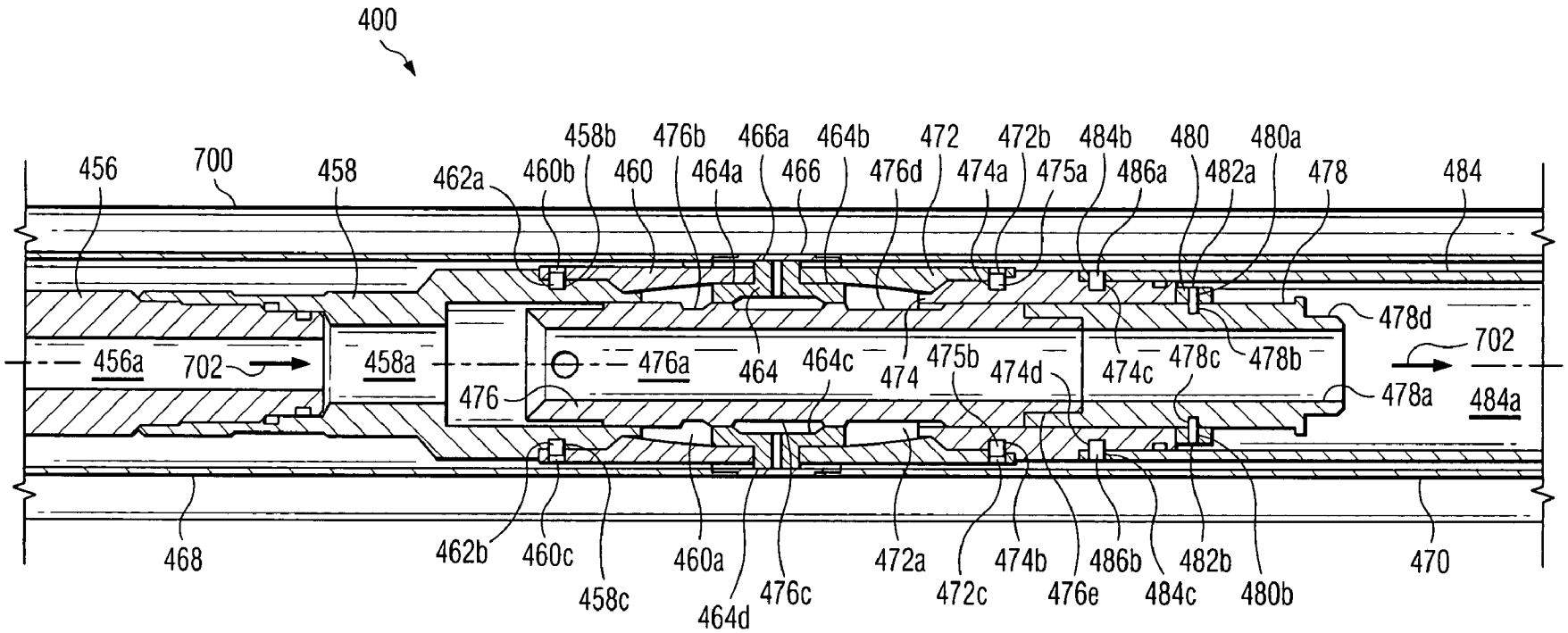
Figure 29E:
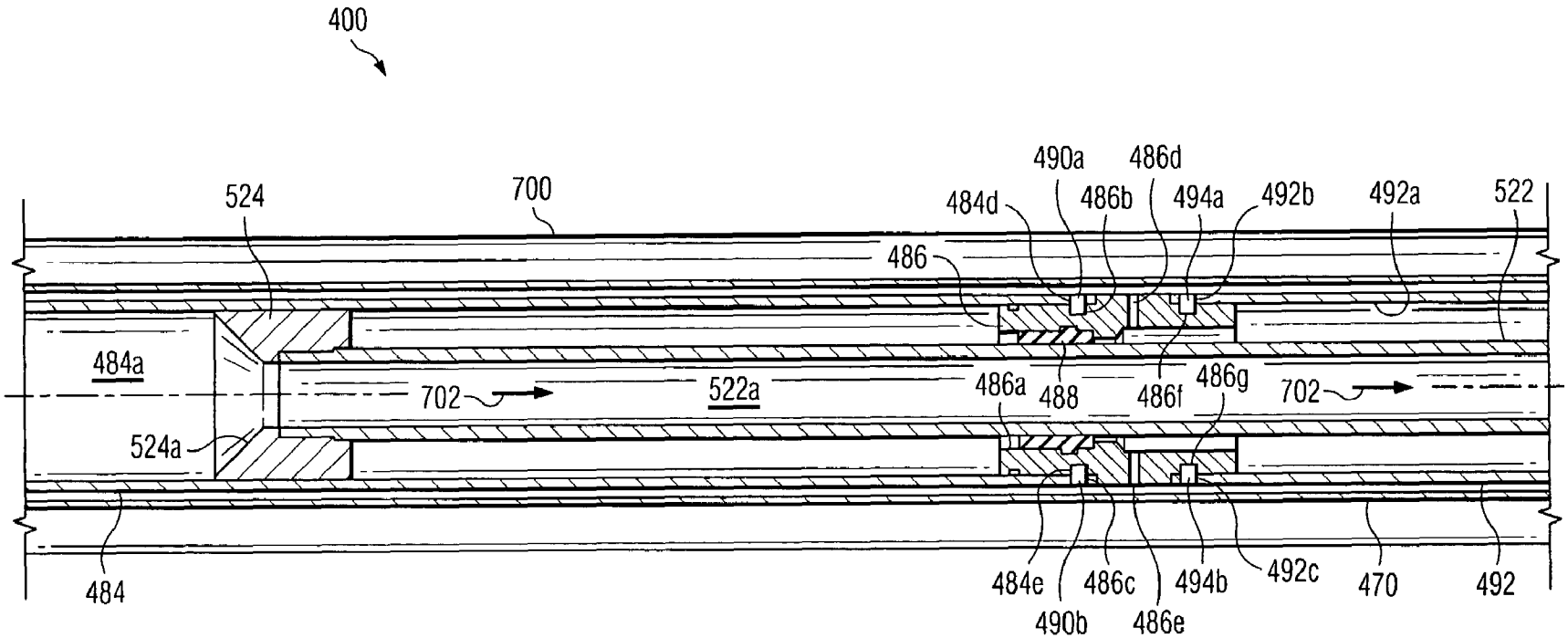
Figure 29F:
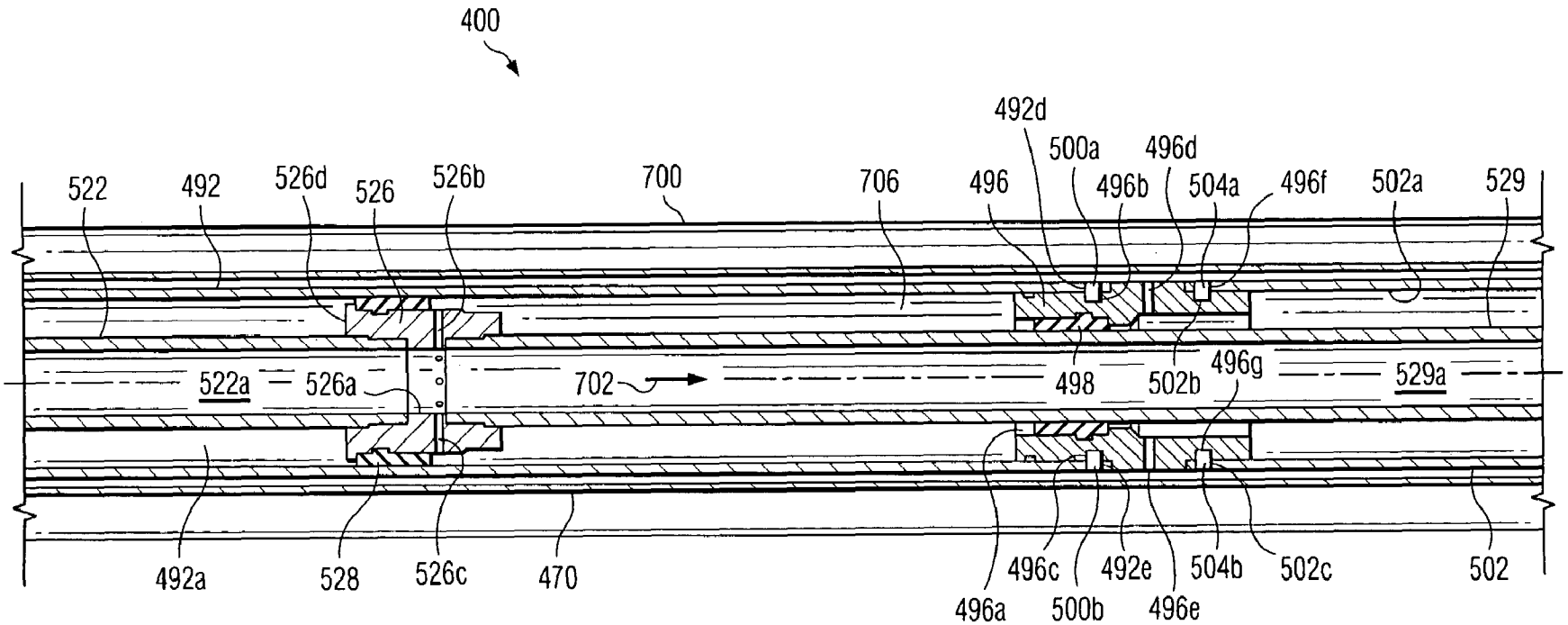
Figure 29G:
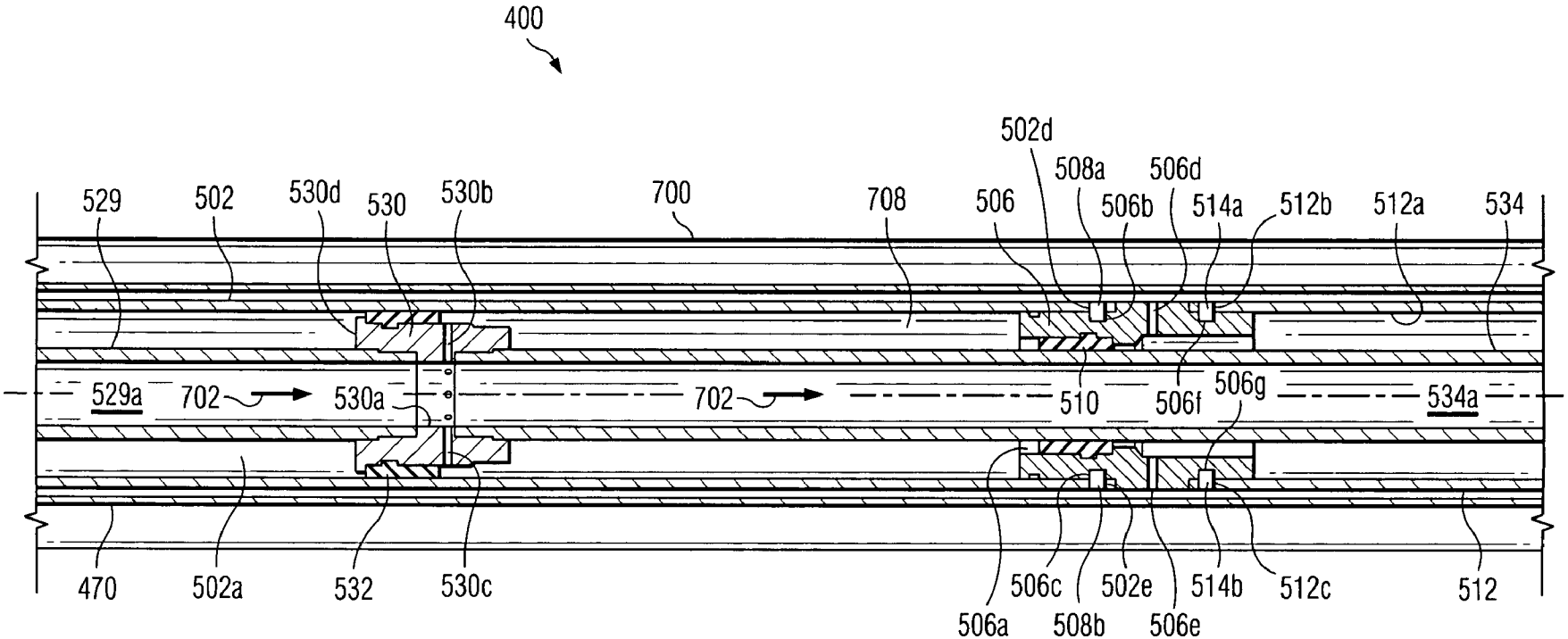
Figure 29H:
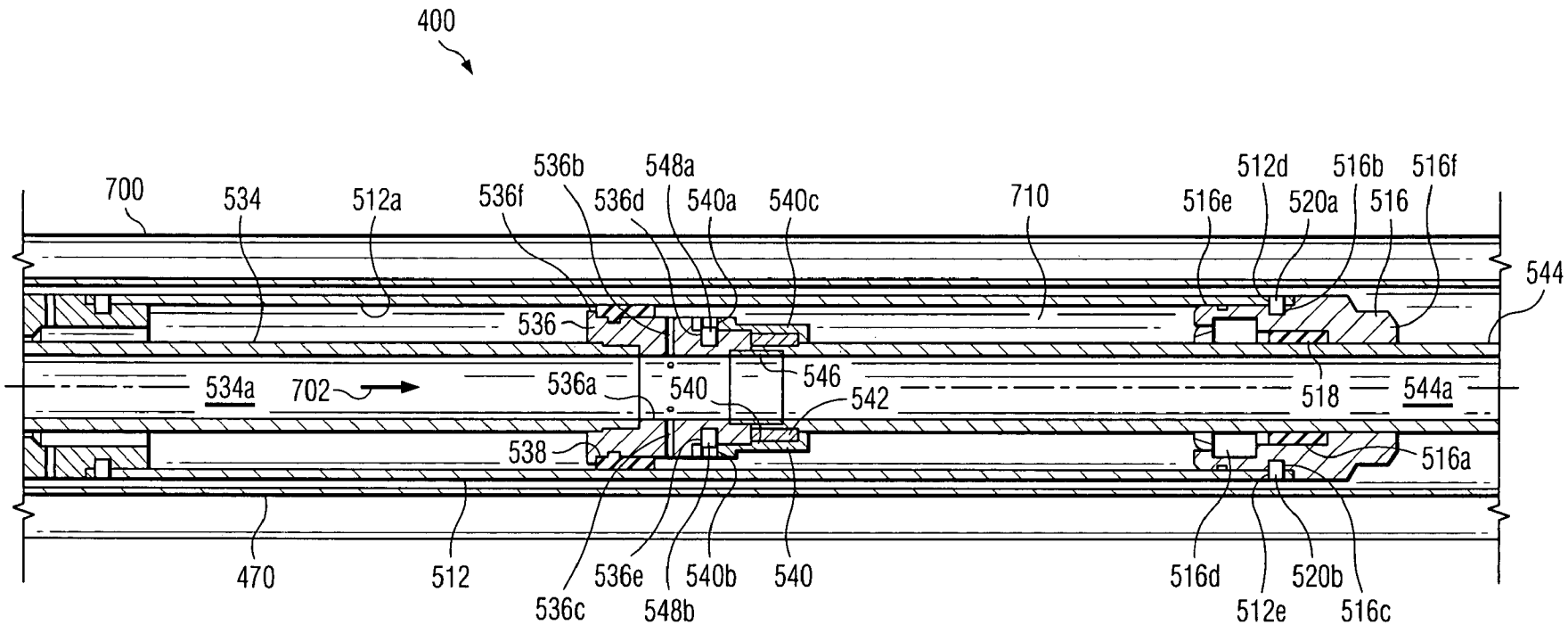
Figure 29I:
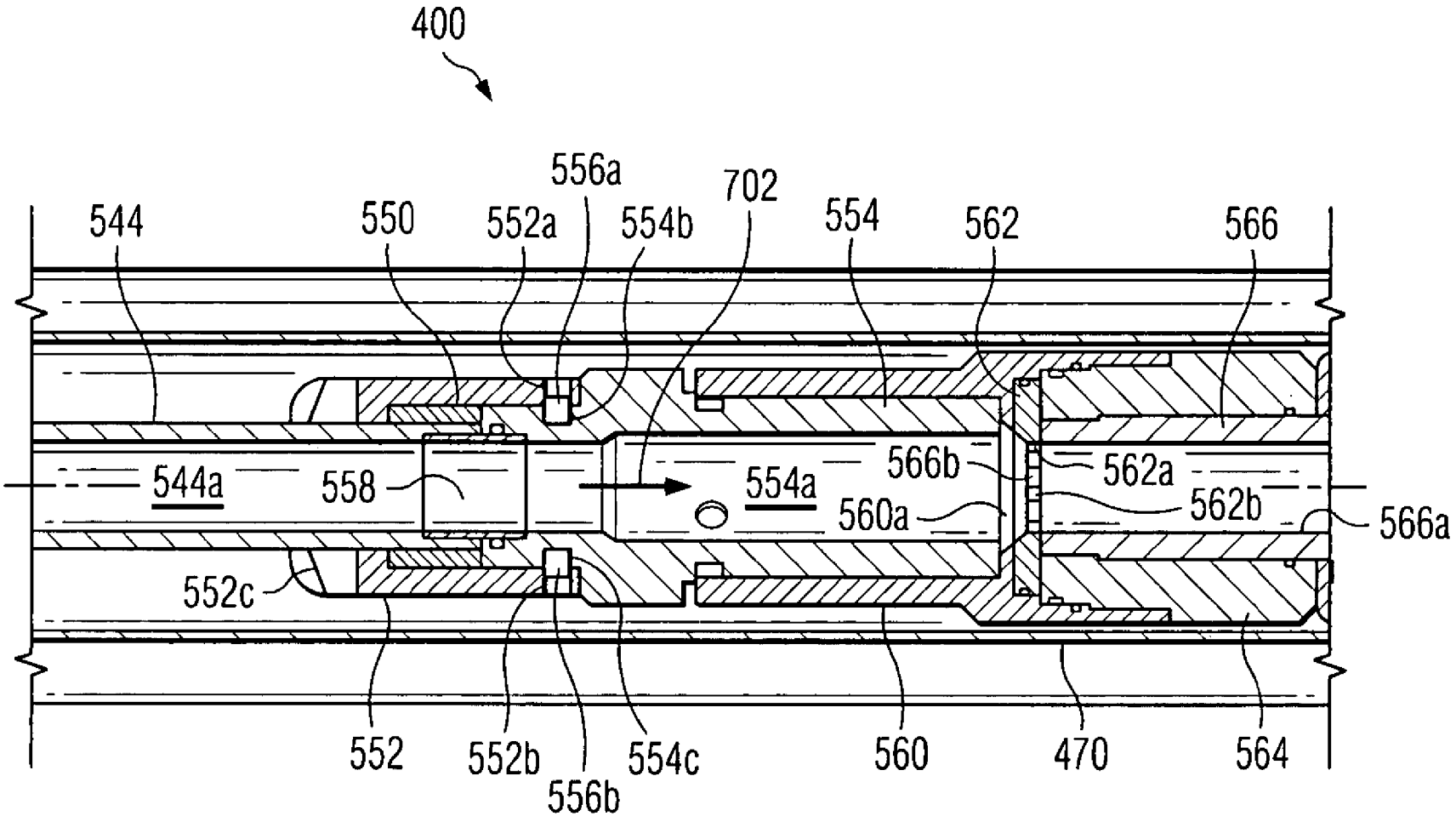
Figure 29J:
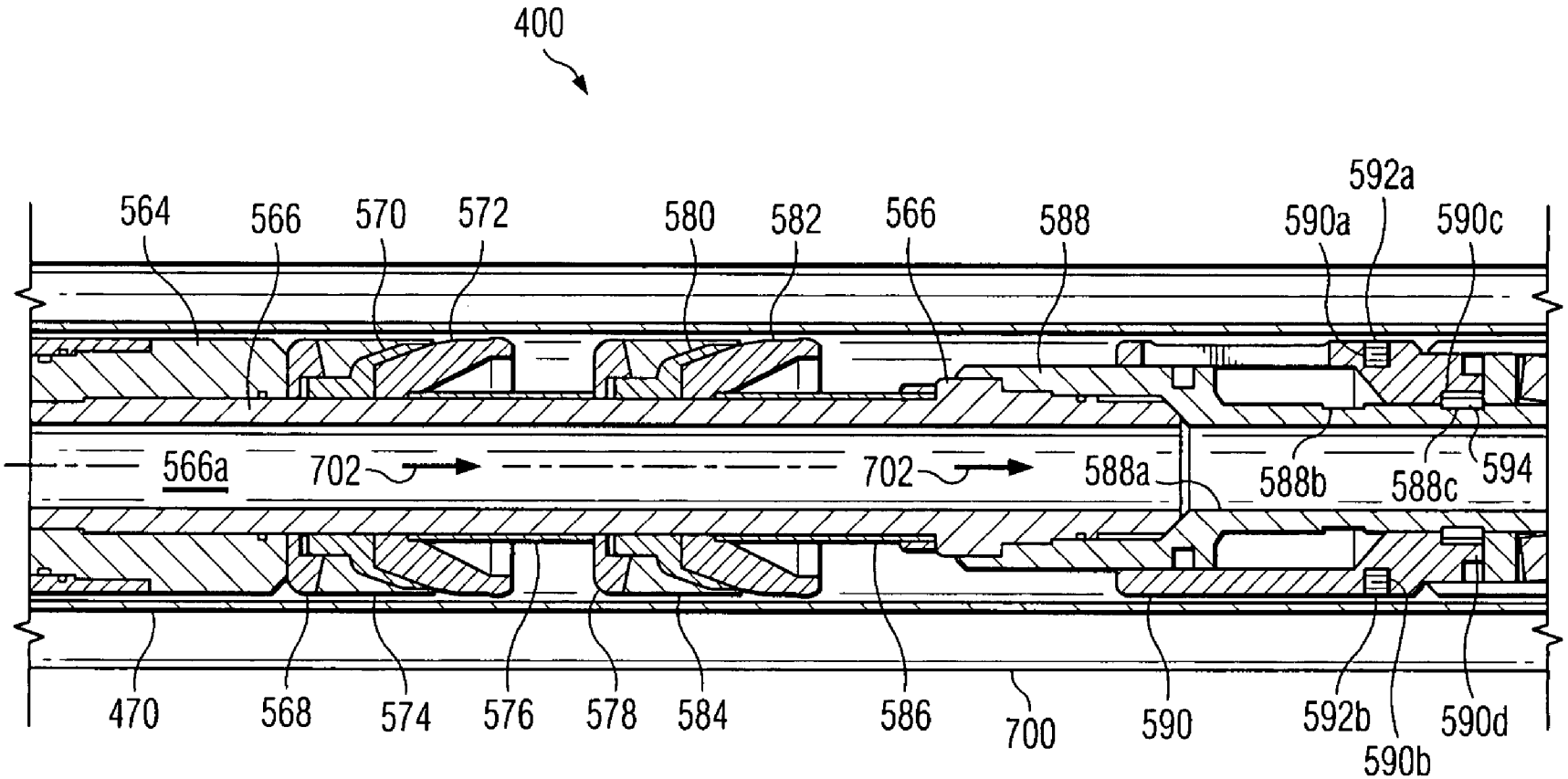
Figure 29K:
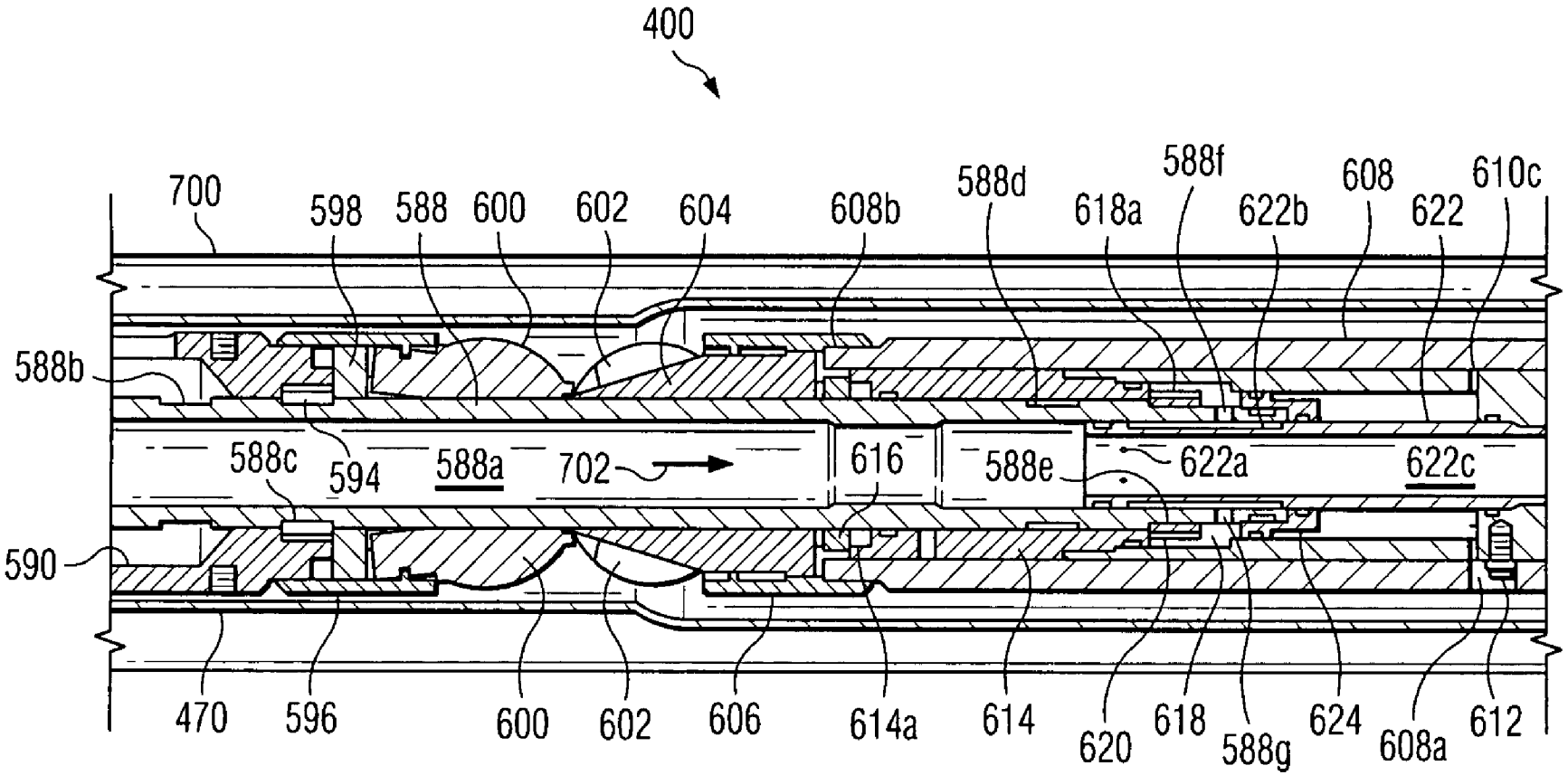
Figure 29L:
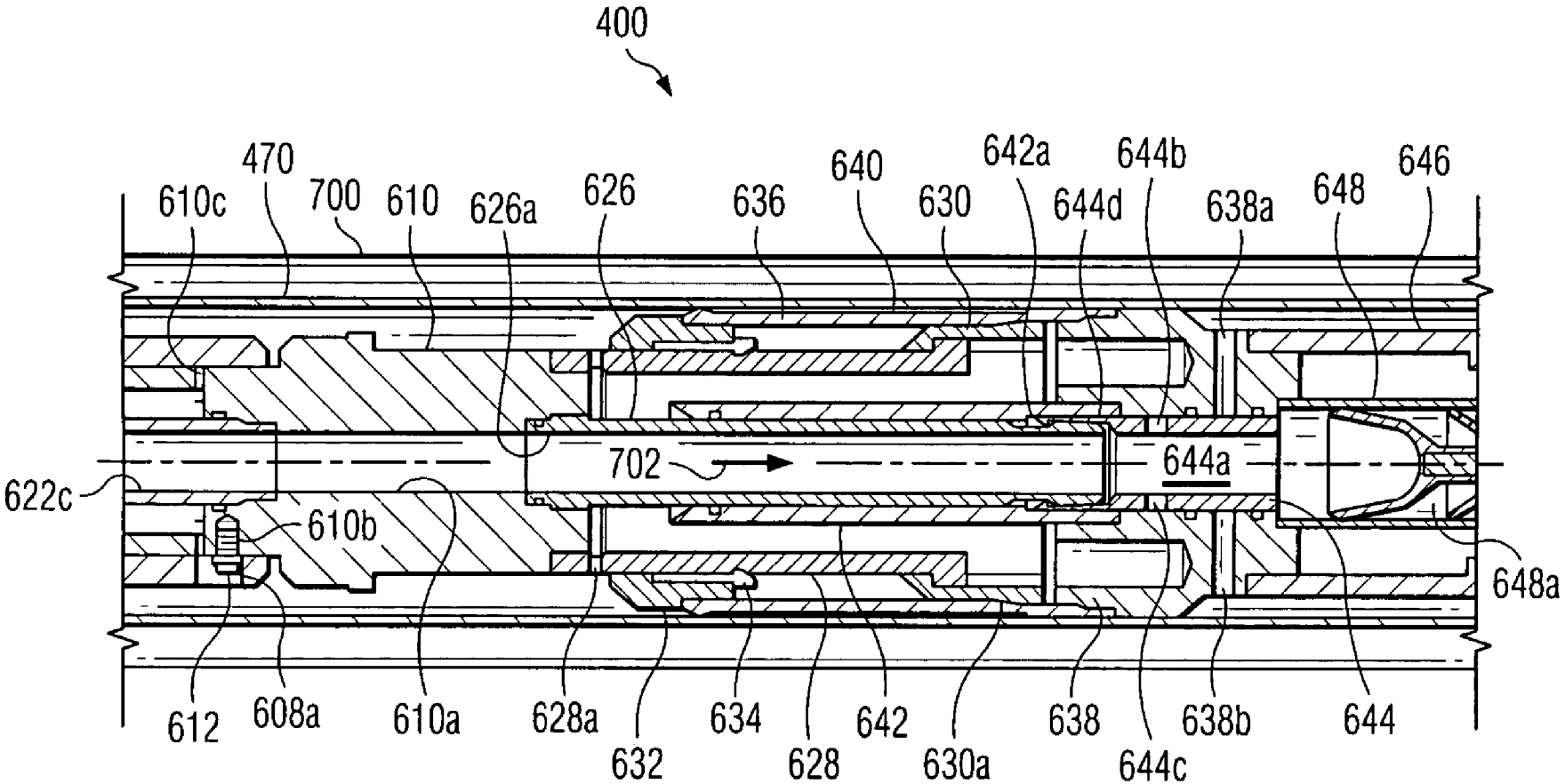
Figure 29M:
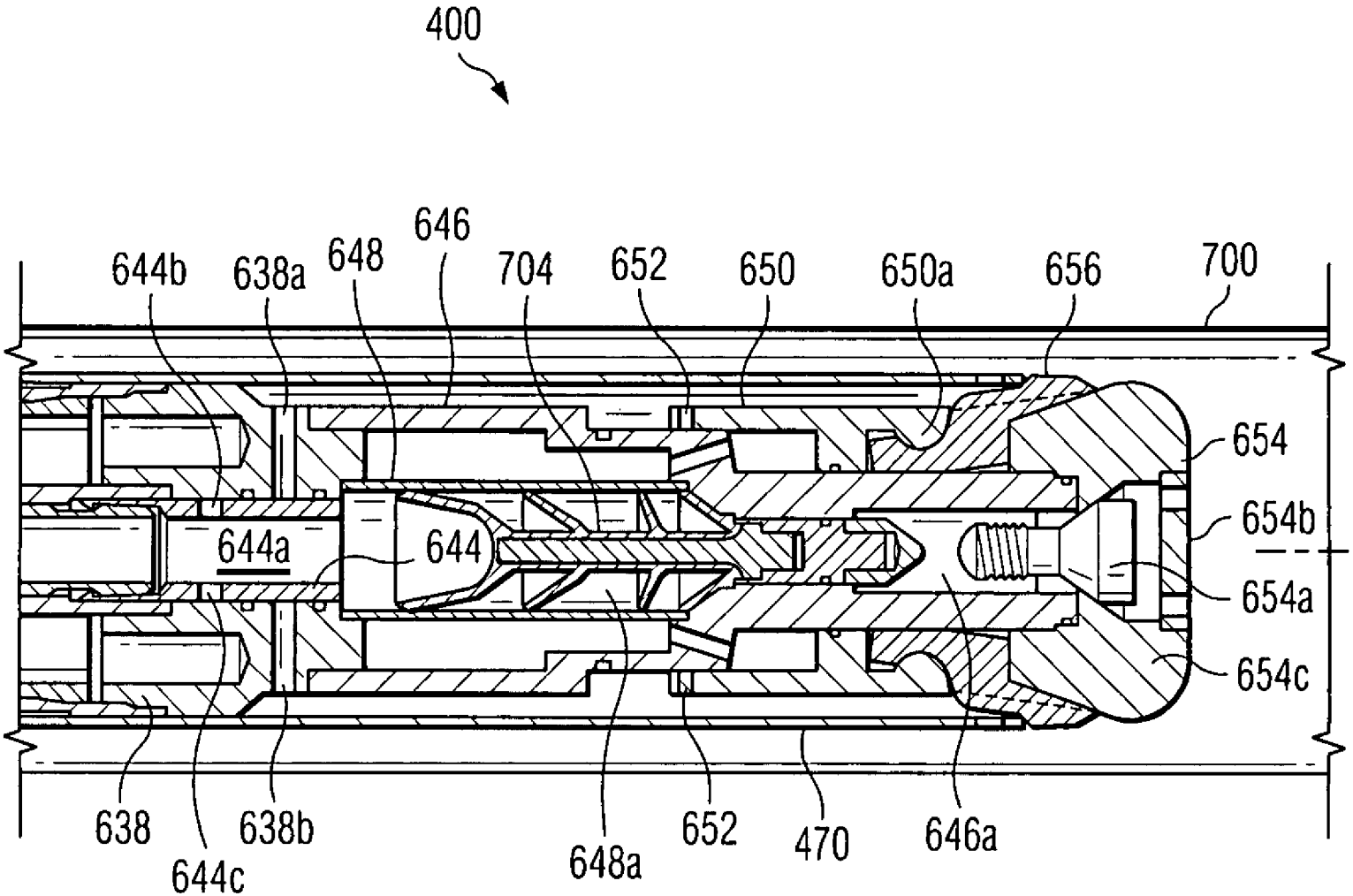

As a result, as illustrated in FIGS. 26*j*, 27*a*, and 27*b*, the shear pin bushing 590, the locking ring 594, the upper cone retainer 596, the upper cam 598, and the upper cone segments 600 are displaced downwardly relative to the cone mandrel 588, the lower cone segments 602, and the lower cam 604 thereby driving the upper cone segments 600 onto and up the cam arms 604*a* of the lower cam 604, and driving the lower cone segments 602 onto and up the cam arms 598*d* of the upper cam 598. During the outward radial displacement of the upper and lower cone segments, 600 and 602, the upper and cone segments translate towards one another in the longitudinal direction and also pivot about the pivot points, 596*b* and 606*a*, of the upper and lower cone retainers, 596 and 606, respectively.

As a result, a segmented expansion cone is formed that includes a substantially continuous outer arcuate spherical surface provided by the axially aligned and interleaved upper and lower expansion cone segments, 600 and 602. Furthermore, the resilient locking ring 594 is relocated from the lock ring groove 588*b* to the lock ring groove 588*c* thereby releasably locking the positions of the shear pin bushing 590, the locking ring 594, the upper cone retainer 596, the upper cam 598, and the upper cone segments 600 relative to the cone mandrel 588.

Referring to FIGS. 28*a* to 28*j*, the continued injection of the fluidic material 702 into the apparatus 400 continues to pressurize annular pressure chambers, 706, 708, and 710. As a result, an upward axial force is applied to the shear pin bushing 590 that causes the torsional shear pins, 592*a* and 592*b*, to be sheared thereby decoupling the wellbore casing 470 from the shear pin bushing 590 and permitting the pistons 526, 530, and 536 to be further displaced upwardly relative to the casing 470. The further upward displacement of the pistons 526, 530, and 536 in turn displaces the cone mandrel 588, the upper cam 598, the upper cone segments 600, the lower cone segments 602, and the lower cam 604 upwardly relative to the casing 470. As a result, the segmented expansion cone provided by the interleaved and axially aligned upper and lower cone segments, 600 and 602, radially expands and plastically deforms a portion of the casing 470.

Referring to FIGS. 29*a*-29*m*, during the continued injection of the fluidic material 702, the segmented expansion cone provided by the interleaved and axially aligned upper and lower cone segments, 600 and 602, will continue to be displaced upwardly relative to the casing 470 thereby continuing to radially expand and plastically deform the casing until the locking dogs 656 engage and push on the lower end of the casing 470. When the locking dogs 656 engage and push on the lower end of the casing 470, the locking dogs 656, the float valve assembly 654, the differential piston 650, the dart guide sleeve 648, the lower mandrel 646, the bypass valve 644, the elastomeric coating 640, the bypass valve body 638, the expandable sealing sleeve 636, the retaining collet 634, the guide 632, the sealing sleeve expansion cone 630, the expansion cone mandrel 628, the bypass valve operating probe 626, the pressure balance piston 624, the emergency release sleeve 622, the resilient locking ring 620, the locking ring retainer 618, the locking dogs 616, the locking dog retainer sleeve 614, the torsion locking pin 612, the lower mandrel 610, the release housing 608, the lower cone retainer 606, the lower cam 604, and the lower cone segments 602 are displaced downwardly in the longitudinal direction relative to the cone mandrel 588. As a result, the upper cam 598 and the upper cone segments 600 are moved out of axial alignment with the lower cone segments 602 and the lower cam 604 thereby collapsing the segmented expansion cone. Furthermore, the locking ring 620 is moved from the lock ring groove 588*d* to the lock ring groove 588*e* thereby releasably fixing the new position of the lower cone segments 602 and the lower cam 604.

Figure 30A:
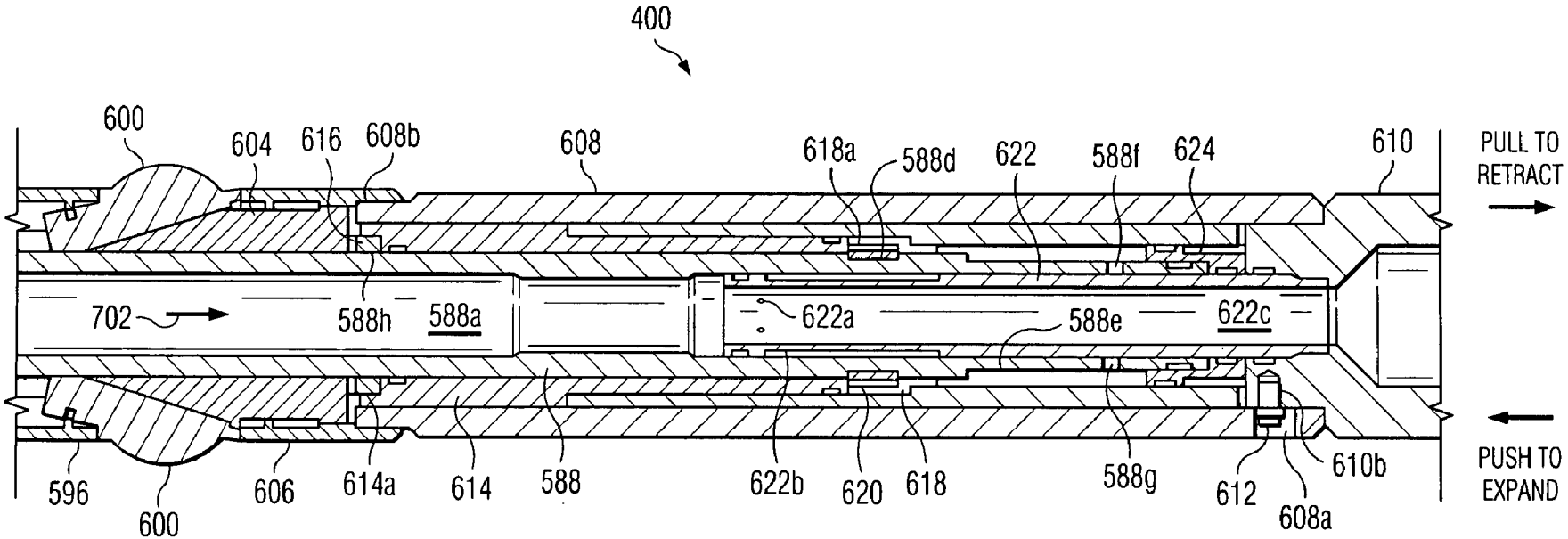
FIG. 30*a*-30*c* are fragmentary cross sectional illustrations of the process for collapsing the expansion cone assembly of the apparatus of FIGS. 29*a*-29*m*.
Figure 30B:
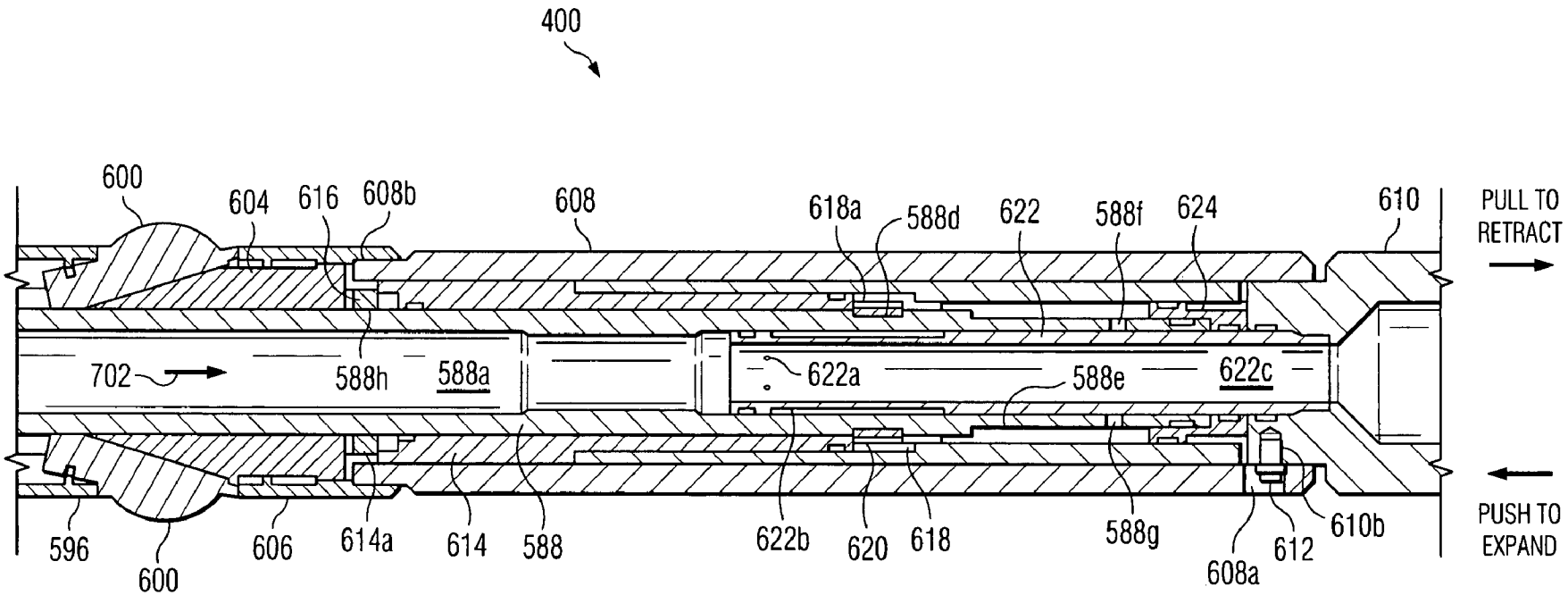

In particular, as illustrated in FIG. 30*a*, when a downward tensile longitudinal force is initially applied to the lower mandrel 610 relative to cone mandrel 588, the lower mandrel, the locking dog retainer sleeve 614, and the locking ring retainer 618 are displaced downwardly relative to the cone mandrel 588 when the applied tensile force is sufficient to release the locking ring 620 from engagement with the lock ring groove 588*d*. As illustrated in FIG. 30*b*, if the applied tensile force is sufficient to release the locking ring 620 from engagement with the lock ring groove 588*d*, the lower mandrel 610, the locking dog retainer sleeve 614, and the locking ring retainer 618 are displaced downwardly relative to the cone mandrel 588 thereby displacing the annular recess 614*a* of the locking dog retainer sleeve downwardly relative to the locking dogs 616. As a result, the locking dogs 616 are released from engagement with the locking dog grooves 588*h* of the cone mandrel 588 thereby permitting the lower cone segments 602, the lower cam 604, and the lower cone retainer 606 to be displaced downwardly relative to the cone mandrel 588.

Figure 30C:
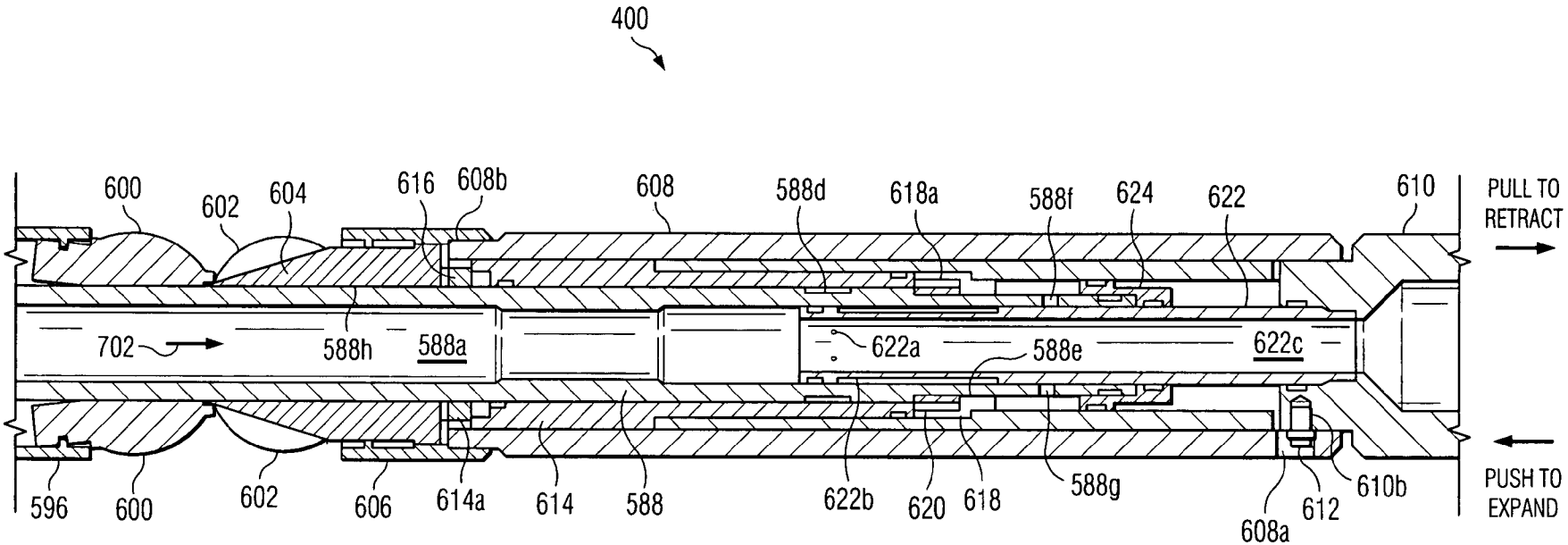

As illustrated in FIG. 30*c*, further downward displacement of the lower mandrel 610 then causes the torsion locking pin 612 to engage and displace the release housing 608 downwardly relative to the cone mandrel 588 thereby displacing the locking dogs 616, the lower cone retainer 606, the lower cam 604, and the lower cam segments 602 downwardly relative to the cone mandrel. As a result, the lower cone segments 602 and the lower cam 604 are displaced downwardly out of axial alignment with the upper cam 598 and the upper cam segments 600 thereby collapsing the segmented expansion cone. Furthermore, the downward displacement of the locking dog retainer sleeve 614 also displaced the locking ring retainer 618 and the locking ring 620 downwardly relative to the cone mandrel 588 thereby relocating the locking ring from the lock ring groove 588*d* to the lock ring groove 588*e*. In this manner, the now position of the lower cone segments 602 and the lower cam 604 are thereby releasably fixed relative to the cam mandrel 588 by the locking ring 620.

The operations of FIGS. 30*a*-30*c* may be reversed, and the segmented expansion cone may again be expanded, by applying a upward compressive force to the lower mandrel 610. If the compressive force is sufficient, the locking ring 620 will be released from engagement with the lock ring groove 588*e*, thereby permitting the lower mandrel 610 and the locking dog retainer 614 to be displaced upwardly relative to the cone mandrel 588. As a result, the locking dog retainer 614 will engage and displace the locking dogs 616, the lower cam 604, the lower cone segments 602, the lower cone retainer 606, and the release housing 608 upwardly relative to the cone mandrel 588 thereby bringing the upper cam 598 and the upper cone segments 600 back into axial alignment with the lower cone segments 602 and the lower cam 604. As a result, the segmented expansion cone is once again expanded. Once the segmented cone has been fully expanded, the locking dogs 616 will once again be positioned in alignment with the locking dog grooves 588*h* of the cone mandrel 588 and will thereby once again engage the locking dog grooves. The continued upward displacement of the lower mandrel 610 relative to cone mandrel 588 will thereby also upwardly displace the locking dog retainer 614 upwardly relative to the cone mandrel thereby once again capturing and restraining the locking dogs 616 within the annular recess 614*a* of the locking dog retainer. As a result, the new expansion position of the lower cone segments 602 and the lower cam 604 relative to the cone mandrel 588 will be releasably locked by the locking dogs 616. Furthermore, the locking ring 620 will also be relocated from engagement with the lock ring groove 588*e* to engagement with the lock ring groove 588*d* to thereby releasably lock the expanded segmented cone in the expanded position.

Figure 31A:
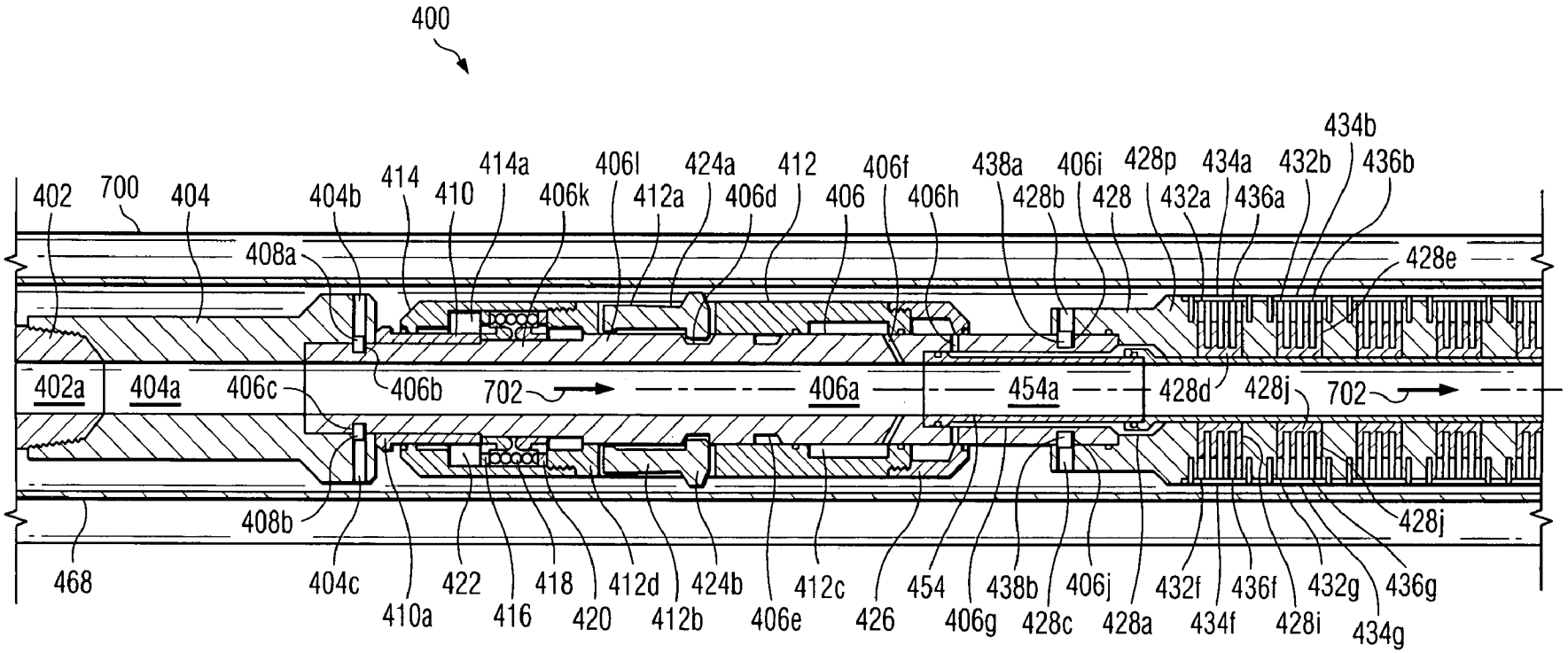
FIGS. 31*a*-31*n* are fragmentary cross sectional illustrations of the apparatus of FIGS. 29*a*-29*m* after the plastic deformation and radial expansion of the sealing sleeve and the disengagement of the casing from the locking dogs of the casing lock assembly.
Figure 31B:
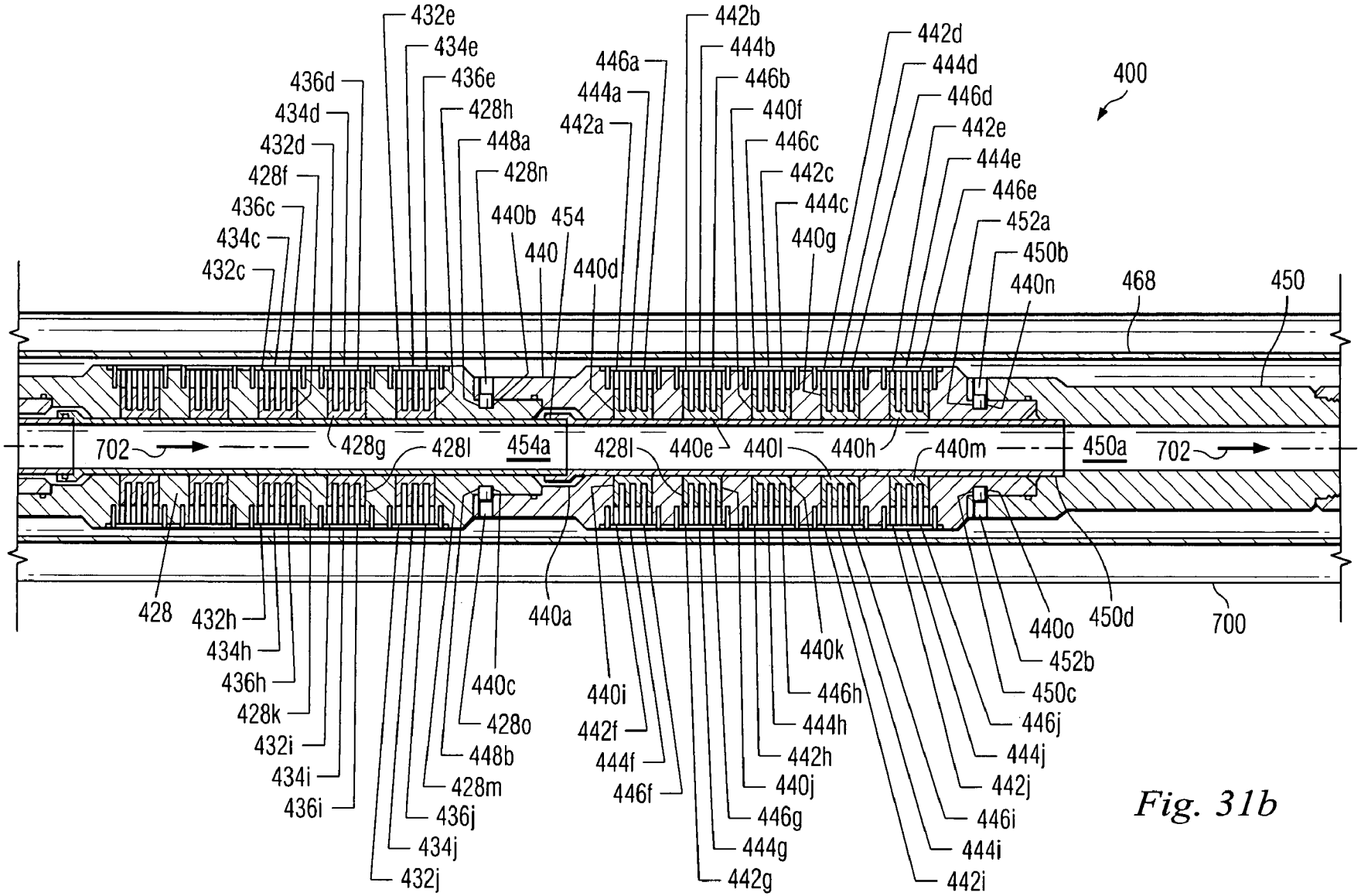
Figure 31C:
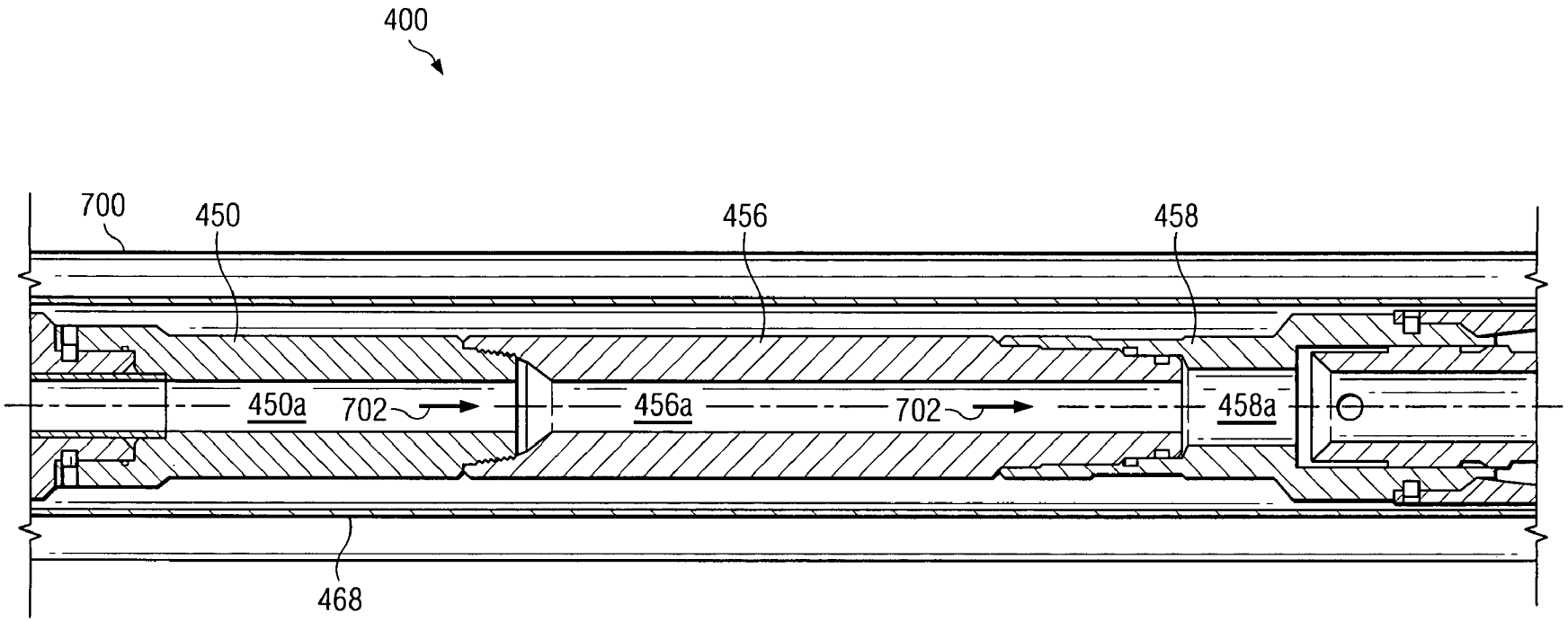
Figure 31D:
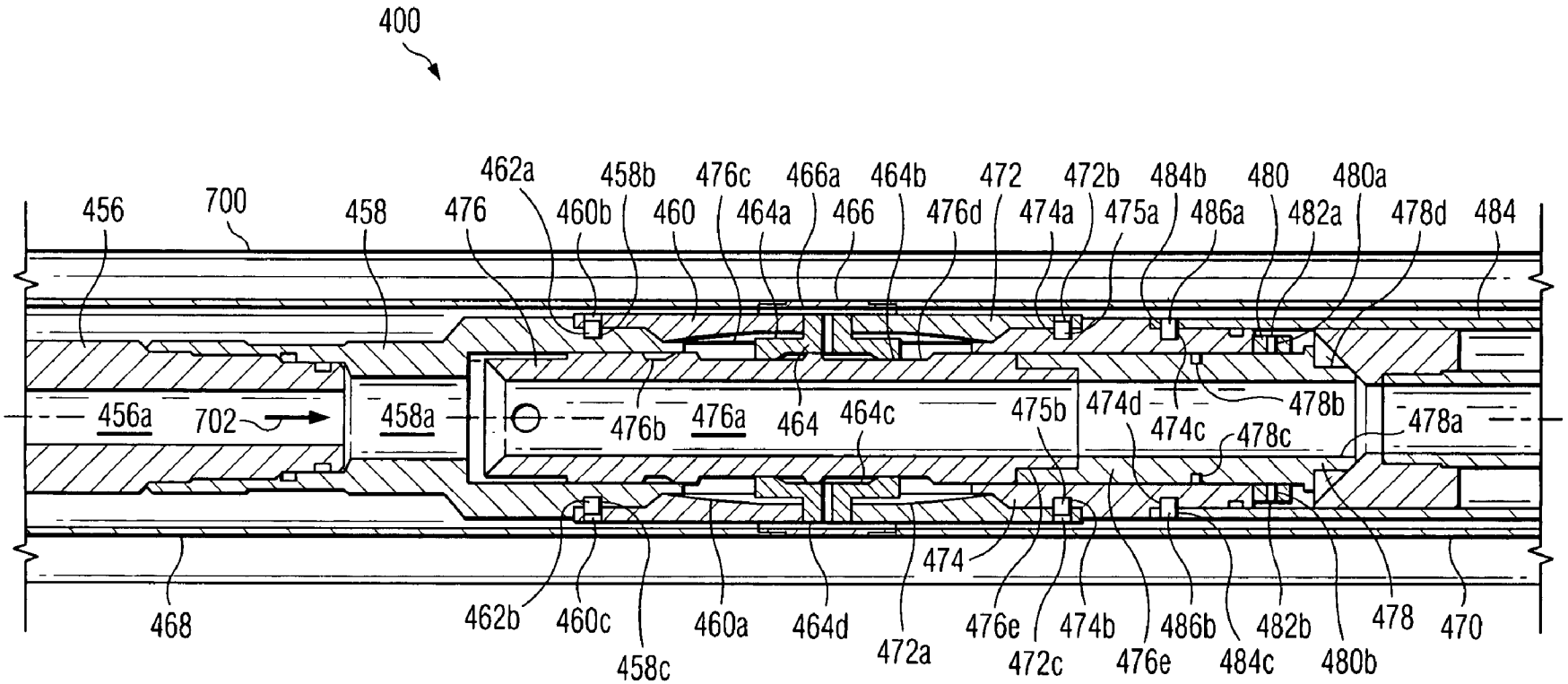
Figure 31E:
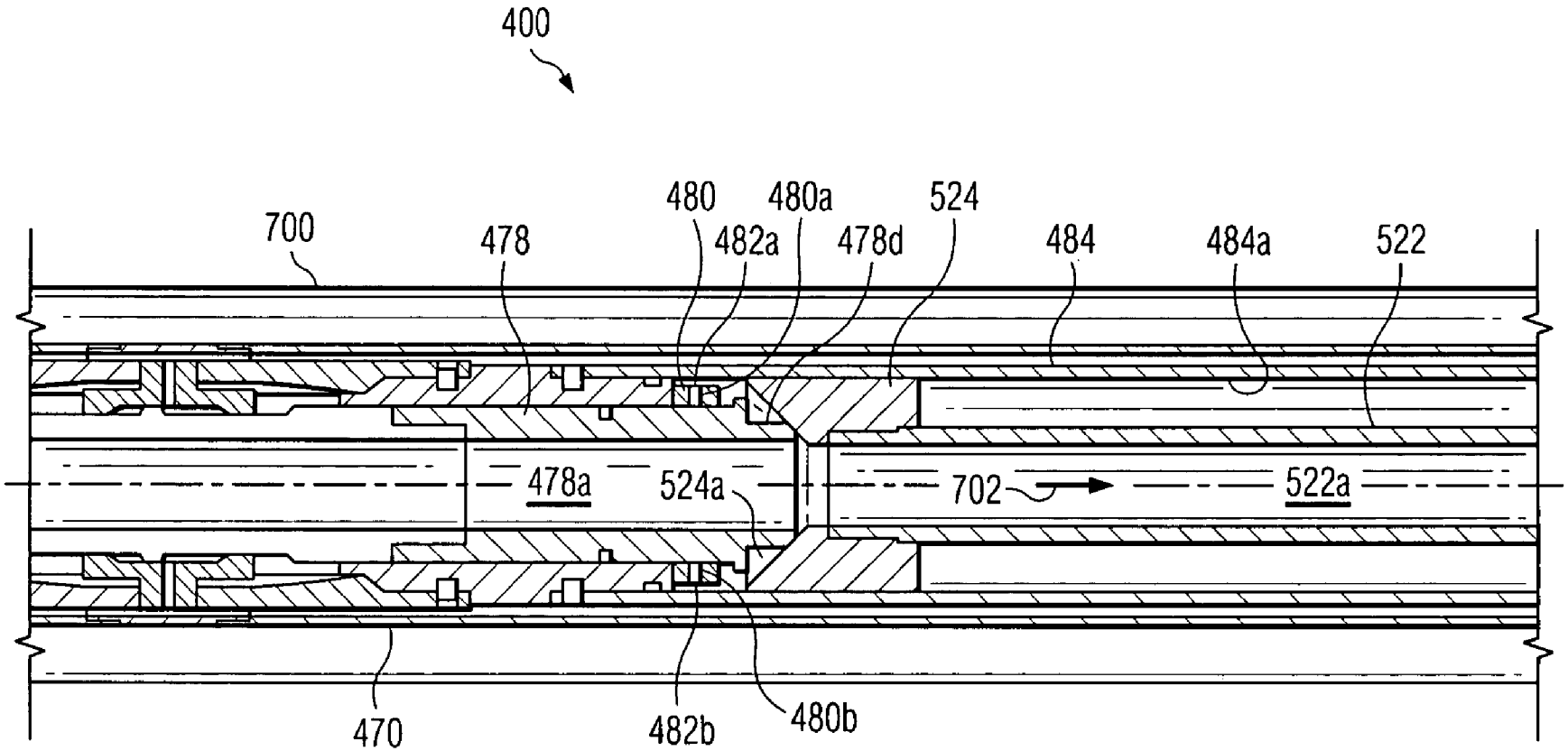
Figure 31F:
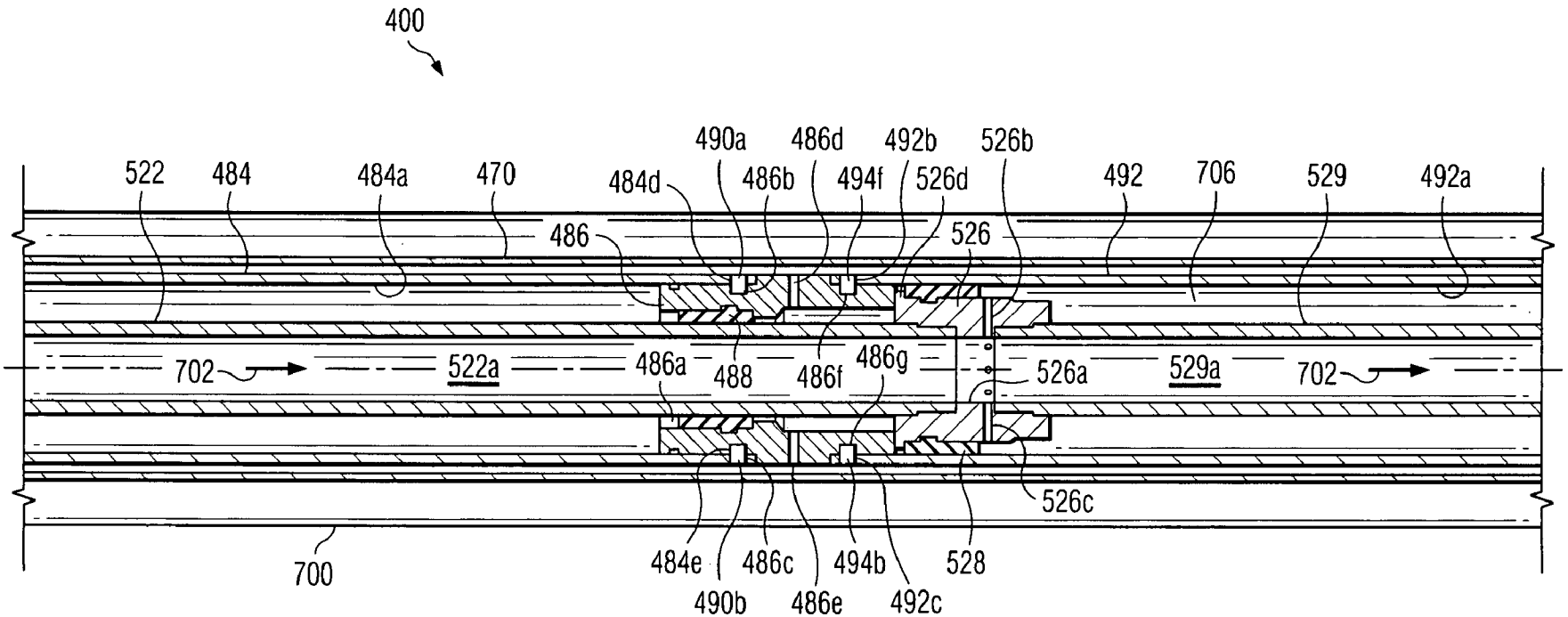
Figure 31G:
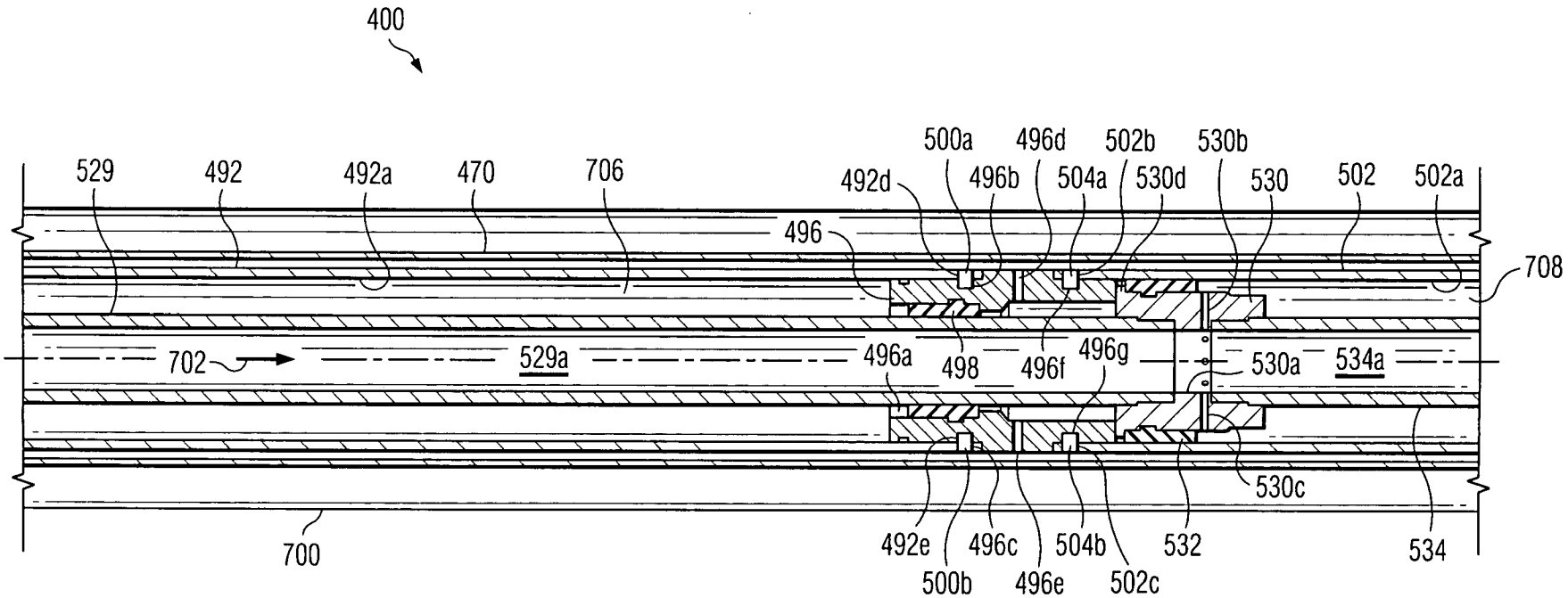
Figure 31H:
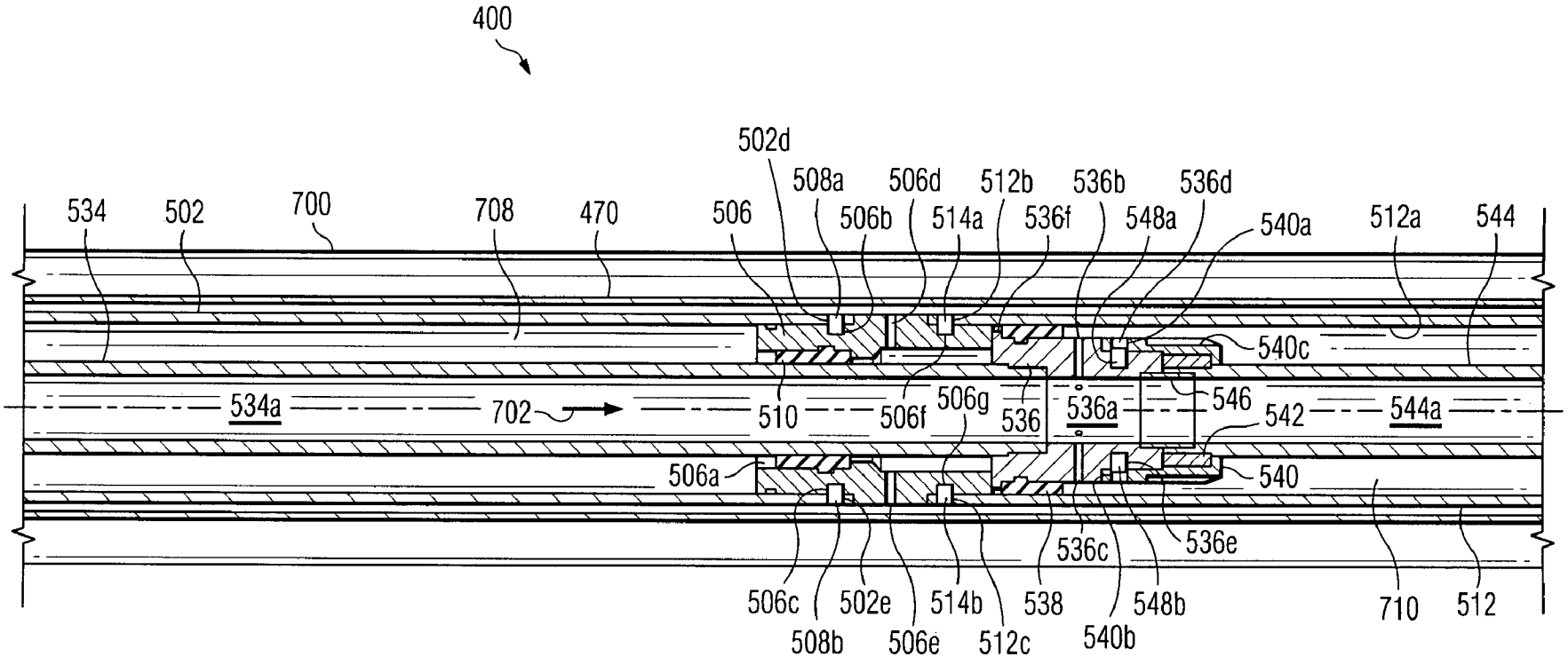
Figure 31I:
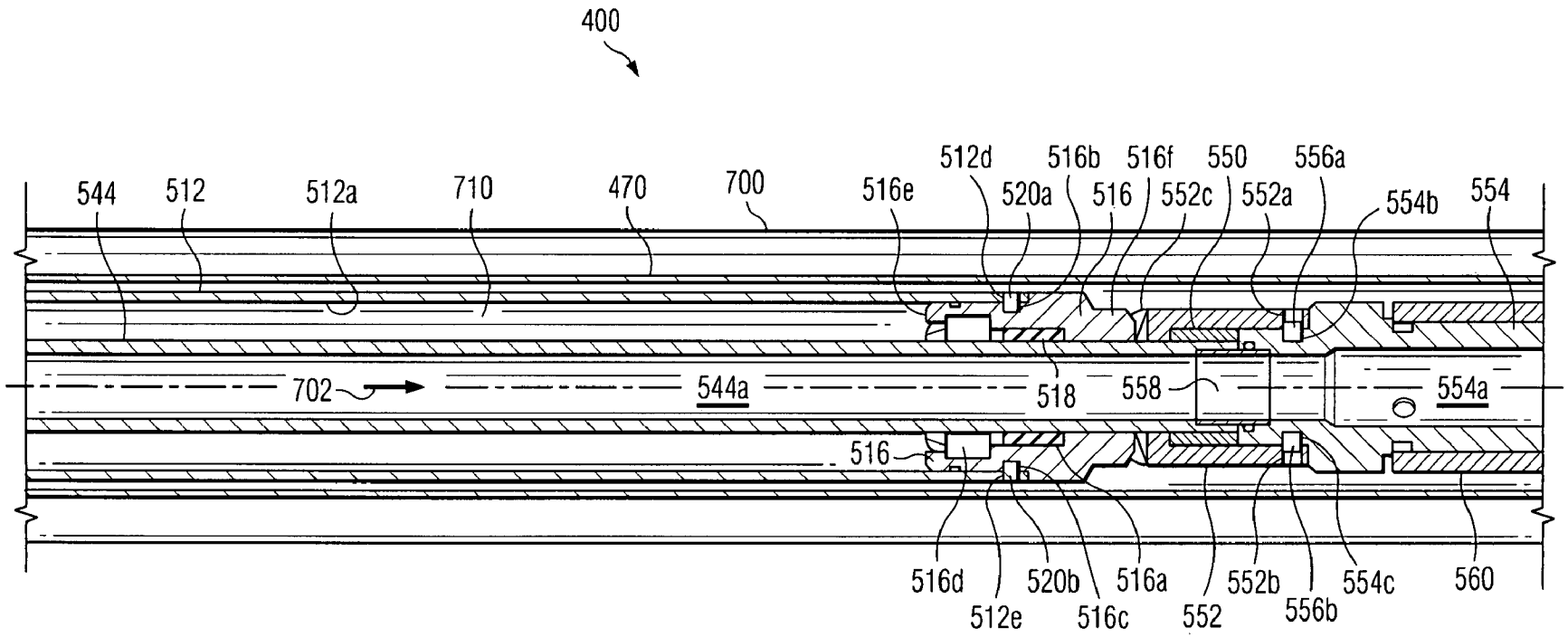
Figure 31J:
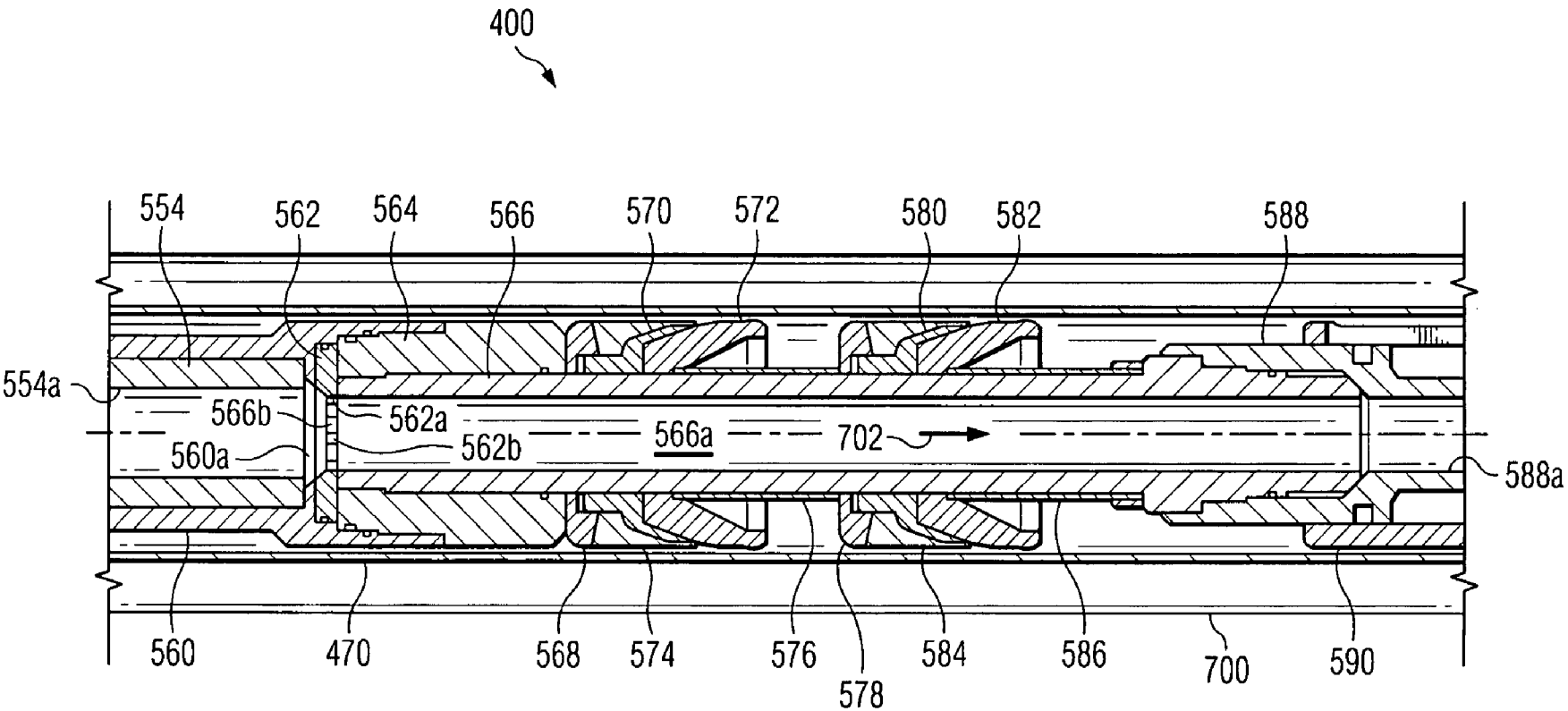
Figure 31K:
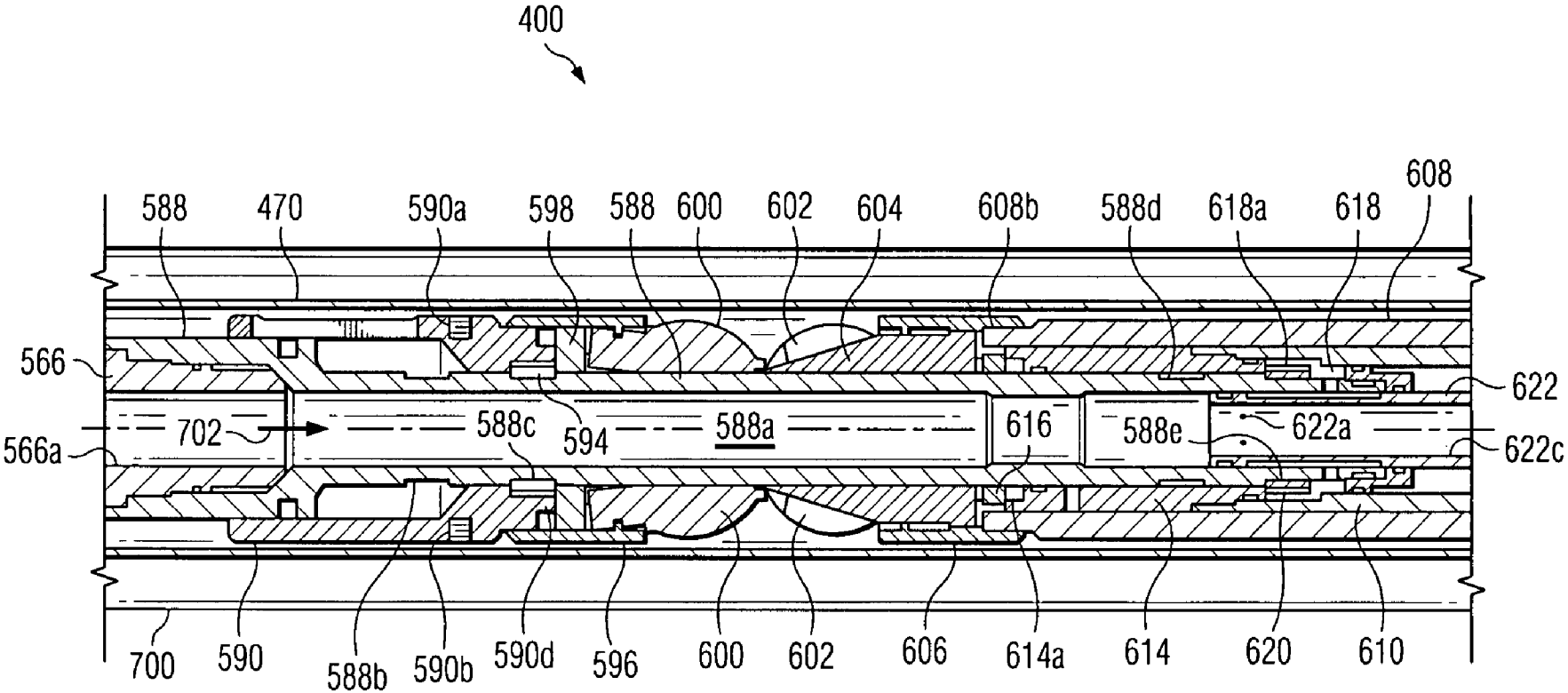
Figure 311:
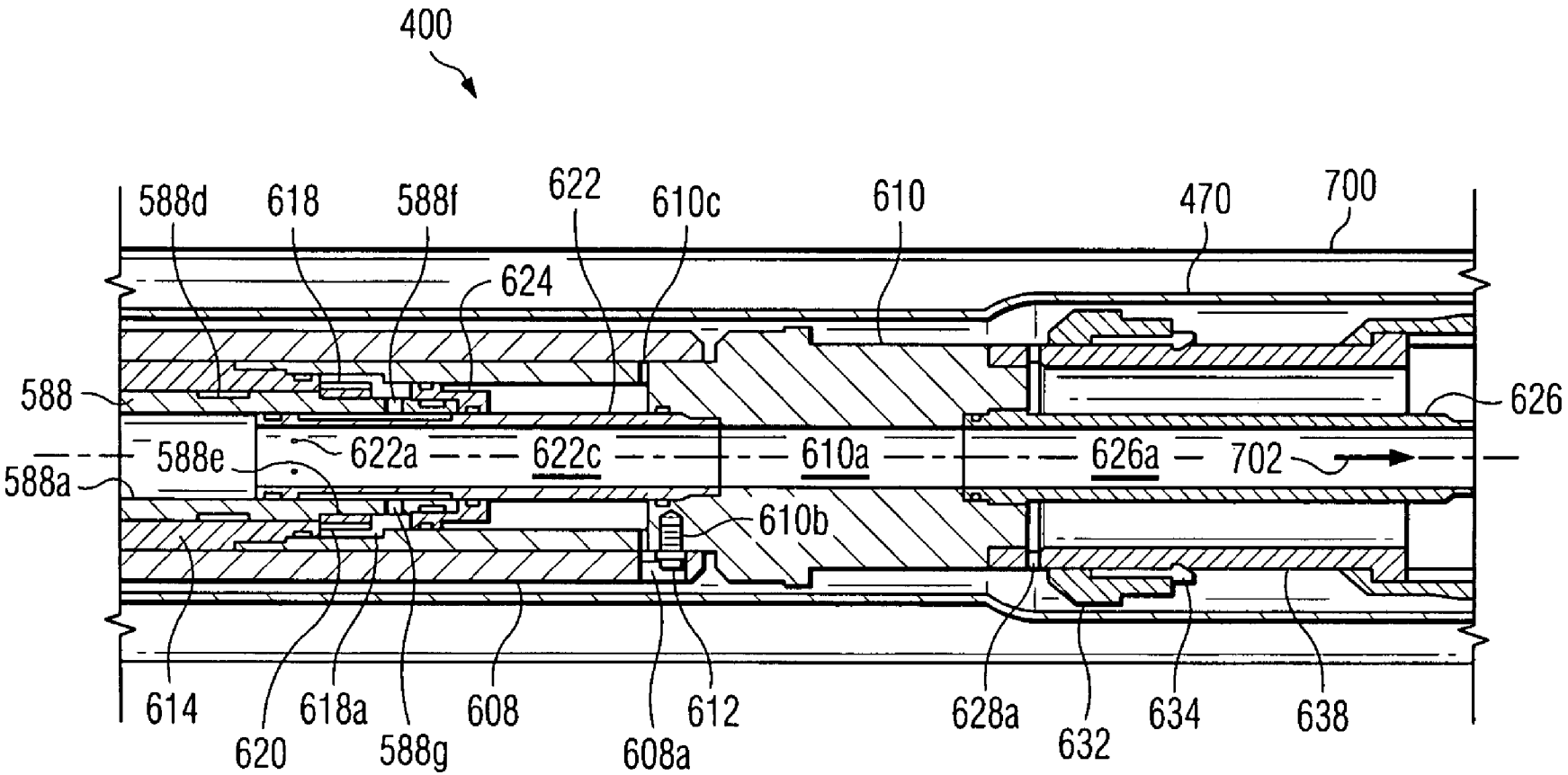
Figure 31M:
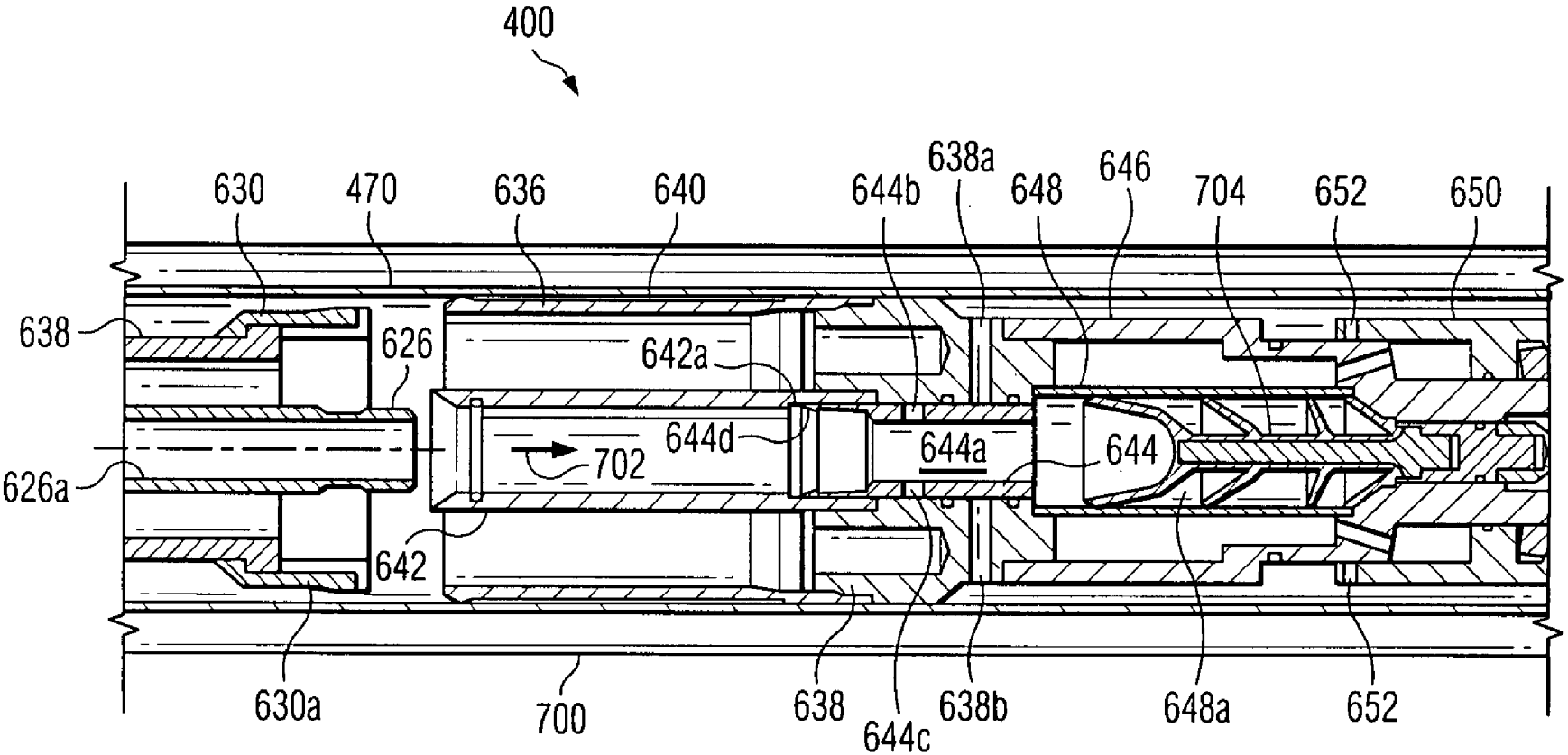
Figure 31N:
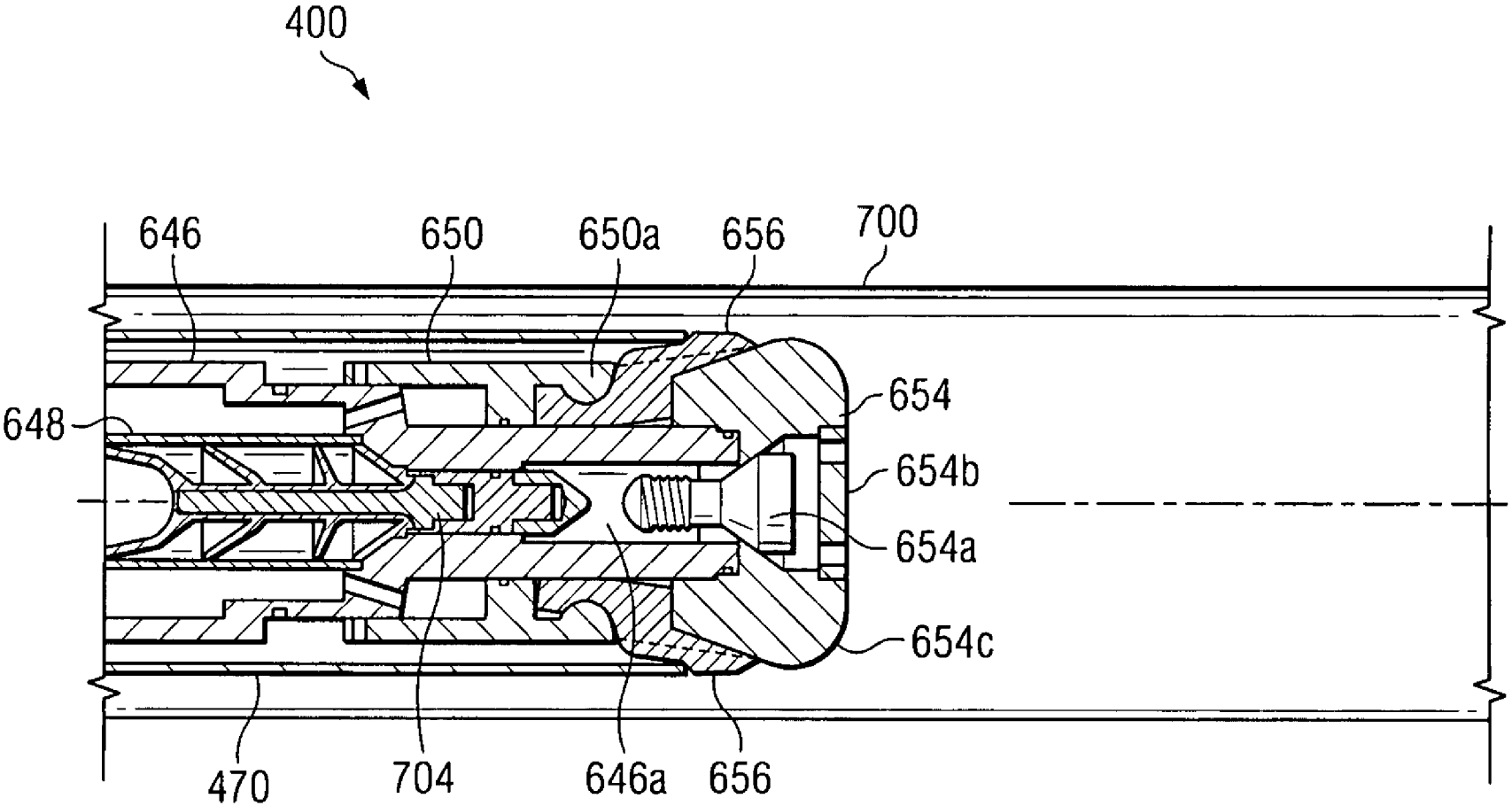
Figure 32A:
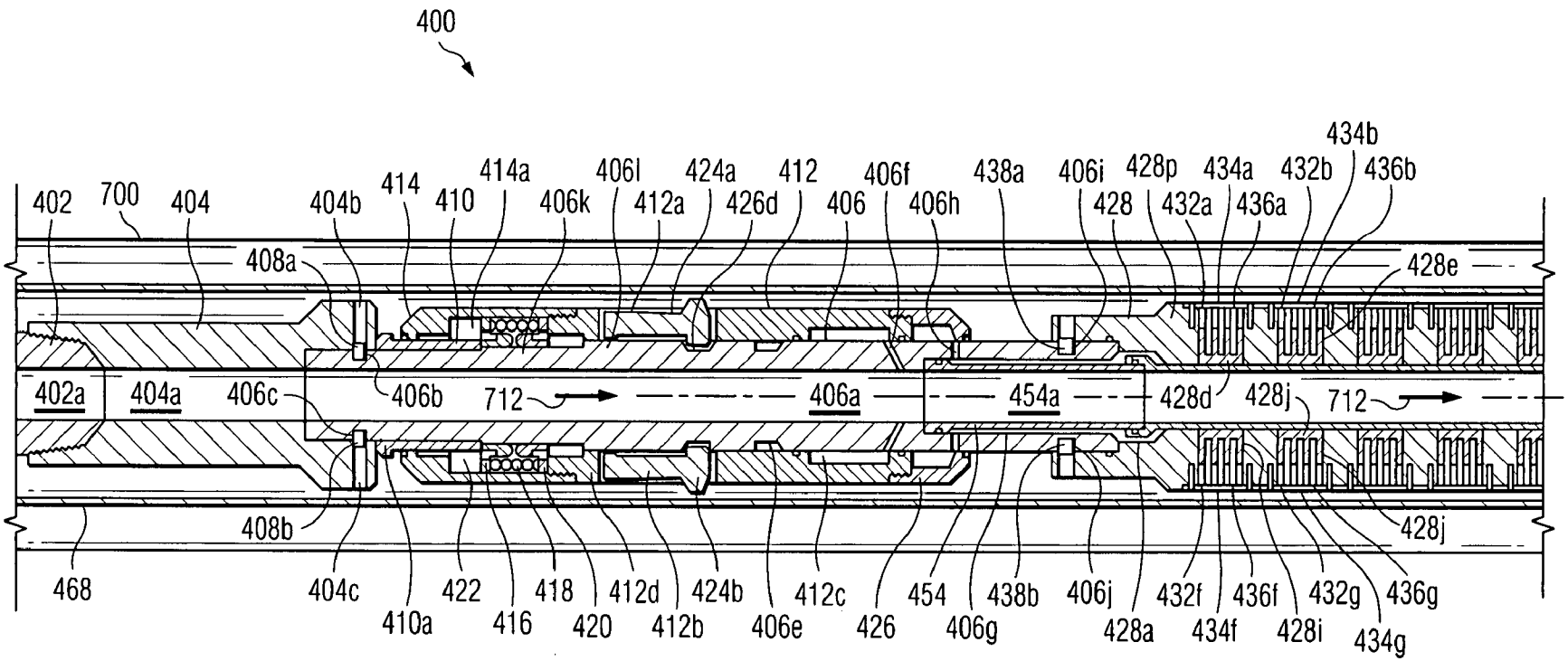
FIGS. 32*a*-32*k* are fragmentary cross sectional illustrations of the apparatus of FIGS. 31*a*-31*n* after setting down the apparatus onto the bottom of the wellbore to open the bypass valve in the shoe and expand the expansion cone assembly.
Figure 32B:
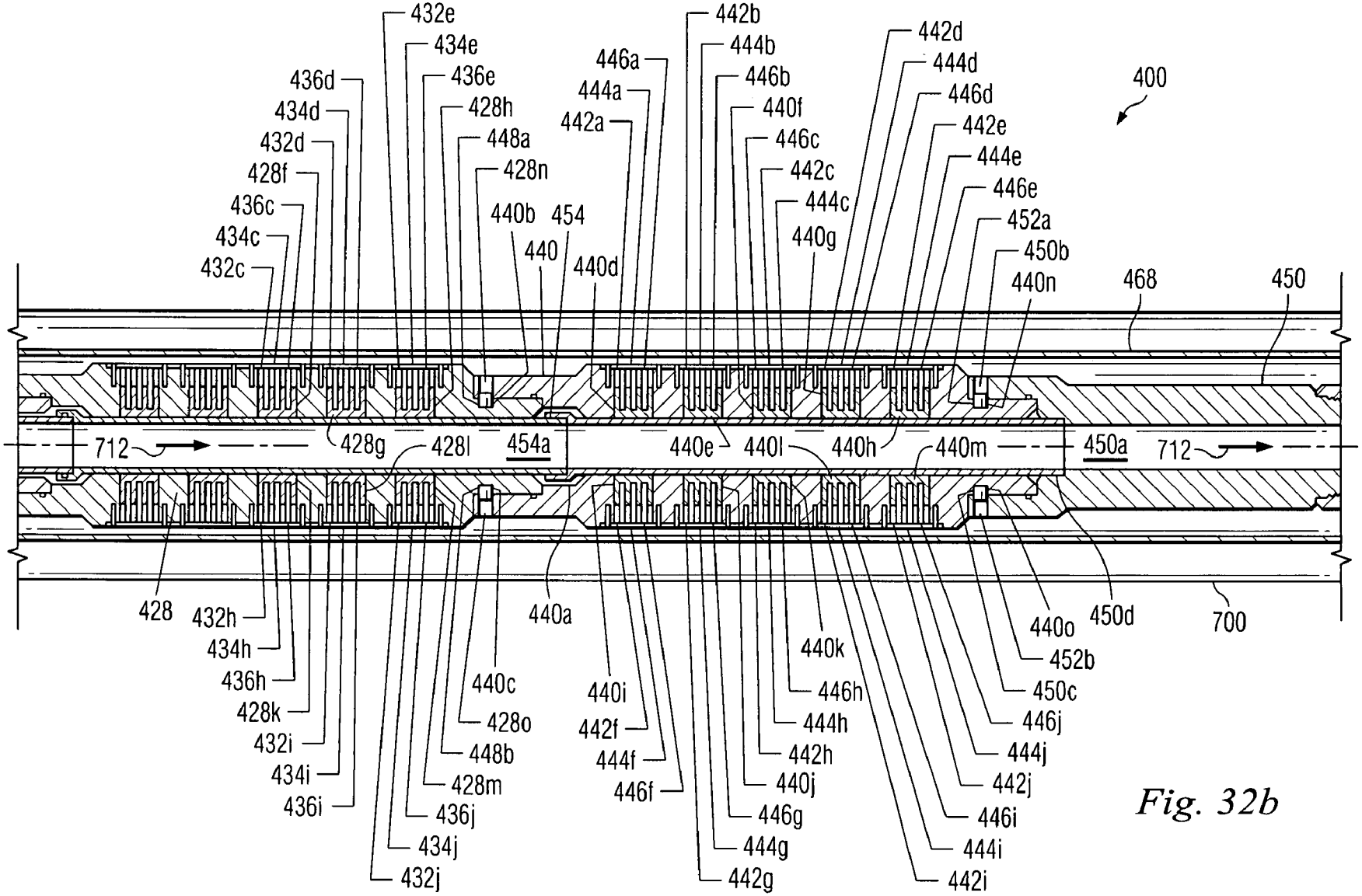
Figure 32C:
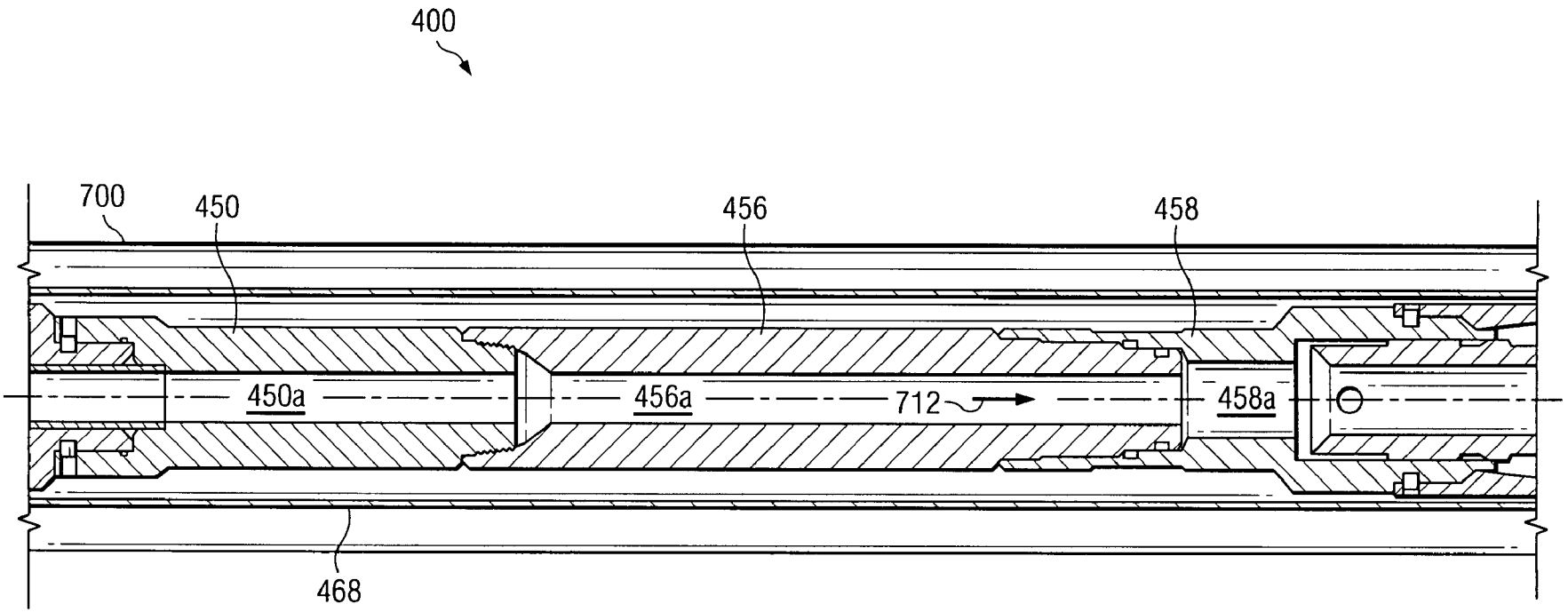
Figure 32D:
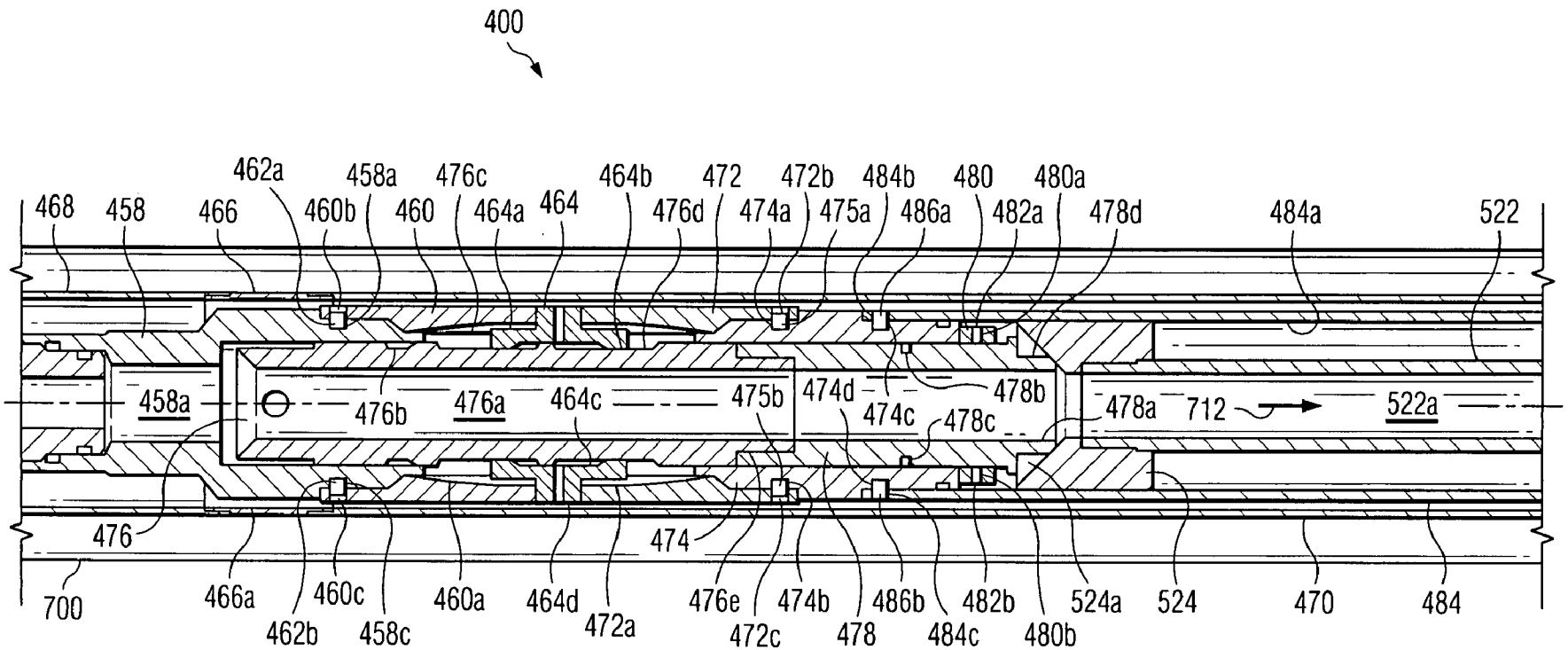
Figure 32E:
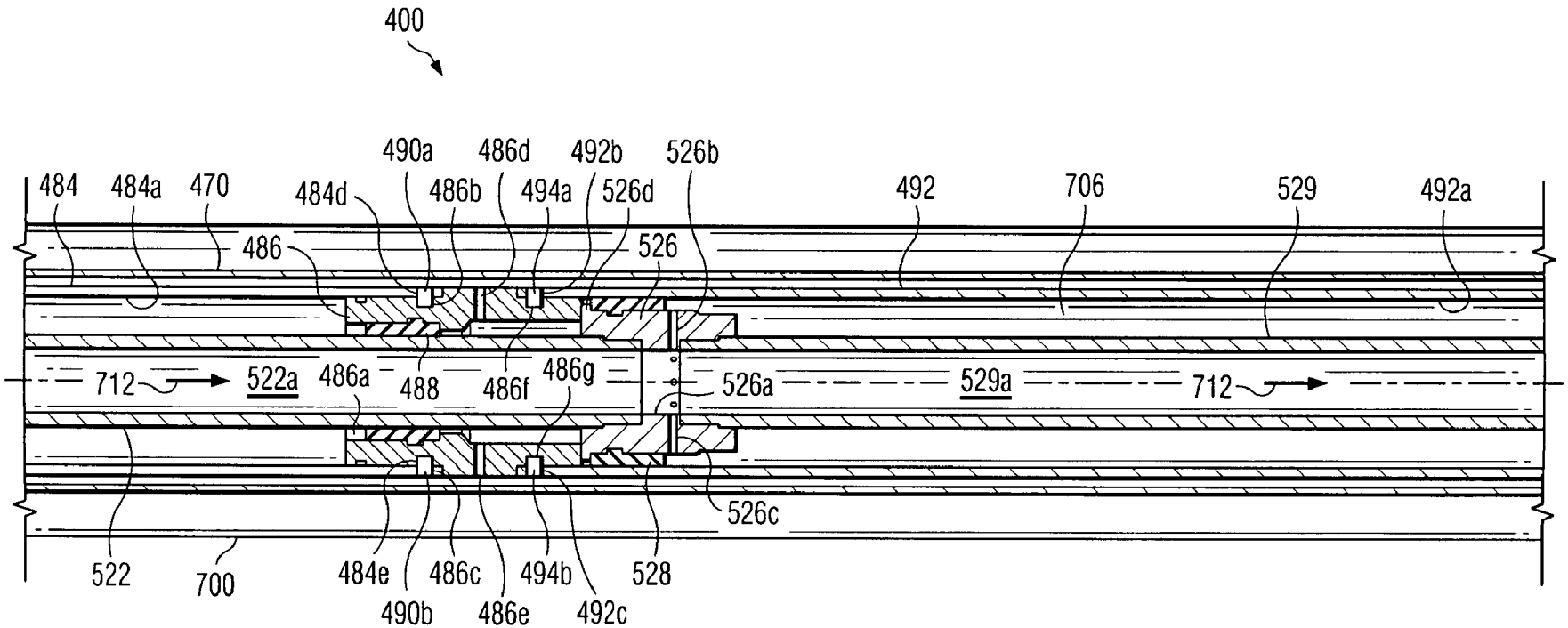
Figure 32F:
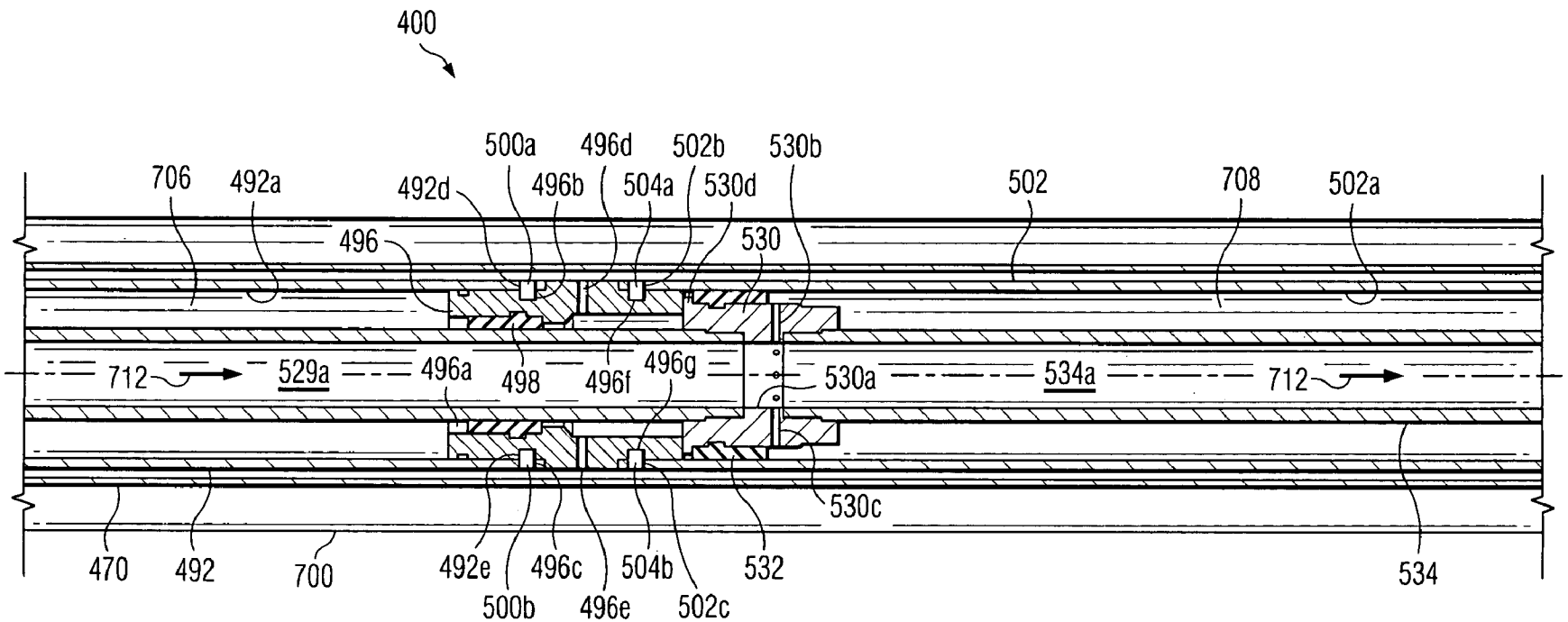
Figure 32G:
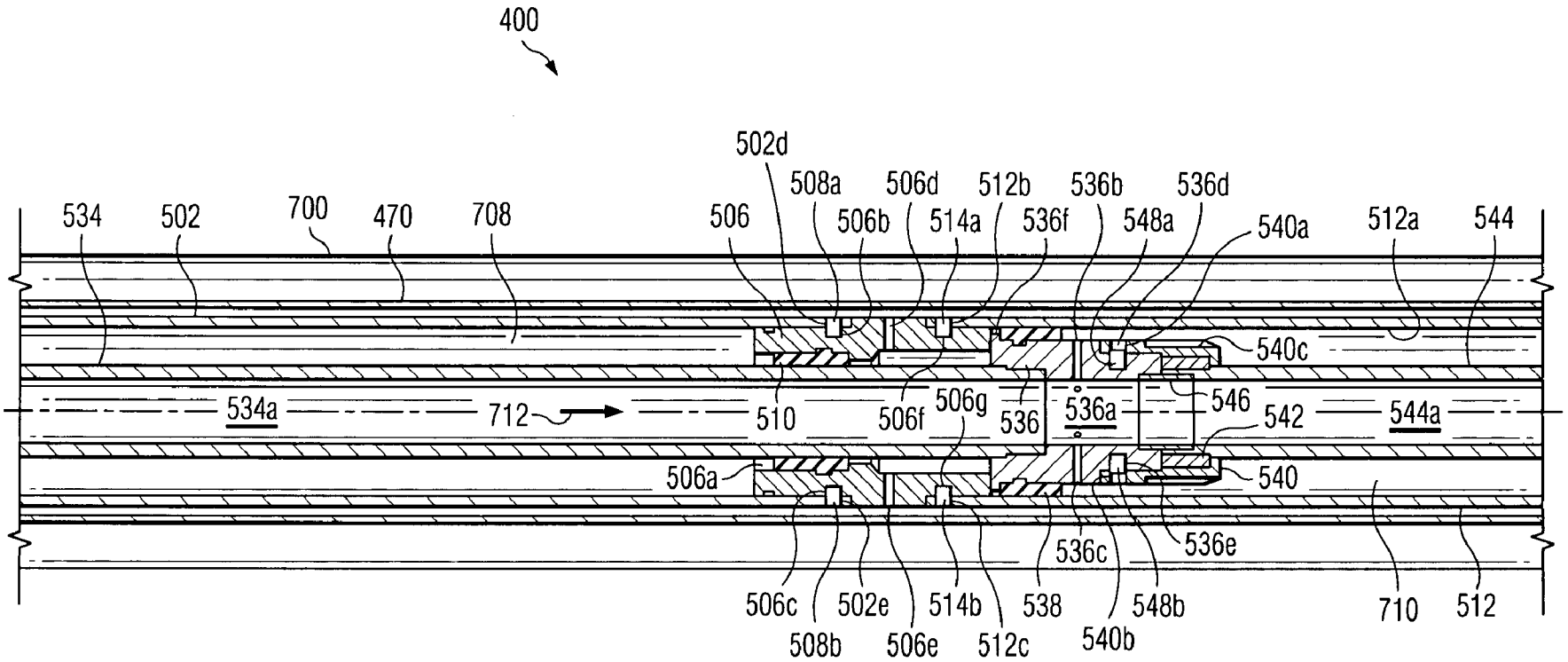
Figure 32H:
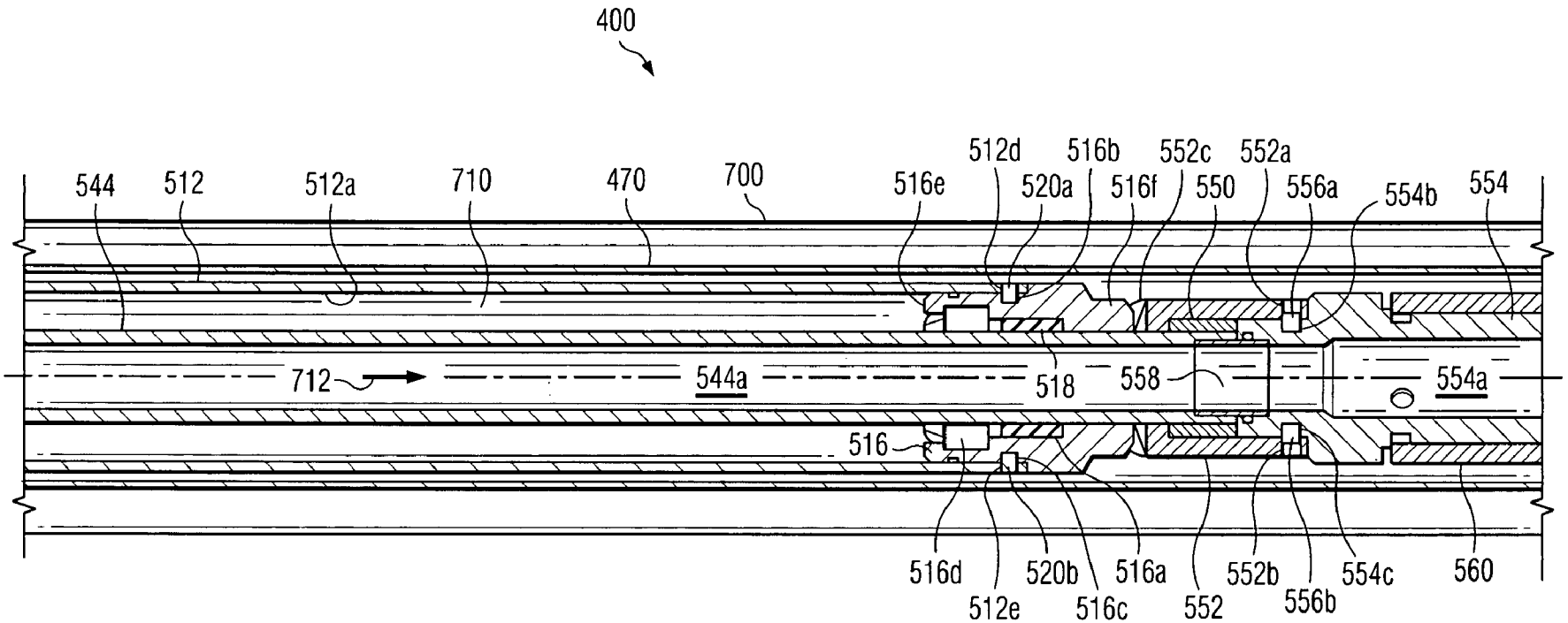
Figure 32I:
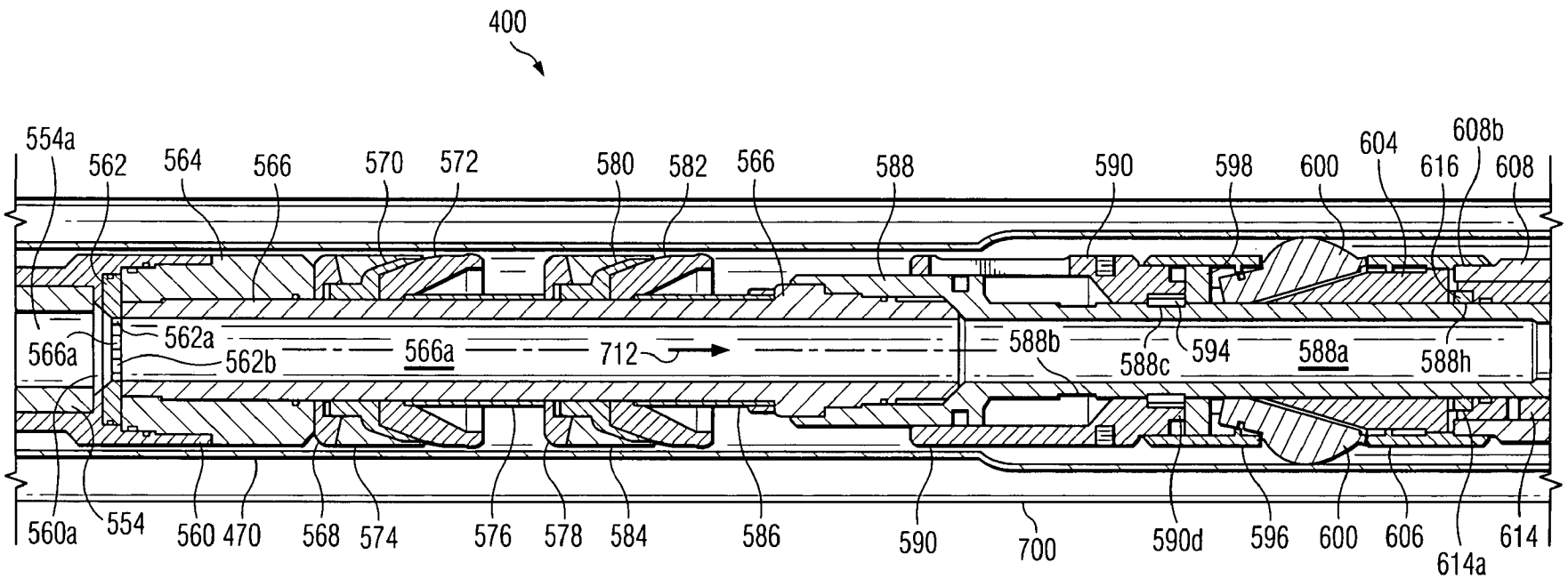
Figure 32J:
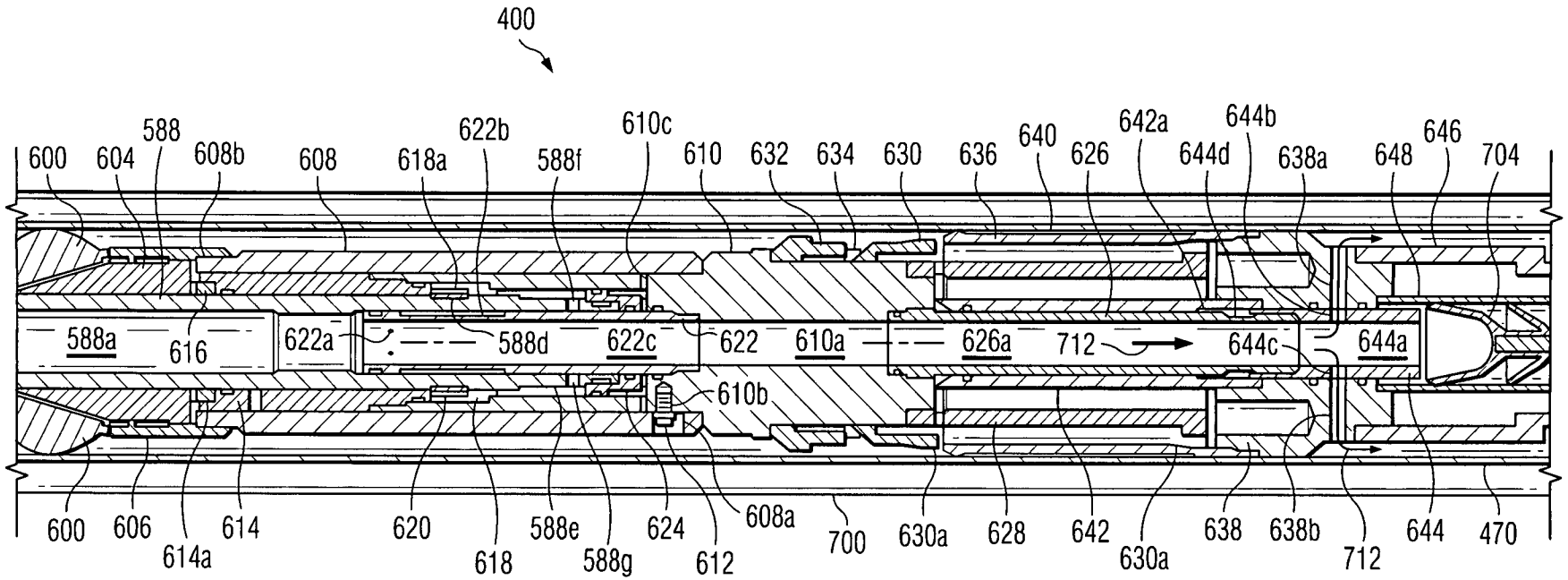
Figure 32K:
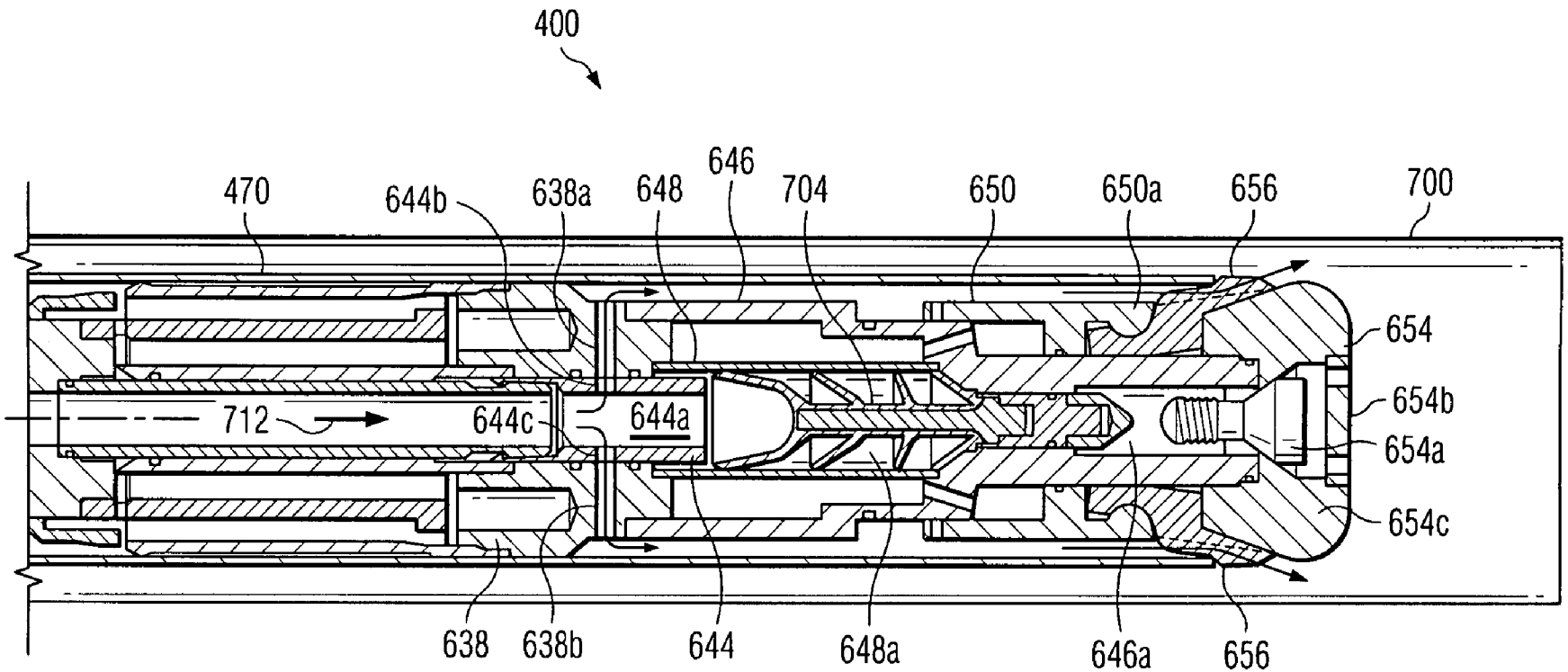

Referring to FIGS. 31*a*-31*n*, the continued injection of the fluidic material 702 into the apparatus 400 continues to pressurize the piston chambers 706, 708, and 710 thereby further displacing the pistons upwardly 526, 530, and 536 upwardly relative to the support member 402. Because the engagement of the locking dogs 656 with the lower end of the casing 470 prevents float valve 654 from entering the casing, the continued upward displacement of the pistons 526, 530, and 536 relative to the support member 402 causes the bypass valve operating probe 626 to be displaced upwardly relative to the support member thereby disengaging the bypass valve operating probe from the probe guide 642, and also causes the sealing sleeve expansion cone 630 to be displaced upwardly relative to the expandable sealing sleeve 636 thereby radially expanding and plastically deforming the sealing sleeve 636 and the elastomeric coating 640 into sealing engagement with the interior surface of the lower end of the casing 470. As a result, the lower end of the casing 470 is fluidicly sealed by the combination of the sealing engagement of the sealing sleeve 636 and elastomeric coating 640 with the interior surface of the lower end of the casing and the positioning the dart 704 within the passage 646*a* of the lower mandrel 646.

Continued injection of the fluidic material 702 into the apparatus 400 continues to pressurize the piston chambers 706, 708, and 710 until the pistons 536, 530 and 536 are displaced upwardly relative to the casing 470 to their maximum upward position relative to the support member 402. As a result, the dart ball guide 524 impacts the positive casing lock mandrel 478 with sufficient force to shear the shear pins, 428*a* and 428*b*, thereby decoupling the positive casing lock mandrel 478 from the casing lock barrel adaptor 474. The positive casing lock mandrel 478 is then displaced upwardly relative to the support member 402 which in turn displaces the positive casing lock releasing mandrel 476 upwardly relative to the positive casing locking dogs 464. As a result, the internal flanges, 464*a* and 464*b*, of the positive casing locking dogs are relocated into engagement with the annular recesses, 476*c* and 476*d*, respectively, of the positive casing lock releasing mandrel 476. The positive casing lock casing collar 466 is thereby released from engagement with the positive casing locking dogs 464 thereby releasing the casings 468 and 470 from engagement with the support member 402. As a result, the positions of the casings, 468 and 470, are no longer fixed relative to the support member 402.

Referring to FIGS. 32*a*-32*k*, the injection of the fluidic material 702 is stopped and the support member 402 is then lowered into the wellbore 700 until the float valve assembly 654 impacts the bottom of the wellbore. The support member 402 is then further lowered into the wellbore 700, with the float valve assembly 654 resting on the bottom of the wellbore, until the bypass valve operating probe 626 impacts and displaces the bypass valve 644 downwardly relative to the bypass valve body 638 to fluidicly couple the passages, 638*a* and 644*b*, and the passages, 638*b* and 644*c*, and until sufficient upward compressive force has been applied to the lower mandrel 610 to re-expand the segmented expansion cone provided by the cone segments, 600 and 602. In an exemplary embodiment, the collet locking member 644*d* of the bypass valve 644 will also engage an end of the bypass valve operating probe 626.

In an exemplary embodiment, the support member 402 is lowered downwardly into the wellbore 700 such that sufficient upward compressive force is applied to the lower mandrel 610 to release the locking ring 620 from engagement with the lock ring groove 588*e*, thereby permitting the lower mandrel 610 and the locking dog retainer 614 to be displaced upwardly relative to the cone mandrel 588. As a result, the locking dog retainer 614 will engage and displace the locking dogs 616, the lower cam 604, the lower cone segments 602, the lower cone retainer 606, and the release housing 608 upwardly relative to the cone mandrel 588 thereby bringing the upper cam 598 and the upper cone segments 600 back into axial alignment with the lower cone segments 602 and the lower cam 604. As a result, the segmented expansion cone is once again expanded. Once the segmented cone has been fully expanded, the locking dogs 616 will once again be positioned in alignment with the locking dog grooves 588*h* of the cone mandrel 588 and will thereby once again engage the locking dog grooves. The continued upward displacement of the lower mandrel 610 relative to cone mandrel 588 will thereby also upwardly displace the locking dog retainer 614 upwardly relative to the cone mandrel thereby once again capturing and restraining the locking dogs 616 within the annular recess 614*a* of the locking dog retainer. As a result, the new expansion position of the lower cone segments 602 and the lower cam 604 relative to the cone mandrel 588 will be releasably locked by the locking dogs 616. Furthermore, the locking ring 620 will also be relocated from engagement with the lock ring groove 588*e* to engagement with the lock ring groove 588*d* to thereby releasably lock the expanded segmented cone in the expanded position.

A hardenable fluidic sealing material 712 may then be injected into the apparatus 400 through the passages 402*a*, 404*a*, 406*a*, 454*a*, 450*a*, 456*a*, 458*a*, 476*a*, 478*a*, 522*a*, 526*a*, 529*a*, 530*a*, 534*a*, 536*a*, 544*a*, 554*a*, 566*a*, 588*a*, 622*a*, 610*a*, 626*a*, 638*a*, 638*b*, 644*b*, and 644*c*, and out of the apparatus through the circumferential gaps defined between the circumferentially spaced apart locking dogs 656 into the annulus between the casings 468 and 470 and the wellbore 700. In an exemplary embodiment, the hardenable fluidic sealing material 712 is a cement suitable for well construction. The hardenable fluidic sealing material 712 may then be allowed to cure before or after the further radial expansion and plastic deformation of the casings 468 and/or 470.

Figure 33A:
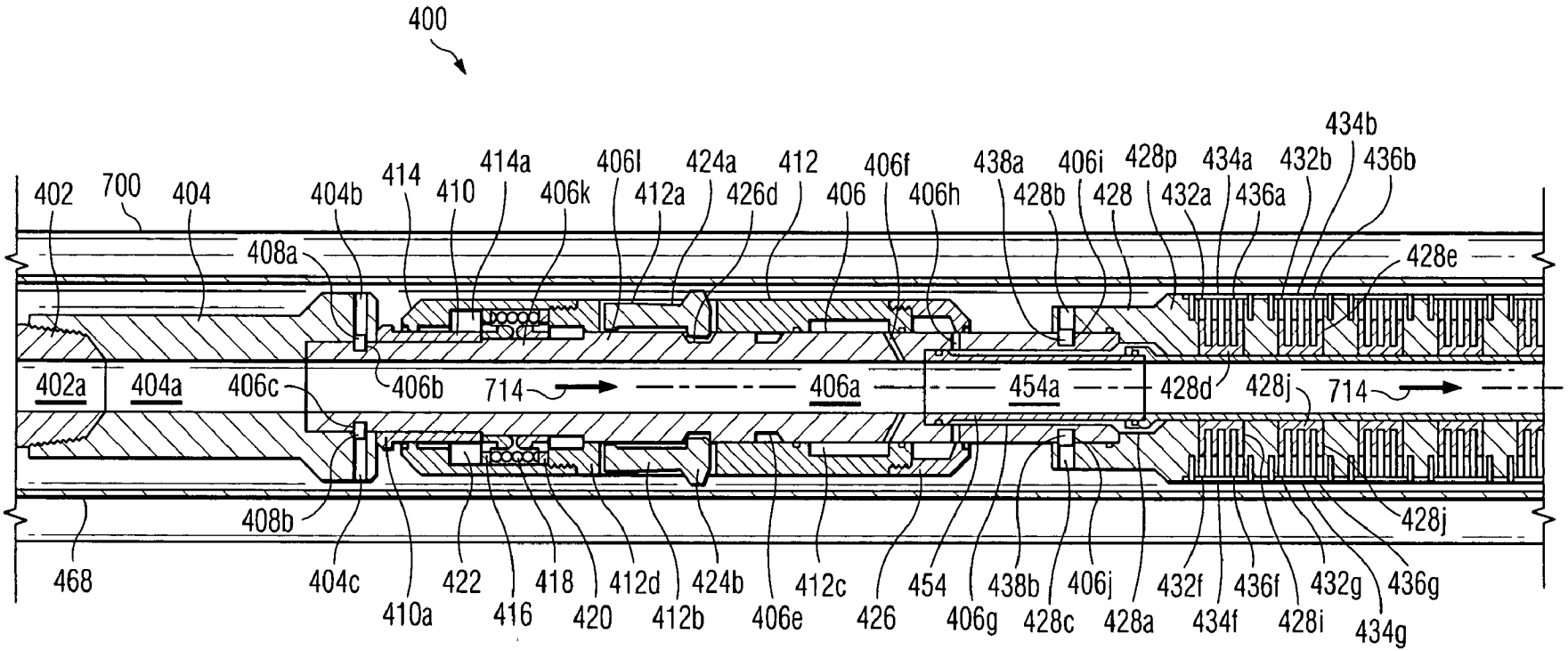
FIGS. 33*a*-33*p* are fragmentary cross sectional illustrations of the apparatus of FIGS. 32*a*-32*k* during the radial expansion and plastic deformation of the casing.
Figure 33B:
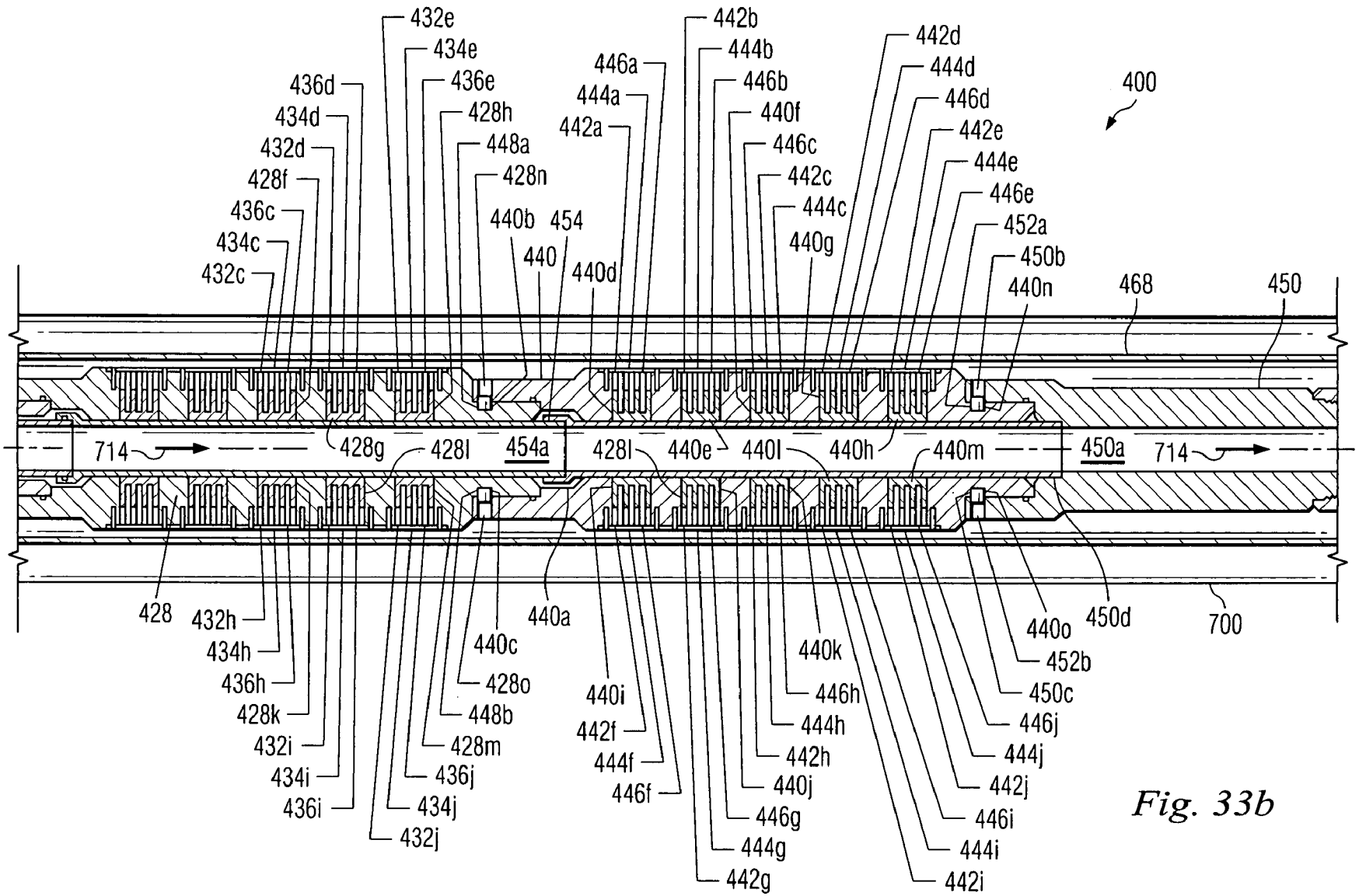
Figure 33C:
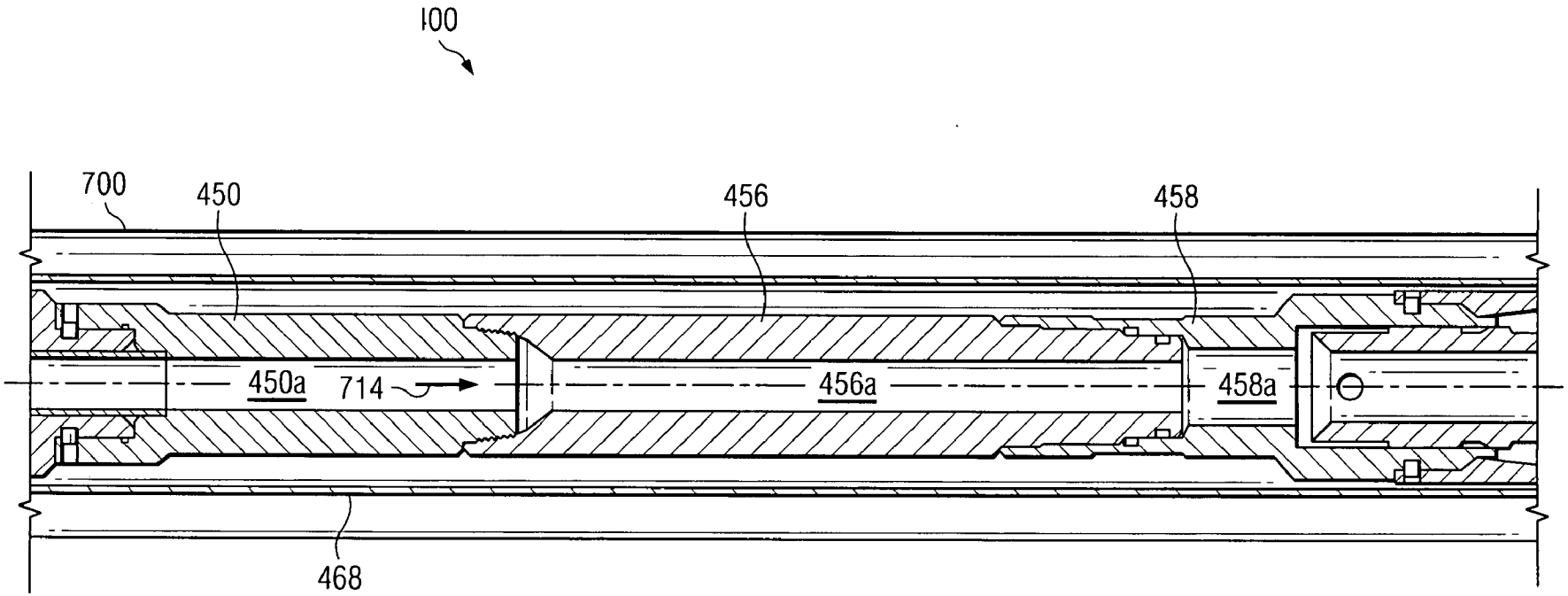
Figure 33D:
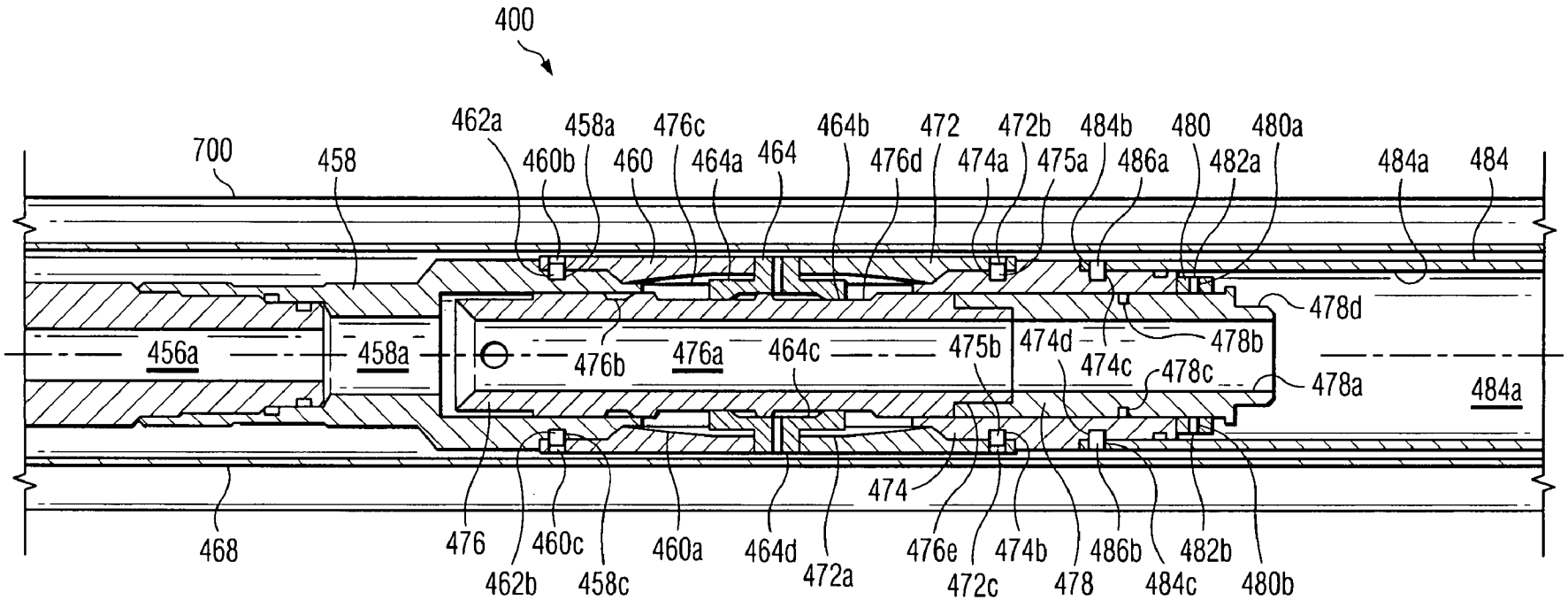
Figure 33E:
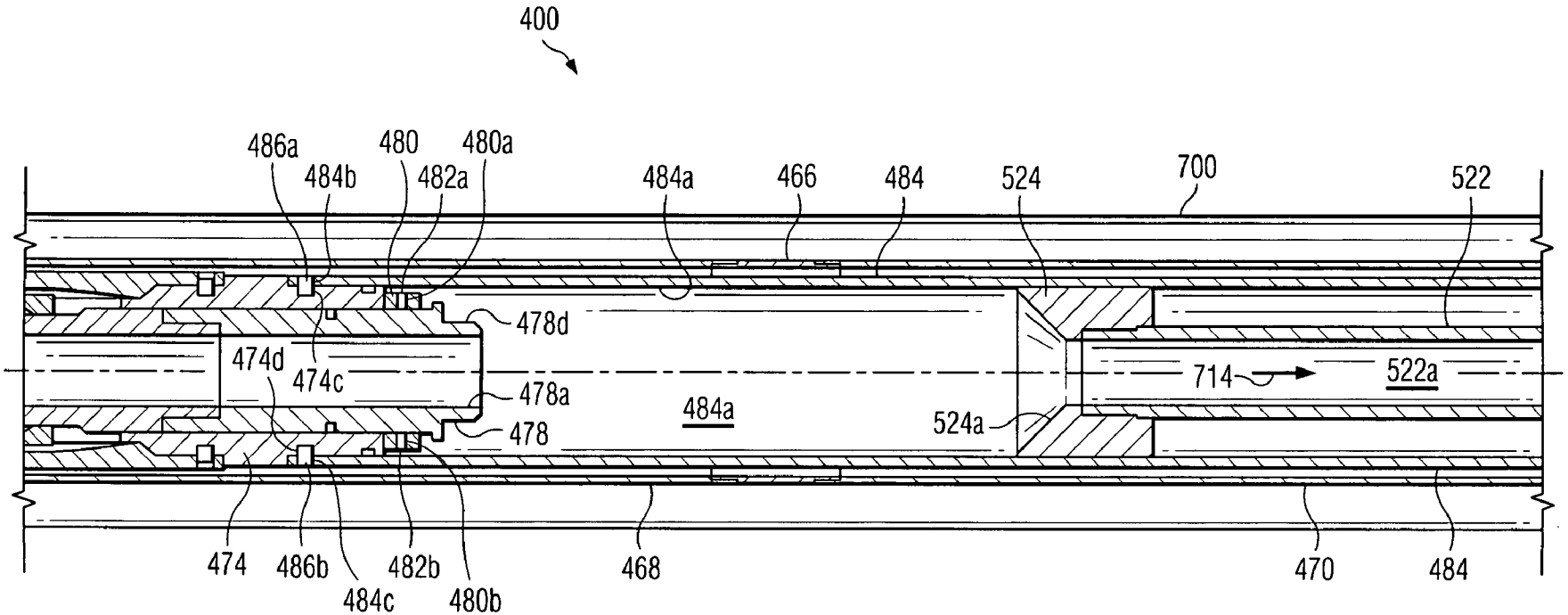
Figure 33F:
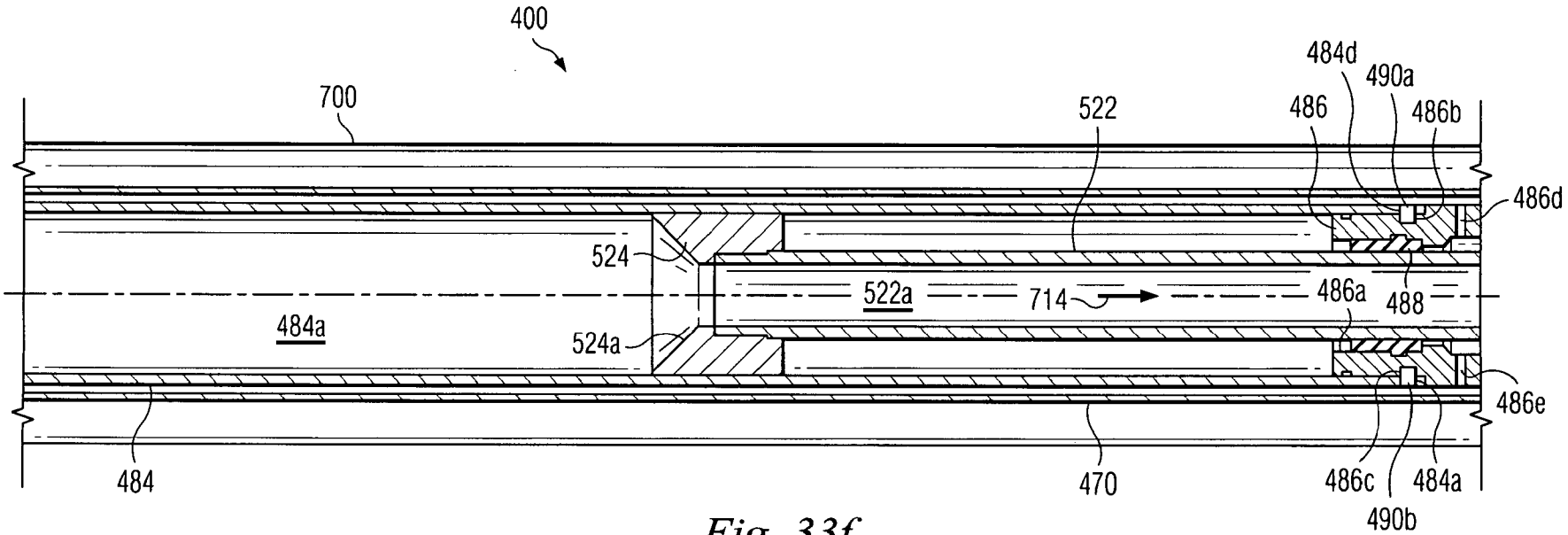
Figure 33G:
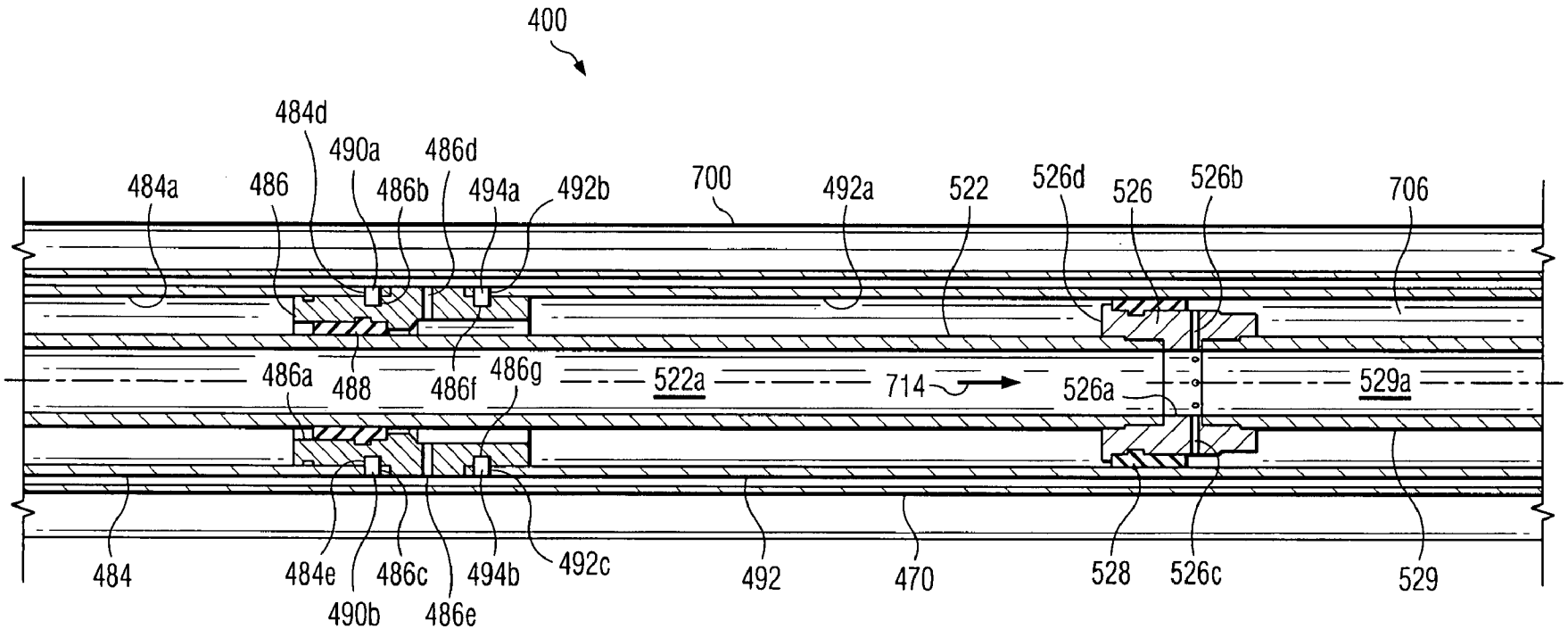
Figure 33H:
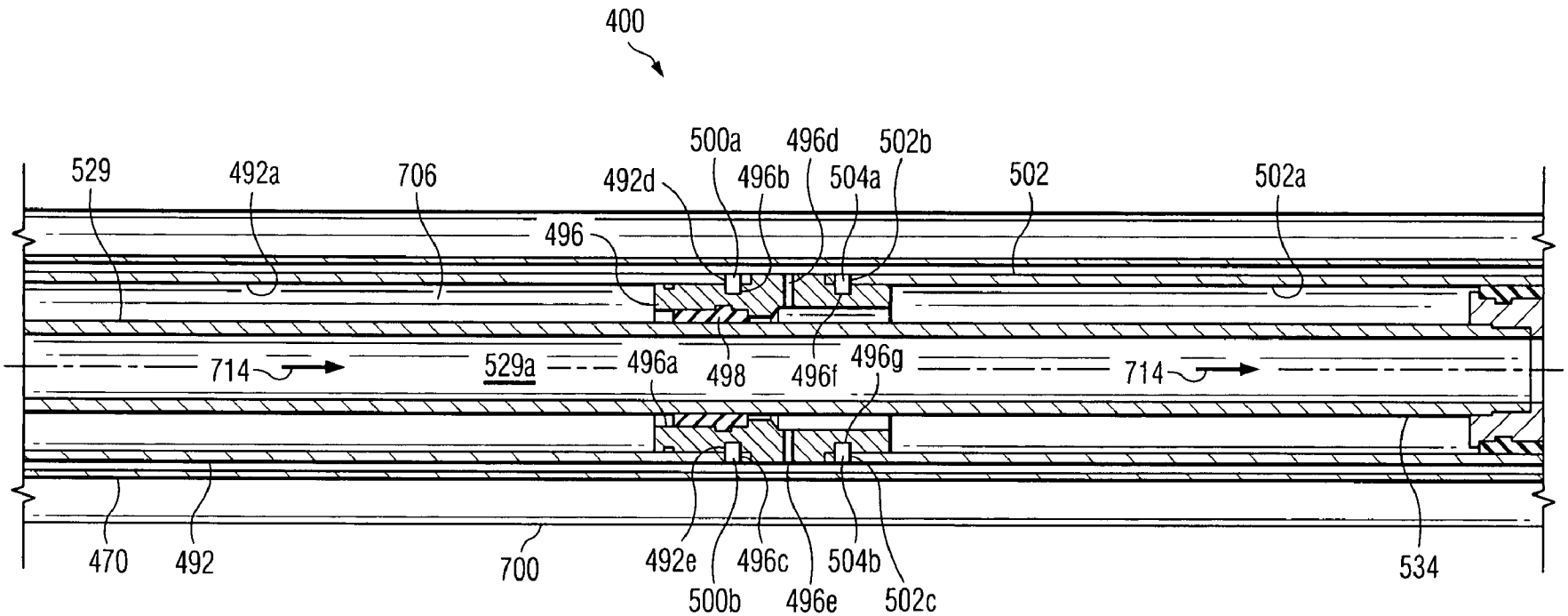
Figure 33I:
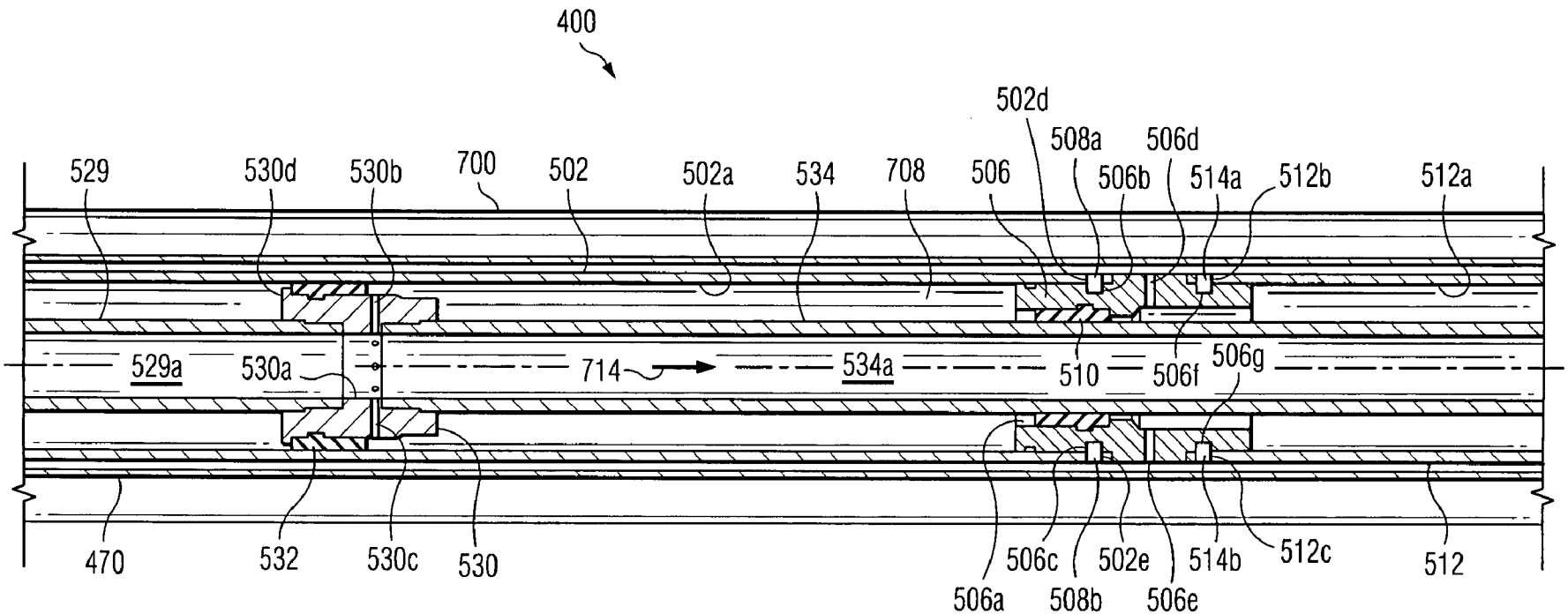
Figure 33J:
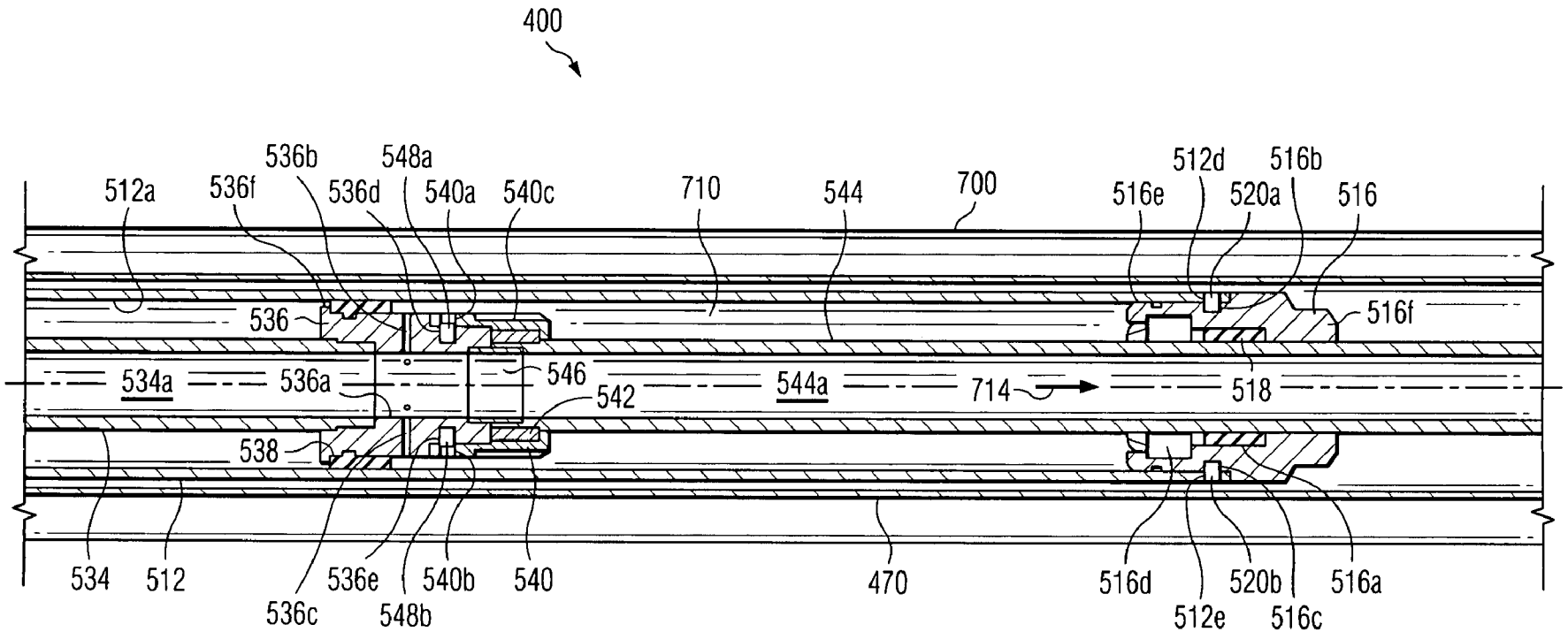
Figure 33K:
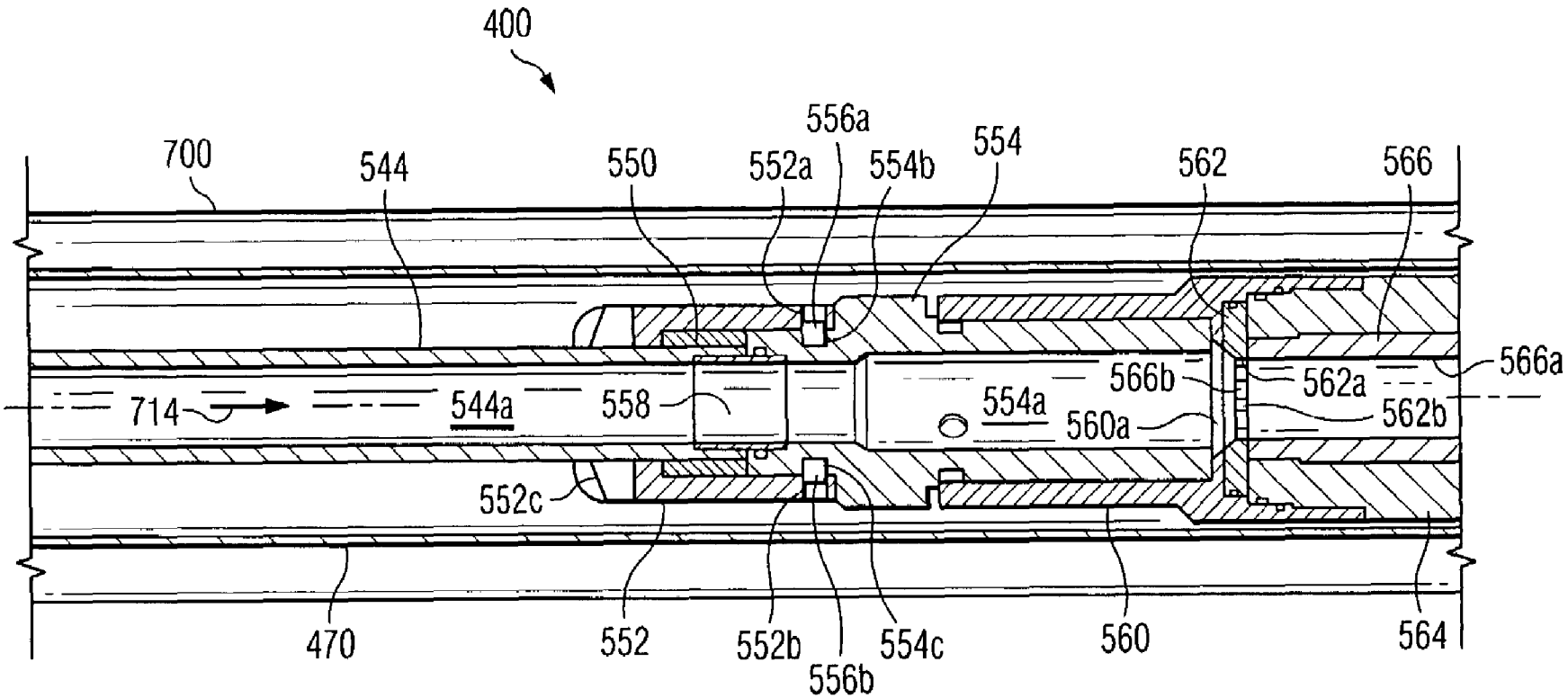
Figure 33L:
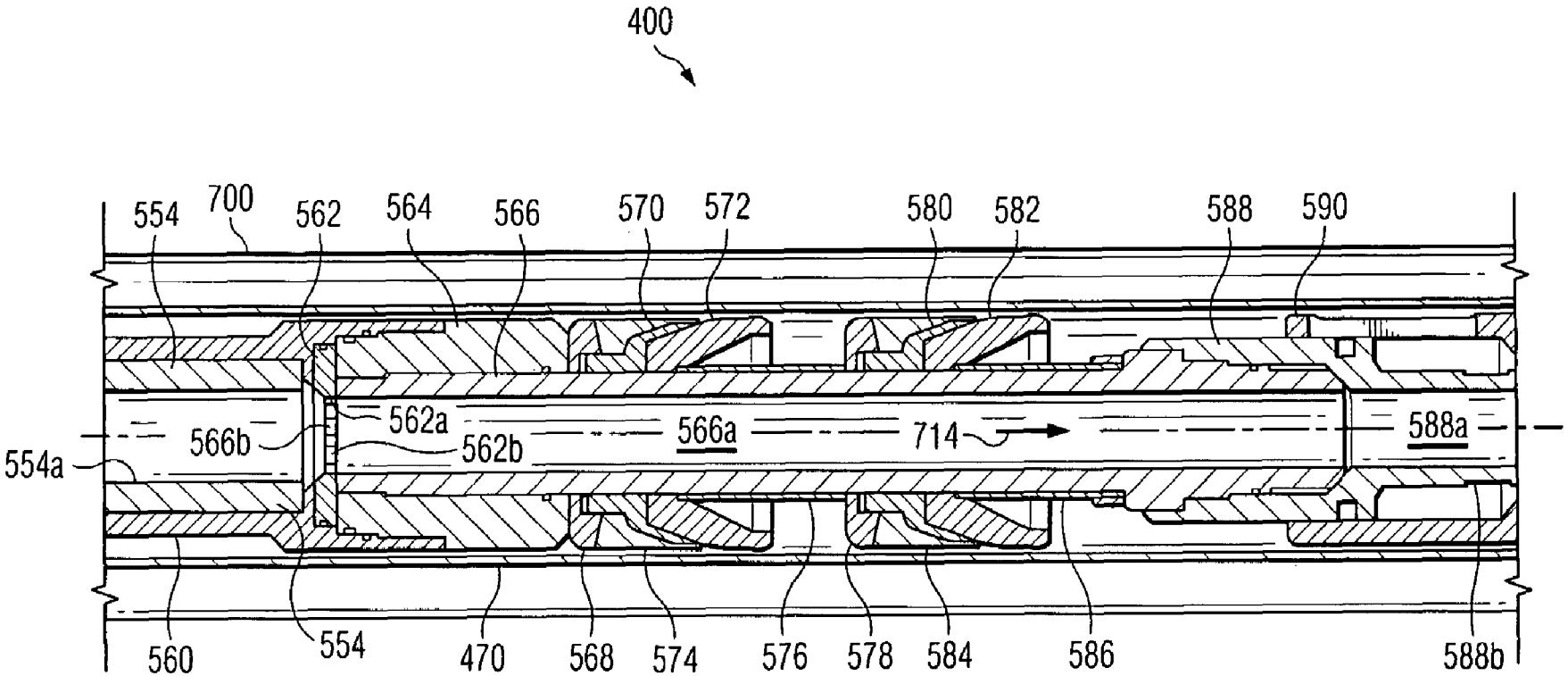
Figure 33M:
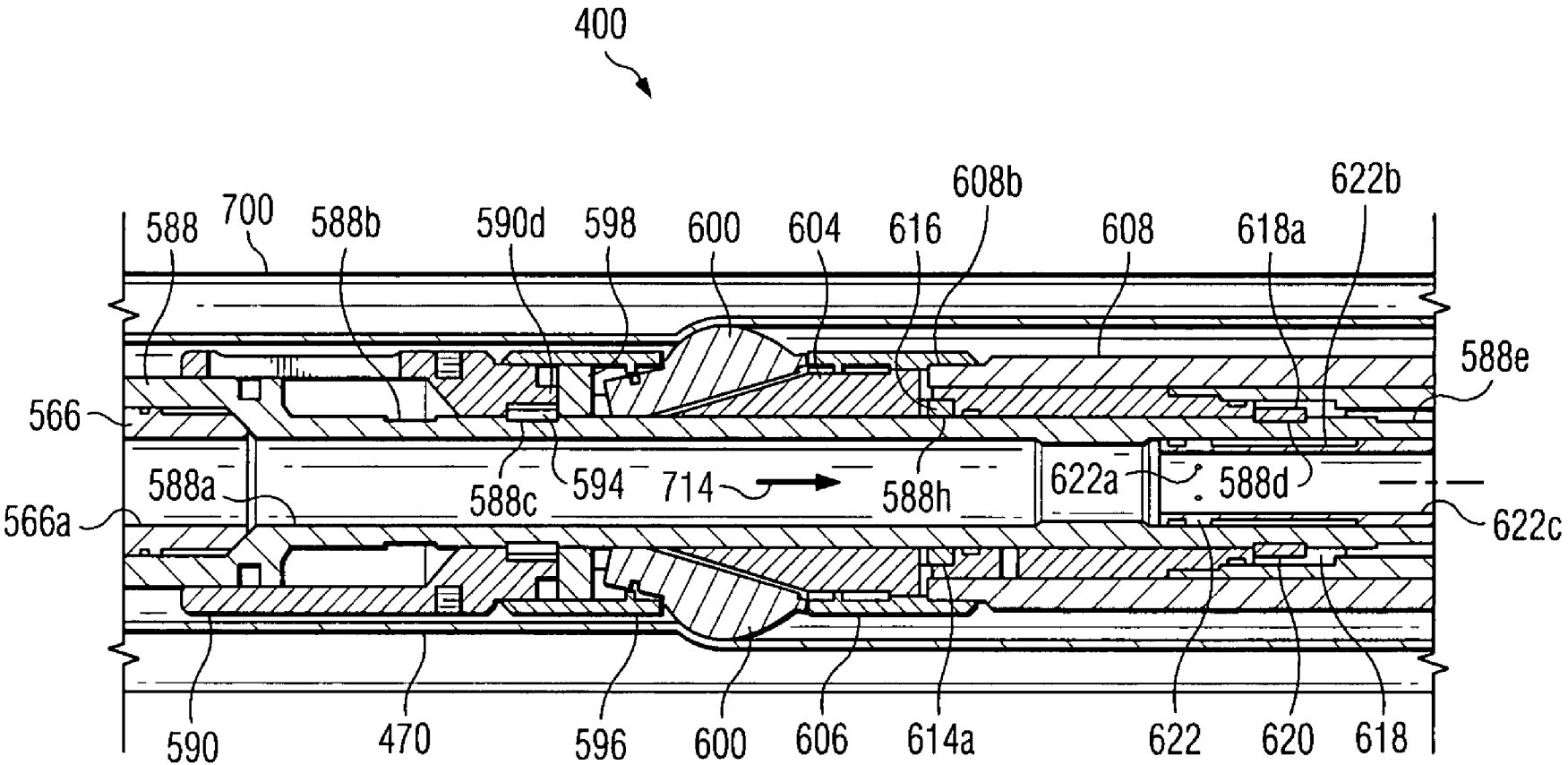
Figure 33N:
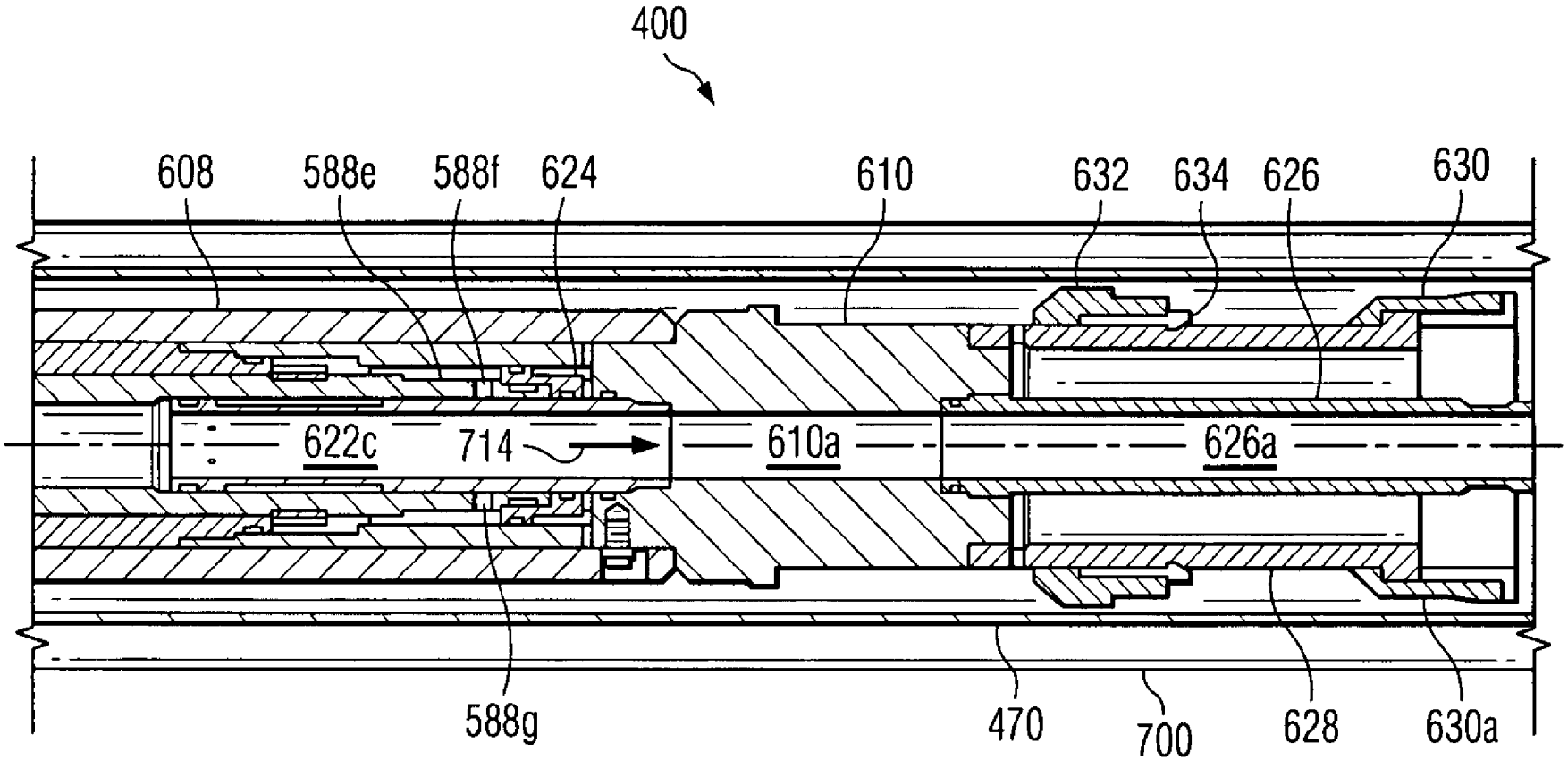
Figure 33O:
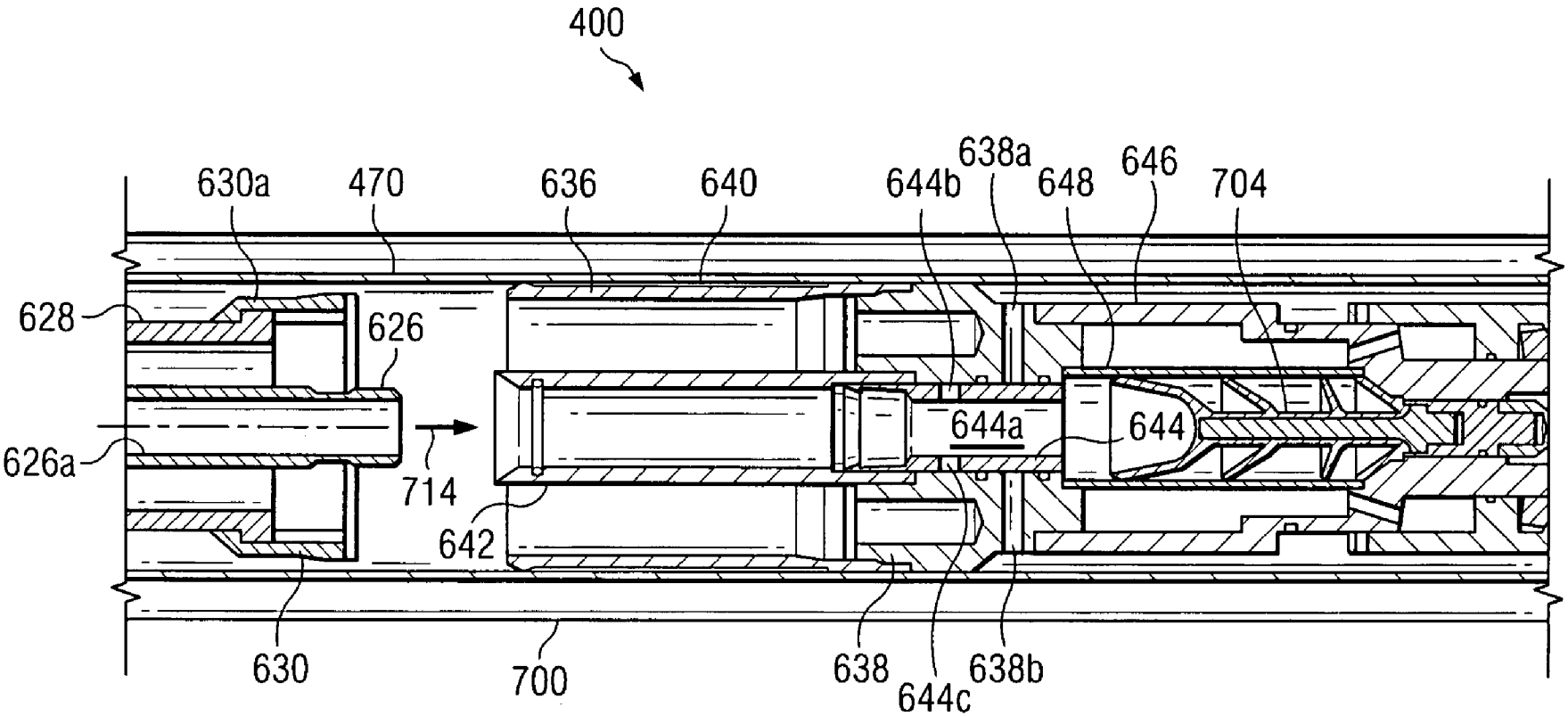
Figure 33P:
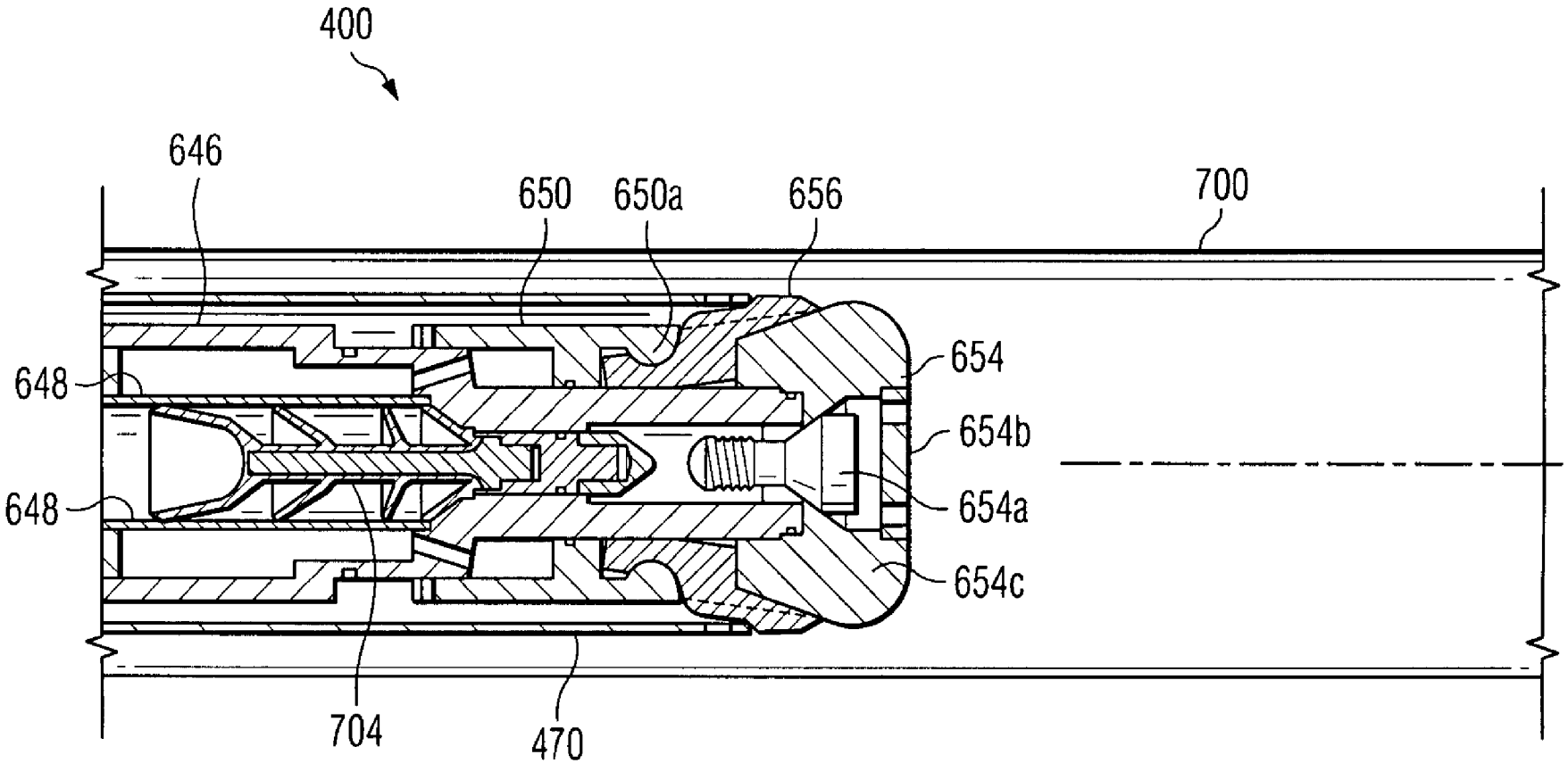

Referring to FIGS. 33*a*-33*p*, after completing the injection of the fluidic material 712, the support member 402 is then lifted upwardly thereby displacing the bypass valve operating probe 626 and the bypass valve 644 upwardly to fluidicly decouple the passages, 638*a* and 644*b* and 638*b* and 644*c*, until the collet locking member 644*d* of the bypass valve is decoupled from the bypass valve operating probe. The support member 402 is then further lifted upwardly until the segmented expansion cone, provided by the interleaved and axially aligned cone segments, 600 and 602, impacts the transition between the expanded and unexpanded sections of the casing 470. A fluidic material 714 is then injected into the apparatus 400 through the passages 402*a*, 404*a*, 406*a*, 454*a*, 450*a*, 456*a*, 458*a*, 476*a*, 478*a*, 484*a*, 524*a*, 522*a*, 526*a*, 529*a*, 530*a*, 534*a*, 536*a*, 544*a*, 554*a*, 566*a*, 588*a*, 622*c*, 610*a*, and 626*a* thereby pressurizing the interior portion of the casing 470 below the packer cups, 572 and 582. In particular, the packer cups, 572 and 582, engage the interior surface of the casings 468 and/or 470 and thereby provide a dynamic movable fluidic seal. As a result, the pressure differential across the packer cups, 572 and 582, causes an upward tensile force that pulls the segmented expansion cone provided by the axially aligned and interleaved cone segments, 600 and 602, to be pulled upwardly out of the casings 468 and/or 407 by the packer cups thereby radially expanding and plastically deforming the casings. Furthermore, the lack of a fluid tight seal between the cone segments, 572 and 582, and the casings 468 and/or 470 permits the fluidic material 714 to lubricate the interface between the cone segments and the casings during the radial expansion and plastic deformations of the casings by the cone segments. In an exemplary embodiment, during the radial expansion and plastic deformation of the wellbore casings 468 and/or 470, the support member 402 is lifted upwardly out of the wellbore 700. In several alternative embodiments, the casings 468 and/or 470 are radially expanded and plastically deformed into engagement with at least a portion of the interior surface of the wellbore 700.

Referring to FIGS. 34*a*-34*l*, in an exemplary embodiment, a preexisting wellbore casing 716 is coupled to, or otherwise support by or within, the wellbore 700. In an exemplary embodiment, during the radial expansion and plastic deformation of the portion of the casing 468 and/or 470 that overlaps with the preexisting casing 716, during the continued injection of the fluidic material 714, the bypass valve body 412 is shifted downwardly relative to the gripper upper mandrel 406 thereby fluidicly coupling the casing gripper hydraulic ports, 406*f* and 406*h*. As a result, the interior passages, 428*a* and 440*a*, of the gripper bodies, 428 and 440, are pressurized thereby displacing the hydraulic slip pistons, 432*a*-432*j* and 442*a*-442*j*, radially outward into engagement with the interior surface of the preexisting wellbore casing 716. After the hydraulic slip pistons, 432*a*-432*j* and 442*a*-442*j*, engage the preexisting wellbore casing 716, the continued injection of the fluidic material 714 causes the segmented expansion cone including the axially aligned and interleaved cone segments, 600 and 602, to be pulled through the overlapping portions of the casings 468 and/or 470 and the preexisting wellbore casing by the upward displacement of the pistons, 526, 530, and 536, relative to the preexisting wellbore casing. In this manner, the overlapping portions of the casings 468 and/or 470 and the preexisting wellbore casing 716 are simultaneously radially expanded and plastically deformed by the upward displacement of the segmented expansion cone including the axially aligned and interleaved cone segments, 600 and 602. In several alternative embodiments, the hydraulic slip pistons, 432*a*-432*j* and 442*a*-442*j*, are displaced radially outward into engagement with the interior surface of the casings 468 and/or 470 and/or the preexisting wellbore casing 716.

Figure 34A:
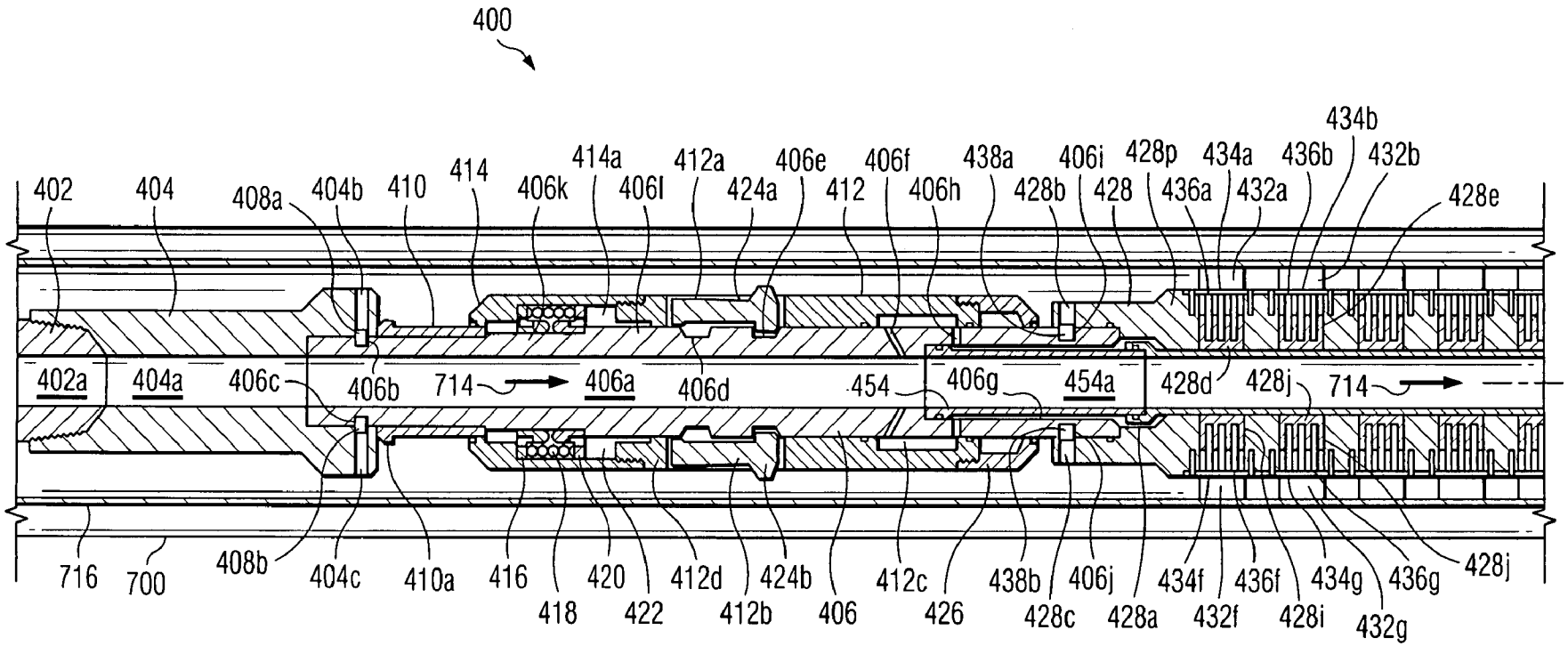
FIGS. 34*a*-34*l* are fragmentary cross sectional illustrations of the apparatus of FIGS. 33*a*-33*p* during the radial expansion and plastic deformation of a portion of the casing that overlaps within a preexisting wellbore casing within the wellbore.
Figure 34B:
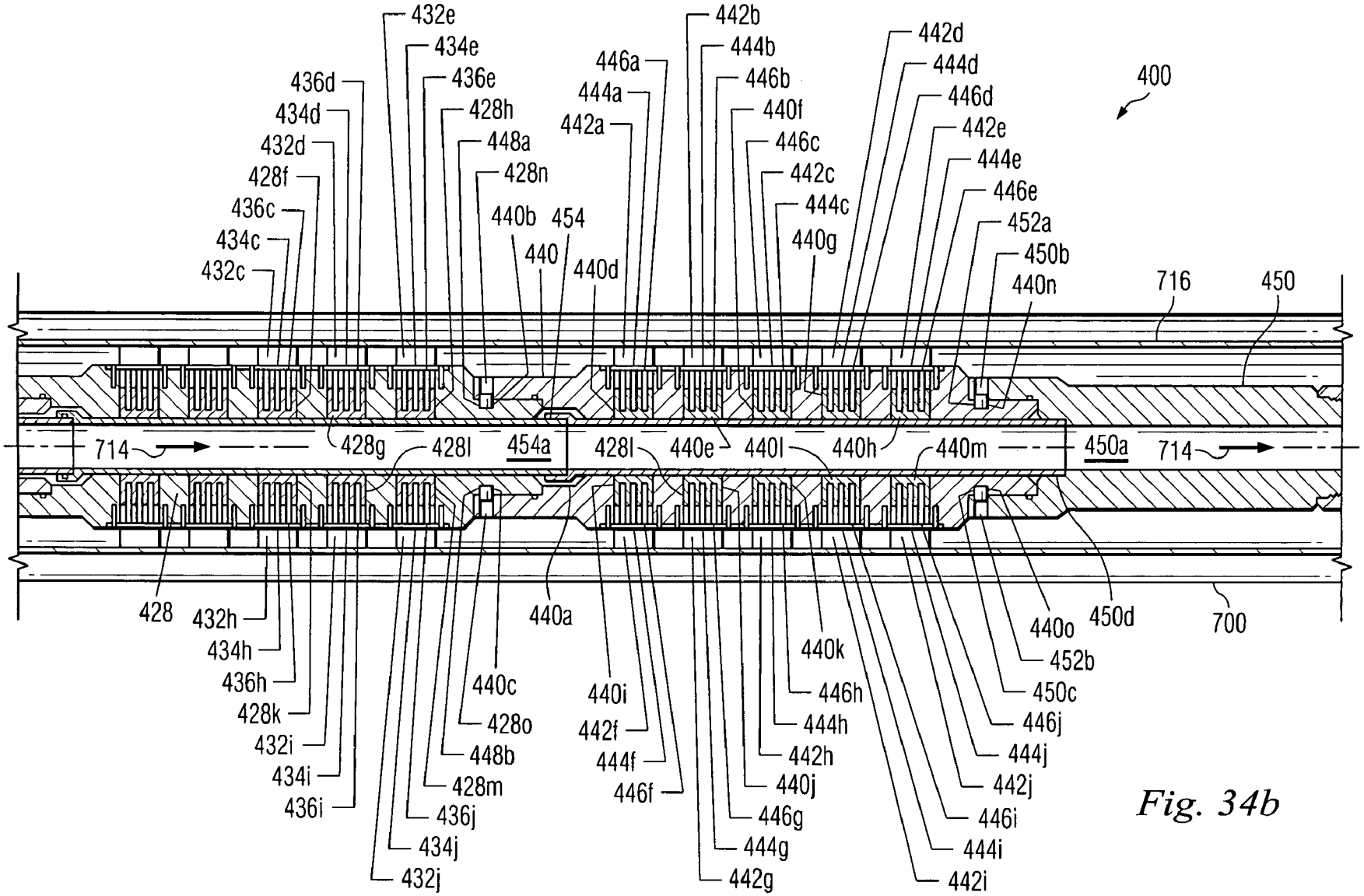
Figure 34C:
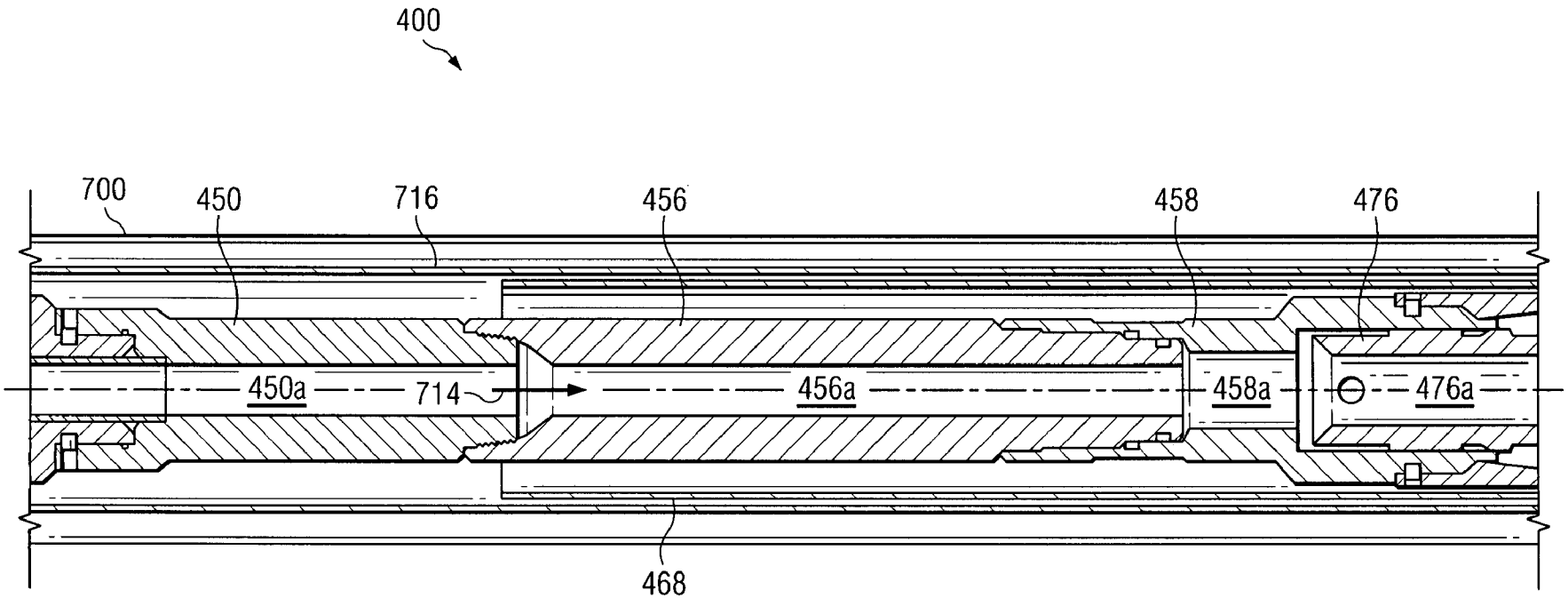
Figure 34D:
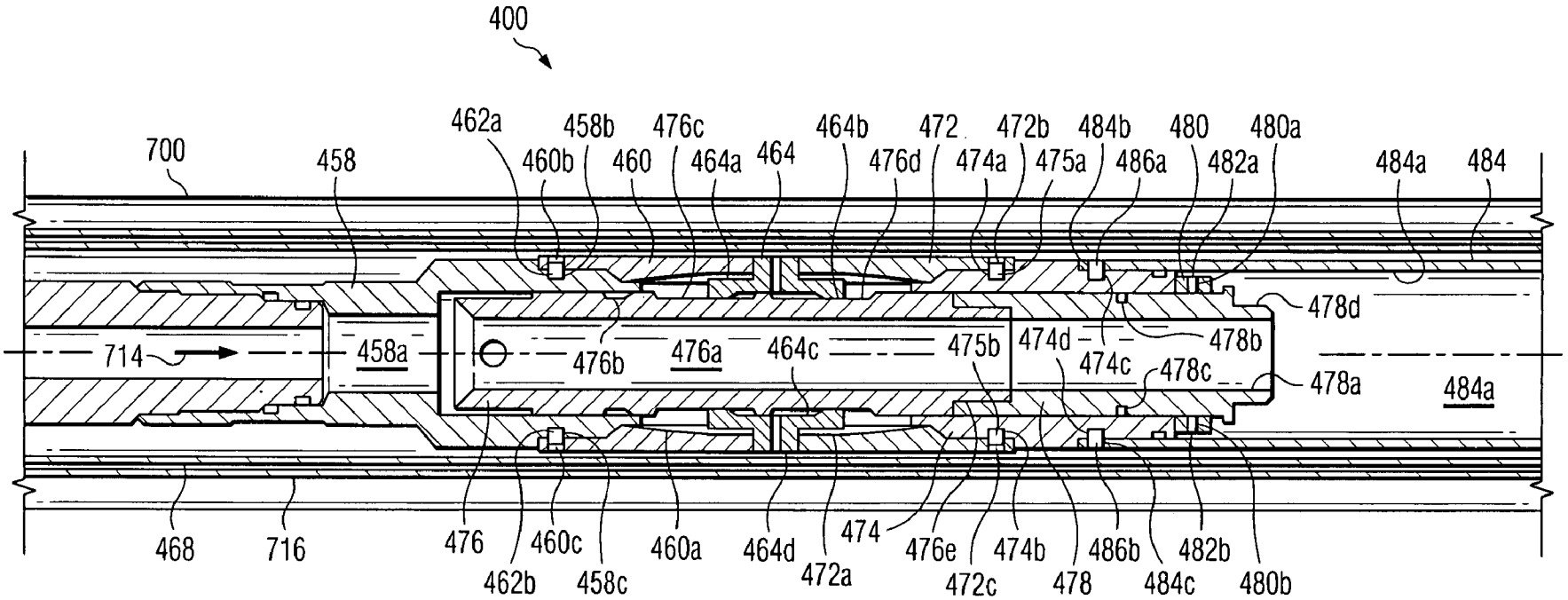
Figure 34E:
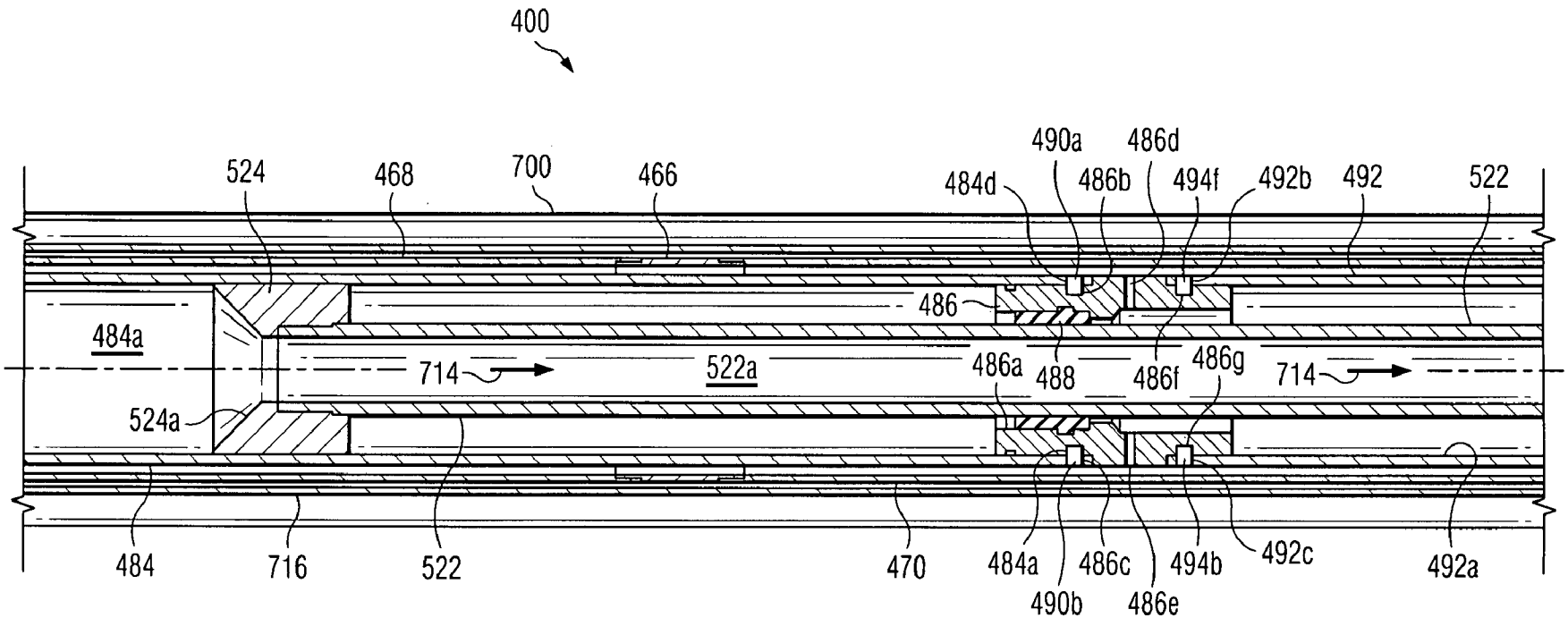
Figure 34F:
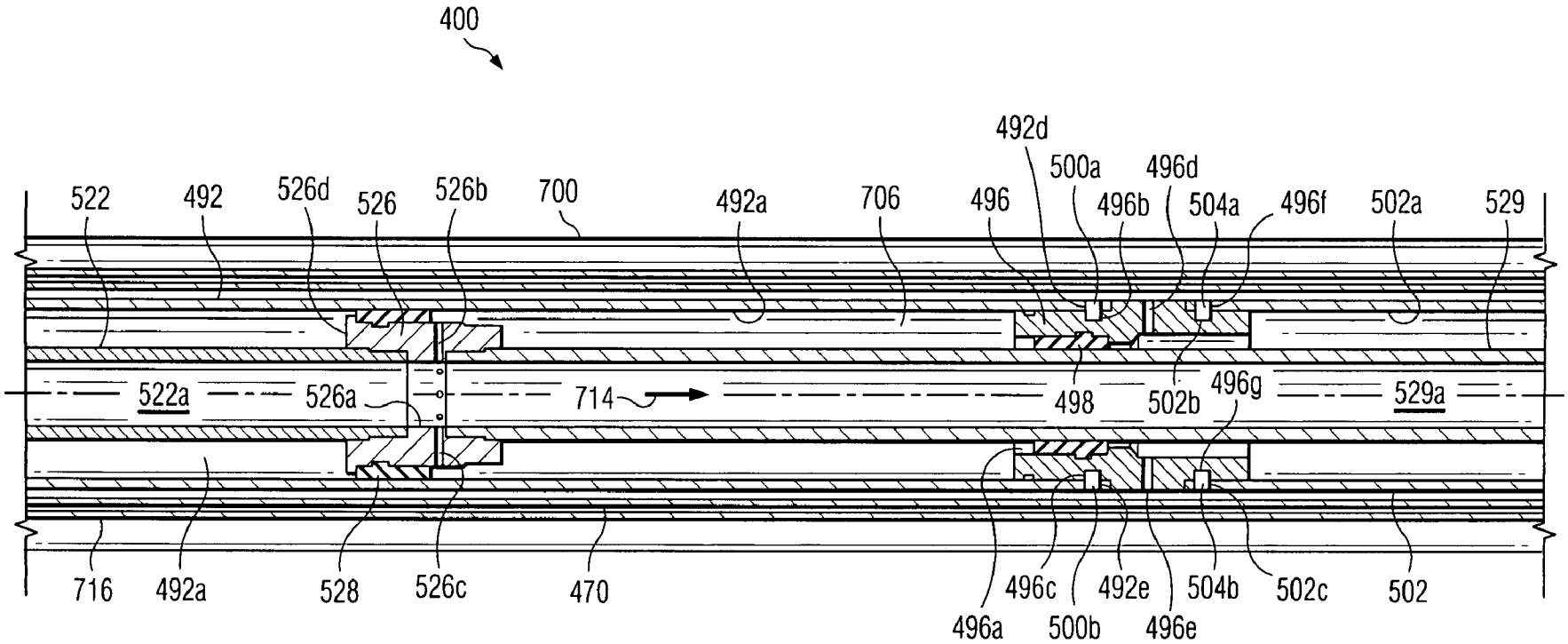
Figure 34G:
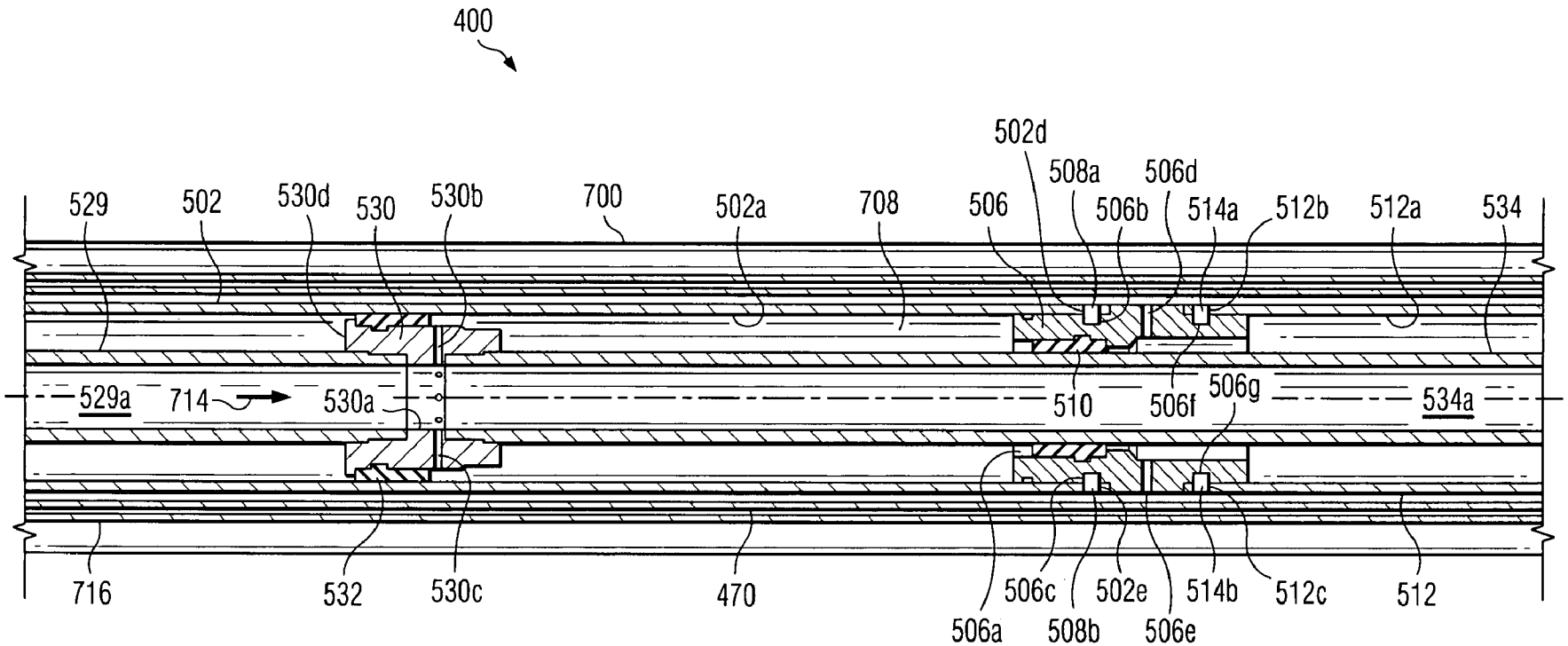
Figure 34H:
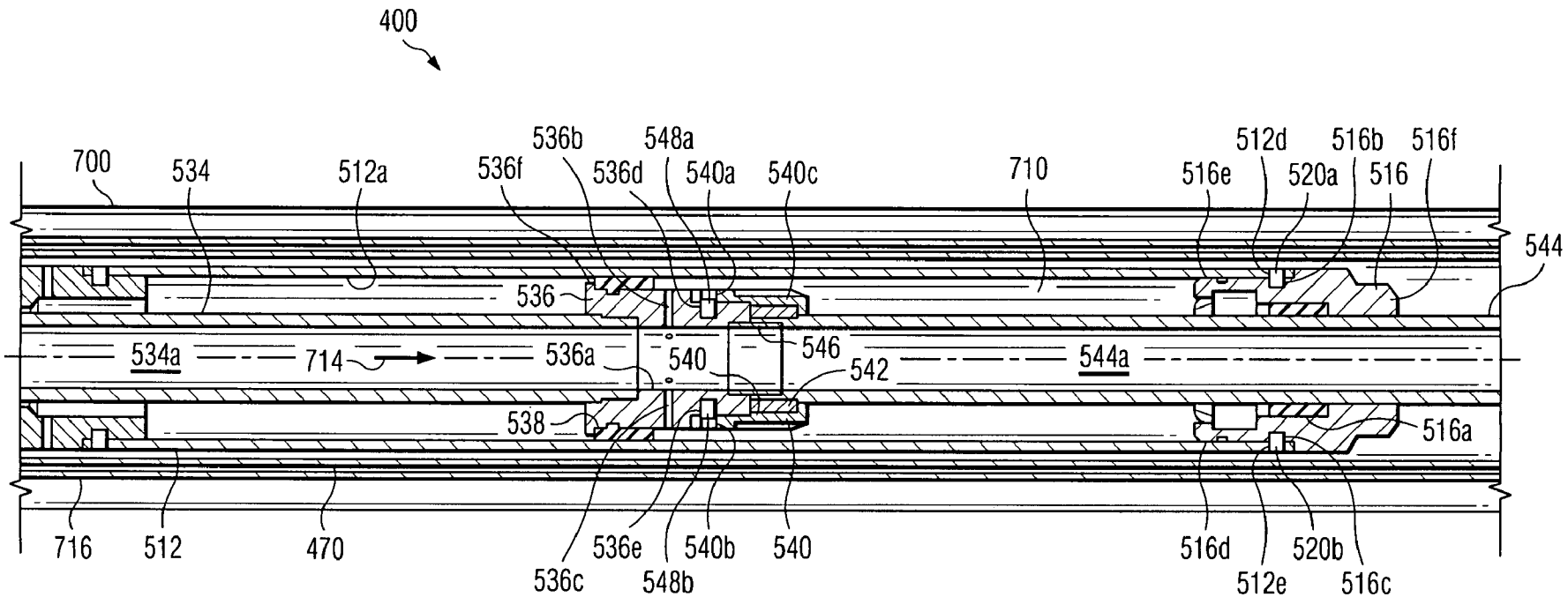
Figure 34I:
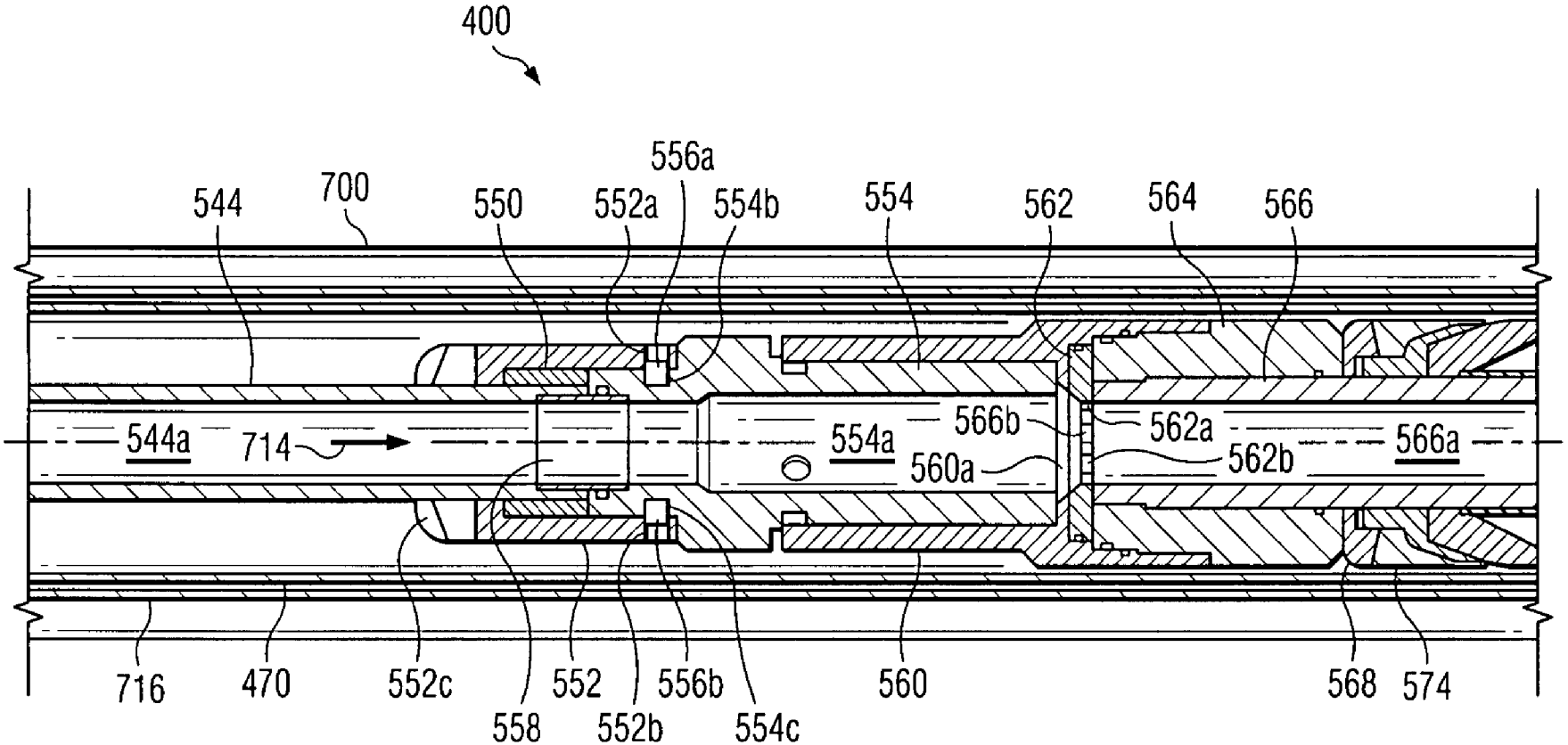
Figure 34J:
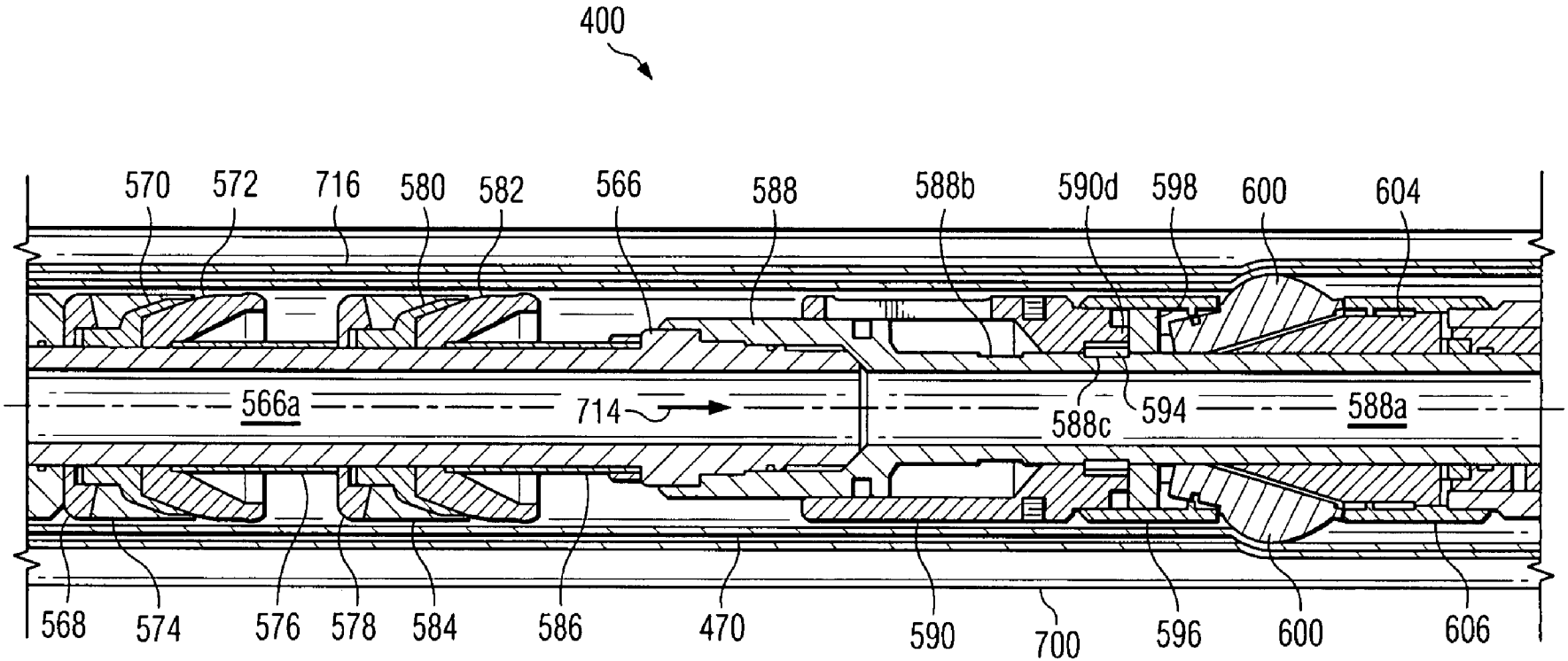
Figure 34K:
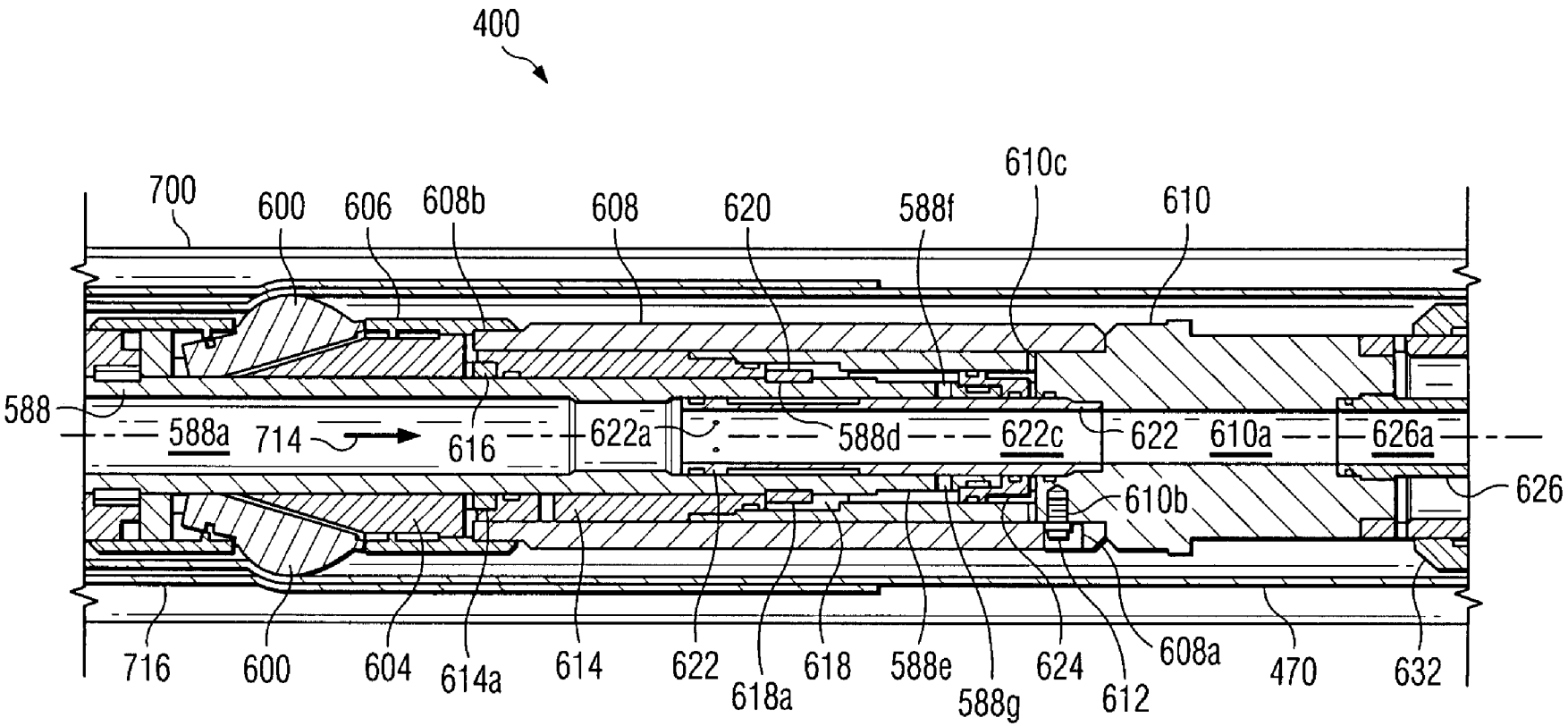
Figure 34L:
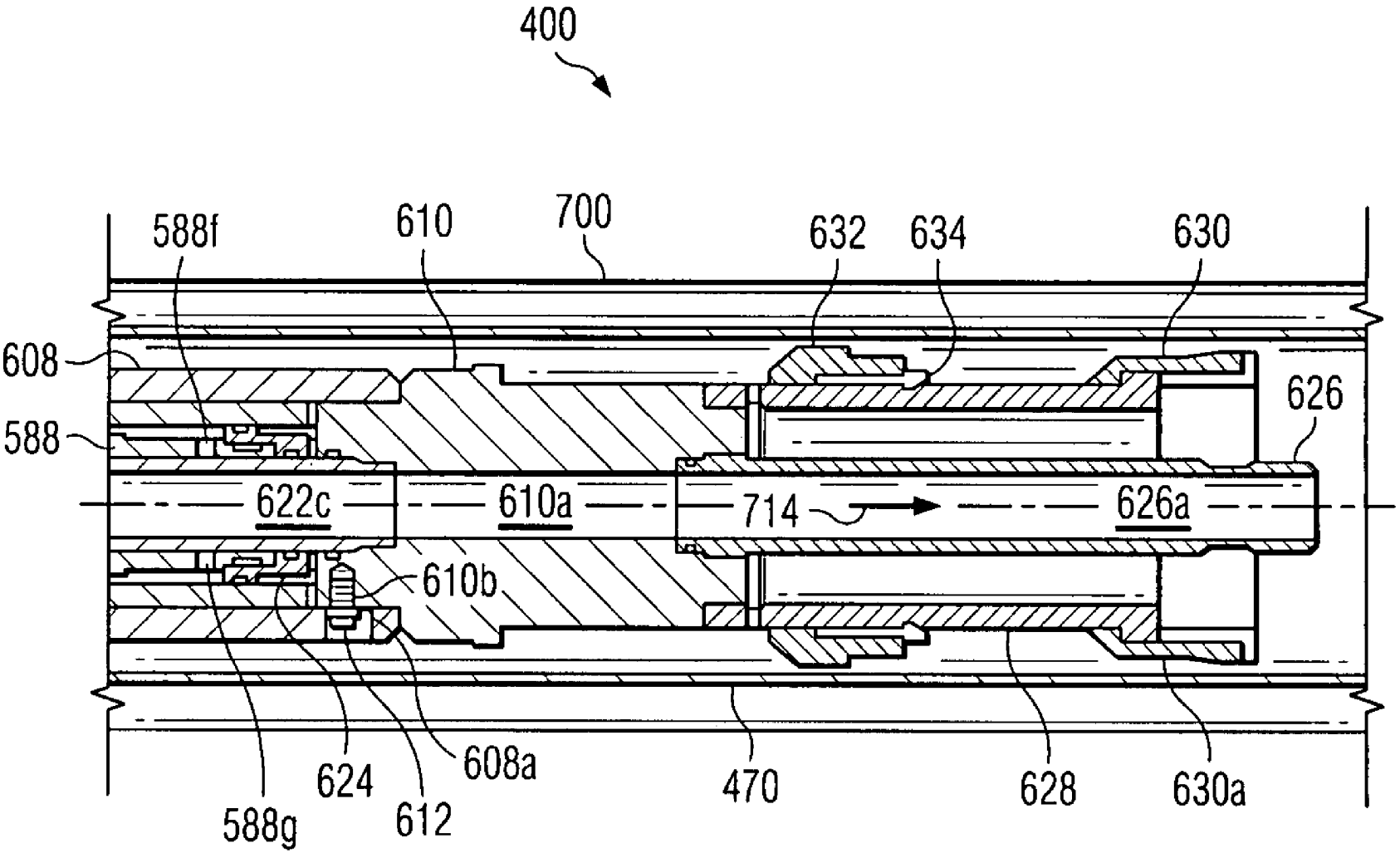
Figure 35A:
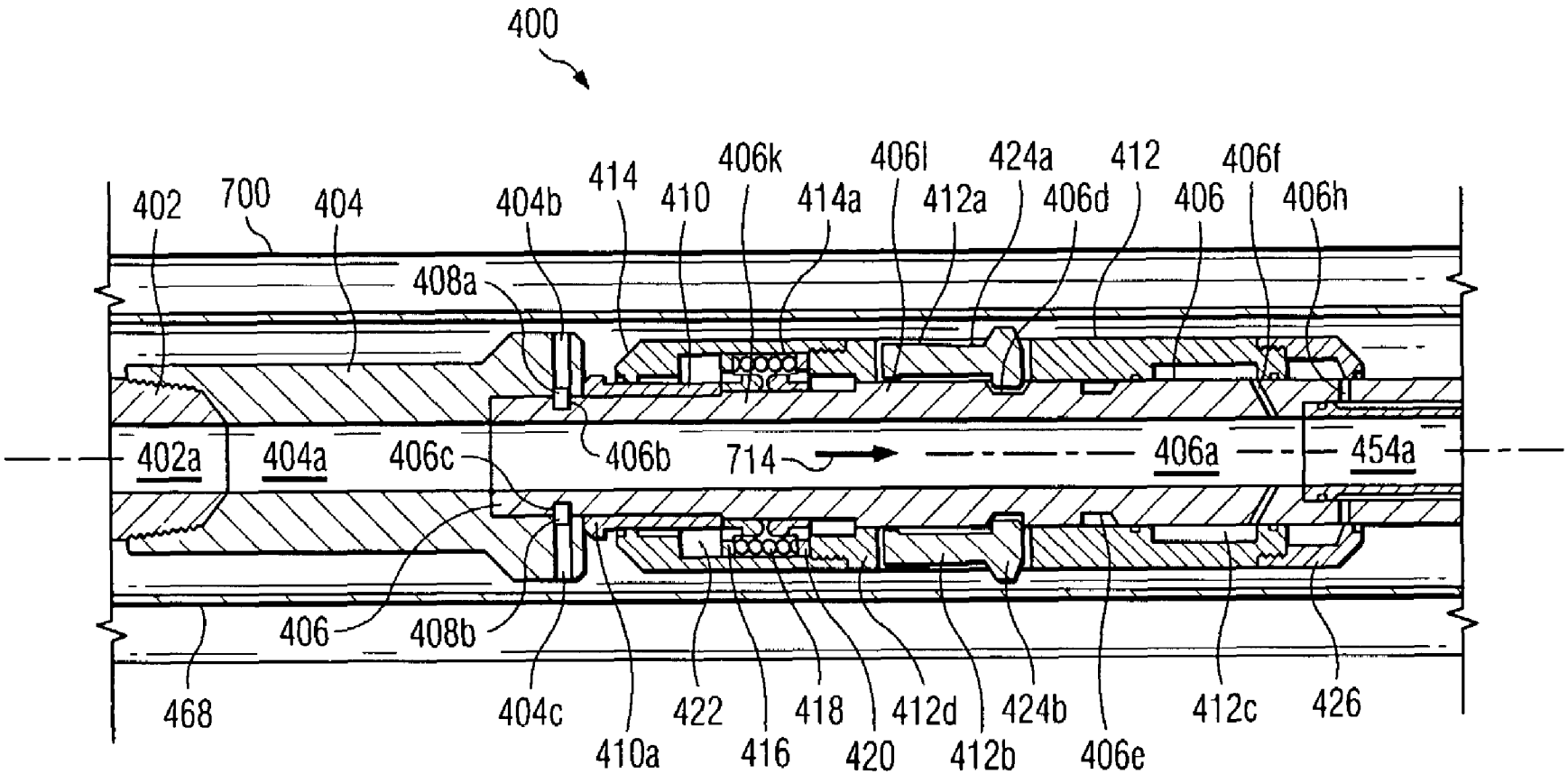
FIGS. 35*a*-35*l* are fragmentary cross sectional illustrations of the apparatus of FIGS. 28*a*-28*j* during the emergency collapse of the expansion cone assembly.
Figure 35B:
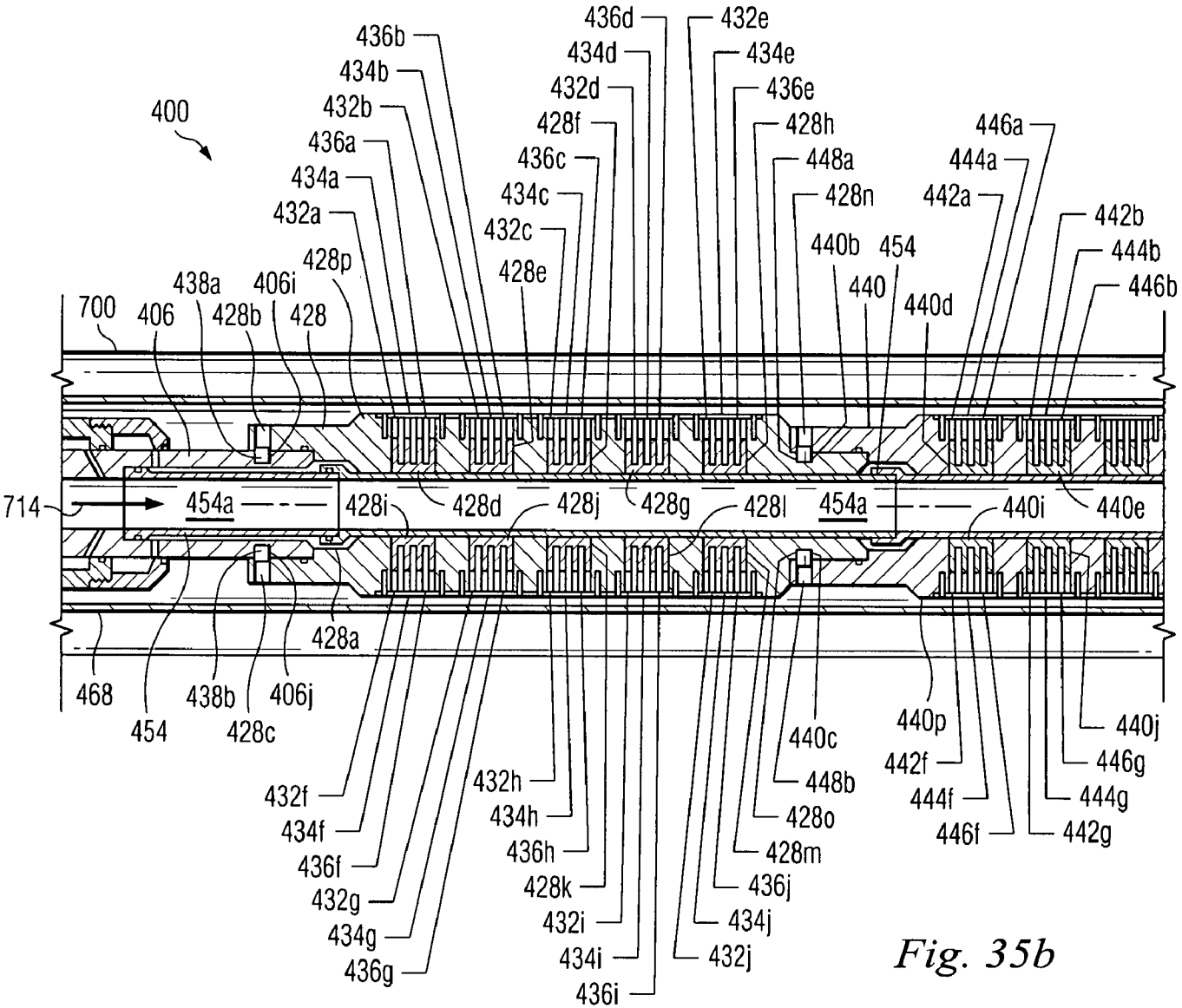
Figure 35C:
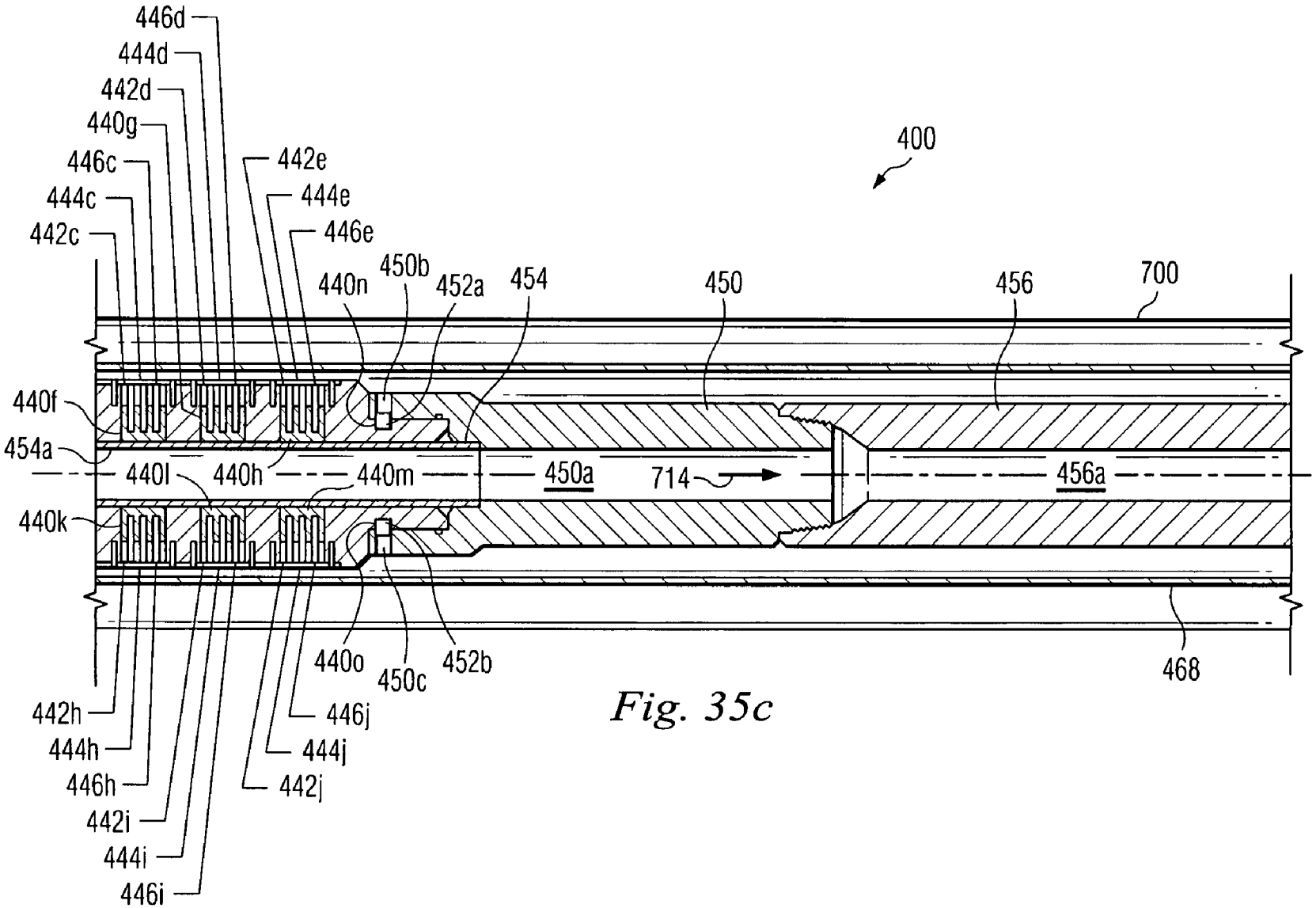
Figure 35D:
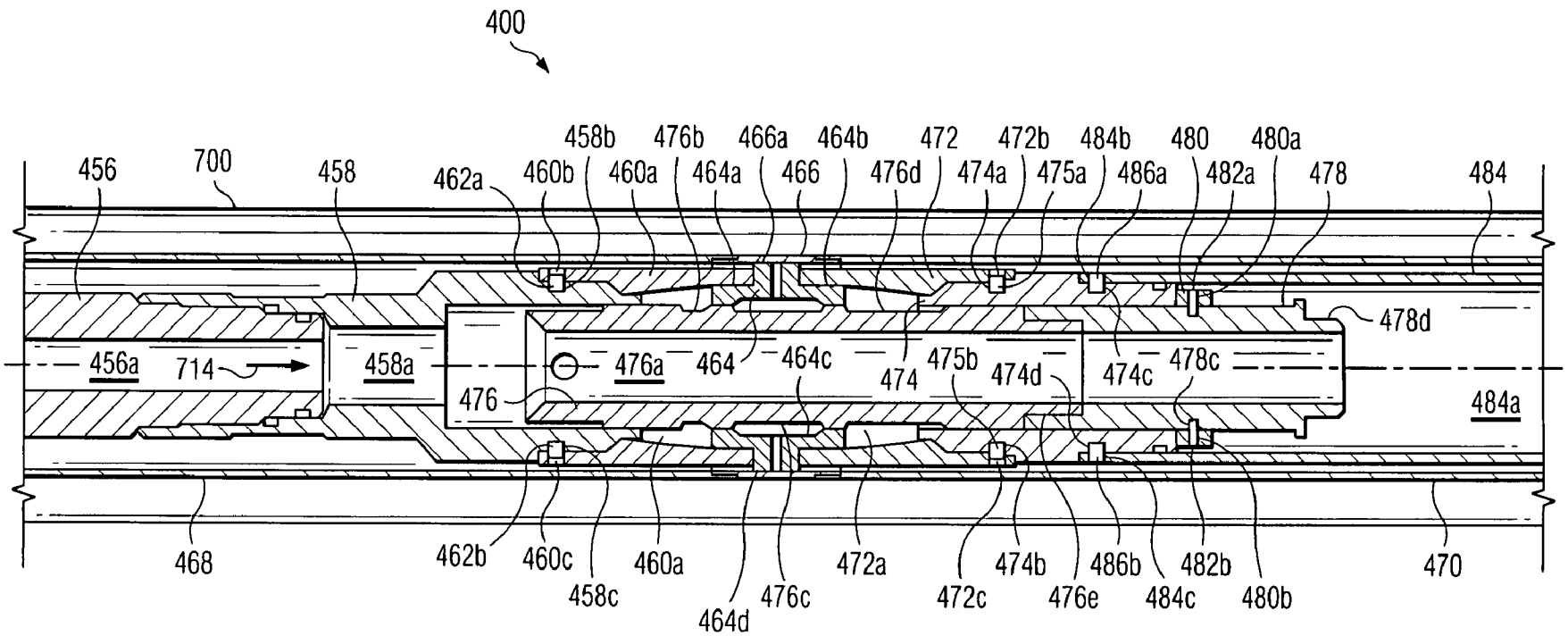
Figure 35E:
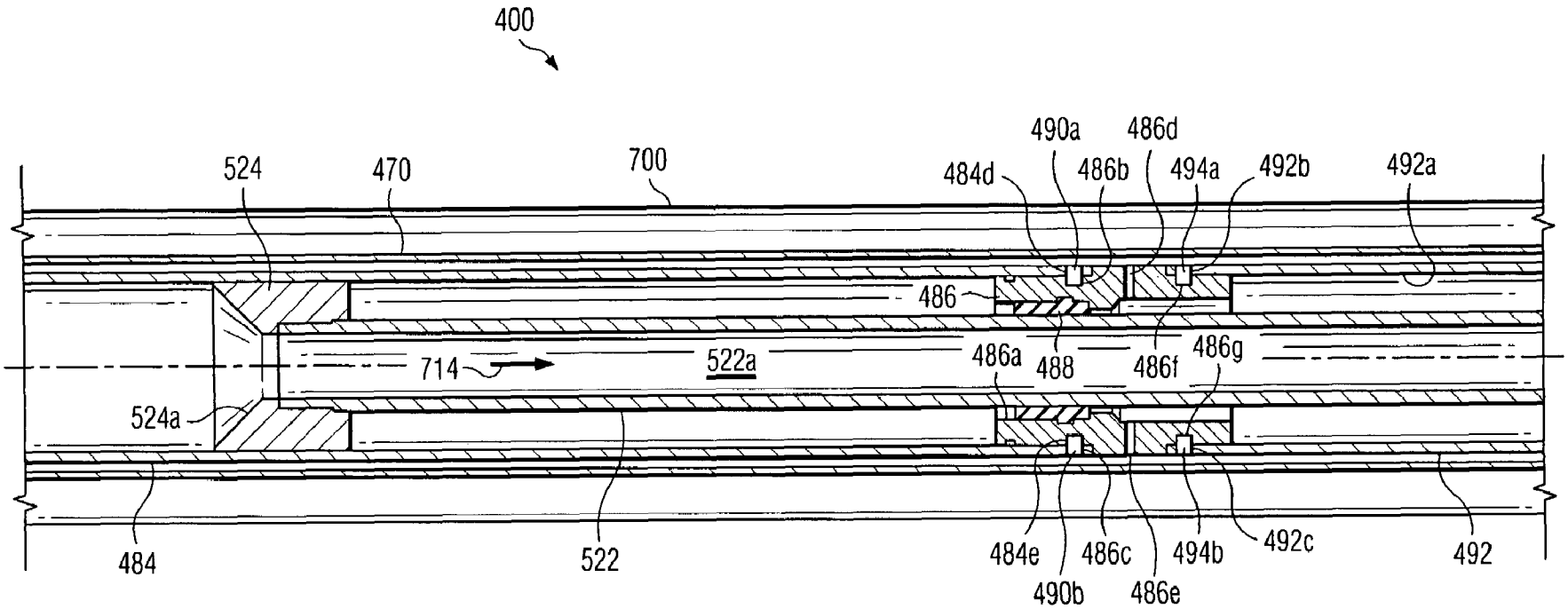
Figure 35F:
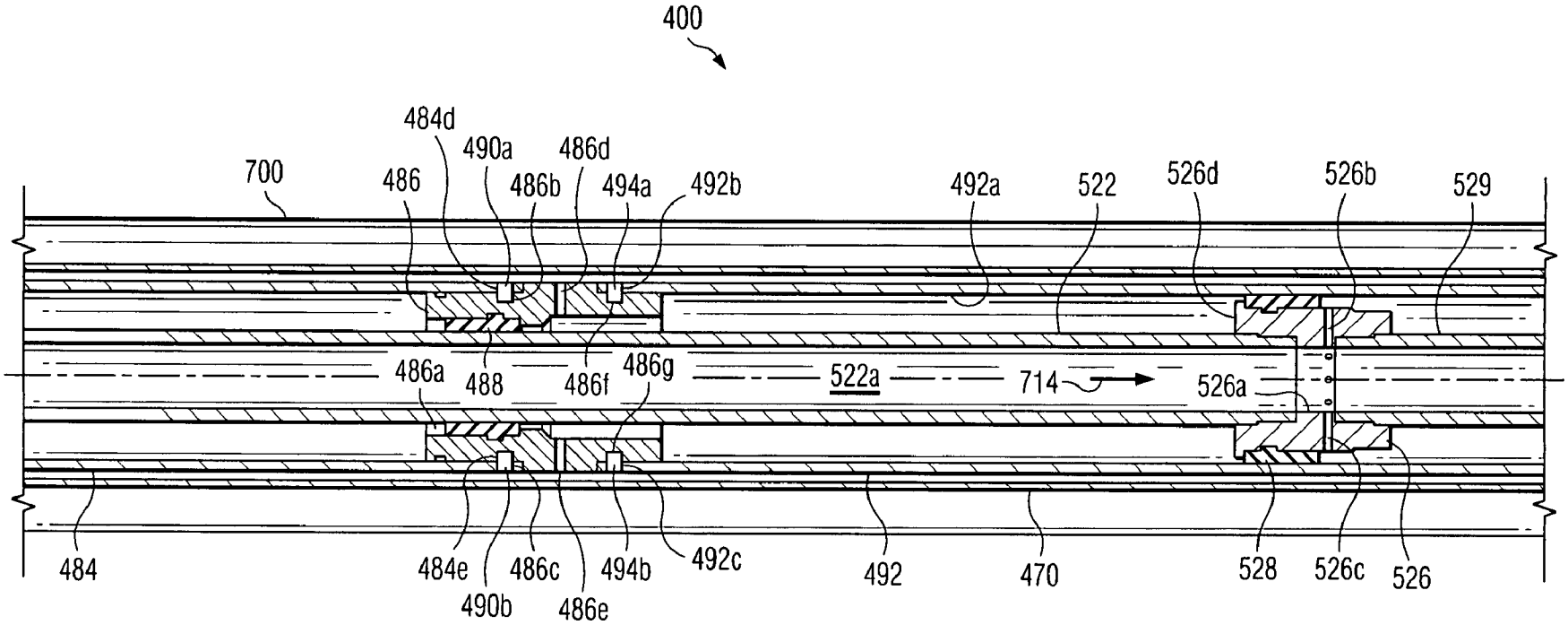
Figure 35G:
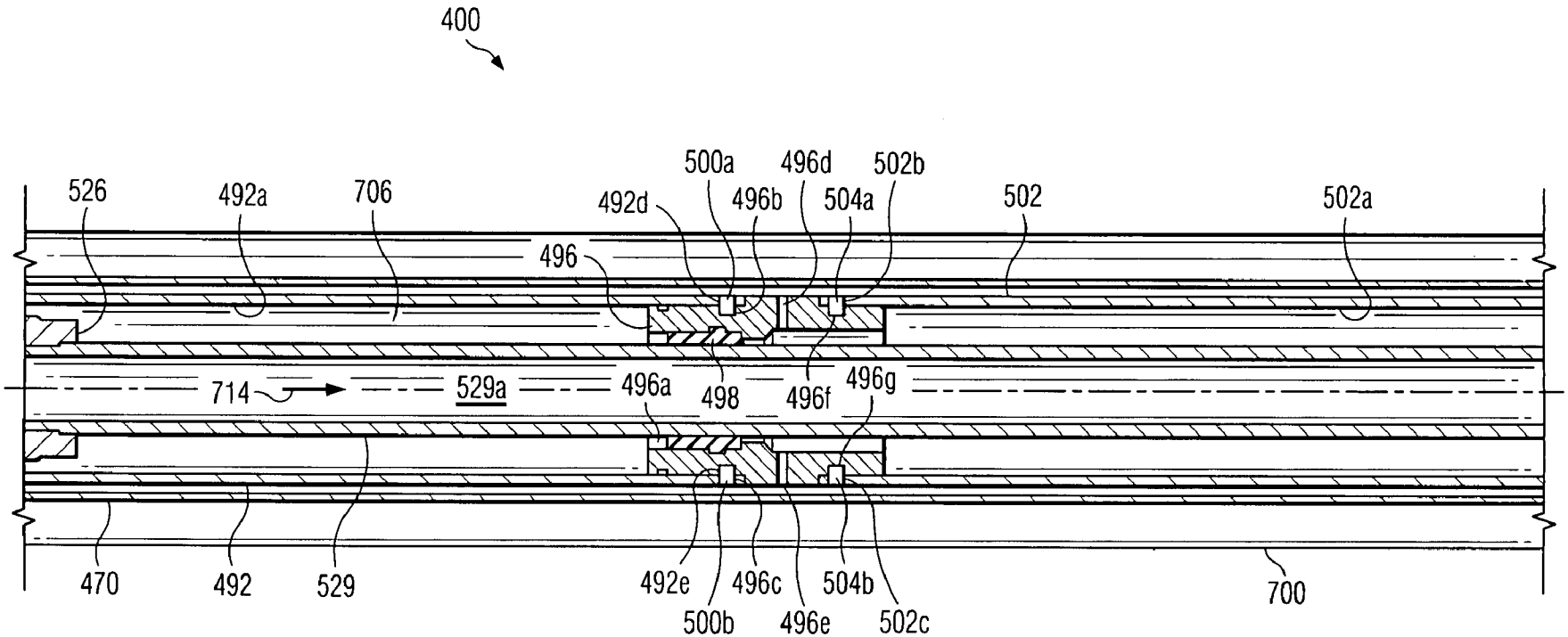
Figure 35H:
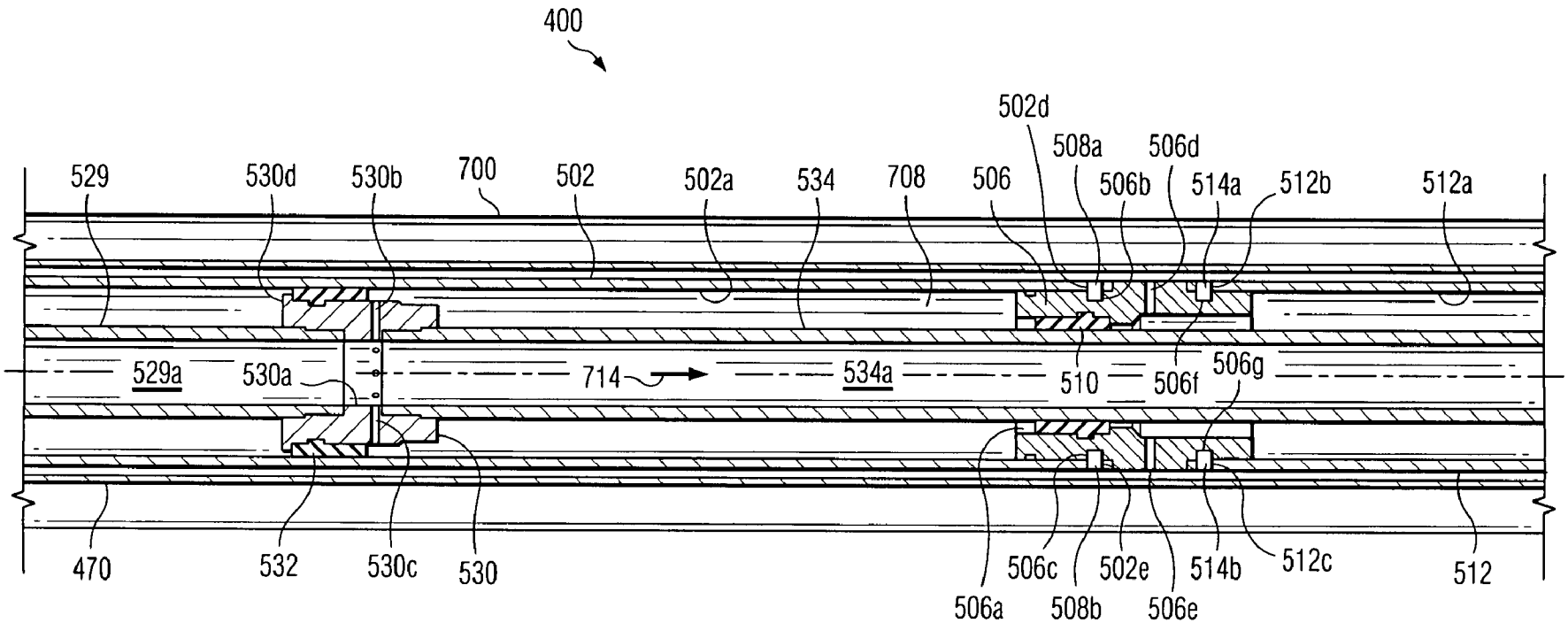
Figure 35I:
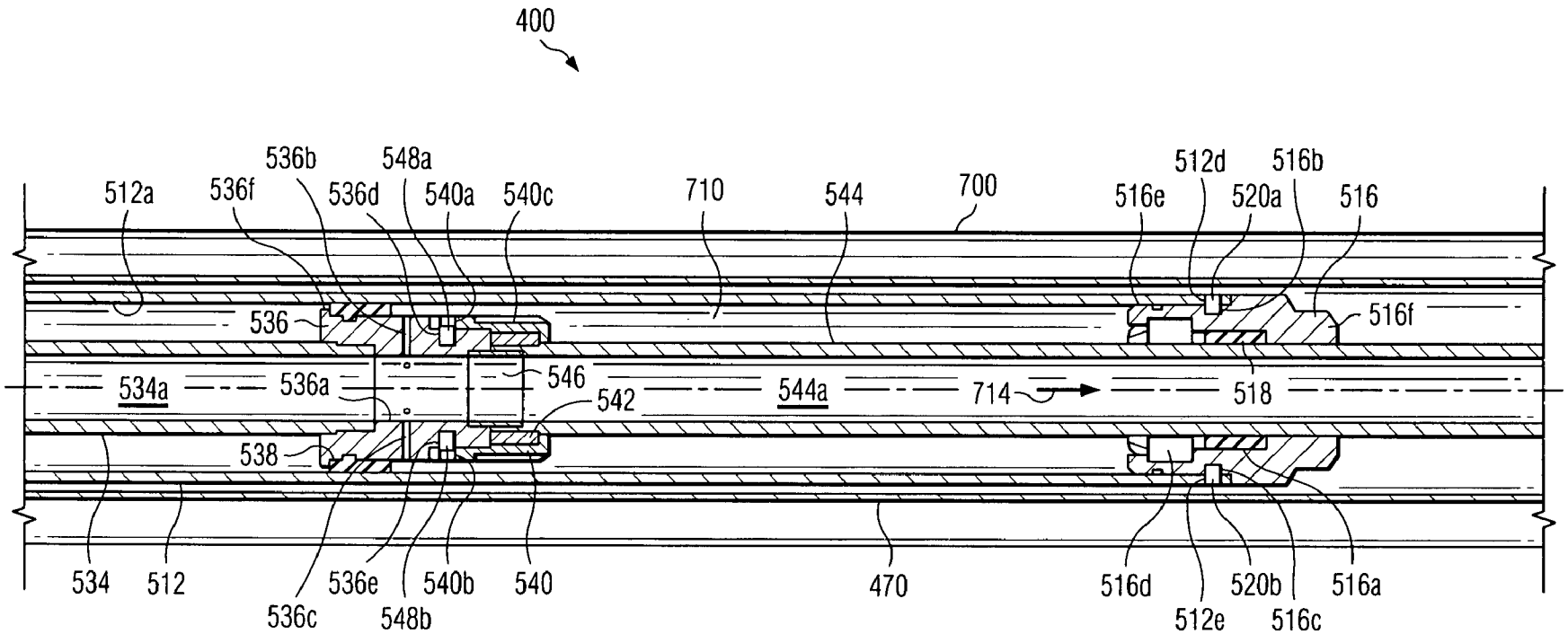
Figure 35J:
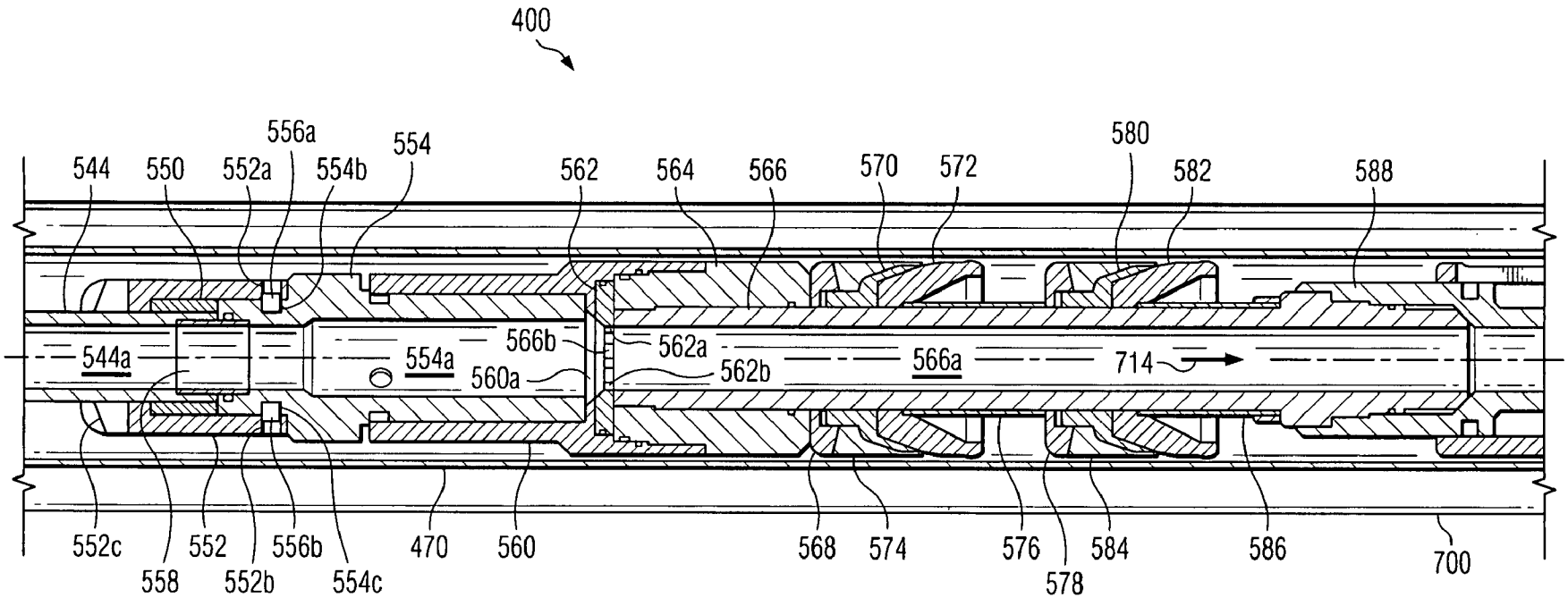
Figure 35K:
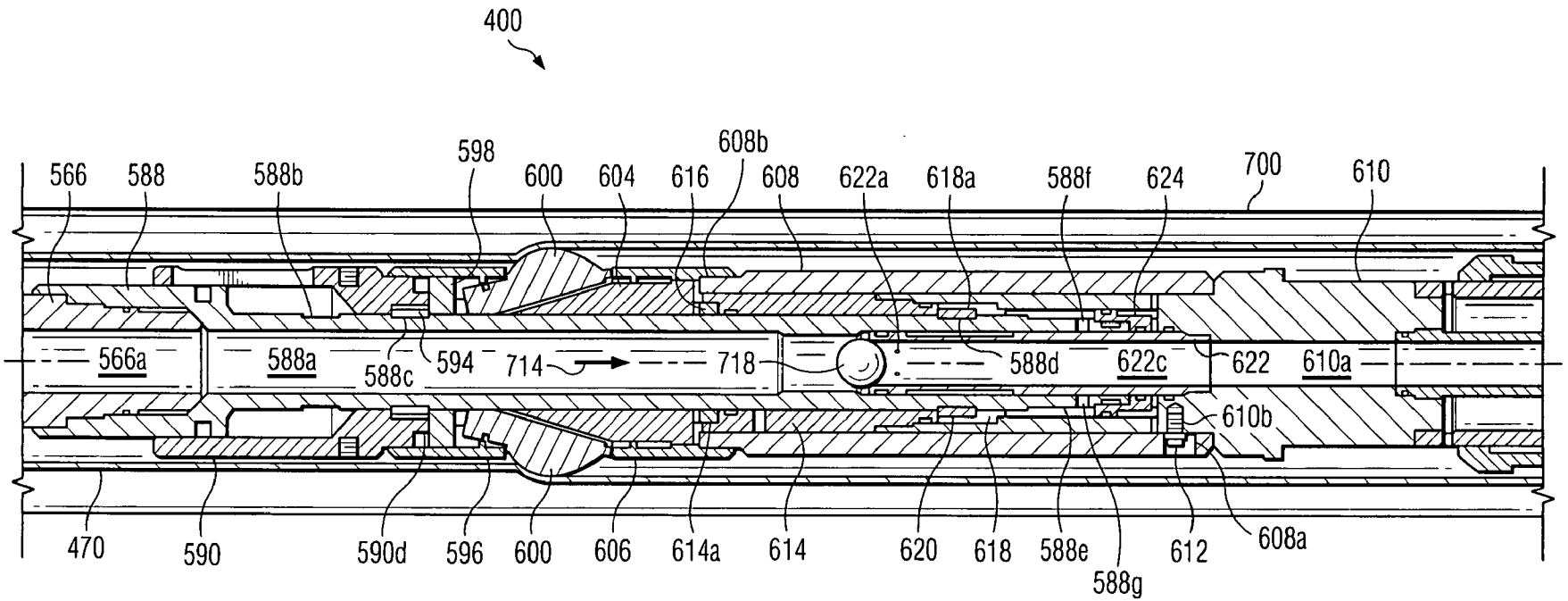
Figure 35L:
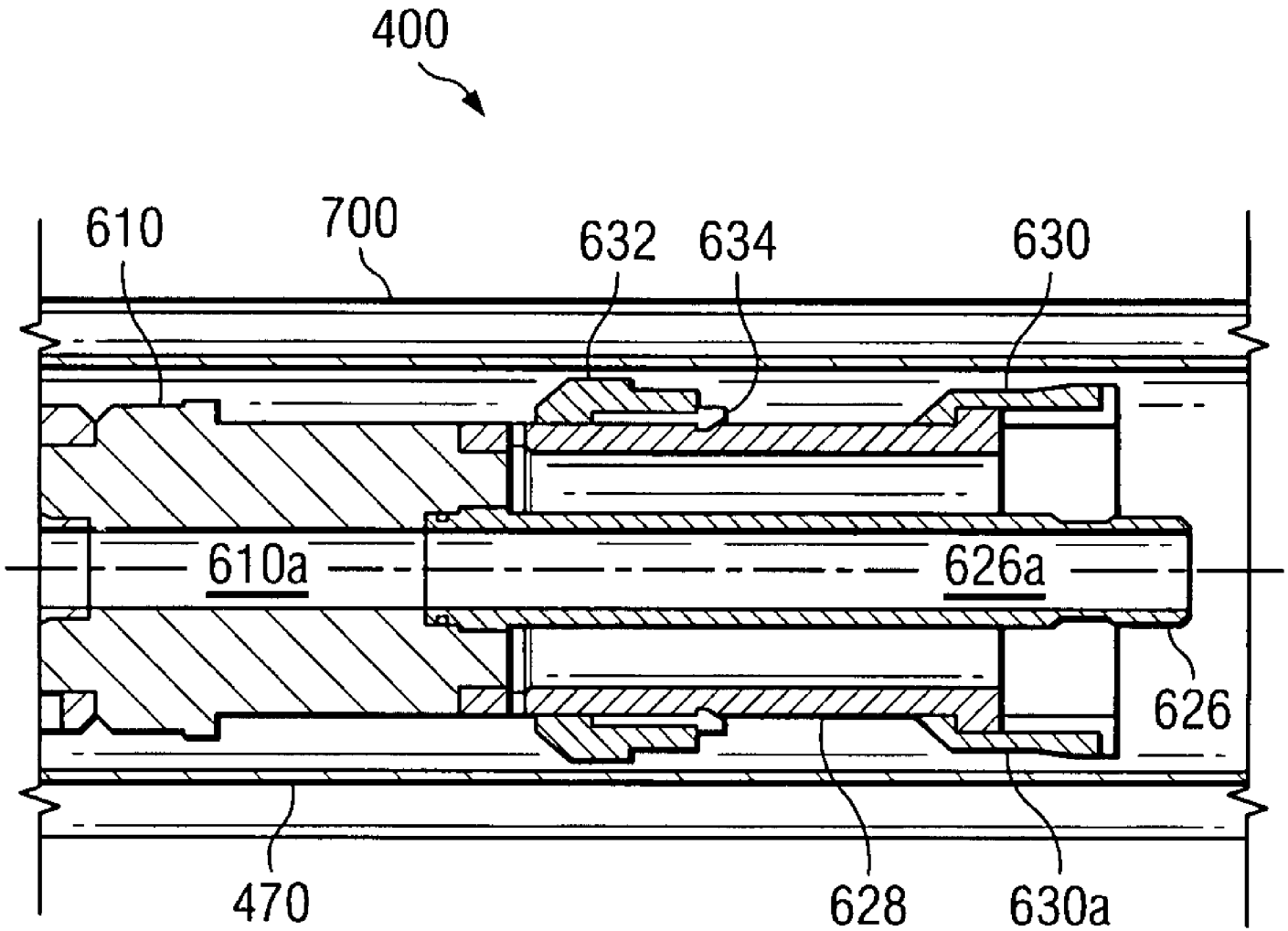

In an exemplary embodiment, the bypass valve body 412 is shifted downwardly relative to the gripper upper mandrel 406 by lowering the casing gripper locking dogs, 424*a* and 424*b*, using the support member 402 to a position below the unexpanded portions of the casings 468 and/or 470 into the radially expanded and plastically deformed portions of the casings. The ends of the casing gripper locking dogs, 424*a* and 424*b*, may then pivot outwardly out of engagement with the outer annular recess 406*d* of the gripper upper mandrel 406 and then are displaced downwardly relative to the gripper upper mandrel, along with the bypass valve body 412, due to the downward longitudinal force provided by the compressed spring 418. As a result, the bypass valve body 412 is placed in the neutral position illustrated in FIG. 25*h*. The casing gripper locking dogs, 424*a* and 424*b*, are then displaced upwardly relative to the casing gripper upper mandrel 406 using the support member 402 thereby impacting the casing gripper locking dogs with the interior diameter of the unexpanded portion of the casings 468 and/or 470. As a result, the casing gripper locking dogs, 424*a* and 424*b*, are displaced downwardly, along with the bypass valve body 412. relative to the casing gripper upper mandrel 406 until the ends of the casing gripper locking dogs pivot radially inwardly into engagement with the outer annular recess 406*e* of the casing gripper upper mandrel thereby positioning the bypass valve body in an active position, as illustrated in FIG. 34*a*, in which the casing gripper hydraulic ports, 406*f* and 406*h*, are fluidicly coupled.

In an alternative embodiment, the bypass valve body 412 is shifted downwardly relative to the gripper upper mandrel 406 by raising the casing gripper locking dogs, 424*a* and 424*b*, to a position above the casing 468 using the support member 402 thereby permitting the ends of the casing gripper locking dogs to pivot radially outward out of engagement with the outer annular recess 406*d* of the gripper upper mandrel 406. The ends of the casing gripper locking dogs, 424*a* and 424*b*, are then displaced downwardly relative to the gripper upper mandrel, along with the bypass valve body 412, due to the downward longitudinal force provided by the compressed spring 418, into engagement with the outer annular recess 406*e* of the casing gripper upper mandrel thereby positioning the bypass valve body in an active position, as illustrated in FIG. 34*a*, in which the casing gripper hydraulic ports, 406*f* and 406*h*, are fluidicly coupled.

In an exemplary embodiment, the process of pulling the segmented expansion cone provided by pulling the interleaved and axially aligned cone segments, 600 and 602, upwardly through the overlapping portions of the casings 468 and/or 470 and the preexisting wellbore casing 716 is repeated by repeatedly stroking the pistons, 526, 530, and 536, upwardly by repeatedly a) injecting the fluidic material 714 to pressurize the apparatus 400 thereby displacing the segmented expansion cone upwardly, b) depressurizing the apparatus by halting the injection of the fluidic material, and then c) lifting the elements of the apparatus upwardly using the support member 402 in order to properly position the pistons for another upward stroke.

Referring to FIGS. 35*a*-35*l*, in an exemplary embodiment, during the operation of the apparatus 400, the segmented expansion cone provided by the interleaved and axially aligned cone segments, 600 and 602, may be collapsed thereby moving the cone segments out of axial alignment by injecting a ball plug 718 into the apparatus using the injected fluidic material 714 through the passages 402*a*, 404*a*, 406*a*, 454*a*, 450*a*, 456*a*, 458*a*, 476*a*, 484*a*, 522*a*, 529*a*, 534*a*, 544*a*, 554*a*, 566*a*, and 588*a* into sealing engagement with the end of the emergency releasing sleeve 622. The continued injection of the fluidic material 714 following the sealing engagement of the ball plug 718 with the end of the emergency releasing sleeve 622 will apply a downward longitudinal tensile force to the lower mandrel 610. As a result, as illustrated and described above with reference to FIG. 30*a*, when the downward tensile longitudinal force is initially applied to the lower mandrel 610 relative to cone mandrel 588, the lower mandrel, the locking dog retainer sleeve 614, and the locking ring retainer 618 are displaced downwardly relative to the cone mandrel 588 when the applied tensile force is sufficient to release the locking ring 620 from engagement with the lock ring groove 588*d*. As illustrated in FIG. 30*b*, if the applied downward tensile longitudinal force is sufficient to release the locking ring 620 from engagement with the lock ring groove 588*d*, the lower mandrel 610, the locking dog retainer sleeve 614, and the locking ring retainer 618 are displaced downwardly relative to the cone mandrel 588 thereby displacing the annular recess 614*a* of the locking dog retainer sleeve downwardly relative to the locking dogs 616. As a result, the locking dogs 616 are released from engagement with the locking dog grooves 588*h* of the cone mandrel 588 thereby permitting the lower cone segments 602, the lower cam 604, and the lower cone retainer 606 to be displaced downwardly relative to the cone mandrel 588.

As illustrated in FIG. 30*c*, further downward displacement of the lower mandrel 610 then causes the torsion locking pin 612 to engage and displace the release housing 608 downwardly relative to the cone mandrel 588 thereby displacing the locking dogs 616, the lower cone retainer 606, the lower cam 604, and the lower cam segments 602 downwardly relative to the cone mandrel. As a result, the lower cone segments 602 and the lower cam 604 are displaced downwardly out of axial alignment with the upper cam 598 and the upper cam segments 600 thereby collapsing the segmented expansion cone. Furthermore, the downward displacement of the locking dog retainer sleeve 614 also displaced the locking ring retainer 618 and the locking ring 620 downwardly relative to the cone mandrel 588 thereby relocating the locking ring from the lock ring groove 588*d* to the lock ring groove 588*e*. In this manner, the now position of the lower cone segments 602 and the lower cam 604 are thereby releasably fixed relative to the cam mandrel 588 by the locking ring 620.

Figure 36A:
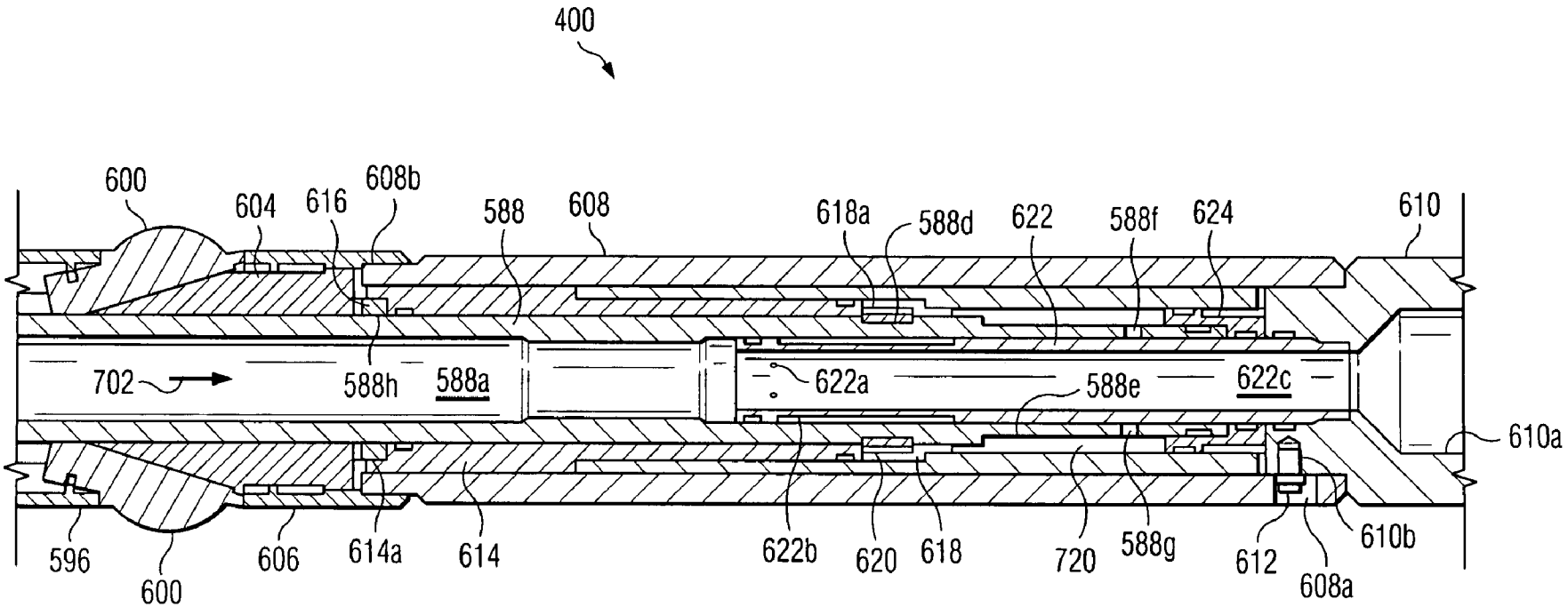
FIGS. 36*a*-36*b* are fragmentary cross sectional illustrations of several exemplary embodiments of the operation of the pressure balance piston.

Referring now to FIG. 36*a*, an exemplary embodiment of the operation of the pressure balance piston 624 during an exemplary embodiment of the operation of the apparatus 400 will now be described. In particular, after the dart 704 is positioned and seated in the passage 646*a* of the lower mandrel 646, the operating pressure within the passage 622*c* will increase. As a result, the operating pressure within the passages 622*a* will increase thereby increasing the operating pressures within the passages, 588*f* and 588*g*, of the cone mandrel 588, and within an annulus 720 defined between the cone mandrel 588 and lower mandrel 610. The operating pressure within the annulus 720 acts upon an end face of the pressure balance piston 624 thereby applying a downward longitudinal force to the cone mandrel 588. As a result, the cone mandrel 588 and the locking dog retainer sleeve 614 could inadvertently be displaced away from each other in opposite directions during the pressurization of the interior passages of the apparatus 400 caused by the placement of the dart 704 in the passage 646*a* of the lower mandrel 646 thereby potentially collapsing the segmented expansion cone including the interleaved and axially aligned cone segments, 600 and 602. Thus, the pressure balance piston 624, in an exemplary embodiment, neutralizes the potential effects of the pressurization of the interior passages of the apparatus 400 caused by the placement of the dart 704 in the passage 646*a* of the lower mandrel 646.

Figure 36B:
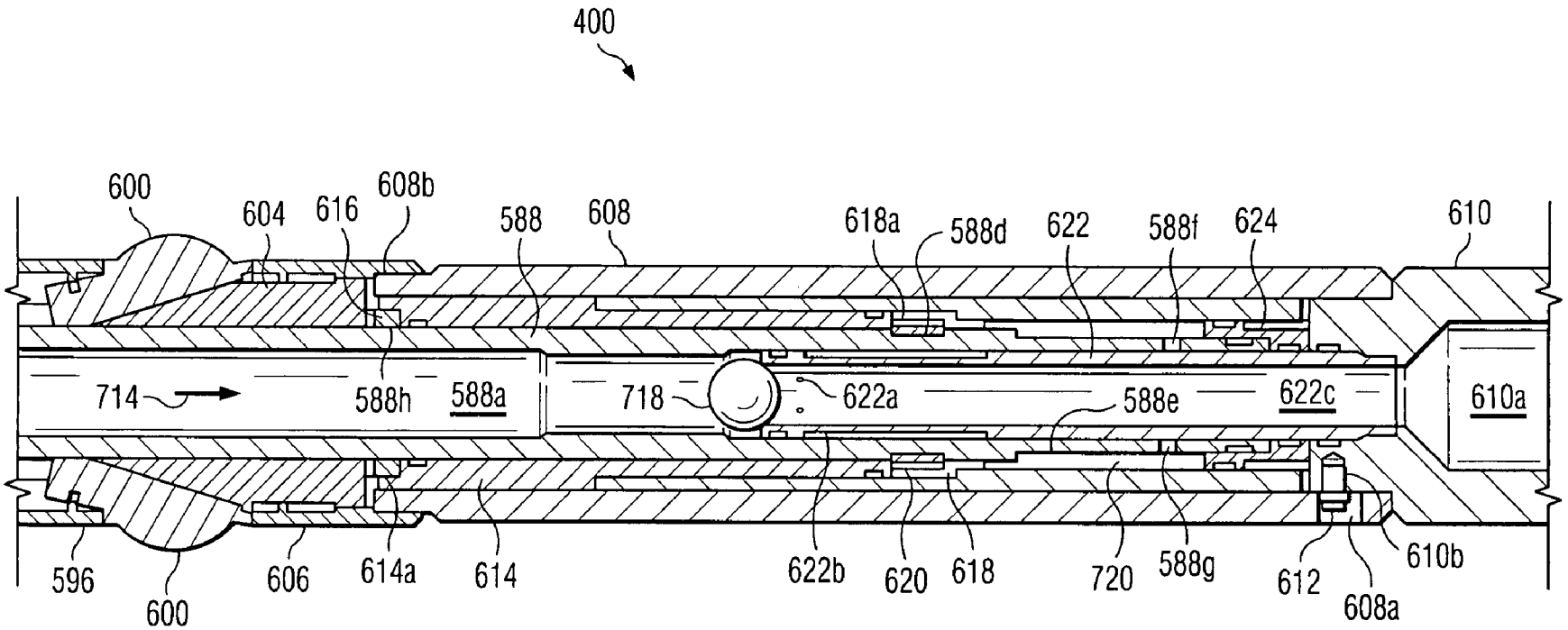

Referring now to FIG. 36*b*, an exemplary embodiment of the operation of the pressure balance piston 624 during another exemplary embodiment of the operation of the apparatus 400 will now be described. In particular, during the placement of the ball 718 within the passage 622*c* of the releasing sleeve 622, the interior passages of the apparatus 400 upstream from the ball are pressurized. However, since the ball 718 blocks the passage 622*c*, the passage 622*a* is not pressurized. As a result, the pressure balance piston 624 does not apply a downward longitudinal force to the cone mandrel 588. As a result, the pressure balance piston 624 does not interfere with the collapse of the segmented expansion cone including the interleaved and axially aligned cone segments, 600 and 602, caused by the placement of the ball 718 within the mouth of the passage 622*c* of the release sleeve 622.

An apparatus for radially expanding and plastically deforming an expandable tubular member has been described that includes a float shoe adapted to mate with an end of the expandable tubular member, an adjustable expansion mandrel coupled to the float shoe adapted to be controllably expanded to a larger outside dimension for radial expansion of the expandable tubular member or collapsed to a smaller outside dimension, an actuator coupled to the adjustable expansion mandrel adapted to controllably displace the adjustable expansion mandrel relative to the expandable tubular member, a locking device coupled to the actuator adapted to controllably engage the expandable tubular member, and a support member coupled to the locking device.

A method for radially expanding and plastically deforming an expandable tubular member within a borehole has been described that includes positioning an adjustable expansion mandrel within the expandable tubular member, supporting the expandable tubular member and the adjustable expansion mandrel within the borehole, lowering the adjustable expansion mandrel out of the expandable tubular member, increasing the outside dimension of the adjustable expansion mandrel, and displacing the adjustable expansion mandrel upwardly relative to the expandable tubular member n times to radially expand and plastically deform n portions of the expandable tubular member.

A method for forming a mono diameter wellbore casing has been described that includes positioning an adjustable expansion mandrel within a first expandable tubular member, supporting the first expandable tubular member and the adjustable expansion mandrel within a borehole, lowering the adjustable expansion mandrel out of the first expandable tubular member, increasing the outside dimension of the adjustable expansion mandrel, displacing the adjustable expansion mandrel upwardly relative to the first expandable tubular member m times to radially expand and plastically deform m portions of the first expandable tubular member within the borehole, positioning the adjustable expansion mandrel within a second expandable tubular member, supporting the second expandable tubular member and the adjustable expansion mandrel within the borehole in overlapping relation to the first expandable tubular member, lowering the adjustable expansion mandrel out of the second expandable tubular member, increasing the outside dimension of the adjustable expansion mandrel, and displacing the adjustable expansion mandrel upwardly relative to the second expandable tubular member n times to radially expand and plastically deform n portions of the second expandable tubular member within the borehole.

An apparatus for radially expanding and plastically deforming an expandable tubular member has been described that includes a float shoe adapted to mate with an end of the expandable tubular member, an adjustable expansion mandrel coupled to the float shoe adapted to be controllably expanded to a larger outside dimension for radial expansion of the expandable tubular member or collapsed to a smaller outside dimension, an actuator coupled to the adjustable expansion mandrel adapted to controllably displace the adjustable expansion mandrel relative to the expandable tubular member, a locking device coupled to the actuator adapted to controllably engage the expandable tubular member, a support member coupled to the locking device, and a sealing member for sealingly engaging the expandable tubular member adapted to define a pressure chamber above the adjustable expansion mandrel during radial expansion of the expandable tubular member.

A method for radially expanding and plastically deforming an expandable tubular member within a borehole has been described that includes positioning an adjustable expansion mandrel within the expandable tubular member, supporting the expandable tubular member and the adjustable expansion mandrel within the borehole, lowering the adjustable expansion mandrel out of the expandable tubular member, increasing the outside dimension of the adjustable expansion mandrel, displacing the adjustable expansion mandrel upwardly relative to the expandable tubular member n times to radially expand and plastically deform n portions of the expandable tubular member within the borehole, and pressurizing an interior region of the expandable tubular member above the adjustable expansion mandrel during the radial expansion and plastic deformation of the expandable tubular member within the borehole.

A method for forming a mono diameter wellbore casing has been described that includes positioning an adjustable expansion mandrel within a first expandable tubular member, supporting the first expandable tubular member and the adjustable expansion mandrel within a borehole, lowering the adjustable expansion mandrel out of the first expandable tubular member, increasing the outside dimension of the adjustable expansion mandrel, displacing the adjustable expansion mandrel upwardly relative to the first expandable tubular member m times to radially expand and plastically deform m portions of the first expandable tubular member within the borehole, pressurizing an interior region of the first expandable tubular member above the adjustable expansion mandrel during the radial expansion and plastic deformation of the first expandable tubular member within the borehole, positioning the adjustable expansion mandrel within a second expandable tubular member, supporting the second expandable tubular member and the adjustable expansion mandrel within the borehole in overlapping relation to the first expandable tubular member, lowering the adjustable expansion mandrel out of the second expandable tubular member, increasing the outside dimension of the adjustable expansion mandrel, displacing the adjustable expansion mandrel upwardly relative to the second expandable tubular member n times to radially expand and plastically deform n portions of the second expandable tubular member within the borehole, and pressurizing an interior region of the second expandable tubular member above the adjustable expansion mandrel during the radial expansion and plastic deformation of the second expandable tubular member within the borehole.

An apparatus for drilling a borehole within a subterranean formation and then radially expanding and plastically deforming an expandable tubular member within the drilled borehole has been described that includes a float shoe adapted to mate with an end of the expandable tubular member, a drilling member coupled to the float shoe adapted to drill the borehole, an adjustable expansion mandrel coupled to the float shoe adapted to be controllably expanded to a larger outside dimension for radial expansion of the expandable tubular member or collapsed to a smaller outside dimension, an actuator coupled to the adjustable expansion mandrel adapted to controllably displace the adjustable expansion mandrel relative to the expandable tubular member, a locking device coupled to the actuator adapted to controllably engage the expandable tubular member, and a support member coupled to the locking device.

A method for drilling a borehole within a subterranean formation and then radially expanding and plastically deforming an expandable tubular member within the drilled borehole has been described that includes positioning an adjustable expansion mandrel within the expandable tubular member, coupling a drilling member to an end of the expandable tubular member, drilling the borehole using the drilling member, positioning the adjustable expansion mandrel and the expandable tubular member within the drilled borehole, lowering the adjustable expansion mandrel out of the expandable tubular member, increasing the outside dimension of the adjustable expansion mandrel, and displacing the adjustable expansion mandrel upwardly relative to the expandable tubular member n times to radially expand and plastically deform n portions of the expandable tubular member within the drilled borehole.

A method for forming a mono diameter wellbore casing within a borehole has been described that includes positioning an adjustable expansion mandrel within a first expandable tubular member, coupling a drilling member to an end of the first expandable tubular member, drilling a first section of the borehole using the drilling member, supporting the first expandable tubular member and the adjustable expansion mandrel within the drilled first section of the borehole, lowering the adjustable expansion mandrel out of the first expandable tubular member, increasing the outside dimension of the adjustable expansion mandrel, displacing the adjustable expansion mandrel upwardly relative to the first expandable tubular member m times to radially expand and plastically deform m portions of the first expandable tubular member within the drilled first section of the borehole, positioning the adjustable expansion mandrel within a second expandable tubular member, coupling the drilling member to an end of the second expandable tubular member, drilling a second section of the borehole using the drilling member, supporting the second expandable tubular member and the adjustable expansion mandrel within the borehole in overlapping relation to the first expandable tubular member within the second drilled section of the borehole, lowering the adjustable expansion mandrel out of the second expandable tubular member, increasing the outside dimension of the adjustable expansion mandrel, and displacing the adjustable expansion mandrel upwardly relative to the second expandable tubular member n times to radially expand and plastically deform n portions of the second expandable tubular member within the drilled second section of the borehole.

An apparatus for drilling a borehole within a subterranean formation and then radially expanding and plastically deforming an expandable tubular member within the drilled borehole has been described that includes a float shoe adapted to mate with an end of the expandable tubular member, a drilling member coupled to the float shoe adapted to drill the borehole, an adjustable expansion mandrel coupled to the float shoe adapted to be controllably expanded to a larger outside dimension for radial expansion of the expandable tubular member or collapsed to a smaller outside dimension, an actuator coupled to the adjustable expansion mandrel adapted to controllably displace the adjustable expansion mandrel relative to the expandable tubular member, a locking device coupled to the actuator adapted to controllably engage the expandable tubular member, a support member coupled to the locking device, and a sealing member for sealing engaging the expandable tubular member adapted to define a pressure chamber above the adjustable expansion mandrel during the radial expansion of the expandable tubular member.

A method for drilling a borehole within a subterranean formation and then radially expanding and plastically deforming an expandable tubular member within the drilled borehole has been described that includes positioning an adjustable expansion mandrel within the expandable tubular member, coupling a drilling member to an end of the expandable tubular member, drilling the borehole using the drilling member, positioning the adjustable expansion mandrel and the expandable tubular member within the drilled borehole, lowering the adjustable expansion mandrel out of the expandable tubular member, increasing the outside dimension of the adjustable expansion mandrel, displacing the adjustable expansion mandrel upwardly relative to the expandable tubular member n times to radially expand and plastically deform n portions of the expandable tubular member within the drilled borehole, and pressuring an interior portion of the expandable tubular member above the adjustable expansion mandrel during the radial expansion and plastic deformation of the expandable tubular member within the drilled borehole.

A method for forming a mono diameter wellbore casing within a borehole has been described that includes positioning an adjustable expansion mandrel within a first expandable tubular member, coupling a drilling member to an end of the first expandable tubular member, drilling a first section of the borehole using the drilling member, supporting the first expandable tubular member and the adjustable expansion mandrel within the drilled first section of the borehole, lowering the adjustable expansion mandrel out of the first expandable tubular member, increasing the outside dimension of the adjustable expansion mandrel, displacing the adjustable expansion mandrel upwardly relative to the first expandable tubular member m times to radially expand and plastically deform m portions of the first expandable tubular member within the drilled first section of the borehole, pressuring an interior portion of the first expandable tubular member above the adjustable expansion mandrel during the radial expansion and plastic deformation of the first expandable tubular member within the first drilled section of the borehole, positioning the adjustable expansion mandrel within a second expandable tubular member, coupling the drilling member to an end of the second expandable tubular member, drilling a second section of the borehole using the drilling member, supporting the second expandable tubular member and the adjustable expansion mandrel within the borehole in overlapping relation to the first expandable tubular member within the second drilled section of the borehole, lowering the adjustable expansion mandrel out of the second expandable tubular member, increasing the outside dimension of the adjustable expansion mandrel, displacing the adjustable expansion mandrel upwardly relative to the second expandable tubular member n times to radially expand and plastically deform n portions of the second expandable tubular member within the drilled second section of the borehole, and pressuring an interior portion of the second expandable tubular member above the adjustable expansion mandrel during the radial expansion and plastic deformation of the second expandable tubular member within the drilled second section of the borehole.

An apparatus for radially expanding and plastically deforming an expandable tubular member has been described that includes a float shoe adapted to mate with an end of the expandable tubular member, a first adjustable expansion mandrel coupled to the float shoe adapted to be controllably expanded to a first larger outside dimension for radial expansion of the expandable tubular member or collapsed to a first smaller outside dimension, a second adjustable expansion mandrel coupled to the first adjustable expansion mandrel adapted to be controllably expanded to a second larger outside dimension for radial expansion of the expandable tubular member or collapsed to a second smaller outside dimension, an actuator coupled to the first and second adjustable expansion mandrels adapted to controllably displace the first and second adjustable expansion mandrels relative to the expandable tubular member, a locking device coupled to the actuator adapted to controllably engage the expandable tubular member, and a support member coupled to the locking device. The first larger outside dimension of the first adjustable expansion mandrel is larger than the second larger outside dimension of the second adjustable expansion mandrel.

A method for radially expanding and plastically deforming an expandable tubular member within a borehole has been described that includes positioning first and second adjustable expansion mandrels within the expandable tubular member, supporting the expandable tubular member and the first and second adjustable expansion mandrels within the borehole, lowering the first adjustable expansion mandrel out of the expandable tubular member, increasing the outside dimension of the first adjustable expansion mandrel, displacing the first adjustable expansion mandrel upwardly relative to the expandable tubular member to radially expand and plastically deform a lower portion of the expandable tubular member, displacing the first adjustable expansion mandrel and the second adjustable expansion mandrel downwardly relative to the expandable tubular member, decreasing the outside dimension of the first adjustable expansion mandrel and increasing the outside dimension of the second adjustable expansion mandrel, and displacing the second adjustable expansion mandrel upwardly relative to the expandable tubular member to radially expand and plastically deform portions of the expandable tubular member above the lower portion of the expandable tubular member. The outside dimension of the first adjustable expansion mandrel is greater than the outside dimension of the second adjustable expansion mandrel.

A method for forming a mono diameter wellbore casing has been described that includes positioning first and second adjustable expansion mandrels within a first expandable tubular member, supporting the first expandable tubular member and the first and second adjustable expansion mandrels within a borehole, lowering the first adjustable expansion mandrel out of the first expandable tubular member, increasing the outside dimension of the first adjustable expansion mandrel, displacing the first adjustable expansion mandrel upwardly relative to the first expandable tubular member to radially expand and plastically deform a lower portion of the first expandable tubular member, displacing the first adjustable expansion mandrel and the second adjustable expansion mandrel downwardly relative to the first expandable tubular member, decreasing the outside dimension of the first adjustable expansion mandrel and increasing the outside dimension of the second adjustable expansion mandrel, displacing the second adjustable expansion mandrel upwardly relative to the first expandable tubular member to radially expand and plastically deform portions of the first expandable tubular member above the lower portion of the expandable tubular member, positioning first and second adjustable expansion mandrels within a second expandable tubular member, supporting the first expandable tubular member and the first and second adjustable expansion mandrels within the borehole in overlapping relation to the first expandable tubular member, lowering the first adjustable expansion mandrel out of the second expandable tubular member, increasing the outside dimension of the first adjustable expansion mandrel, displacing the first adjustable expansion mandrel upwardly relative to the second expandable tubular member to radially expand and plastically deform a lower portion of the second expandable tubular member, displacing the first adjustable expansion mandrel and the second adjustable expansion mandrel downwardly relative to the second expandable tubular member, decreasing the outside dimension of the first adjustable expansion mandrel and increasing the outside dimension of the second adjustable expansion mandrel, and displacing the second adjustable expansion mandrel upwardly relative to the second expandable tubular member to radially expand and plastically deform portions of the second expandable tubular member above the lower portion of the second expandable tubular member. The outside dimension of the first adjustable expansion mandrel is greater than the outside dimension of the second adjustable expansion mandrel.

An apparatus for radially expanding and plastically deforming an expandable tubular member has been described that includes a float shoe adapted to mate with an end of the expandable tubular member, a first adjustable expansion mandrel coupled to the float shoe adapted to be controllably expanded to a first larger outside dimension for radial expansion of the expandable tubular member or collapsed to a first smaller outside dimension, a second adjustable expansion mandrel coupled to the first adjustable expansion mandrel adapted to be controllably expanded to a second larger outside dimension for radial expansion of the expandable tubular member or collapsed to a second smaller outside dimension, an actuator coupled to the first and second adjustable expansion mandrels adapted to controllably displace the first and second adjustable expansion mandrels relative to the expandable tubular member, a locking device coupled to the actuator adapted to controllably engage the expandable tubular member, a support member coupled to the locking device, and a sealing member for sealingly engaging the expandable tubular adapted to define a pressure chamber above the first and second adjustable expansion mandrels during the radial expansion of the expandable tubular member. The first larger outside dimension of the first adjustable expansion mandrel is larger than the second larger outside dimension of the second adjustable expansion mandrel.

A method for radially expanding and plastically deforming an expandable tubular member within a borehole has been described that includes positioning first and second adjustable expansion mandrels within the expandable tubular member, supporting the expandable tubular member and the first and second adjustable expansion mandrels within the borehole, lowering the first adjustable expansion mandrel out of the expandable tubular member, increasing the outside dimension of the first adjustable expansion mandrel, displacing the first adjustable expansion mandrel upwardly relative to the expandable tubular member to radially expand and plastically deform a lower portion of the expandable tubular member, pressurizing an interior region of the expandable tubular member above the first adjustable expansion mandrel during the radial expansion of the lower portion of the expandable tubular member by the first adjustable expansion mandrel, displacing the first adjustable expansion mandrel and the second adjustable expansion mandrel downwardly relative to the expandable tubular member, decreasing the outside dimension of the first adjustable expansion mandrel and increasing the outside dimension of the second adjustable expansion mandrel, displacing the second adjustable expansion mandrel upwardly relative to the expandable tubular member to radially expand and plastically deform portions of the expandable tubular member above the lower portion of the expandable tubular member, and pressurizing an interior region of the expandable tubular member above the second adjustable expansion mandrel during the radial expansion of the portions of the expandable tubular member above the lower portion of the expandable tubular member by the second adjustable expansion mandrel. The outside dimension of the first adjustable expansion mandrel is greater than the outside dimension of the second adjustable expansion mandrel.

A method for forming a mono diameter wellbore casing has been described that includes positioning first and second adjustable expansion mandrels within a first expandable tubular member, supporting the first expandable tubular member and the first and second adjustable expansion mandrels within a borehole, lowering the first adjustable expansion mandrel out of the first expandable tubular member, increasing the outside dimension of the first adjustable expansion mandrel, displacing the first adjustable expansion mandrel upwardly relative to the first expandable tubular member to radially expand and plastically deform a lower portion of the first expandable tubular member, pressurizing an interior region of the first expandable tubular member above the first adjustable expansion mandrel during the radial expansion of the lower portion of the first expandable tubular member by the first adjustable expansion mandrel, displacing the first adjustable expansion mandrel and the second adjustable expansion mandrel downwardly relative to the first expandable tubular member, decreasing the outside dimension of the first adjustable expansion mandrel and increasing the outside dimension of the second adjustable expansion mandrel, displacing the second adjustable expansion mandrel upwardly relative to the first expandable tubular member to radially expand and plastically deform portions of the first expandable tubular member above the lower portion of the expandable tubular member, pressurizing an interior region of the first expandable tubular member above the second adjustable expansion mandrel during the radial expansion of the portions of the first expandable tubular member above the lower portion of the first expandable tubular member by the second adjustable expansion mandrel, positioning first and second adjustable expansion mandrels within a second expandable tubular member, supporting the first expandable tubular member and the first and second adjustable expansion mandrels within the borehole in overlapping relation to the first expandable tubular member, lowering the first adjustable expansion mandrel out of the second expandable tubular member, increasing the outside dimension of the first adjustable expansion mandrel, displacing the first adjustable expansion mandrel upwardly relative to the second expandable tubular member to radially expand and plastically deform a lower portion of the second expandable tubular member, pressurizing an interior region of the second expandable tubular member above the first adjustable expansion mandrel during the radial expansion of the lower portion of the second expandable tubular member by the first adjustable expansion mandrel, displacing the first adjustable expansion mandrel and the second adjustable expansion mandrel downwardly relative to the second expandable tubular member, decreasing the outside dimension of the first adjustable expansion mandrel and increasing the outside dimension of the second adjustable expansion mandrel, displacing the second adjustable expansion mandrel upwardly relative to the second expandable tubular member to radially expand and plastically deform portions of the second expandable tubular member above the lower portion of the second expandable tubular member, and pressurizing an interior region of the second expandable tubular member above the second adjustable expansion mandrel during the radial expansion of the portions of the second expandable tubular member above the lower portion of the second expandable tubular member by the second adjustable expansion mandrel. The outside dimension of the first adjustable expansion mandrel is greater than the outside dimension of the second adjustable expansion mandrel.

An apparatus for radially expanding and plastically deforming an expandable tubular member has been described that includes a support member, a locking device coupled to the support member and releasably coupled to the expandable tubular member, an adjustable expansion mandrel adapted to be controllably expanded to a larger outside dimension for radial expansion and plastic deformation of the expandable tubular member or collapsed to a smaller outside dimension, and an actuator coupled to the locking member and the adjustable expansion mandrel adapted to displace the adjustable expansion mandrel upwardly through the expandable tubular member to radially expand and plastically deform a portion of the expandable tubular member. In an exemplary embodiment, the apparatus further includes a gripping assembly coupled to the support member and the actuator for controllably gripping at least one of the expandable tubular member or another tubular member. In an exemplary embodiment, the apparatus further includes one or more cup seals coupled to the support member for sealingly engaging the expandable tubular member above the adjustable expansion mandrel. In an exemplary embodiment, the apparatus further includes an expansion mandrel coupled to the adjustable expansion mandrel, and a float collar assembly coupled to the adjustable expansion mandrel that includes a float valve assembly and a sealing sleeve coupled to the float valve assembly adapted to be radially expanded and plastically deformed by the expansion mandrel.

A method for radially expanding and plastically deforming an expandable tubular member within a borehole has also been described that includes supporting the expandable tubular member, an hydraulic actuator, and an adjustable expansion mandrel within the borehole, increasing the size of the adjustable expansion mandrel, and displacing the adjustable expansion mandrel upwardly relative to the expandable tubular member using the hydraulic actuator to radially expand and plastically deform a portion of the expandable tubular member. In an exemplary embodiment, the method further includes reducing the size of the adjustable expansion mandrel after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion mandrel. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and a preexisting structure after permitting the position of the expandable tubular member to float relative to the position of the hydraulic actuator. In an exemplary embodiment, the method further includes increasing the size of the adjustable expansion mandrel after permitting the position of the expandable tubular member to float relative to the position of the hydraulic actuator. In an exemplary embodiment, the method further includes displacing the adjustable expansion cone upwardly relative to the expandable tubular member to radially expand and plastically deform another portion of the expandable tubular member. In an exemplary embodiment, the method further includes if the end of the other portion of the expandable tubular member overlaps with a preexisting structure, then not permitting the position of the expandable tubular member to float relative to the position of the hydraulic actuator, and displacing the adjustable expansion cone upwardly relative to the expandable tubular member using the hydraulic actuator to radially expand and plastically deform the end of the other portion of the expandable tubular member that overlaps with the preexisting structure.

A method for forming a mono diameter wellbore casing within a borehole that includes a preexisting wellbore casing has been described that includes supporting the expandable tubular member, an hydraulic actuator, and an adjustable expansion mandrel within the borehole, increasing the size of the adjustable expansion mandrel, displacing the adjustable expansion mandrel upwardly relative to the expandable tubular member using the hydraulic actuator to radially expand and plastically deform a portion of the expandable tubular member, and displacing the adjustable expansion mandrel upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the method further includes reducing the size of the adjustable expansion mandrel after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion mandrel. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and the borehole after permitting the position of the expandable tubular member to float relative to the position of the hydraulic actuator. In an exemplary embodiment, the method further includes increasing the size of the adjustable expansion mandrel after permitting the position of the expandable tubular member to float relative to the position of the hydraulic actuator. In an exemplary embodiment, the method further includes displacing the adjustable expansion cone upwardly relative to the expandable tubular member to radially expand and plastically deform the remaining portion of the expandable tubular member. In an exemplary embodiment, the method further includes not permitting the position of the expandable tubular member to float relative to the position of the hydraulic actuator, and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

An apparatus for radially expanding and plastically deforming an expandable tubular member has been described that includes a support member; an expansion device for radially expanding and plastically deforming the tubular member coupled to the support member; and an actuator coupled to the support member for displacing the expansion device relative to the support member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the locking device includes a pressure sensor for controllably unlocking the locking device from engagement with the tubular member when the operating pressure within the apparatus exceeds a predetermined amount. In an exemplary embodiment, the locking device includes a position sensor for controllably unlocking the locking device from engagement with the tubular member when the position of the actuator exceeds a predetermined amount. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements includes a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes: a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include: a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a sealing assembly for sealing an annulus defined between the support member and the tubular member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the apparatus further includes a locking device for locking the position of the tubular member relative to the support member. In an exemplary embodiment, wherein the locking device includes a pressure sensor for controllably unlocking the locking device from engagement with the tubular member when the operating pressure within the apparatus exceeds a predetermined amount. In an exemplary embodiment, the locking device includes a position sensor for controllably unlocking the locking device from engagement with the tubular member when the position of a portion of the apparatus exceeds a predetermined amount. In an exemplary embodiment, the apparatus further includes an actuator for displacing the expansion device relative to the support member. In an exemplary embodiment, the actuator includes means for transferring torsional loads between the support member and the expansion device. In an exemplary embodiment, the actuator includes a plurality of pistons positioned within corresponding piston chambers. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include: a first set of expansion elements; and a second set of expansion elements; wherein the first set of expansion elements are interleaved with the second set of expansion elements. In an exemplary embodiment, wherein in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, wherein the expansion elements include: a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a first expansion device for radially expanding and plastically deforming the tubular member coupled to the support member; and a second expansion device for radially expanding and plastically deforming the tubular member coupled to the support member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the locking device includes a pressure sensor for controllably unlocking the locking device from engagement with the tubular member when the operating pressure within the apparatus exceeds a predetermined amount. In an exemplary embodiment, the locking device includes a position sensor for controllably unlocking the locking device from engagement with the tubular member when the position of a portion of the apparatus exceeds a predetermined amount. In an exemplary embodiment, the apparatus further includes an actuator for displacing the expansion device relative to the support member. In an exemplary embodiment, the actuator includes means for transferring torsional loads between the support member and the expansion device. In an exemplary embodiment, the actuator includes a plurality of pistons positioned within corresponding piston chambers. In an exemplary embodiment, at least one of the first second expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the first and second expansion devices comprise a plurality of expansion devices. In an exemplary embodiment, at least one of the first and second expansion device comprise an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member. In an exemplary embodiment, the locking device includes a pressure sensor for controllably unlocking the locking device from engagement with the tubular member when the operating pressure within the apparatus exceeds a predetermined amount. In an exemplary embodiment, the locking device includes a position sensor for controllably unlocking the locking device from engagement with the tubular member when the position of a portion of the apparatus exceeds a predetermined amount. In an exemplary embodiment, the gripping device includes a plurality of movable gripping elements. In an exemplary embodiment, the gripping elements are moveable in a radial direction relative to the support member. In an exemplary embodiment, the sealing device seals an annulus defines between the support member and the tubular member. In an exemplary embodiment, the actuator includes means for transferring torsional loads between the support member and the expansion device. In an exemplary embodiment, the actuator includes a plurality of pistons positioned within corresponding piston chambers. In an exemplary embodiment, at least one of the adjustable expansion devices include: a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include: a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the adjustable expansion devices comprise a plurality of expansion devices. In an exemplary embodiment, at least one of the adjustable expansion devices include: a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the expansion elements include: a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An actuator has been described that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber. In an exemplary embodiment, the actuator further includes means for transmitting torsional loads between the tubular housing and the tubular piston rod.

A method of radially expanding and plastically deforming an expandable tubular member within a borehole having a preexisting wellbore casing has been described that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, radially expanding and plastically deforming a portion of the tubular member to form a bell section includes: positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; and displacing the adjustable expansion device upwardly relative to the expandable tubular member n times to radially expand and plastically deform n portions of the expandable tubular member, wherein n is greater than or equal to 1.

A method for radially expanding and plastically deforming an expandable tubular member within a borehole has been described that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and a preexisting structure after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform another portion of the expandable tubular member. In an exemplary embodiment, the method further includes if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

A method for forming a mono diameter wellbore casing within a borehole that includes a preexisting wellbore casing has been described that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and the borehole after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform the remaining portion of the expandable tubular member. In an exemplary embodiment, the method further includes not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A method of radially expanding and plastically deforming a tubular member has been described that includes positioning the tubular member within a preexisting structure; radially expanding and plastically deforming a lower portion of the tubular member to form a bell section; and radially expanding and plastically deforming a portion of the tubular member above the bell section. In an exemplary embodiment, positioning the tubular member within a preexisting structure includes locking the tubular member to an expansion device. In an exemplary embodiment, positioning the tubular member within a preexisting structure includes unlocking the tubular member from an expansion device if the operating pressure within the preexisting structure exceeds a predetermined amount. In an exemplary embodiment, positioning the tubular member within a preexisting structure includes unlocking the tubular member from an expansion device if the position of an actuator coupled to the tubular member exceeds a predetermined amount. In an exemplary embodiment, radially expanding and plastically deforming a lower portion of the tubular member to form a bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, wherein gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, radially expanding and plastically deforming a portion of the tubular member above the bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes fluidicly sealing an end of the tubular member; and pulling the expansion device through the tubular member. In an exemplary embodiment, wherein the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes overlapping the portion of the tubular member above the bell section with an end of a preexisting tubular member; and pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the overlapping portions of the tubular member and the preexisting tubular member includes gripping the tubular member; and pulling the expansion device through the overlapping portions of the tubular member and the preexisting tubular member. In an exemplary embodiment, pulling the expansion device through the overlapping portions of the tubular member and the preexisting tubular member includes pulling the expansion device through the overlapping portions of the tubular member and the preexisting tubular member using an actuator. In an exemplary embodiment, pulling the expansion device through the overlapping portions of the tubular member and the preexisting tubular member includes pulling the expansion device through the overlapping portions of the tubular member and the preexisting tubular member using fluid pressure. In an exemplary embodiment, pulling the expansion device through the overlapping portions of the tubular member and the preexisting tubular member using fluid pressure includes pressurizing an annulus within the tubular member above the expansion device. In an exemplary embodiment, the method further includes injecting a hardenable fluidic sealing material into an annulus between the expandable tubular member and the preexisting structure.

A method of injecting a hardenable fluidic sealing material into an annulus between a tubular member and a preexisting structure has been described that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

A method of engaging a tubular member has been described that includes positioning a plurality of elements within the tubular member; and bringing the elements into engagement with the tubular member. In an exemplary embodiment, the elements include a first group of elements; and a second group of elements; wherein the first group of elements are interleaved with the second group of elements. In an exemplary embodiment, bringing the elements into engagement with the tubular member includes bringing the elements into axial alignment. In an exemplary embodiment, bringing the elements into engagement with the tubular member further includes pivoting the elements. In an exemplary embodiment, bringing the elements into engagement with the tubular member further includes translating the elements. In an exemplary embodiment, bringing the elements into engagement with the tubular member further includes pivoting the elements; and translating the elements. In an exemplary embodiment, bringing the elements into engagement with the tubular member includes rotating the elements about a common axis. In an exemplary embodiment, bringing the elements into engagement with the tubular member includes pivoting the elements about corresponding axes; translating the elements; and rotating the elements about a common axis. In an exemplary embodiment, the method further includes preventing the elements from coming into engagement with the tubular member if the inside diameter of the tubular member is less than a predetermined value. In an exemplary embodiment, preventing the elements from coming into engagement with the tubular member if the inside diameter of the tubular member is less than a predetermined value includes sensing the inside diameter of the tubular member.

A locking device for locking a tubular member to a support member has been described that includes a radially movable locking device coupled to the support member for engaging an interior surface of the tubular member. In an exemplary embodiment, the device further includes a pressure sensor for controllably unlocking the locking device from engagement with the tubular member when an operating pressure exceeds a predetermined amount. In an exemplary embodiment, the device further includes a position sensor for controllably unlocking the locking device from engagement with the tubular member when a position exceeds a predetermined amount.

A method of locking a tubular member to a support member has been described that includes locking a locking element in a position that engages an interior surface of the tubular member. In an exemplary embodiment, the method further includes controllably unlocking the locking element from engagement with the tubular member when an operating pressure exceeds a predetermined amount. In an exemplary embodiment, the method further includes controllably unlocking the locking element from engagement with the tubular member when a position exceeds a predetermined amount.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, the expansion surfaces of the upper and lower cone segments, 600 and 602, may include any form of inclined surface or combination of inclined surfaces such as, for example, conical, spherical, elliptical, and/or parabolic that may or may not be faceted. Finally, one or more of the steps of the methods of operation of the exemplary embodiments may be omitted and/or performed in another order.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for radially expanding and plastically deforming an expandable tubular member, comprising:

a float shoe adapted to mate with an end of the expandable tubular member;

an adjustable expansion device coupled to the float shoe adapted to be controllably expanded to a larger outside dimension for radial expansion of the expandable tubular member or collapsed to a smaller outside dimension;

an actuator coupled to the adjustable expansion device adapted to controllably displace the adjustable expansion device relative to the expandable tubular member;

a locking device coupled to the actuator adapted to controllably engage the expandable tubular member; and a support member coupled to the locking device.

2. A method for radially expanding and plastically deforming an expandable tubular member within a borehole, comprising:

positioning an adjustable expansion device within the expandable tubular member;

supporting the expandable tubular member and the adjustable expansion device within the borehole;

lowering the adjustable expansion device out of the expandable tubular member;

increasing the outside dimension of the adjustable expansion device; and displacing the adjustable expansion device upwardly relative to the expandable tubular member n times to radially expand and plastically deform n portions of the expandable tubular member.

3. A method for forming a mono diameter wellbore casing, comprising:

positioning an adjustable expansion device within a first expandable tubular member;

supporting the first expandable tubular member and the adjustable expansion device within a borehole;

lowering the adjustable expansion device out of the first expandable tubular member;

increasing the outside dimension of the adjustable expansion device;

displacing the adjustable expansion device upwardly relative to the first expandable tubular member m times to radially expand and plastically deform m portions of the first expandable tubular member within the borehole;

positioning the adjustable expansion device within a second expandable tubular member;

supporting the second expandable tubular member and the adjustable expansion device within the borehole in overlapping relation to the first expandable tubular member;

lowering the adjustable expansion device out of the second expandable tubular member;

increasing the outside dimension of the adjustable expansion device; and displacing the adjustable expansion device upwardly relative to the second expandable tubular member n times to radially expand and plastically deform n portions of the second expandable tubular member within the borehole.

4. An apparatus for radially expanding and plastically deforming an expandable tubular member, comprising:

a float shoe adapted to mate with an end of the expandable tubular member;

an adjustable expansion device coupled to the float shoe adapted to be controllably expanded to a larger outside dimension for radial expansion of the expandable tubular member or collapsed to a smaller outside dimension;

an actuator coupled to the adjustable expansion device adapted to controllably displace the adjustable expansion device relative to the expandable tubular member;

a locking device coupled to the actuator adapted to controllably engage the expandable tubular member;

a support member coupled to the locking device; and a sealing member for sealingly engaging the expandable tubular member adapted to define a pressure chamber above the adjustable expansion device during radial expansion of the expandable tubular member.

5. A method for radially expanding and plastically deforming an expandable tubular member within a borehole, comprising:

positioning an adjustable expansion device within the expandable tubular member;

supporting the expandable tubular member and the adjustable expansion device within the borehole;

lowering the adjustable expansion device out of the expandable tubular member;

increasing the outside dimension of the adjustable expansion device;

displacing the adjustable expansion device upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

6. A method for forming a mono diameter wellbore casing, comprising:

positioning an adjustable expansion device within a first expandable tubular member;

supporting the first expandable tubular member and the adjustable expansion device within a borehole;

lowering the adjustable expansion device out of the first expandable tubular member;

increasing the outside dimension of the adjustable expansion device;

displacing the adjustable expansion device upwardly relative to the first expandable tubular member m times to radially expand and plastically deform m portions of the first expandable tubular member within the borehole;

pressurizing an interior region of the first expandable tubular member above the adjustable expansion device during the radial expansion and plastic deformation of the first expandable tubular member within the borehole;

positioning the adjustable expansion device within a second expandable tubular member;

supporting the second expandable tubular member and the adjustable expansion device within the borehole in overlapping relation to the first expandable tubular member;

lowering the adjustable expansion device out of the second expandable tubular member;

increasing the outside dimension of the adjustable expansion device;

displacing the adjustable expansion device upwardly relative to the second expandable tubular member n times to radially expand and plastically deform n portions of the second expandable tubular member within the borehole; and pressurizing an interior region of the second expandable tubular member above the adjustable expansion device during the radial expansion and plastic deformation of the second expandable tubular member within the borehole.

7. An apparatus for drilling a borehole within a subterranean formation and then radially expanding and plastically deforming an expandable tubular member within the drilled borehole, comprising:

a float shoe adapted to mate with an end of the expandable tubular member;

a drilling member coupled to the float shoe adapted to drill the borehole;

an adjustable expansion device coupled to the float shoe adapted to be controllably expanded to a larger outside dimension for radial expansion of the expandable tubular member or collapsed to a smaller outside dimension;

an actuator coupled to the adjustable expansion device adapted to controllably displace the adjustable expansion device relative to the expandable tubular member;

a locking device coupled to the actuator adapted to controllably engage the expandable tubular member; and a support member coupled to the locking device.

8. A method for drilling a borehole within a subterranean formation and then radially expanding and plastically deforming an expandable tubular member within the drilled borehole, comprising:

positioning an adjustable expansion device within the expandable tubular member;

coupling a drilling member to an end of the expandable tubular member;

drilling the borehole using the drilling member;

positioning the adjustable expansion device and the expandable tubular member within the drilled borehole;

lowering the adjustable expansion device out of the expandable tubular member;

increasing the outside dimension of the adjustable expansion device; and displacing the adjustable expansion device upwardly relative to the expandable tubular member n times to radially expand and plastically deform n portions of the expandable tubular member within the drilled borehole.

9. A method for forming a mono diameter wellbore casing within a borehole, comprising:

positioning an adjustable expansion device within a first expandable tubular member;

coupling a drilling member to an end of the first expandable tubular member;

drilling a first section of the borehole using the drilling member;

supporting the first expandable tubular member and the adjustable expansion device within the drilled first section of the borehole;

lowering the adjustable expansion device out of the first expandable tubular member;

increasing the outside dimension of the adjustable expansion device;

displacing the adjustable expansion device upwardly relative to the first expandable tubular member m times to radially expand and plastically deform m portions of the first expandable tubular member within the drilled first section of the borehole;

positioning the adjustable expansion device within a second expandable tubular member;

coupling the drilling member to an end of the second expandable tubular member;

drilling a second section of the borehole using the drilling member;

supporting the second expandable tubular member and the adjustable expansion device within the borehole in overlapping relation to the first expandable tubular member within the second drilled section of the borehole;

lowering the adjustable expansion device out of the second expandable tubular member;

increasing the outside dimension of the adjustable expansion device; and displacing the adjustable expansion device upwardly relative to the second expandable tubular member n times to radially expand and plastically deform n portions of the second expandable tubular member within the drilled second section of the borehole.

10. An apparatus for drilling a borehole within a subterranean formation and then radially expanding and plastically deforming an expandable tubular member within the drilled borehole, comprising:

a float shoe adapted to mate with an end of the expandable tubular member;

a drilling member coupled to the float shoe adapted to drill the borehole;

an adjustable expansion device coupled to the float shoe adapted to be controllably expanded to a larger outside dimension for radial expansion of the expandable tubular member or collapsed to a smaller outside dimension;

an actuator coupled to the adjustable expansion device adapted to controllably displace the adjustable expansion device relative to the expandable tubular member;

a locking device coupled to the actuator adapted to controllably engage the expandable tubular member;

a support member coupled to the locking device; and a sealing member for sealing engaging the expandable tubular member adapted to define a pressure chamber above the adjustable expansion device during the radial expansion of the expandable tubular member.

11. A method for drilling a borehole within a subterranean formation and then radially expanding and plastically deforming an expandable tubular member within the drilled borehole, comprising:

positioning an adjustable expansion device within the expandable tubular member;

coupling a drilling member to an end of the expandable tubular member;

drilling the borehole using the drilling member;

positioning the adjustable expansion device and the expandable tubular member within the drilled borehole;

lowering the adjustable expansion device out of the expandable tubular member;

increasing the outside dimension of the adjustable expansion device;

displacing the adjustable expansion device upwardly relative to the expandable tubular member n times to radially expand and plastically deform n portions of the expandable tubular member within the drilled borehole; and pressuring an interior portion of the expandable tubular member above the adjustable expansion device during the radial expansion and plastic deformation of the expandable tubular member within the drilled borehole.

12. A method for forming a mono diameter wellbore casing within a borehole, comprising:

positioning an adjustable expansion device within a first expandable tubular member;

coupling a drilling member to an end of the first expandable tubular member;

drilling a first section of the borehole using the drilling member;

supporting the first expandable tubular member and the adjustable expansion device within the drilled first section of the borehole;

lowering the adjustable expansion device out of the first expandable tubular member;

increasing the outside dimension of the adjustable expansion device;

displacing the adjustable expansion device upwardly relative to the first expandable tubular member m times to radially expand and plastically deform m portions of the first expandable tubular member within the drilled first section of the borehole;

pressuring an interior portion of the first expandable tubular member above the adjustable expansion device during the radial expansion and plastic deformation of the first expandable tubular member within the first drilled section of the borehole;

positioning the adjustable expansion device within a second expandable tubular member;

coupling the drilling member to an end of the second expandable tubular member;

drilling a second section of the borehole using the drilling member;

supporting the second expandable tubular member and the adjustable expansion device within the borehole in overlapping relation to the first expandable tubular member within the second drilled section of the borehole; lowering the adjustable expansion device out of the second expandable tubular member;

increasing the outside dimension of the adjustable expansion device;

displacing the adjustable expansion device upwardly relative to the second expandable tubular member n times to radially expand and plastically deform n portions of the second expandable tubular member within the drilled second section of the borehole; and pressuring an interior portion of the second expandable tubular member above the adjustable expansion device during the radial expansion and plastic deformation of the second expandable tubular member within the drilled second section of the borehole.

13. An apparatus for radially expanding and plastically deforming an expandable tubular member, comprising:

a float shoe adapted to mate with an end of the expandable tubular member;

a first adjustable expansion device coupled to the float shoe adapted to be controllably expanded to a first larger outside dimension for radial expansion of the expandable tubular member or collapsed to a first smaller outside dimension;

a second adjustable expansion device coupled to the first adjustable expansion device adapted to be controllably expanded to a second larger outside dimension for radial expansion of the expandable tubular member or collapsed to a second smaller outside dimension;

an actuator coupled to the first and second adjustable expansion devices adapted to controllably displace the first and second adjustable expansion devices relative to the expandable tubular member;

a locking device coupled to the actuator adapted to controllably engage the expandable tubular member; and a support member coupled to the locking device;

wherein the first larger outside dimension of the first adjustable expansion device is larger than the second larger outside dimension of the second adjustable expansion device.

14. A method for radially expanding and plastically deforming an expandable tubular member within a borehole, comprising:

positioning first and second adjustable expansion devices within the expandable tubular member;

supporting the expandable tubular member and the first and second adjustable expansion devices within the borehole;

lowering the first adjustable expansion device out of the expandable tubular member;

increasing the outside dimension of the first adjustable expansion device;

displacing the first adjustable expansion device upwardly relative to the expandable tubular member to radially expand and plastically deform a lower portion of the expandable tubular member;

displacing the first adjustable expansion device and the second adjustable expansion device downwardly relative to the expandable tubular member;

decreasing the outside dimension of the first adjustable expansion device and increasing the outside dimension of the second adjustable expansion device;

displacing the second adjustable expansion device upwardly relative to the expandable tubular member to radially expand and plastically deform portions of the expandable tubular member above the lower portion of the expandable tubular member;

wherein the outside dimension of the first adjustable expansion device is greater than the outside dimension of the second adjustable expansion device.

15. A method for forming a mono diameter wellbore casing, comprising:

positioning first and second adjustable expansion devices within a first expandable tubular member;

supporting the first expandable tubular member and the first and second adjustable expansion devices within a borehole;

lowering the first adjustable expansion device out of the first expandable tubular member;

increasing the outside dimension of the first adjustable expansion device;

displacing the first adjustable expansion device upwardly relative to the first expandable tubular member to radially expand and plastically deform a lower portion of the first expandable tubular member;

displacing the first adjustable expansion device and the second adjustable expansion device downwardly relative to the first expandable tubular member;

decreasing the outside dimension of the first adjustable expansion device and increasing the outside dimension of the second adjustable expansion device;

displacing the second adjustable expansion device upwardly relative to the first expandable tubular member to radially expand and plastically deform portions of the first expandable tubular member above the lower portion of the expandable tubular member;

positioning first and second adjustable expansion devices within a second expandable tubular member;

supporting the first expandable tubular member and the first and second adjustable expansion devices within the borehole in overlapping relation to the first expandable tubular member;

lowering the first adjustable expansion device out of the second expandable tubular member;

increasing the outside dimension of the first adjustable expansion device;

displacing the first adjustable expansion device upwardly relative to the second expandable tubular member to radially expand and plastically deform a lower portion of the second expandable tubular member;

displacing the first adjustable expansion device and the second adjustable expansion device downwardly relative to the second expandable tubular member;

decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member;

wherein the outside dimension of the first adjustable expansion device is greater than the outside dimension of the second adjustable expansion device.

16. An apparatus for radially expanding and plastically deforming an expandable tubular member, comprising:

a float shoe adapted to mate with an end of the expandable tubular member;

a first adjustable expansion device coupled to the float shoe adapted to be controllably expanded to a first larger outside dimension for radial expansion of the expandable tubular member or collapsed to a first smaller outside dimension;

a second adjustable expansion device coupled to the first adjustable expansion device adapted to be controllably expanded to a second larger outside dimension for radial expansion of the expandable tubular member or collapsed to a second smaller outside dimension;

an actuator coupled to the first and second adjustable expansion devices adapted to controllably displace the first and second adjustable expansion devices relative to the expandable tubular member;

a locking device coupled to the actuator adapted to controllably engage the expandable tubular member;

a support member coupled to the locking device; and a sealing member for sealingly engaging the expandable tubular adapted to define a pressure chamber above the first and second adjustable expansion devices during the radial expansion of the expandable tubular member;

wherein the first larger outside dimension of the first adjustable expansion device is larger than the second larger outside dimension of the second adjustable expansion device.

17. A method for radially expanding and plastically deforming an expandable tubular member within a borehole, comprising:

positioning first and second adjustable expansion devices within the expandable tubular member;

supporting the expandable tubular member and the first and second adjustable expansion devices within the borehole;

lowering the first adjustable expansion device out of the expandable tubular member;

increasing the outside dimension of the first adjustable expansion device;

displacing the first adjustable expansion device upwardly relative to the expandable tubular member to radially expand and plastically deform a lower portion of the expandable tubular member;

pressurizing an interior region of the expandable tubular member above the first adjustable expansion device during the radial expansion of the lower portion of the expandable tubular member by the first adjustable expansion device;

displacing the first adjustable expansion device and the second adjustable expansion device downwardly relative to the expandable tubular member;

decreasing the outside dimension of the first adjustable expansion device and increasing the outside dimension of the second adjustable expansion device;

displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

18. A method for forming a mono diameter wellbore casing, comprising:

positioning first and second adjustable expansion devices within a first expandable tubular member;

supporting the first expandable tubular member and the first and second adjustable expansion devices within a borehole;

lowering the first adjustable expansion device out of the first expandable tubular member;

increasing the outside dimension of the first adjustable expansion device;

displacing the first adjustable expansion device upwardly relative to the first expandable tubular member to radially expand and plastically deform a lower portion of the first expandable tubular member;

pressurizing an interior region of the first expandable tubular member above the first adjustable expansion device during the radial expansion of the lower portion of the first expandable tubular member by the first adjustable expansion device;

displacing the first adjustable expansion device and the second adjustable expansion device downwardly relative to the first expandable tubular member;

decreasing the outside dimension of the first adjustable expansion device and increasing the outside dimension of the second adjustable expansion device;

displacing the second adjustable expansion device upwardly relative to the first expandable tubular member to radially expand and plastically deform portions of the first expandable tubular member above the lower portion of the expandable tubular member;

pressurizing an interior region of the first expandable tubular member abovethe second adjustable expansion device during the radial expansion of the portions of the first expandable tubular member above the lower portion of the first expandable tubular member by the second adjustable expansion device;

positioning first and second adjustable expansion devices within a second expandable tubular member;

supporting the first expandable tubular member and the first and second adjustable expansion devices within the borehole in overlapping relation to the first expandable tubular member;

lowering the first adjustable expansion device out of the second expandable tubular member;

increasing the outside dimension of the first adjustable expansion device;

displacing the first adjustable expansion device upwardly relative to the second expandable tubular member to radially expand and plastically deform a lower portion of the second expandable tubular member;

pressurizing an interior region of the second expandable tubular member above the first adjustable expansion device during the radial expansion of the lower portion of the second expandable tubular member by the first adjustable expansion device;

displacing the first adjustable expansion device and the second adjustable expansion device downwardly relative to the second expandable tubular member;

decreasing the outside dimension of the first adjustable expansion device and increasing the outside dimension of the second adjustable expansion device;

displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device;

wherein the outside dimension of the first adjustable expansion device is greater than the outside dimension of the second adjustable expansion device.

19. An apparatus for radially expanding and plastically deforming an expandable tubular member, comprising:

a support member; a locking device coupled to the support member and releasably coupled to the expandable tubular member;

an adjustable expansion device adapted to be controllably expanded to a larger outside dimension for radial expansion and plastic deformation of the expandable tubular member or collapsed to a smaller outside dimension; and an actuator coupled to the locking member and the adjustable expansion device adapted to displace the adjustable expansion device upwardly through the expandable tubular member to radially expand and plastically deform a portion of the expandable tubular member.

20. The apparatus of claim 19, further comprising:

a gripping assembly coupled to the support member and the actuator for controllably gripping at least one of the expandable tubular member or another tubular member.

21. The apparatus of claim 19, further comprising:

one or more cup seals coupled to the support member for sealingly engaging the expandable tubular member above the adjustable expansion device.

22. The apparatus of claim 19, further comprising:

an expansion device coupled to the adjustable expansion device; and a float collar assembly coupled to the adjustable expansion device comprising:

a float valve assembly; and a sealing sleeve coupled to the float valve assembly adapted to be radially expanded and plastically deformed by the expansion device.

23. A method for radially expanding and plastically deforming an expandable tubular member within a borehole, comprising:

supporting the expandable tubular member, an hydraulic actuator, and an adjustable expansion device within the borehole;

increasing the size of the adjustable expansion device; and displacing the adjustable expansion device upwardly relative to the expandable tubular member using the hydraulic actuator to radially expand and plastically deform a portion of the expandable tubular member.

24. The method of claim 23, further comprising:

reducing the size of the adjustable expansion device after the portion of the expandable tubular member has been radially expanded and plastically deformed.

25. The method of claim 24, further comprising:

fluidicly sealing the radially expanded and plastically deformed end of the expandable tubular member after reducing the size of the adjustable expansion device.

26. The method of claim 25, further comprising:

permitting the position of the expandable tubular member to float relative to the position of the hydraulic actuator after fluidicly sealing the radially expanded and plastically deformed end of the expandable tubular member.

27. The method of claim 26, further comprising:

injecting a hardenable fluidic sealing material into an annulus between the expandable tubular member and a preexisting structure after permitting the position of the expandable tubular member to float relative to the position of the hydraulic actuator.

28. The method of claim 26, further comprising:

increasing the size of the adjustable expansion device after permitting the position of the expandable tubular member to float relative to the position of the hydraulic actuator.

29. The method of claim 28, further comprising:

displacing the adjustable expansion cone upwardly relative to the expandable tubular member to radially expand and plastically deform another portion of the expandable tubular member.

30. The method of claim 29, further comprising:

if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

31. A method for forming a mono diameter wellbore casing within a borehole that includes a preexisting wellbore casing, comprising:

supporting the expandable tubular member, an hydraulic actuator, and an adjustable expansion device within the borehole;

increasing the size of the adjustable expansion device;

displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

32. The method of claim 31, further comprising:

reducing the size of the adjustable expansion device after the portion of the expandable tubular member has been radially expanded and plastically deformed.

33. The method of claim 32, further comprising:

fluidicly sealing the radially expanded and plastically deformed end of the expandable tubular member after reducing the size of the adjustable expansion device.

34. The method of claim 33, further comprising:

permitting the position of the expandable tubular member to float relative to the position of the hydraulic actuator after fluidicly sealing the radially expanded and plastically deformed end of the expandable tubular member.

35. The method of claim 34, further comprising:

injecting a hardenable fluidic sealing material into an annulus between the expandable tubular member and the borehole after permitting the position of the expandable tubular member to float relative to the position of the hydraulic actuator.

36. The method of claim 34, further comprising:

increasing the size of the adjustable expansion device after permitting the position of the expandable tubular member to float relative to the position of the hydraulic actuator.

37. The method of claim 36, further comprising:

displacing the adjustable expansion cone upwardly relative to the expandable tubular member to radially expand and plastically deform the remaining portion of the expandable tubular member.

38. The method of claim 37, further comprising:

not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

39. An apparatus for radially expanding and plastically deforming an expandable tubular member, comprising:

a support member;

an expansion device for radially expanding and plastically deforming the tubular member coupled to the support member; and an actuator coupled to the support member for upwardly displacing the expansion device relative to the support member to radially expand and plastically deform the tubular member.

40. The apparatus of claim 39, further comprising: a sealing device for sealing an interface with the tubular member coupled to the support member.

41. The apparatus of claim 39, further comprising: a locking device for locking the position of the tubular member relative to the support member.

42. The apparatus of claim 39, wherein the expansion device comprises:

a plurality of movable expansion elements coupled to the support member.

43. The apparatus of claim 42, wherein:

the expansion elements are movable between a first position and a second position;

wherein in the first position, the expansion elements do not engage the tubular member; and wherein in the second position, the expansion elements engage the tubular member.

44. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and a gripping device for gripping the tubular member coupled to the support member.

45. The apparatus of claim 44, wherein the gripping device comprises a plurality of movable gripping elements.

46. The apparatus of claim 45, wherein the gripping elements are moveable in a radial direction relative to the support member.

47. The apparatus of claim 44, wherein the expansion device comprises an adjustable expansion device.

48. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member;

a sealing device for sealing an interface with the tubular member coupled to the support member, wherein the sealing device seals an annulus defined between the support member and the tubular member.

49. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and a locking device for locking the position of the tubular member relative to the support member, wherein the locking device comprises a pressure sensor for controllably unlocking the locking device from engagement with the tubular member when the operating pressure within the apparatus exceeds a predetermined amount.

50. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and wherein the locking device comprises:

a position sensor for controllably unlocking the locking device from engagement with the tubular member when the position of the actuator exceeds a predetermined amount.

51. An apparatus for radially expanding and plastically deforming an expandable tubular member, comprising:

a support member;

an expansion device for radially expanding and plastically deforming the tubular member coupled to the support member; and an actuator coupled to the support member for displacing the expansion device relative to the support member;

wherein the expansion device comprises a plurality of movable expansion elements coupled to the support member, the expansion elements being movable between a first position and a second position, wherein in the first position, the expansion elements do not engage the tubular member, and wherein in the second position, the expansion elements engage the tubular member, wherein the expansion elements comprise:

a first set of expansion elements; and a second set of expansion elements;

wherein the first set of expansion elements are interleaved with the second set of expansion elements.

52. The apparatus of claim 51, wherein in the first position, the first set of expansion elements are not axially aligned with the second set of expansion elements.

53. The apparatus of claim 51, wherein in the second position, the first set of expansion elements are axially aligned with the second set of expansion elements.

54. An apparatus for radially expanding and plastically deforming an expandable tubular member, comprising:

a support member;

an expansion device for radially expanding and plastically deforming the tubular member coupled to the support member; and an actuator coupled to the support member for displacing the expansion device relative to the support member, wherein the expansion device comprises a plurality of expansion mechanisms.

55. The apparatus of claim 54, wherein at least one of the expansion mechanisms comprises an adjustable expansion mechanism.

56. The apparatus of claim 55, wherein the adjustable expansion mechanism comprises:

a plurality of movable expansion elements coupled to the support member.

57. The apparatus of claim 56, wherein:

the expansion elements are movable between a first position and a second position;

wherein in the first position, the expansion elements do not engage the tubular member; and wherein in the second position, the expansion elements engage the tubular member.

58. The apparatus of claim 57, wherein the expansion elements comprise: a first set of expansion elements; and a second set of expansion elements; wherein the first set of expansion elements are interleaved with the second set of expansion elements.

59. The apparatus of claim 58, wherein in the first position, the first set of expansion elements are not axially aligned with the second set of expansion elements.

60. The apparatus of claim 58, wherein in the second position, the first set of expansion elements are axially aligned with the second set of expansion elements.

61. An apparatus for radially expanding and plastically deforming an expandable tubular member, comprising:

an elongated support member;

an expansion device for radially expanding and plastically deforming the tubular member coupled to the support member, the expansion device being longitudinally displaceable relative to the support member; and a sealing assembly for sealing an annulus defined between the support member and the tubular member.

62. The apparatus of claim 61, further comprising:

a gripping device for gripping the tubular member coupled to the support member.

63. The apparatus of claim 62, wherein the gripping device comprises a plurality of movable gripping elements.

64. The apparatus of claim 63, wherein the gripping elements are moveable in a radial direction relative to the support member.

65. The apparatus of claim 61, further comprising:

a locking device for locking the position of the tubular member relative to the support member.

66. The apparatus of claim 65, wherein the locking device comprises:

a pressure sensor for controllably unlocking the locking device from engagement with the tubular member when the operating pressure within the apparatus exceeds a predetermined amount.

67. The apparatus of claim 65, wherein the locking device comprises:

a position sensor for controllably unlocking the locking device from engagement with the tubular member when the position of a portion of the apparatus exceeds a predetermined amount.

68. The apparatus of claim 61, further comprising:

an actuator for displacing the expansion device relative to the support member.

69. The apparatus of claim 68, wherein the actuator comprises means for transferring torsional loads between the support member and the expansion device.

70. The apparatus of claim 68, wherein the actuator comprises a plurality of pistons positioned within corresponding piston chambers.

71. The apparatus of claim 61, wherein the expansion device comprises:

a plurality of movable expansion elements coupled to the support member.

72. The apparatus of claim 71, wherein:

the expansion elements are movable between a first position and a second position;

wherein in the first position, the expansion elements do not engage the tubular member; and wherein in the second position, the expansion elements engage the tubular member.

73. The apparatus of claim 72, wherein the expansion elements comprise:

a first set of expansion elements; and a second set of expansion elements;

wherein the first set of expansion elements are interleaved with the second set of expansion elements.

74. The apparatus of claim 73, wherein in the first position, the first set of expansion elements are not axially aligned with the second set of expansion elements.

75. The apparatus of claim 73, wherein in the second position, the first set of expansion elements are axially aligned with the second set of expansion elements.

76. The apparatus of claim 61, wherein the expansion device comprises an adjustable expansion device.

77. The apparatus of claim 61, wherein the expansion device comprises a plurality of expansion mechanisms.

78. The apparatus of claim 77, wherein at least one of the expansion mechanisms comprises an adjustable expansion mechanism.

79. The apparatus of claim 78, wherein the adjustable expansion mechanism comprises:

a plurality of movable expansion elements coupled to the support member.

80. The apparatus of claim 79, wherein:

the expansion elements are movable between a first position and a second position;

wherein in the first position, the expansion elements do not engage the tubular member; and wherein in the second position, the expansion elements engage the tubular member.

81. The apparatus of claim 80, wherein the expansion elements comprise:

a first set of expansion elements; and a second set of expansion elements;

wherein the first set of expansion elements are interleaved with the second set of expansion elements.

82. The apparatus of claim 81, wherein in the first position, the first set of expansion elements are not axially aligned with the second set of expansion elements.

83. The apparatus of claim 81, wherein in the second position, the first set of expansion elements are axially aligned with the second set of expansion elements.

84. An apparatus for radially expanding and plastically deforming an expandable tubular member, comprising:

a support member;

a gripping device for gripping the tubular member coupled to the support member;

a first adjustable expansion device for radially expanding and plastically deforming the tubular member coupled to the support member; and a second adjustable expansion device for radially expanding and plastically deforming the tubular member coupled to the support member.

85. The apparatus of claim 84, wherein the gripping device comprises a plurality of movable gripping elements.

86. The apparatus of claim 85, wherein the gripping elements are moveable in a radial direction relative to the support member.

87. The apparatus of claim 84, further comprising:

a sealing device for sealing an interface with the tubular member coupled to the support member.

88. The apparatus of claim 87, wherein the sealing device seals an annulus defines between the support member and the tubular member.

89. The apparatus of claim 84, further comprising:

a locking device for locking the position of the tubular member relative to the support member.

90. The apparatus of claim 89, wherein the locking device comprises:

a pressure sensor for controllably unlocking the locking device from engagement with the tubular member when the operating pressure within the apparatus exceeds a predetermined amount.

91. The apparatus of claim 89, wherein the locking device comprises:

a position sensor for controllably unlocking the locking device from engagement with the tubular member when the position of a portion of the apparatus exceeds a predetermined amount.

92. The apparatus of claim 84, further comprising: an actuator for displacing the expansion device relative to the support member.

93. The apparatus of claim 92, wherein the actuator comprises means for transferring torsional loads between the support member and the expansion device.

94. The apparatus of claim 92, wherein the actuator comprises a plurality of pistons positioned within corresponding piston chambers.

95. The apparatus of claim 84, wherein at least one of the first and second expansion devices comprise:

a plurality of movable expansion elements coupled to the support member.

96. The apparatus of claim 95, wherein:

the expansion elements are movable between a first position and a second position;

wherein in the first position, the expansion elements do not engage the tubular member; and wherein in the second position, the expansion elements engage the tubular member.

97. The apparatus of claim 96, wherein the expansion elements comprise:

a first set of expansion elements; and a second set of expansion elements;

wherein the first set of expansion elements are interleaved with the second set of expansion elements.

98. The apparatus of claim 97, wherein in the first position, the first set of expansion elements are not axially aligned with the second set of expansion elements.

99. The apparatus of claim 97, wherein in the second position, the first set of expansion elements are axially aligned with the second set of expansion elements.

100. The apparatus of claim 84, wherein at least one of the first and second expansion devices comprise a plurality of expansion devices.

101. The apparatus of claim 100, wherein at least one of the first and second expansion device comprise an adjustable expansion device.

102. The apparatus of claim 101, wherein the adjustable expansion device comprises:

a plurality of movable expansion elements coupled to the support member.

103. The apparatus of claim 102, further comprising:

an actuator coupled to the support member for moving the expansion elements between a first position and a second position;

wherein in the first position, the expansion elements do not engage the tubular member; and wherein in the second position, the expansion elements engage the tubular member.

104. The apparatus of claim 103, wherein the expansion elements comprise:

a first set of expansion elements; and a second set of expansion elements;

wherein the first set of expansion elements are interleaved with the second set of expansion elements.

105. The apparatus of claim 104, wherein in the first position, the first set of expansion elements are not axially aligned with the second set of expansion elements.

106. The apparatus of claim 104, wherein in the second position, the first set of expansion elements are axially aligned with the second set of expansion elements.

107. An apparatus for radially expanding and plastically deforming an expandable tubular member, comprising:

a support member;

a gripping device for gripping the tubular member coupled to the support member;

a sealing device for sealing an interface with the tubular member coupled to the support member;

a locking device for locking the position of the tubular member relative to the support member;

a first adjustable expansion device for radially expanding and plastically deforming the tubular member coupled to the support member;

a second adjustable expansion device for radially expanding and plastically deforming the tubular member coupled to the support member;

a packer coupled to the support member; and an actuator for displacing one or more of the sealing assembly, first and second adjustable expansion devices, and packer relative to the support member.

108. The apparatus of claim 107, wherein the locking device comprises:

a pressure sensor for controllably unlocking the locking device from engagement with the tubular member when the operating pressure within the apparatus exceeds a predetermined amount.

109. The apparatus of claim 107, wherein the locking device comprises:

a position sensor for controllably unlocking the locking device from engagement with the tubular member when the position of a portion of the apparatus exceeds a predetermined amount.

110. The apparatus of claim 107, wherein the gripping device comprises a plurality of movable gripping elements.

111. The apparatus of claim 110, wherein the gripping elements are moveable in a radial direction relative to the support member.

112. The apparatus of claim 107, wherein the sealing device seals an annulus defines between the support member and the tubular member.

113. The apparatus of claim 107, wherein the actuator comprises means for transferring torsional loads between the support member and the expansion devices.

114. The apparatus of claim 107, wherein the actuator comprises a plurality of pistons positioned within corresponding piston chambers.

115. The apparatus of claim 107, wherein at least one of the adjustable expansion devices comprise:

a plurality of movable expansion elements coupled to the support member.

116. The apparatus of claim 115, wherein:

the expansion elements between a first position and a second position;

wherein in the first position, the expansion elements do not engage the tubular member; and wherein in the second position, the expansion elements engage the tubular member.

117. The apparatus of claim 116, wherein the expansion elements comprise: a first set of expansion elements; and a second set of expansion elements; wherein the first set of expansion elements are interleaved with the second set of expansion elements.

118. The apparatus of claim 117, wherein in the first position, the first set of expansion elements are not axially aligned with the second set of expansion elements.

119. The apparatus of claim 117, wherein in the second position, the first set of expansion elements are axially aligned with the second set of expansion elements.

120. The apparatus of claim 107, wherein at least one of the adjustable expansion devices comprise a plurality of movable expansion elements.

121. The apparatus of claim 120, wherein:

the plurality of movable expansion elements are coupled to the support member.

122. The apparatus of claim 121, wherein:

the expansion elements are movable between a first position and a second position;

wherein in the first position, the expansion elements do not engage the tubular member; and wherein in the second position, the expansion elements engage the tubular member.

123. The apparatus of claim 122, wherein the expansion elements comprise:

a first set of expansion elements; and a second set of expansion elements;

wherein the first set of expansion elements are interleaved with the second set of expansion elements.

124. The apparatus of claim 123, wherein in the first position, the first set of expansion elements are not axially aligned with the second set of expansion elements.

125. The apparatus of claim 123, wherein in the second position, the first set of expansion elements are axially aligned with the second set of expansion elements.

126. An actuator, comprising:

a tubular housing;

a tubular piston rod movably coupled to and at least partially positioned within the housing;

a plurality of annular piston chambers defined by the tubular housing and the tubular piston rod; and a plurality of tubular pistons coupled to the tubular piston rod, each tubular piston movably positioned within a corresponding annular piston chamber.

127. The actuator of claim 126, further comprising means for transmitting torsional loads between the tubular housing and the tubular piston rod.

128. A method of radially expanding and plastically deforming an expandable tubular member within a borehole having a preexisting wellbore casing, comprising:

positioning the tubular member within the borehole in overlapping relation to the wellbore casing;

radially expanding and plastically deforming a portion of the tubular member to form a bell section; and radially expanding and plastically deforming a portion of the tubular member above the bell section comprising a portion of the tubular member that overlaps with the wellbore casing;

wherein the inside diameter of the bell section is greater than the inside diameter of the radially expanded and plastically deformed portion of the tubular member above the bell section.

129. The method of claim 128, wherein radially expanding and plastically deforming a portion of the tubular member to form a bell section comprises:

positioning an adjustable expansion device within the expandable tubular member;

supporting the expandable tubular member and the adjustable expansion device within the borehole;

lowering the adjustable expansion device out of the expandable tubular member;

increasing the outside dimension of the adjustable expansion device; and displacing the adjustable expansion device upwardly relative to the expandable tubular member n times to radially expand and plastically deform n portions of the expandable tubular member, wherein n is greater than or equal to 1.

130. A method for radially expanding and plastically deforming an expandable tubular member within a borehole, comprising:

supporting the expandable tubular member, an hydraulic actuator, and an adjustable expansion device within the borehole;

increasing the size of the adjustable expansion device; and displacing the adjustable expansion device upwardly relative to the expandable tubular member using the hydraulic actuator to radially expand and plastically deform a portion of the expandable tubular member.

131. The method of claim 130, further comprising:

reducing the size of the adjustable expansion device after the portion of the expandable tubular member has been radially expanded and plastically deformed.

132. The method of claim 131, further comprising:

fluidicly sealing the radially expanded and plastically deformed end of the expandable tubular member after reducing the size of the adjustable expansion device.

133. The method of claim 132, further comprising:

permitting the position of the expandable tubular member to float relative to the position of the hydraulic actuator after fluidicly sealing the radially expanded and plastically deformed end of the expandable tubular member.

134. The method of claim 133, further comprising:

injecting a hardenable fluidic sealing material into an annulus between the expandable tubular member and a preexisting structure after permitting the position of the expandable tubular member to float relative to the position of the hydraulic actuator.

135. The method of claim 133, further comprising:

increasing the size of the adjustable expansion device after permitting the position of the expandable tubular member to float relative to the position of the hydraulic actuator.

136. The method of claim 135, further comprising:

displacing the adjustable expansion cone upwardly relative to the expandable tubular member to radially expand and plastically deform another portion of the expandable tubular member.

137. The method of claim 136, further comprising:

if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

138. A method for forming a mono diameter wellbore casing within a borehole that includes a preexisting wellbore casing, comprising:

supporting the expandable tubular member, an hydraulic actuator, and an adjustable expansion device within the borehole;

increasing the size of the adjustable expansion device;

displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

139. The method of claim 138, further comprising:

reducing the size of the adjustable expansion device after the portion of the expandable tubular member has been radially expanded and plastically deformed.

140. The method of claim 139, further comprising:

fluidicly sealing the radially expanded and plastically deformed end of the expandable tubular member after reducing the size of the adjustable expansion device.

141. The method of claim 140, further comprising:

permitting the position of the expandable tubular member to float relative to the position of the hydraulic actuator after fluidicly sealing the radially expanded and plastically deformed end of the expandable tubular member.

142. The method of claim 141, further comprising:

injecting a hardenable fluidic sealing material into an annulus between the expandable tubular member and the borehole after permitting the position of the expandable tubular member to float relative to the position of the hydraulic actuator.

143. The method of claim 141, further comprising:

increasing the size of the adjustable expansion device after permitting the position of the expandable tubular member to float relative to the position of the hydraulic actuator.

144. The method of claim 143, further comprising:

displacing the adjustable expansion cone upwardly relative to the expandable tubular member to radially expand and plastically deform the remaining portion of the expandable tubular member.

145. The method of claim 144, further comprising:

not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

146. The method of claim 141, wherein radially expanding and plastically deforming a portion of the tubular member above the bell section comprises:

lowering an expansion device out of an end of the tubular member; and pulling the expansion device through the end of the tubular member.

147. The method of claim 146, wherein lowering an expansion device out of an end of the tubular member comprises:

lowering the expansion device out of the end of the tubular member; and adjusting the size of the expansion device.

148. The method of claim 147, wherein the expansion device is adjustable to a plurality of sizes.

149. The method of claim 147, wherein the expansion device comprises a plurality of adjustable expansion devices.

150. The method of claim 149, wherein at least one of the adjustable expansion devices is adjustable to a plurality of sizes.

151. The method of claim 146, wherein pulling the expansion device through the end of the tubular member comprises:

gripping the tubular member; and pulling an expansion device through an end of the tubular member.

152. The method of claim 151, wherein gripping the tubular member comprises:

permitting axial displacement of the tubular member in a first direction; and not permitting axial displacement of the tubular member in a second direction.

153. The method of claim 151, wherein pulling the expansion device through the end of the tubular member comprises:

pulling the expansion device through the end of the tubular member using an actuator.

154. The method of claim 146, wherein pulling the expansion device through the end of the tubular member comprises:

pulling the expansion device through the end of the tubular member using fluid pressure.

155. The method of claim 154, wherein pulling the expansion device through the end of the tubular member using fluid pressure comprises:

pressurizing an annulus within the tubular member above the expansion device.

156. A method of radially expanding and plastically deforming a tubular member, comprising:

positioning the tubular member within a preexisting structure;

radially expanding and plastically deforming a lower portion of the tubular member to form a bell section; and radially expanding and plastically deforming a portion of the tubular member above the bell section.

157. The method of claim 156, wherein positioning the tubular member within a preexisting structure comprises:

locking the tubular member to an expansion device.

158. The method of claim 157, wherein positioning the tubular member within a preexisting structure comprises:

unlocking the tubular member from an expansion device if the operating pressure within the preexisting structure exceeds a predetermined amount.

159. The method of claim 157, wherein positioning the tubular member within a preexisting structure comprises:

unlocking the tubular member from an expansion device if the position of an actuator coupled to the tubular member exceeds a predetermined amount.

160. The method of claim 156, wherein radially expanding and plastically deforming a lower portion of the tubular member to form a bell section comprises:

lowering an expansion device out of an end of the tubular member; and pulling the expansion device through the end of the tubular member.

161. The method of claim 160, wherein lowering an expansion device out of an end of the tubular member comprises:

lowering the expansion device out of the end of the tubular member; and adjusting the size of the expansion device.

162. The method of claim 161, wherein the expansion device is adjustable to a plurality of sizes.

163. The method of claim 161, wherein the expansion device comprises a plurality of adjustable expansion devices.

164. The method of claim 163, wherein at least one of the adjustable expansion devices is adjustable to a plurality of sizes.

165. The method of claim 160, wherein pulling the expansion device through the end of the tubular member comprises:

gripping the tubular member; and pulling an expansion device through an end of the tubular member.

166. The method of claim 165, wherein gripping the tubular member comprises:

permitting axial displacement of the tubular member in a first direction; and not permitting axial displacement of the tubular member in a second direction.

167. The method of claim 165, wherein pulling the expansion device through the end of the tubular member comprises:

pulling the expansion device through the end of the tubular member using an actuator.

168. The method of claim 156, wherein radially expanding and plastically deforming a portion of the tubular member above the bell section comprises:

fluidicly sealing an end of the tubular member; and pulling the expansion device through the tubular member.

169. The method of claim 168, wherein the expansion device is adjustable.

170. The method of claim 169, wherein the expansion device is adjustable to a plurality of sizes.

171. The method of claim 168, wherein the expansion device comprises a plurality of adjustable expansion devices.

172. The method of claim 171, wherein at least one of the adjustable expansion devices is adjustable to a plurality of sizes.

173. The method of claim 168, wherein pulling the expansion device through the end of the tubular member comprises:

gripping the tubular member; and pulling an expansion device through an end of the tubular member.

174. The method of claim 173, wherein pulling the expansion device through the end of the tubular member comprises:

pulling the expansion device through the end of the tubular member using an actuator.

175. The method of claim 168, wherein pulling the expansion device through the end of the tubular member comprises:

pulling the expansion device through the end of the tubular member using fluid pressure.

176. The method of claim 175, wherein pulling the expansion device through the end of the tubular member using fluid pressure comprises:

pressurizing an annulus within the tubular member above the expansion device.

177. The method of claim 156, wherein radially expanding and plastically deforming a portion of the tubular member above the bell section comprises:

overlapping the portion of the tubular member above the bell section with an end of a preexisting tubular member; and pulling an expansion device through the overlapping portions of the tubular member and the preexisting tubular member.

178. The method of claim 177, wherein the expansion device is adjustable.

179. The method of claim 178, wherein the expansion device is adjustable to a plurality of sizes.

180. The method of claim 177, wherein the expansion device comprises a plurality of adjustable expansion devices.

181. The method of claim 180, wherein at least one of the adjustable expansion devices is adjustable to a plurality of sizes.

182. The method of claim 177, wherein pulling the expansion device through the overlapping portions of the tubular member and the preexisting tubular member comprises:

gripping the tubular member; and pulling the expansion device through the overlapping portions of the tubular member and the preexisting tubular member.

183. The method of claim 182, wherein pulling the expansion device through the overlapping portions of the tubular member and the preexisting tubular member comprises:

pulling the expansion device through the overlapping portions of the tubular member and the preexisting tubular member using an actuator.

184. The method of claim 177, wherein pulling the expansion device through the overlapping portions of the tubular member and the preexisting tubular member comprises:

pulling the expansion device through the overlapping portions of the tubular member and the preexisting tubular member using fluid pressure.

185. The method of claim 184, wherein pulling the expansion device through the overlapping portions of the tubular member and the preexisting tubular member using fluid pressure comprises:

pressurizing an annulus within the tubular member above the expansion device.

186. The method of claim 156, further comprising:

injecting a hardenable fluidic sealing material into an annulus between the expandable tubular member and the preexisting structure.

187. A method of engaging a tubular member, comprising:

positioning a plurality of elements within the tubular member;

bringing the elements into engagement with the tubular member, wherein the elements comprise:

a first group of elements, and a second group of elements, the first group of elements being interleaved with the second group of elements.

188. The method of claim 187, wherein bringing the elements into engagement with the tubular member comprises:

bringing the elements into axial alignment.

189. The method of claim 187, wherein bringing the elements into engagement with the tubular member further comprises:

pivoting the elements.

190. The method of claim 187, wherein bringing the elements into engagement with the tubular member further comprises:

translating the elements.

191. The method of claim 187, wherein bringing the elements into engagement with the tubular member further comprises:

pivoting the elements; and translating the elements.

192. The method of claim 187, wherein bringing the elements into engagement with the tubular member comprises:

rotating the elements about a common axis.

193. The method of claim 187, wherein bringing the elements into engagement with the tubular member comprises:

pivoting the elements about corresponding axes;

translating the elements; and rotating the elements about a common axis.

194. The method of claim 187, further comprising:

preventing the elements from coming into engagement with the tubular member if the inside diameter of the tubular member is less than a predetermined value.

195. The method of claim 194, wherein preventing the elements from coming into engagement with the tubular member if the inside diameter of the tubular member is less than a predetermined value comprises:

sensing the inside diameter of the tubular member.

196. A locking device for locking a tubular member to a support member, comprising:

a radially movable locking device coupled to the support member for engaging an interior surface of the tubular member, and a pressure sensor for controllably unlocking the locking device from engagement with the tubular member when an operating pressure exceeds a predetermined amount.

197. A locking device for locking a tubular member to a support member, comprising:

a radially movable locking device coupled to the support member for engaging an interior surface of the tubular member, and a position sensor for controllably unlocking the locking device from engagement with the tubular member when a position exceeds a predetermined amount.

198. The method of locking a tubular member to a support member, comprising:

locking a locking element in a position that engages an interior surface of the tubular member; and controllably unlocking the locking element from engagement with the tubular member when an operating pressure exceeds a predetermined amount.

199. A method of locking a tubular member to a support member, comprising:

locking a locking element in a position that engages an interior surface of the tubular member; and controllably unlocking the locking element from engagement with the tubular member when a position exceeds a predetermined amount.

* * * * *